US011471728B2

(12) United States Patent
Schranz

(10) Patent No.: US 11,471,728 B2
(45) Date of Patent: Oct. 18, 2022

(54) EXERCISE APPARATUS

(71) Applicant: Paul Steven Schranz, Bowen Island (CA)

(72) Inventor: Paul Steven Schranz, Bowen Island (CA)

( * ) Notice: Subject to any disclaimer, the term of this patent is extended or adjusted under 35 U.S.C. 154(b) by 128 days.

(21) Appl. No.: 16/812,366

(22) Filed: Mar. 9, 2020

(65) Prior Publication Data

US 2020/0222753 A1 Jul. 16, 2020

Related U.S. Application Data

(63) Continuation-in-part of application No. 15/978,715, filed on May 14, 2018, now Pat. No. 10,583,320.
(Continued)

(51) Int. Cl.
*A63B 22/06* (2006.01)
*A63B 23/04* (2006.01)

(52) U.S. Cl.
CPC ..... *A63B 22/0605* (2013.01); *A63B 23/0476* (2013.01); *A63B 2022/0641* (2013.01); *A63B 2208/0228* (2013.01)

(58) Field of Classification Search
CPC .... A63B 1/00; A63B 3/00; A63B 7/00; A63B 7/02; A63B 21/00058; A63B 21/00069; A63B 21/00072; A63B 21/00076; A63B 21/00178; A63B 21/00181; A63B 21/00185; A63B 21/002; A63B 21/0023; A63B 21/005; A63B 21/0051; A63B 21/0052; A63B 21/0058; A63B 21/008; A63B 21/0083; A63B 21/0084; A63B 21/00845; A63B 21/0085; A63B 21/0087; A63B 21/0088; A63B 21/02; A63B 21/021; A63B 21/023; A63B 21/025; A63B 21/026; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/068; A63B 21/08; A63B 21/15; A63B 21/158; A63B 21/159; A63B 21/16; A63B 21/1618; A63B 21/1627; A63B 21/1636; A63B 21/1645; A63B 21/1654; A63B 21/1663; A63B 21/1681; A63B 21/169; A63B 21/22; A63B 21/4027; A63B 21/4033; A63B 21/4035; A63B 21/4041; A63B 21/4045; A63B 21/4047;
(Continued)

(56) References Cited

U.S. PATENT DOCUMENTS 4,296,924 A * 10/1981 Anzaldua ..... A63B 23/0211 482/94
4,456,245 A * 6/1984 Baldwin ..... A63B 21/155 482/136
(Continued)

*Primary Examiner* — Gary D Urbiel Goldner

(57) ABSTRACT

An improved exercise equipment including a stationary exercise apparatus, a lever arm pivotably biased about a pivot axis, and a support for supporting the lever arm above the stationary exercise apparatus. The pivot axis extends substantially in a vertical direction. The stationary exercise apparatus is of a type to cause the legs of a user to scissor as the user operates the stationary exercise apparatus. In an exemplary embodiment, the stationary exercise apparatus is a treadmill.

14 Claims, 81 Drawing Sheets

Related U.S. Application Data

(60) Provisional application No. 62/823,658, filed on Mar. 26, 2019.

(58) Field of Classification Search
CPC ..... A63B 21/4049; A63B 22/0015; A63B 22/0017; A63B 22/0046; A63B 22/0048; A63B 22/0061; A63B 22/02; A63B 22/18; A63B 2022/0051; A63B 23/02; A63B 23/0211; A63B 23/0216; A63B 23/0222; A63B 2023/003; A63B 2023/006; A63B 69/0064; A63B 71/0009; A63B 71/0054; A63B 2071/0063; A63B 2071/0072; A63B 2208/0204; A63B 2225/09; A63B 2225/093
See application file for complete search history.

(56) References Cited

U.S. PATENT DOCUMENTS 4,725,055 A * 2/1988 Skowronski ..... A63B 21/4047 482/901
4,732,381 A * 3/1988 Skowronski ..... A63B 23/0233 73/379.06
4,749,184 A * 6/1988 Tobin ..... A63B 69/0091 482/129
5,000,440 A * 3/1991 Lynch ..... A63B 22/0012 482/130
5,039,091 A * 8/1991 Johnson ..... A63B 69/36213 428/110
5,072,932 A * 12/1991 Johnson ..... A63B 21/04 482/92
5,104,119 A * 4/1992 Lynch ..... A63B 21/00072 482/901
5,171,196 A * 12/1992 Lynch ..... A63B 21/4047 482/7
5,419,747 A * 5/1995 Piaget ..... A63B 22/001 482/70
5,518,470 A * 5/1996 Piaget ..... A63B 22/001 482/53
5,622,527 A * 4/1997 Watterson ..... A63B 21/05 482/53
5,698,782 A * 12/1997 Gledhill ..... A63B 23/03533 73/379.03
RE37,132 E * 4/2001 Douglas ..... A63B 23/0211 482/136
6,371,863 B1 * 4/2002 Moran ..... A63B 69/0057 473/207
6,520,891 B1 * 2/2003 Stephens, Jr. ..... A63B 23/047 482/121
7,081,074 B1 * 7/2006 Rubin ..... A63B 22/14 482/146
7,494,450 B2 * 2/2009 Solomon ..... A63B 21/00181 482/69
7,641,595 B2 * 1/2010 Sharps ..... A63B 21/4049 482/136
7,878,950 B1 * 2/2011 Bastian ..... A63B 21/4035 482/54
8,221,295 B2 * 7/2012 Wilkins ..... A63B 21/055 482/130
8,663,075 B2 * 3/2014 Reyes ..... A63B 23/0405 482/92
8,992,393 B2 * 3/2015 Reyes ..... A63B 21/4047 482/137
9,498,696 B1 * 11/2016 Razon ..... A63B 22/0046
9,675,838 B2 * 6/2017 Manzke ..... A63B 21/0442
10,376,734 B1 * 8/2019 Razon ..... A61B 5/0077
10,383,784 B2 * 8/2019 Murphy ..... A63B 24/0087
10,493,309 B2 * 12/2019 Jue ..... A63B 21/00069
10,583,320 B2 * 3/2020 Schranz ..... A63B 22/0046
10,857,407 B2 * 12/2020 Crist ..... A63B 23/047
11,007,401 B2 * 5/2021 Kennedy ..... A63B 21/0615
2002/0026130 A1 * 2/2002 West ..... A61H 1/0262 601/23
2003/0114238 A1 * 6/2003 Meneghini ..... A63B 69/36213 473/257
2004/0033863 A1 * 2/2004 Carlson ..... A63B 21/023 482/121
2007/0054785 A1 * 3/2007 Drechsler ..... A63B 21/156 482/94
2007/0072694 A1 * 3/2007 Meneghini ..... A63B 69/36213 473/259
2007/0161470 A1 * 7/2007 Berryman ..... A63B 69/3629 482/100
2007/0161472 A1 * 7/2007 Drechsler ..... A63B 21/4017 482/99
2008/0287267 A1 * 11/2008 Ellis ..... A63B 21/4035 482/54
2009/0118103 A1 * 5/2009 Ellis ..... A63B 22/02 482/54
2011/0082011 A1 * 4/2011 Ellis ..... A63B 21/4047 482/54
2011/0118089 A1 * 5/2011 Ellis ..... A63B 23/047 482/54
2011/0118090 A1 * 5/2011 Ellis ..... A63B 21/4017 482/133
2011/0281691 A1 * 11/2011 Ellis ..... A63B 23/047 482/54
2015/0087448 A1 * 3/2015 Huang ..... A63B 69/0071 473/447
2016/0001118 A1 * 1/2016 Kuehne ..... A63B 23/04 482/54
2016/0166460 A1 * 6/2016 Murphy ..... A63B 21/00178 601/34
2016/0339294 A1 * 11/2016 Blach ..... A63B 21/04
2018/0326255 A1 * 11/2018 Schranz ..... A63B 21/08
2020/0222753 A1 * 7/2020 Schranz ..... A63B 21/4035

* cited by examiner

EXERCISE APPARATUS

FIELD OF THE INVENTION

The present application relates to an exercise apparatus and a method of operating the exercise apparatus

BACKGROUND OF THE INVENTION

Many people suffer from back and buttock pain for a variety of reasons. One reason for the pain may be muscle imbalances and/or compensations in the body resulting from use patterns, leg length differences, injuries, hips dysplasia, ankle disorders, congenital issues as well as other factors. Acute pain comes on suddenly and typically lasts less than six weeks, for example, which may be caused by a fall or heavy lifting. Chronic pain can last more than three months, for example, and some people suffering from chronic pain may have a level of pain consistently.

Leg length differences are common in the general population. The leg length difference may be anatomical, where the measurement from the bony protuberance (the greater trochanter) of the hip joint to the lateral ankle measures shorter on one side than the other, or the difference may be functional where the measurement from the same two points is equal on both sides, but there is still an apparent short leg. Pelvic obliquity, a rotation or displacement of the pelvis on one or both sides, is associated with leg length discrepancies, and causes abnormal stress on all muscles, nerves, and joints that are involved. The longer a person has a leg length discrepancy the greater the chance for a secondary compensatory problem somewhere else in the body, usually in the upper back, shoulders or neck. Common symptoms include muscular pains in the involved areas, headaches, numbness and/or tingling in the arms or hands. Muscles of the back are also affected by this asymmetry. One side will be overstretched and subject to strain and spasm; the other side will become contracted and shorter. The uneven load on the hips and knees can result in arthritis in those joints as well as shin splints, ankle problems, and heel pains.

Various muscle groups will develop asymmetrically over time due to the habitual asymmetrical loading pattern. The firing order for the muscles during movement, such as walking, running, cycling and swimming, may become less optimal compared to a person without a leg length discrepancy. The head of the femur may be less optimally seated in the acetabulum in one or both legs due these muscle imbalances and less favourable muscle firing order, further impacting movement patterns and athletic performance. Once these muscle patterns have become ingrained in the body it is very difficult to correct them, even after adjusting for a leg length difference with a lift or orthotic. It may be that back and buttock pain is reduced after the lift is used, but the muscular imbalance may not be corrected substantially and the feeling of asymmetry remains along with less than optimal movement patterns and athletic performance. Furthermore, the body does not easily accept correcting with a lift equal in height to the leg length difference, even after wearing a lift for several years, Physiotherapists often recommend using a lift height no more than half the leg length difference.

Health professionals employ a variety of techniques to reduce muscle imbalances in the body. These involve both strengthening and stretching exercises. Activities such as yoga and Pilates are beneficial. Cycling is also a beneficial activity that has a low impact on the joints and promotes healthy hip function. However, it is possible that cycling will enhance a pre-existing muscle imbalance, instead of reducing it, and may lead to anterior pelvic tilt and lordosis in the spine due to repetitive cycling with a small hip angle and shortened hip flexors.

The state of the art is lacking in techniques for exercise equipment and more particularly rehabilitative exercise equipment. The present apparatus and method provide an improved exercise equipment apparatus and method of operating the exercise apparatus.

SUMMARY OF THE INVENTION

An improved exercise equipment including a stationary exercise apparatus, a lever arm pivotably biased about a pivot axis, and a support for supporting the lever arm above the stationary exercise apparatus. The pivot axis extends substantially in a vertical direction. The stationary exercise apparatus is of a type to cause the legs of a user to scissor as the user operates the stationary exercise apparatus. In an exemplary embodiment, the stationary exercise apparatus is one of a treadmill, a stationary bicycle, and a stair climber.

BRIEF DESCRIPTION OF THE DRAWINGS

FIG. 118 is a side elevational view of an adjustable handlebar apparatus for the exercise bicycle of FIG. 116.

FIG. 119 is a partial top view of a bicycle apparatus including a handlebar stem according to another embodiment.

FIG. 120 is a top view of a handlebar according to another embodiment.

FIG. 121 is a top view of a handlebar according to another embodiment.

FIG. 122 is a partial top view of a bicycle apparatus with the handlebar of FIG. 121 such that a mid-hand-position plane is in the position of the embodiment of FIG. 61

FIG. 123 is a side elevational view of an adjustable stem illustrated in a first position.

FIG. 124 is a side elevational view of the adjustable stem of FIG. 123 illustrated in a second position.

FIG. 125 is a side elevational view of a bearing according to another embodiment.

FIG. 126 is a front elevational view of the bearing of FIG. 125.

FIG. 127 is a side elevational view of a bearing according to another embodiment.

FIG. 128 is a front elevational view of the bearing of FIG. 127.

FIG. 129 is a method of physiotherapy according to an embodiment.

Figure 130:
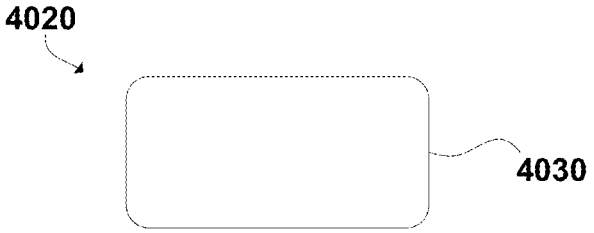

FIG. 130 is a method of physiotherapy according to another embodiment.

Figure 131:
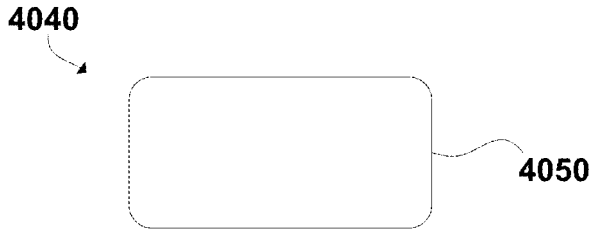

FIG. 131 is a method of physiotherapy according to another embodiment.

Figure 132:
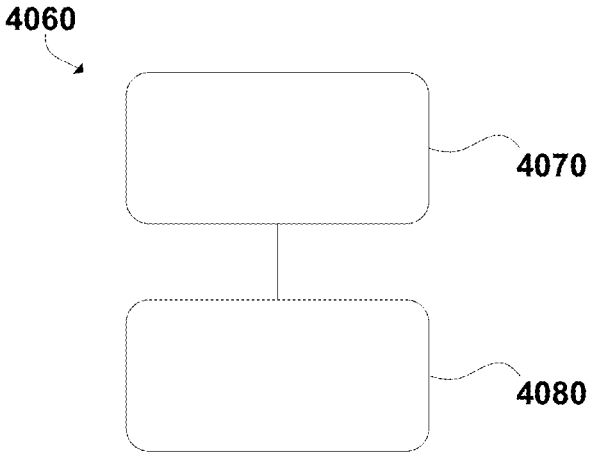

FIG. 132 is a method of physiotherapy according to another embodiment.

Figure 133:
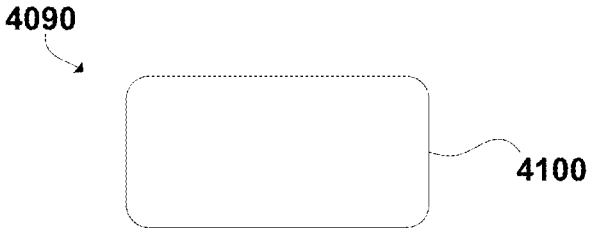

FIG. 133 is a method of physiotherapy according to another embodiment.

Figure 134:
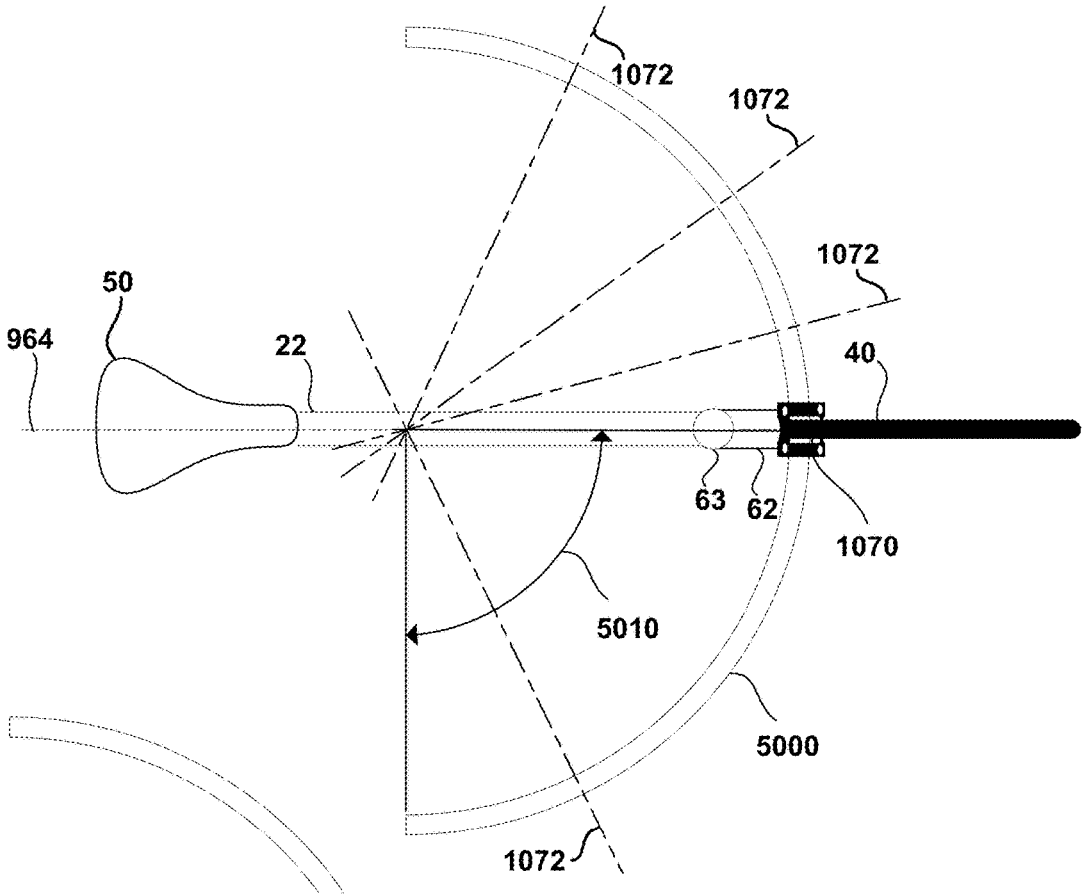

FIG. 134 is a partial plan view of a bicycle apparatus including a handlebar according to another embodiment.

Figure 135:
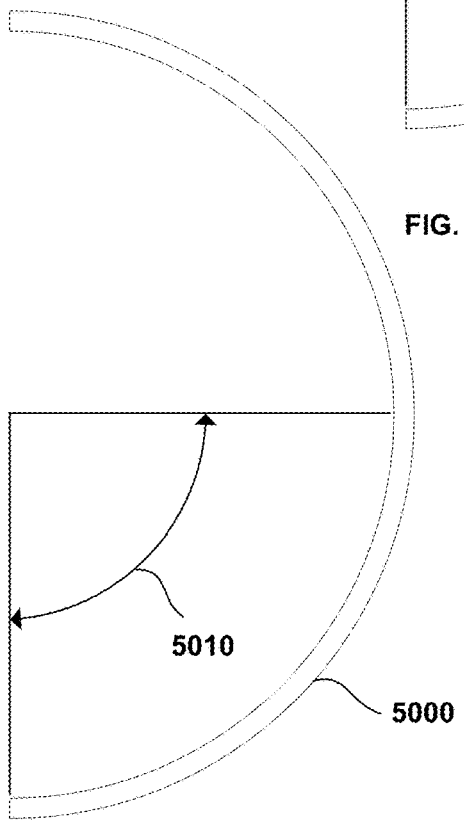

FIG. 135 is a plan view of the handlebar of FIG. 134.

Figure 136:
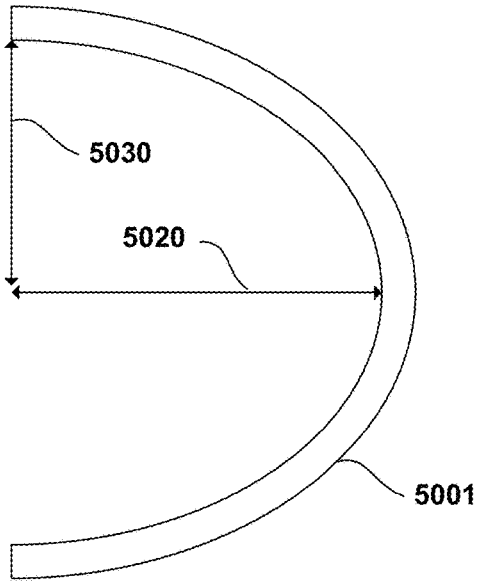

FIG. 136 is a plan view of a handlebar according to another embodiment.

Figure 137:
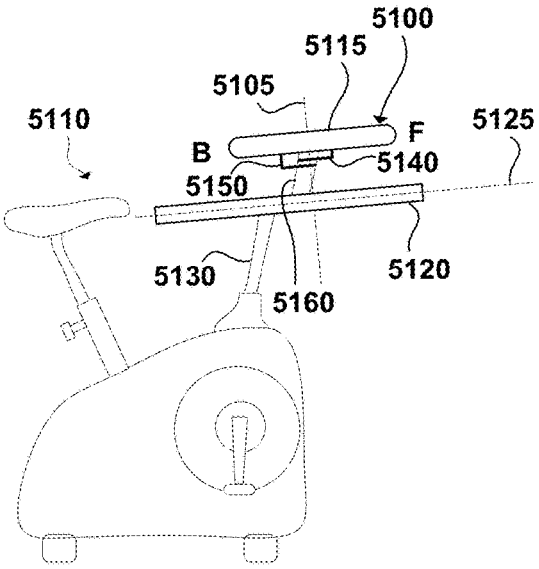

FIG. 137 is a side elevational view of a stationary bicycle including a biased handlebar in the form of a steering wheel according to another embodiment.

Figure 138:
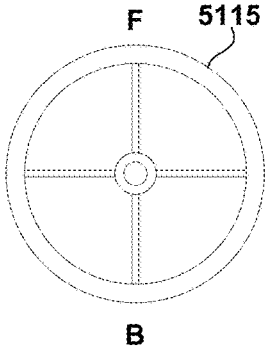

FIG. 138 is a plan view of the steering wheel of FIG. 137 illustrating a neutral position.

Figure 139:
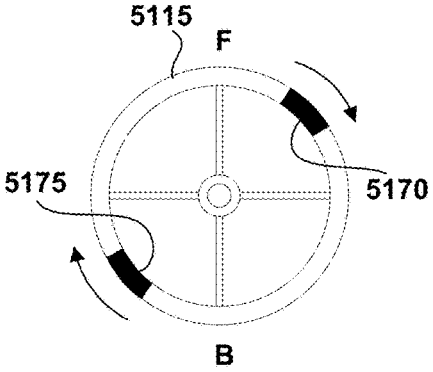

FIG. 139 is a plan view of the steering wheel of FIG. 137 illustrated in the neutral position and grip positions for a rider before turning the steering wheel.

Figure 140:
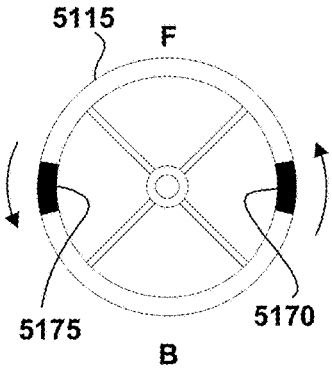

FIG. 140 is a plan view of the steering wheel of FIG. 139 illustrated in a rotated position.

Figure 141:
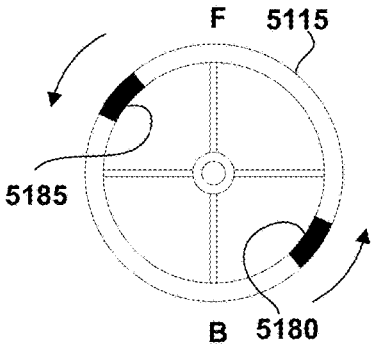

FIG. 141 is a plan view of the steering wheel of FIG. 137 illustrated in the neutral position and grip positions for a rider before turning the steering wheel.

Figure 142:
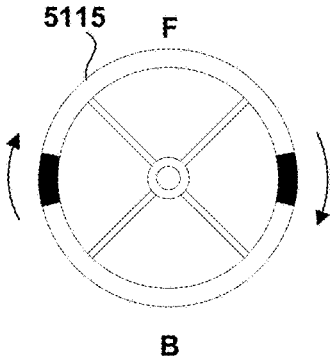

FIG. 142 is a plan view of the steering wheel of FIG. 139 illustrated in a rotated position.

Figure 143:
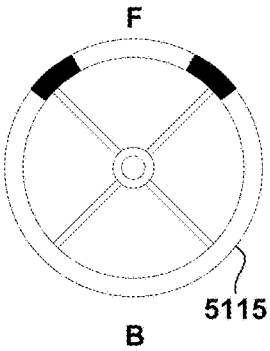

FIG. 143 is plan view of the steering wheel of FIG. 137 illustrating grip positions in a biased position.

Figure 144:
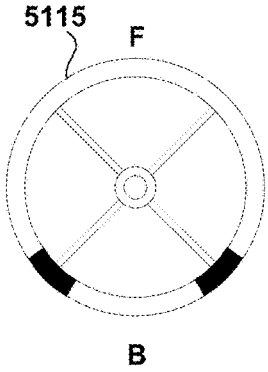

FIG. 144 is plan view of the steering wheel of FIG. 137 illustrating grip positions in a biased position.

Figure 145:
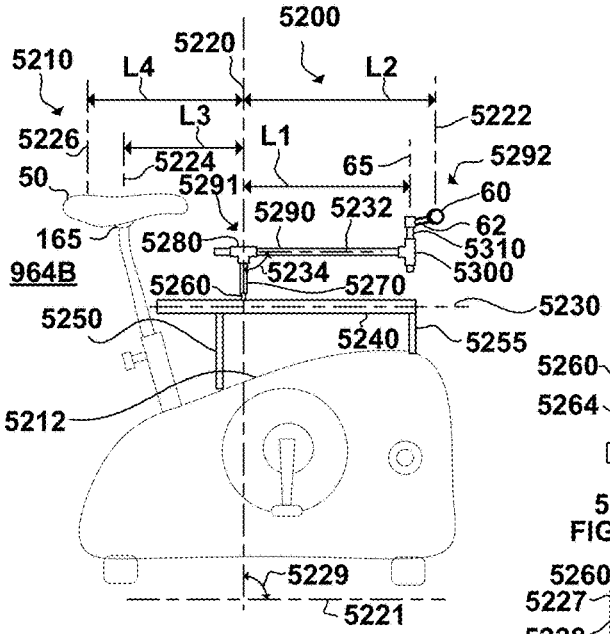

FIG. 145 is a side elevational view of a stationary bicycle with a biased handlebar apparatus illustrated in a first position according to another embodiment.

Figure 145B:
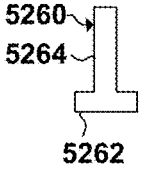

FIG. 145*b* is a side elevational view of a t-shaped member of the biased handlebar apparatus of FIG. 145.

Figure 145C:
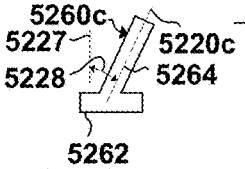

FIG. 145*c* is a side elevational view of a t-shaped member of the biased handlebar apparatus of FIG. 145.

Figure 146:
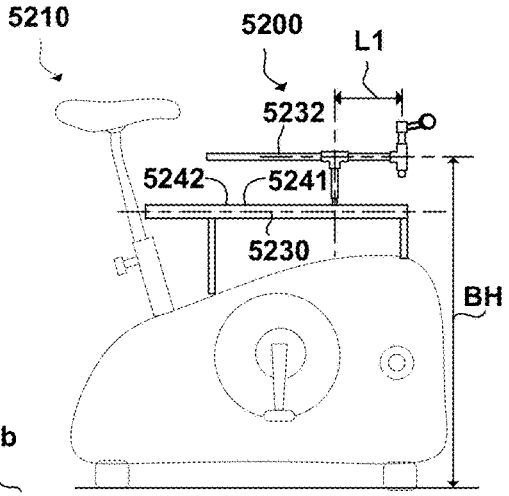

FIG. 146 is a side elevational view of the stationary bicycle with the biased handlebar apparatus of FIG. 145 illustrated in a second position.

Figure 147:
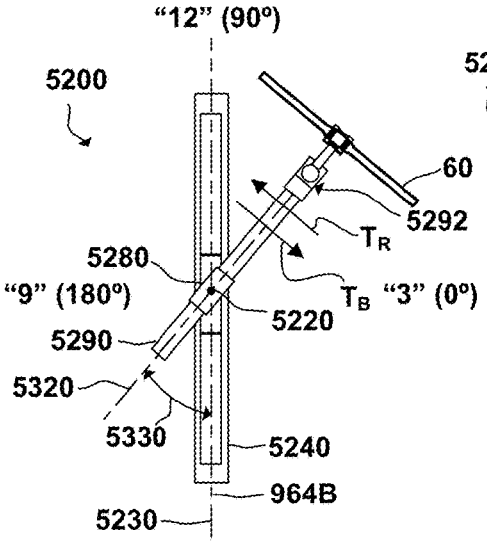

FIG. 147 is a plan view of the biased handlebar apparatus of FIG. 145 illustrated in a neutral position.

Figure 148:
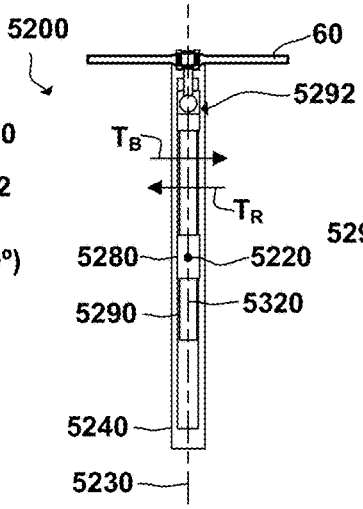

FIG. 148 is a plan view of the biased handlebar apparatus of FIG. 145 illustrated in a biased position.

Figure 149:
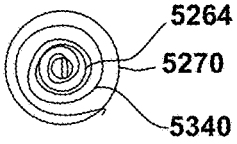

FIG. 149 is a plan view of a biasing device for the biased handlebar apparatus of FIG. 145.

Figure 150:
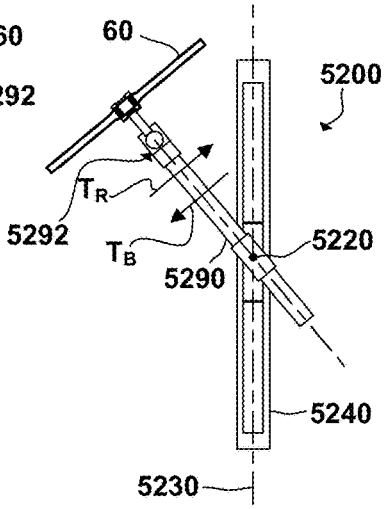

FIG. 150 is a plan view of the biased handlebar apparatus of FIG. 145 illustrated in an alternative neutral position.

Figure 150B:
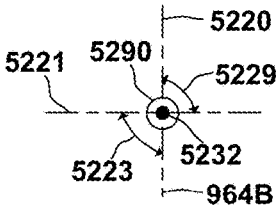

FIG. 150*b* is partial, cross-sectional view of the biased handlebar apparatus of FIG. 145.

Figure 151:
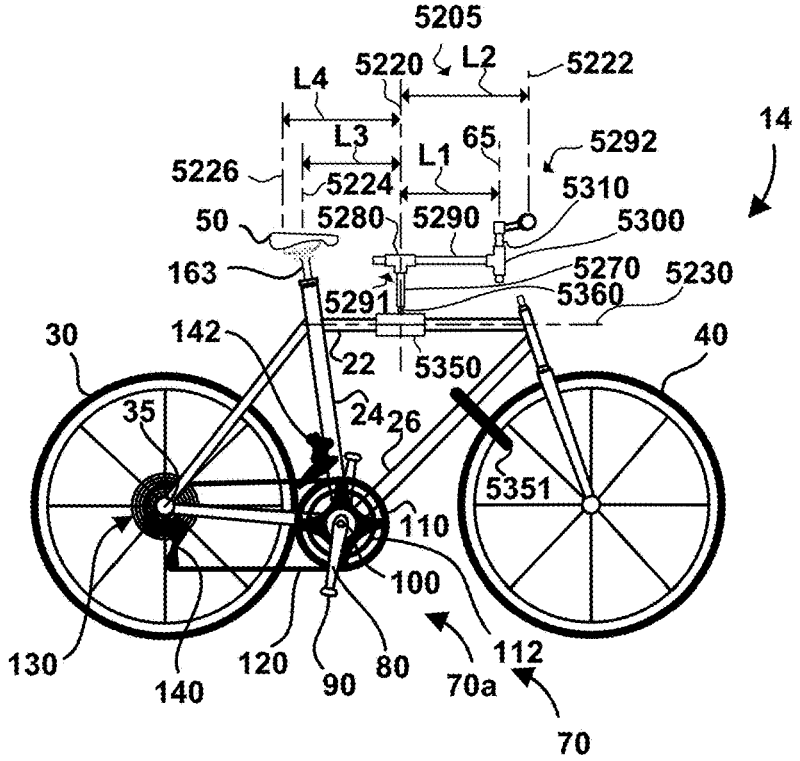

FIG. 151 is a side elevational view of a mobile bicycle with a biased handlebar apparatus according to another embodiment for employment in a stationary cycling application.

Figure 152:
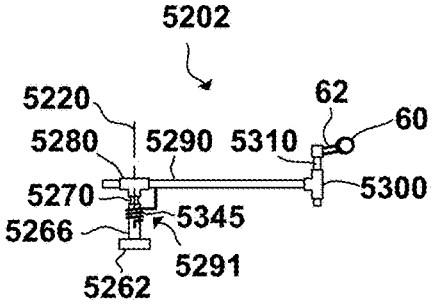

FIG. 152 is a side elevational view of a biased handlebar apparatus according to another embodiment.

Figure 152B:
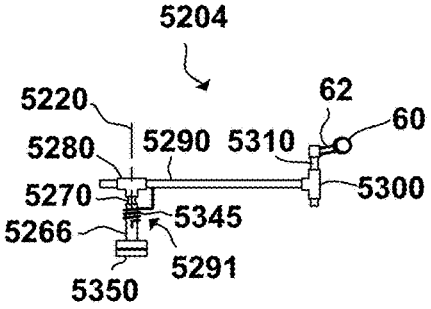

FIG. 152*b* is a side elevational view of a biased handlebar apparatus according to another embodiment.

Figure 153:
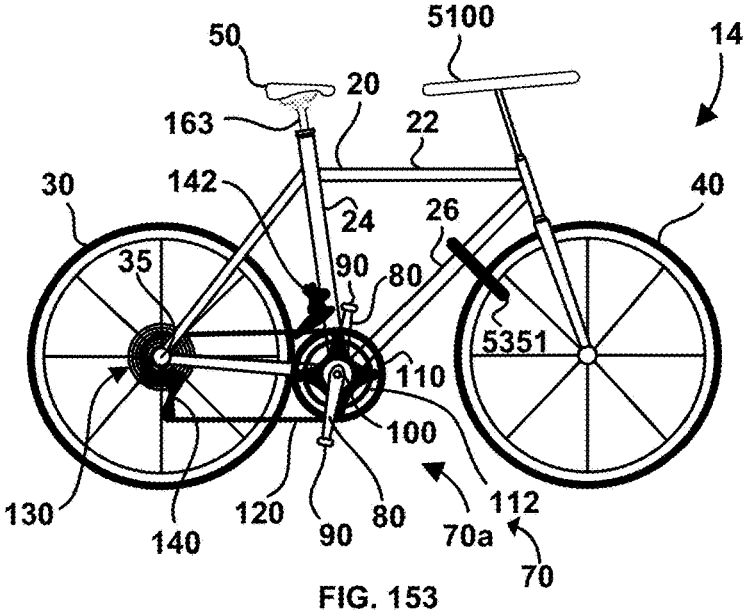

FIG. 153 is a side elevational view of a mobile bicycle with a biased handlebar apparatus according to another embodiment for employment in a stationary cycling application.

Figure 154:
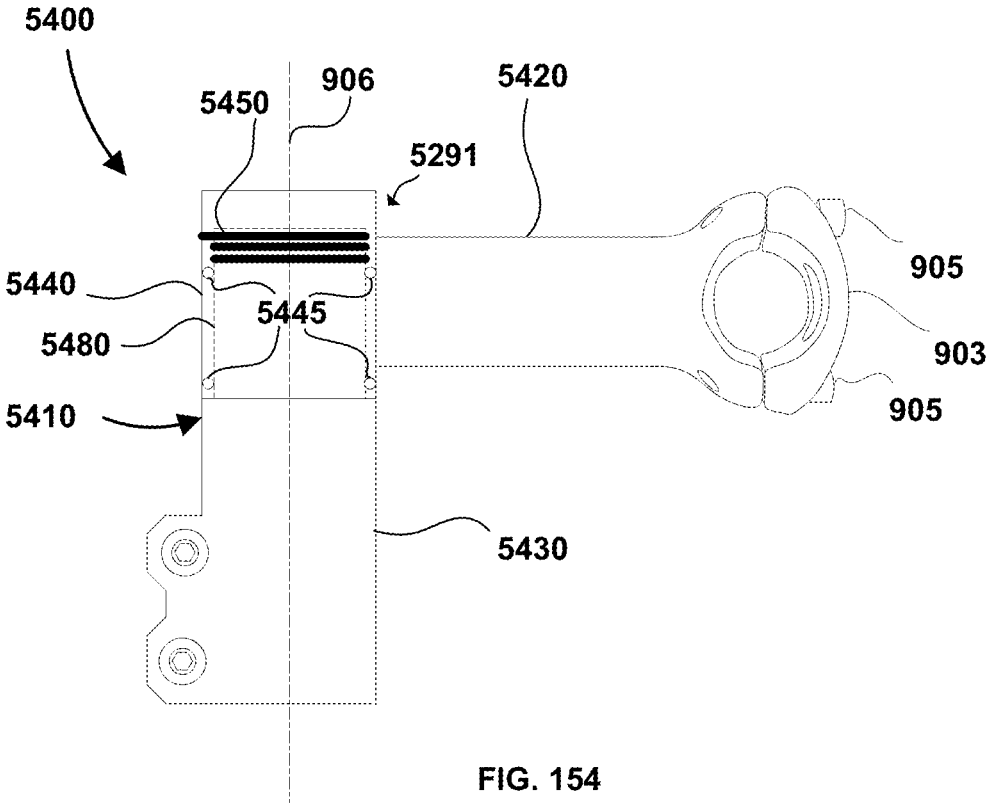

FIG. 154 is a side elevational view of a biased handlebar stem according to another embodiment.

Figure 155:
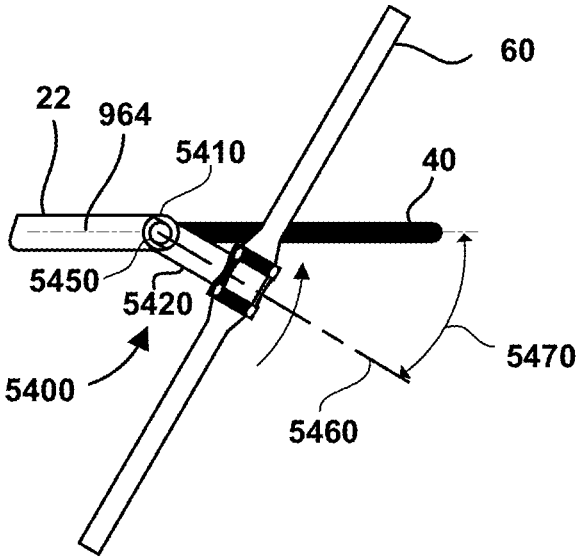

FIG. 155 is a partial plan view of a bicycle apparatus with the biased handlebar stem of FIG. 154 illustrated in a neutral position connected with a handlebar.

Figure 156:
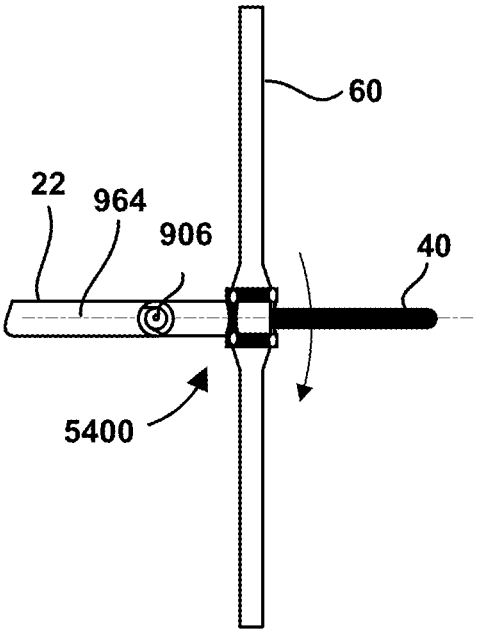

FIG. 156 is a partial plan view of the biased handlebar stem of FIG. 155 illustrated in a biased position.

Figure 157:
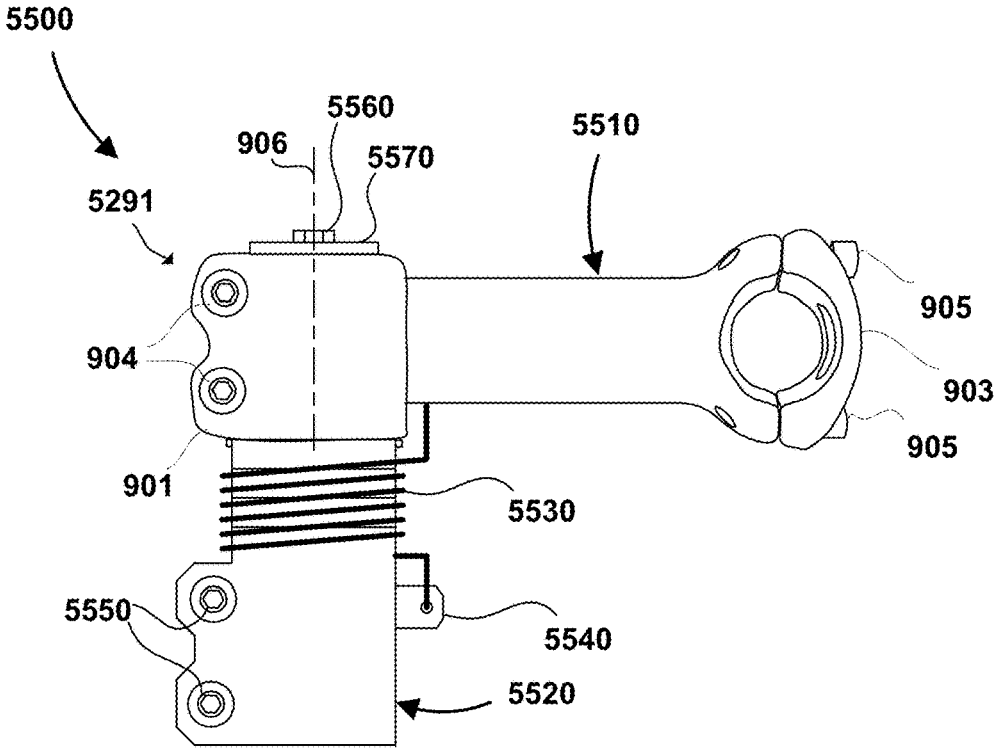

FIG. 157 is a side elevational view of a biased handlebar stem according to another embodiment.

Figure 158:
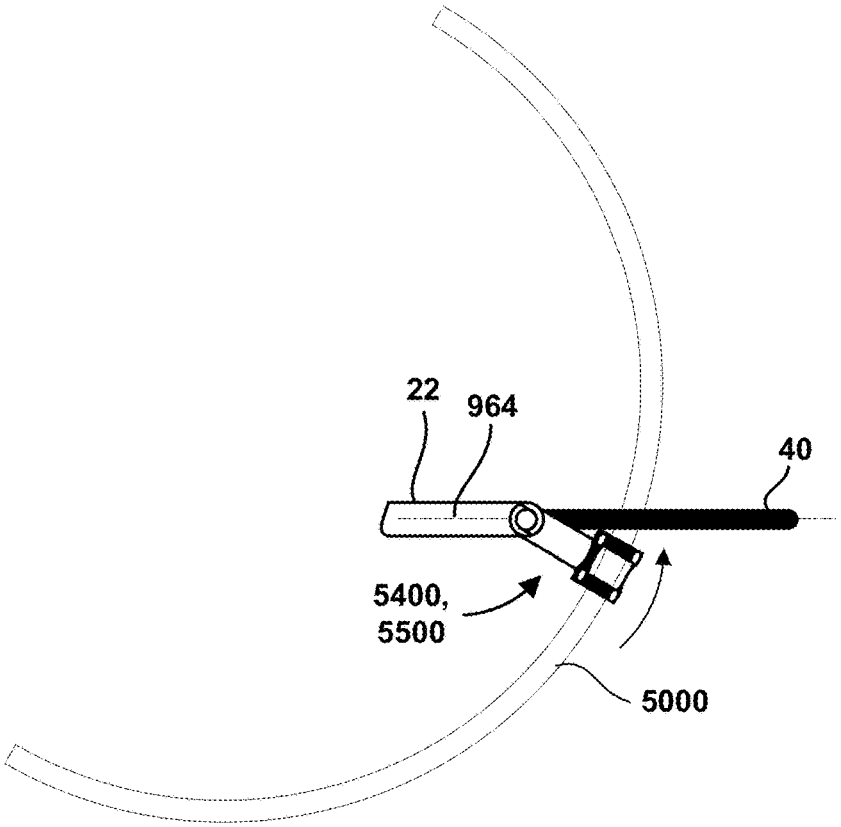

FIG. 158 is a partial plan view a bicycle with a biased handlebar stem and a handlebar illustrated in a neutral position.

Figure 159:
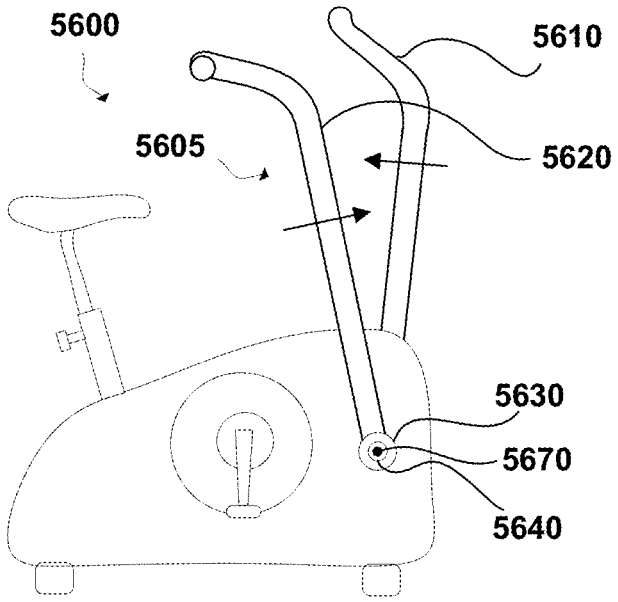

FIG. 159 is a side elevational view of a stationary bicycle according to another embodiment with a biased handlebar apparatus illustrated in a neutral position.

Figure 160:
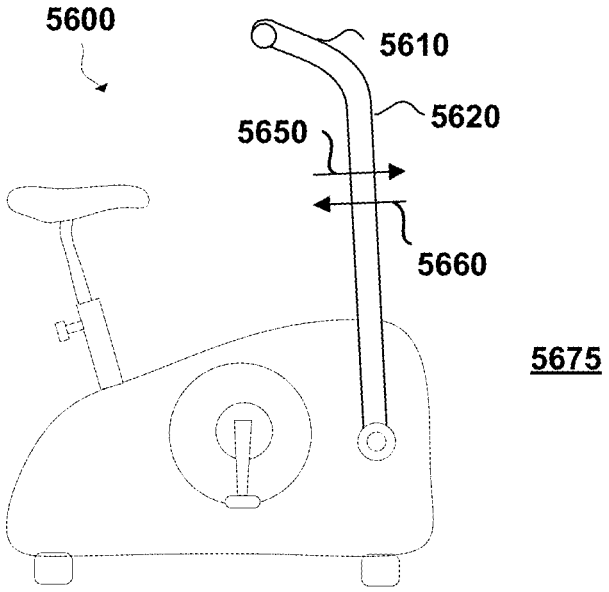

FIG. 160 is a side elevational view of the stationary bicycle of FIG. 159 illustrating the biased handlebar apparatus in a biased position.

Figure 161:
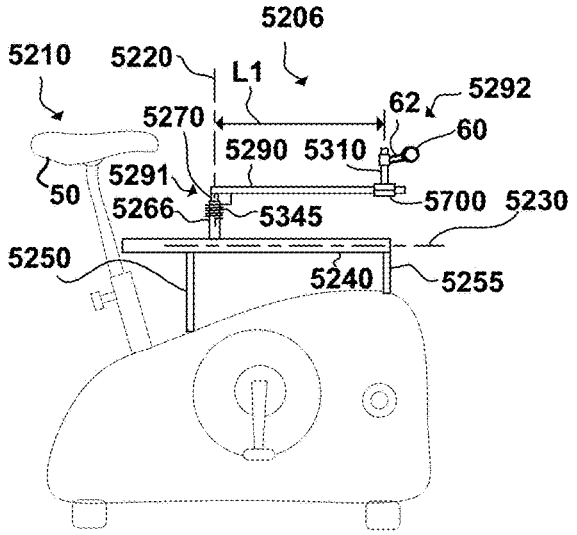

FIG. 161 is a side elevational view of a stationary bicycle with a biased handlebar apparatus illustrated in a first position according to another embodiment.

Figure 162:
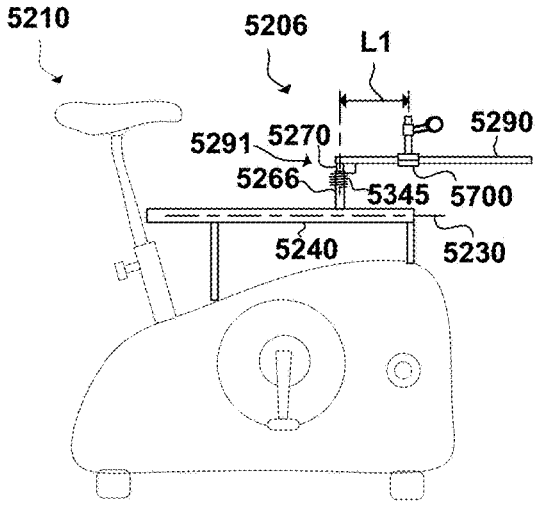
Figure 163:
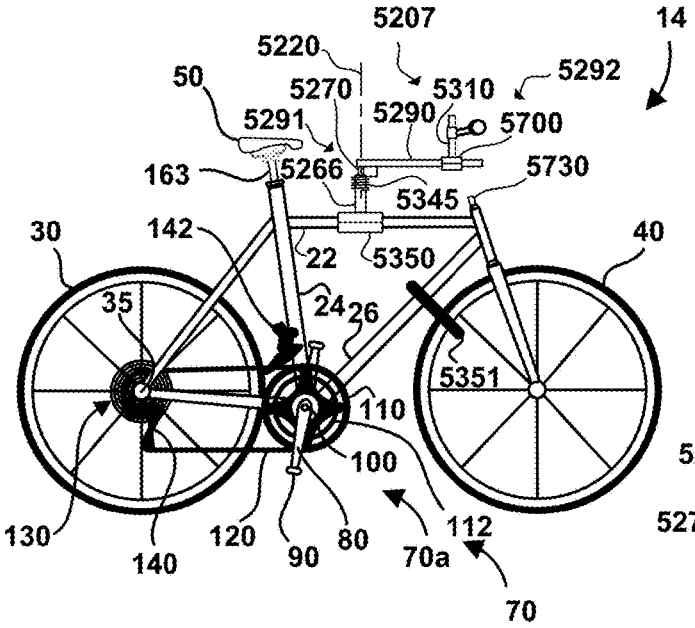

FIG. 162 is a side elevational view of the stationary bicycle with the biased handlebar apparatus of FIG. 161 illustrated in a second position FIG. 163 is a side elevational view of a mobile bicycle with a biased handlebar apparatus according to another embodiment for employment in a stationary cycling application.

Figure 164A:
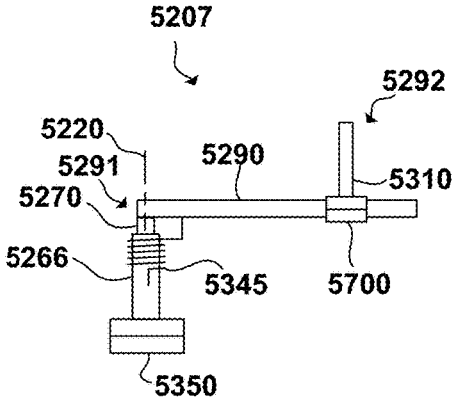

FIG. 164*a* is a side elevational view of the biased handlebar apparatus of FIG. 163.

Figure 164B:
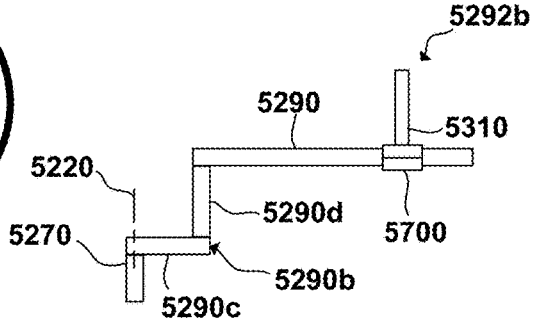

FIG. 164*b* is a side elevational view of a lever arm according to another embodiment.

Figure 165:
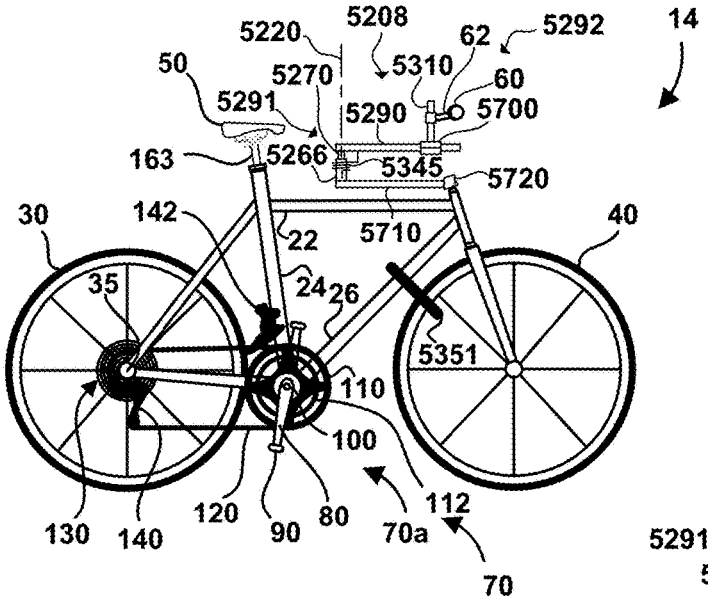

FIG. 165 is a side elevational view of a mobile bicycle with a biased handlebar apparatus according to another embodiment for employment in a stationary cycling application.

Figure 166:
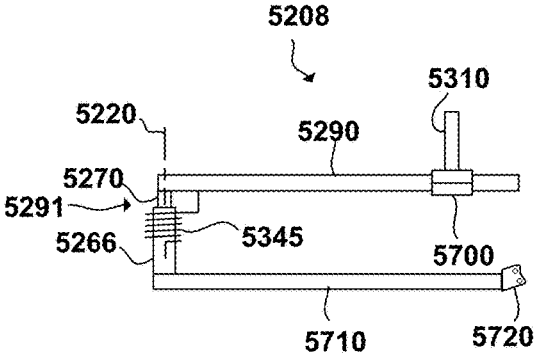

FIG. 166 is a side elevational view of the biased handlebar apparatus of FIG. 165.

Figure 167:
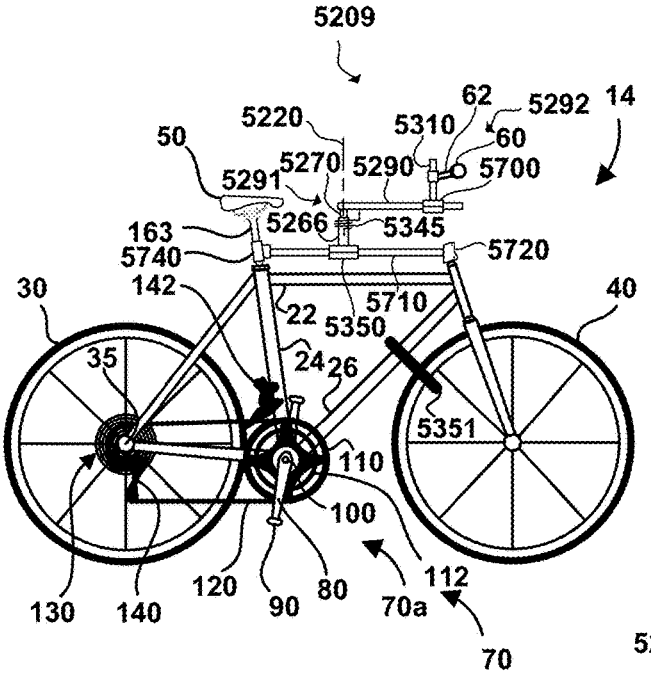

FIG. 167 is a side elevational view of a mobile bicycle with a biased handlebar apparatus according to another embodiment for employment in a stationary cycling application.

Figure 168:
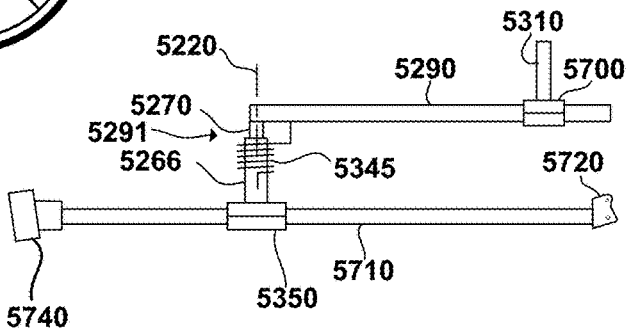

FIG. 168 is a side elevational view of the biased handlebar apparatus of FIG. 165.

Figure 169:
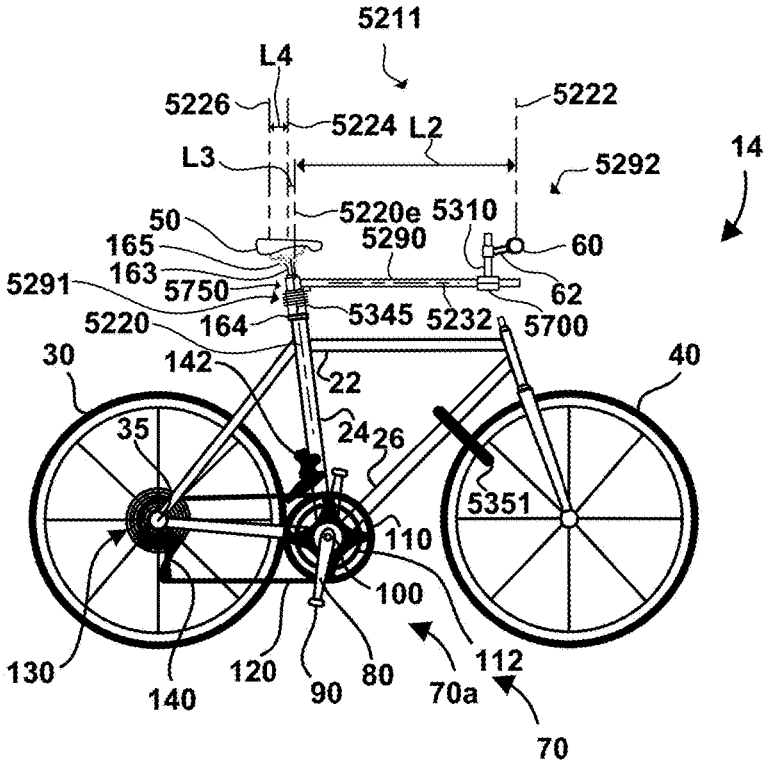

FIG. 169 is a side elevational view of a mobile bicycle with a biased handlebar apparatus according to another embodiment for employment in a stationary cycling application.

Figure 170:
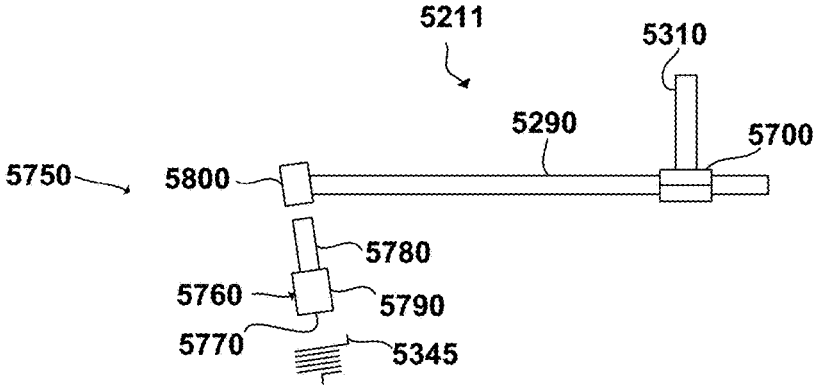

FIG. 170 is a side elevational view of the biased handlebar apparatus of FIG. 169.

Figure 171:
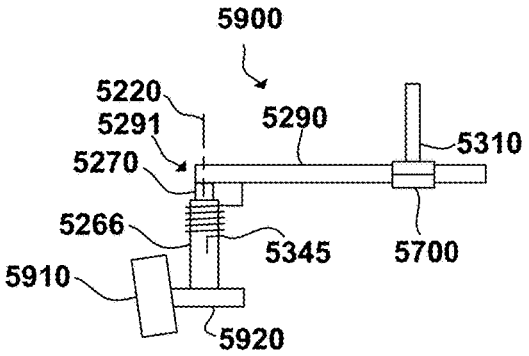

FIG. 171 is a side elevational view of a biased handlebar apparatus according to another embodiment for employment in a stationary cycling application or a mobile application with a wind trainer.

Figure 172:
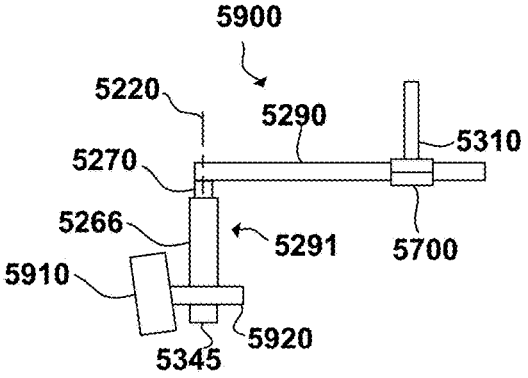

FIG. 172 is a side elevational view of a biased handlebar apparatus according to another embodiment for employment in a stationary cycling application or a mobile application with a wind trainer.

Figure 172B:
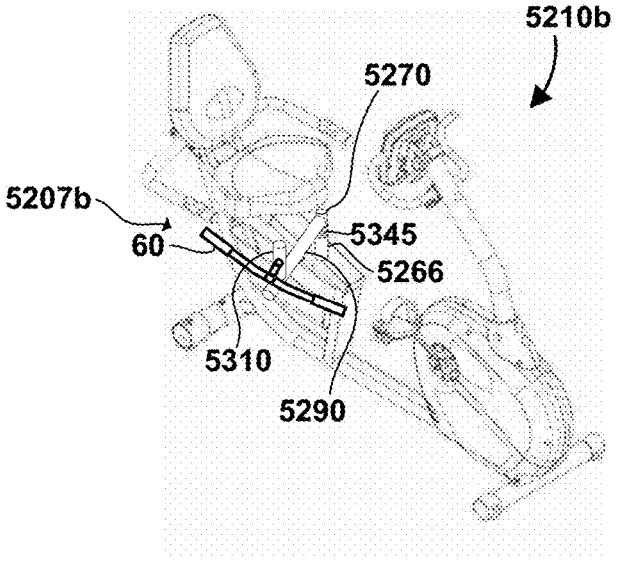

FIG. 172*b* is a perspective view of a recumbent exercise bicycle employing a biased handlebar apparatus according to another embodiment.

Figure 173:
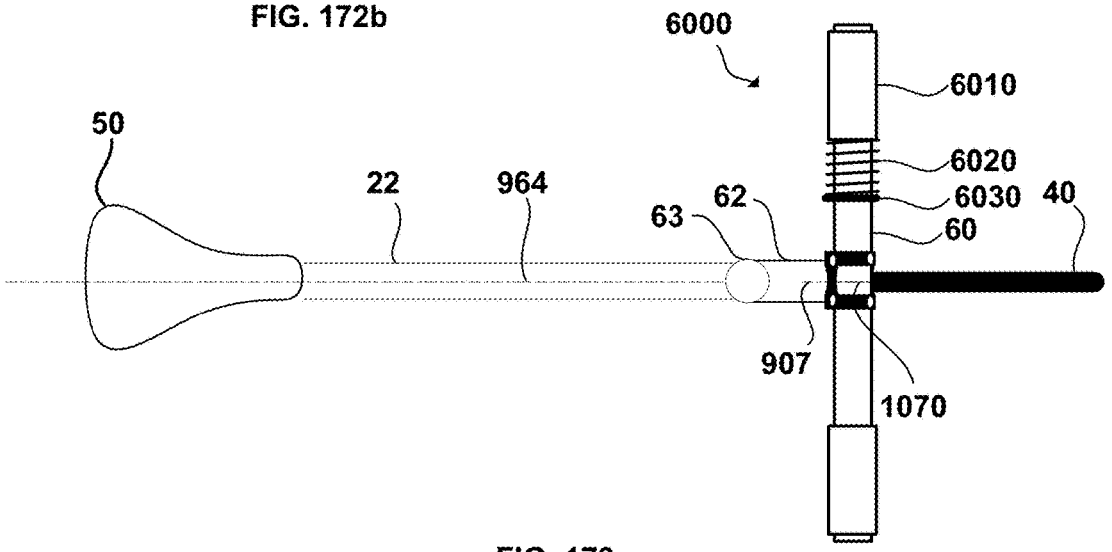

FIG. 173 is a side elevational view of a mobile bicycle with a biased handlebar apparatus according to another embodiment for employment in a stationary cycling application.

Figure 174:
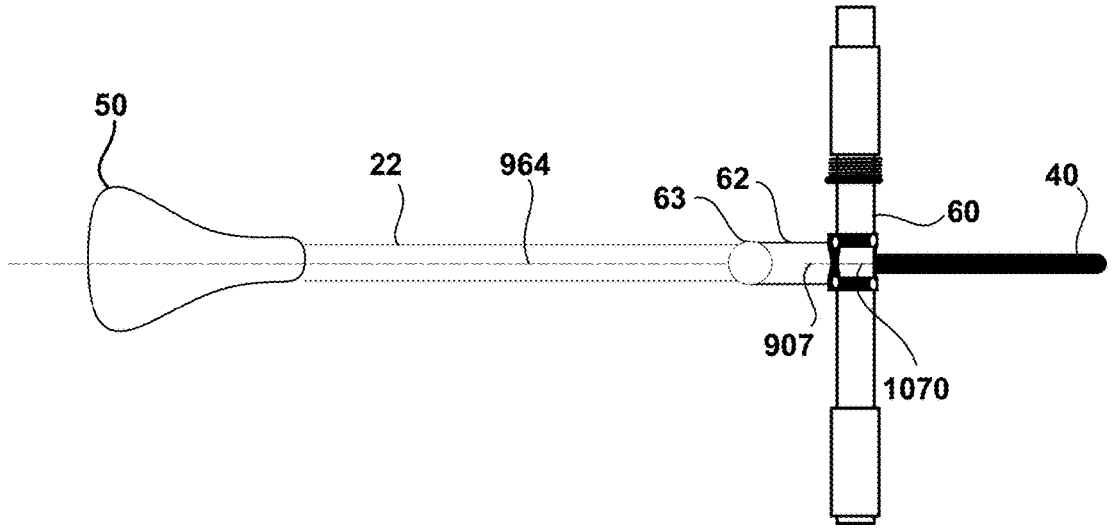

FIG. 174 is a side elevational view of the biased handlebar apparatus of FIG. 173.

Figure 175:
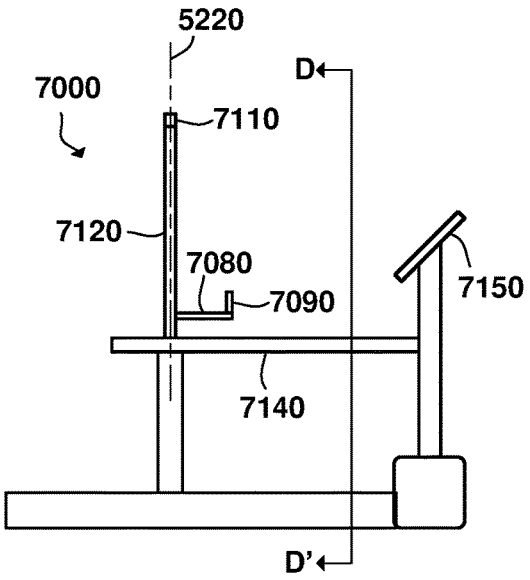

FIG. 175 is a side elevational view of a treadmill apparatus according to another embodiment.

Figure 176:
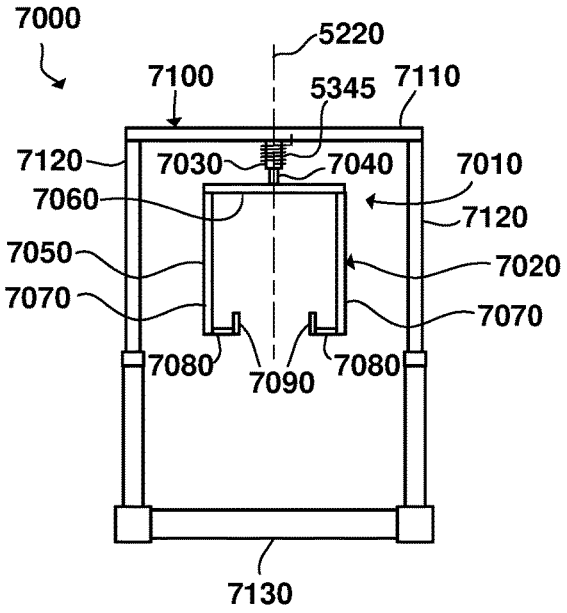

FIG. 176 is a cross-sectional, elevational view of the treadmill in FIG. 175 taken at line D-D'.

Figure 177:
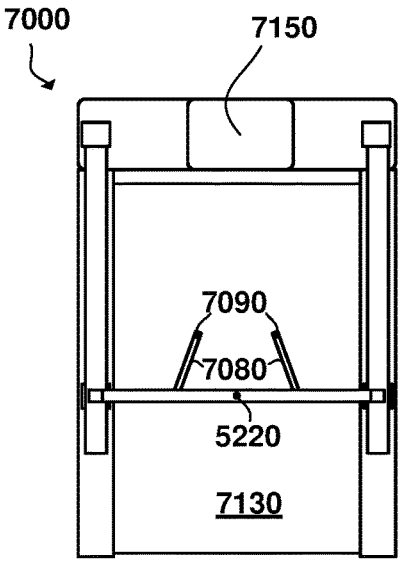

FIG. 177 is a plan view of the treadmill in FIG. 175 illustrating a biased bar apparatus in a biased position.

Figure 178:
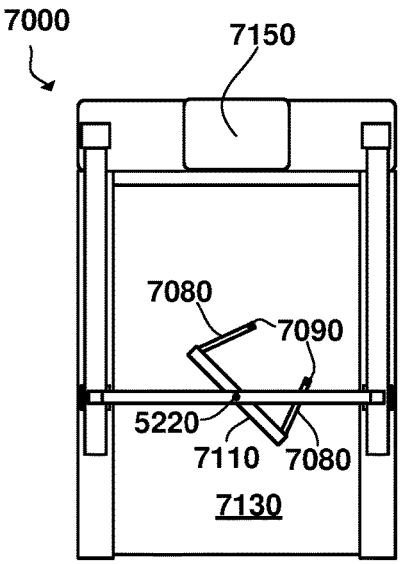

FIG. 178 is a plan view of the treadmill in FIG. 175 illustrating a biased bar apparatus in a neutral position.

Figure 179:
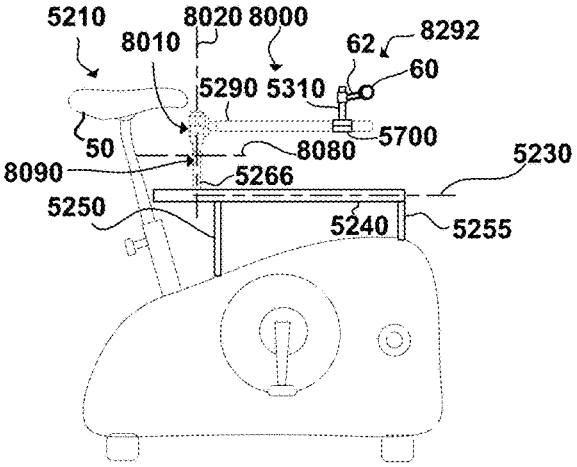

FIG. 179 is a side elevational view of a biased handlebar apparatus according to another embodiment for employment in a stationary cycling application or a mobile application with a wind trainer.

Figure 180:
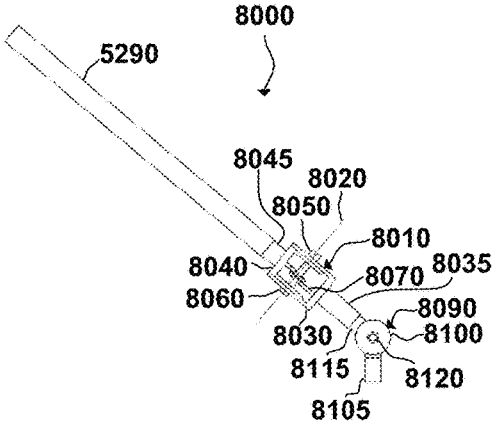

FIG. 180 is a partial front elevational view of the biased handlebar apparatus of FIG. 179 illustrated in an unbiased position.

Figure 181:
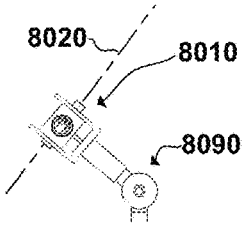

FIG. 181 is a partial front elevational view of the biased handlebar apparatus of FIG. 179 illustrated in a biased position.

Figure 182:
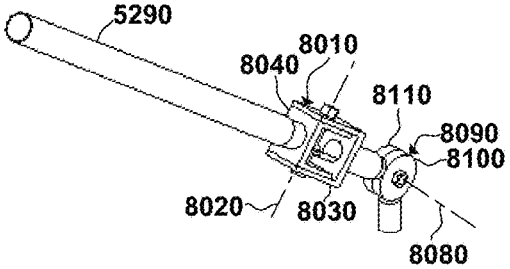

FIG. 182 is a partial perspective view of the biased handlebar apparatus of FIG. 179 illustrated in the unbiased position of FIG. 180.

Figure 183:
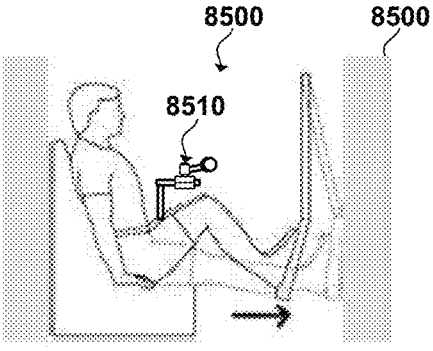

FIG. 183 is a side elevational view of a leg press machine with a biased handlebar apparatus.

Figure 184:
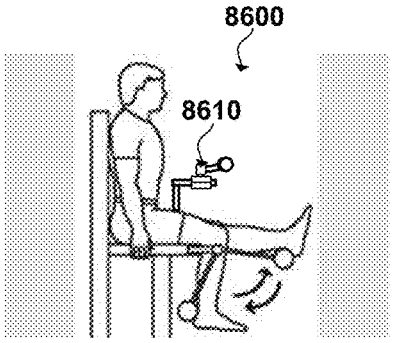

FIG. 184 is a side elevational view of a leg curl machine with a biased handlebar apparatus.

Figure 185:
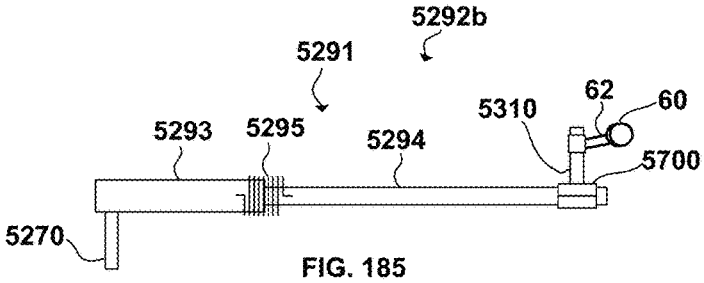

FIG. 185 is a side elevational view of a lever arm according to another embodiment.

Figure 186:
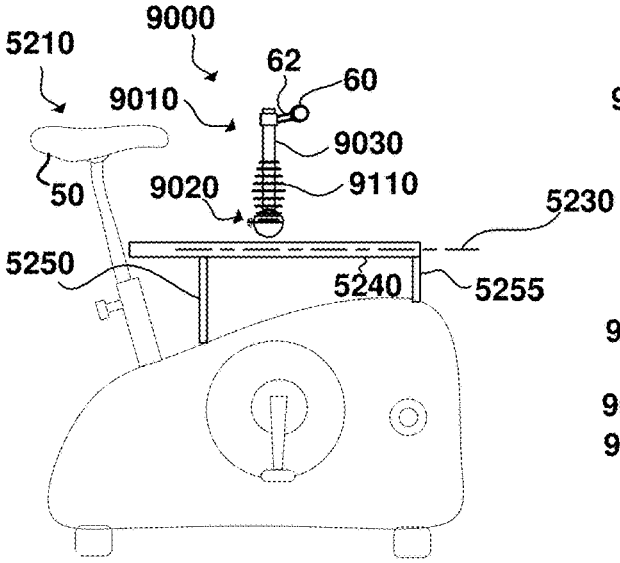

FIG. 186 is a side elevational view of an exercise bicycle employing a biased handlebar apparatus according to another embodiment.

Figure 187:
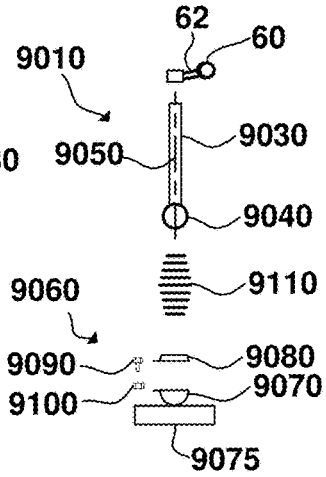

FIG. 187 is an exploded view of the biased handlebar apparatus of FIG. 186.

Figure 188:
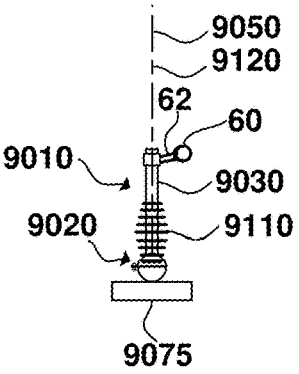

FIG. 188 is a side elevational view of the biased handlebar apparatus of FIG. 186 illustrated in a neutral position.

Figure 189:
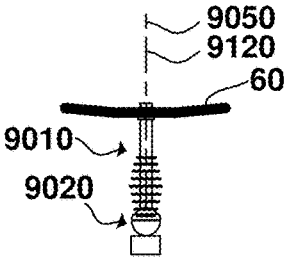

FIG. 189 is a front elevational view of the biased handlebar apparatus of FIG. 186 illustrated in a neutral position.

Figure 190:
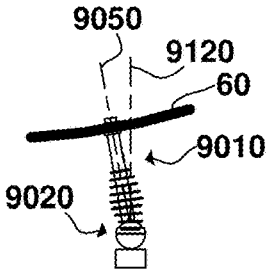

FIG. 190 is a front elevational view of the biased handlebar apparatus of FIG. 186 illustrated in a second position.

Figure 190B:
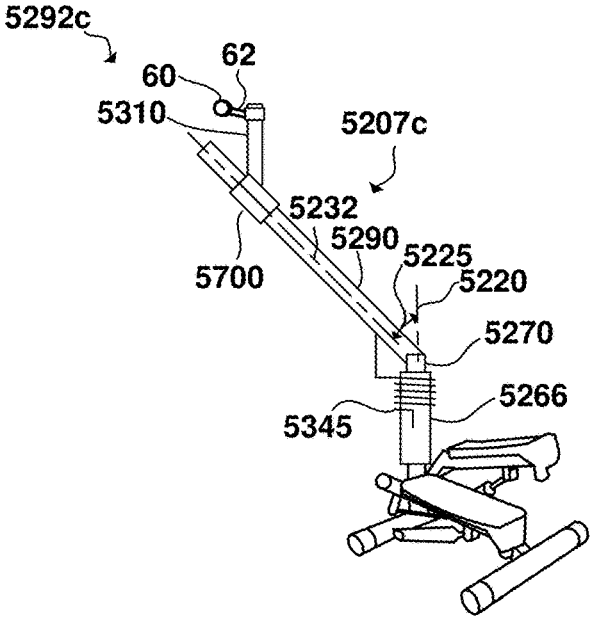

FIG. 190*b* is perspective view of a stepper exercise machine employing a biased handlebar apparatus according to another embodiment.

Figure 191:
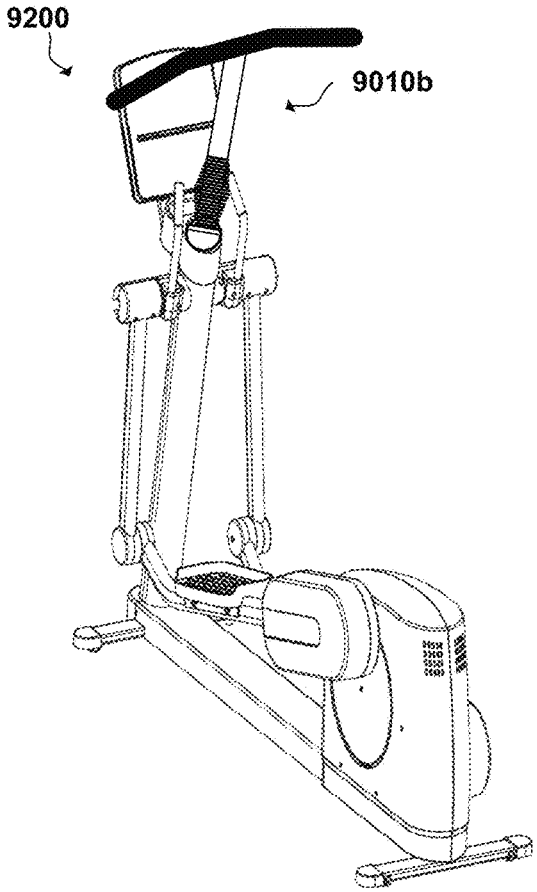

FIG. 191 is a perspective view of an elliptical trainer employing a biased handlebar apparatus according to another embodiment.

Figure 192:
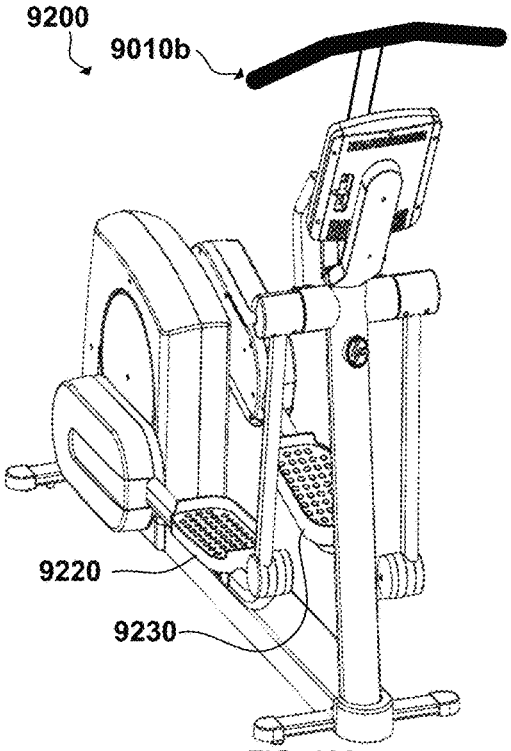

FIG. 192 is a perspective view of the elliptical trainer of FIG. 191.

Figure 193:
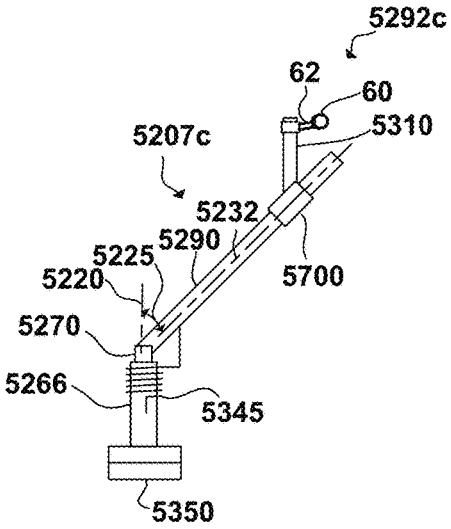

FIG. 193 is a side elevational view of a biased handlebar apparatus according to another embodiment.

Figure 194:
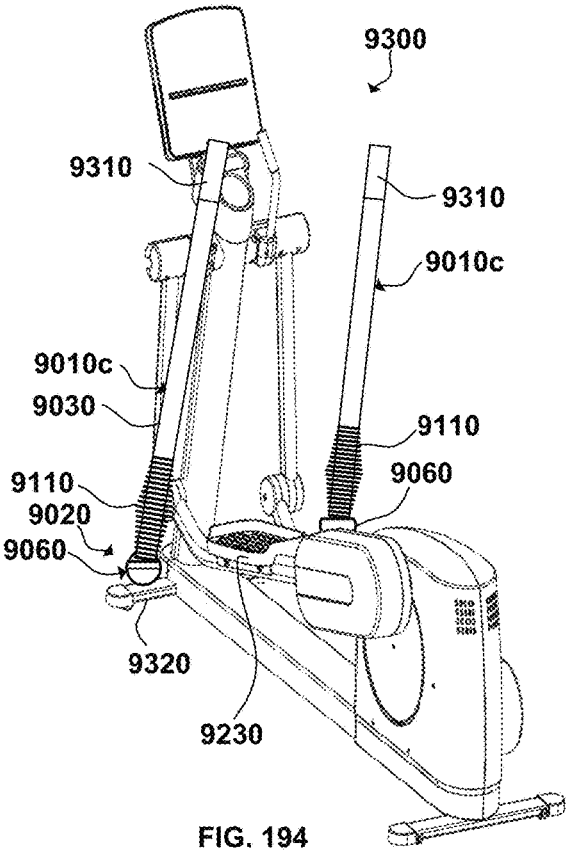

FIG. 194 is a perspective view of an elliptical trainer employing a biased handlebar apparatus according to another embodiment.

Figure 195:
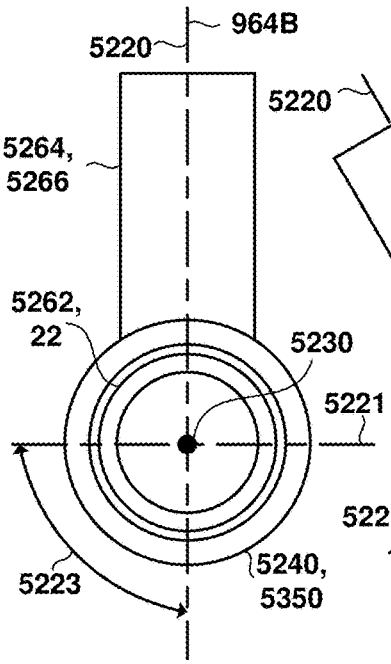

FIG. 195 is a partial front elevational view taken along line 5220 in FIG. 145 illustrating a tubular elongate member in a first position.

Figure 196:
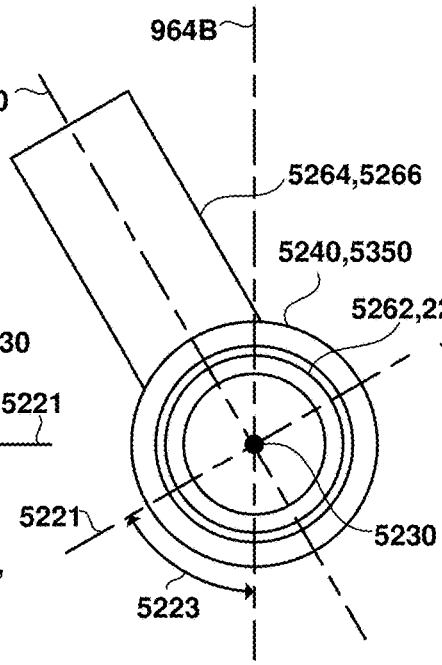

FIG. 196 is a partial front elevational view taken along line 5220 in FIG. 145 illustrating a tubular elongate member in a second position.

Figure 197:
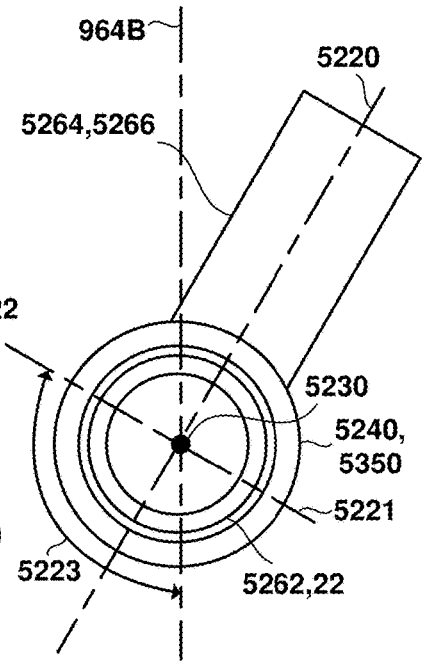

FIG. 197 is a partial front elevational view taken along line 5220 in FIG. 145 illustrating a tubular elongate member in a third position.

Figure 198:
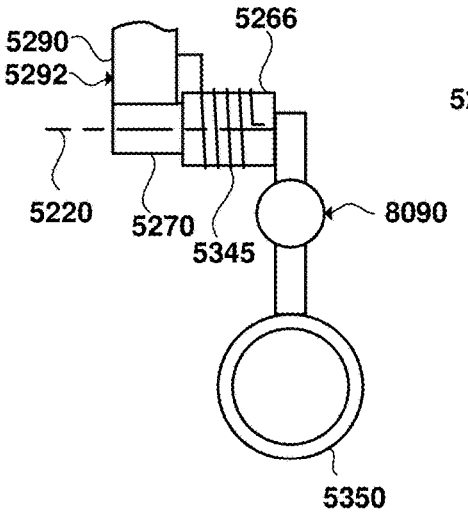

FIG. 198 is a partial front elevational view illustrating a biased handlebar apparatus in a first position.

Figure 199:
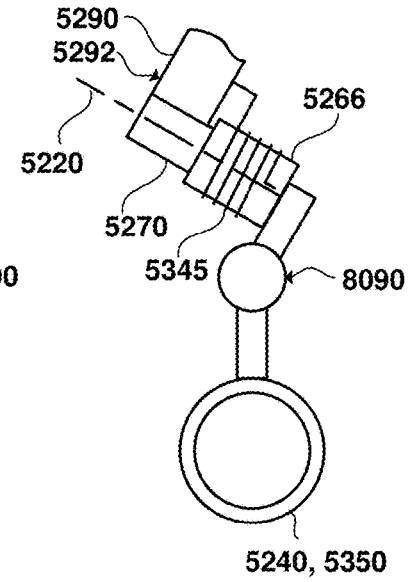

FIG. 199 is a partial front elevational view illustrating a biased handlebar apparatus in a second position.

Figure 200:
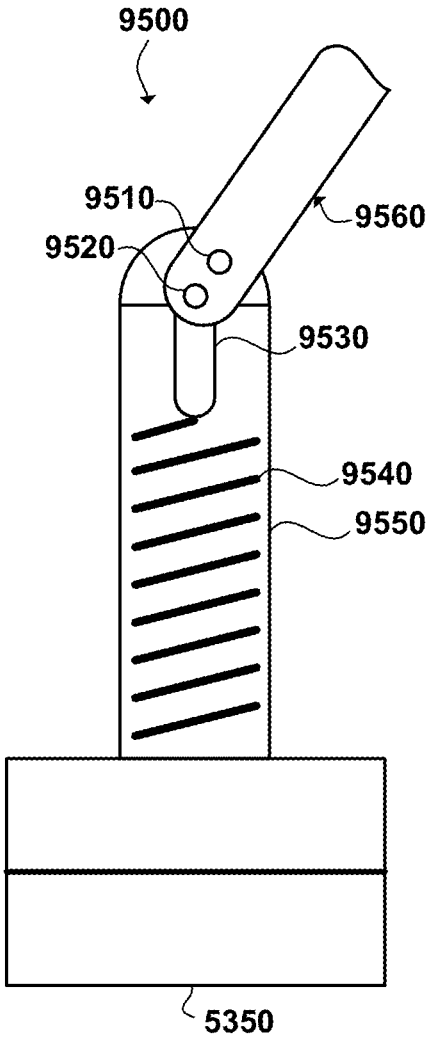

FIG. 200 is a side elevational view of a biased handlebar apparatus illustrated in a neutral position according to another embodiment.

Figure 201:
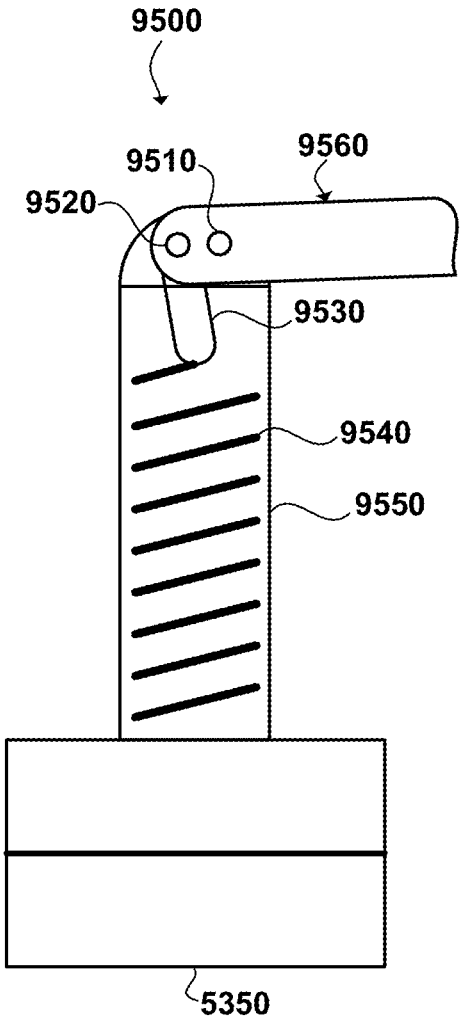

FIG. 201 is a side elevational view of the biased handlebar apparatus of FIG. 200 illustrated in a second position.

Figure 202:
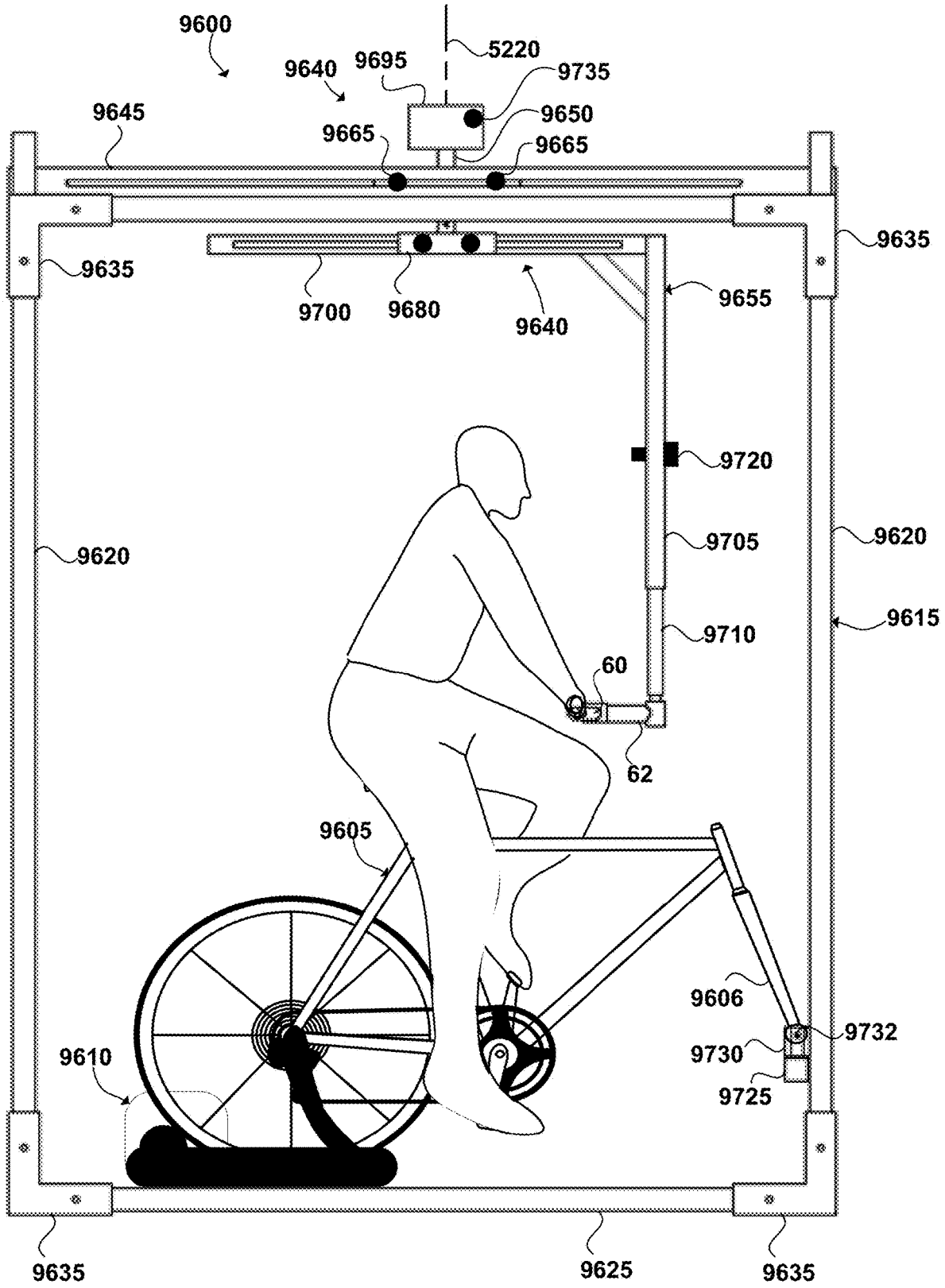

FIG. 202 is a side elevational view of a biased handlebar apparatus according to another embodiment illustrated with a bicycle and a wind trainer.

Figure 203:
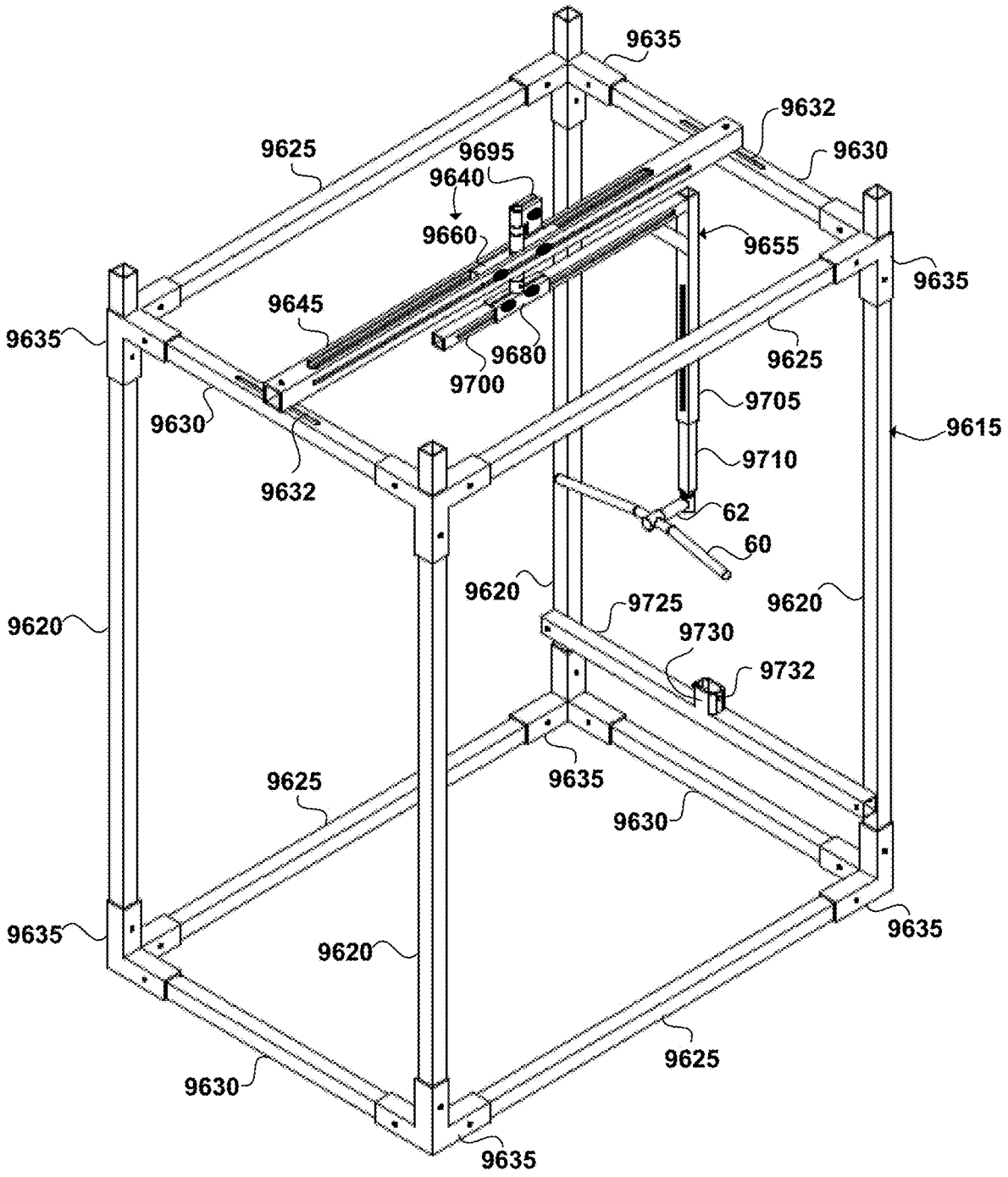

FIG. 203 is a perspective view of the biased handlebar apparatus of FIG. 202.

Figure 204:
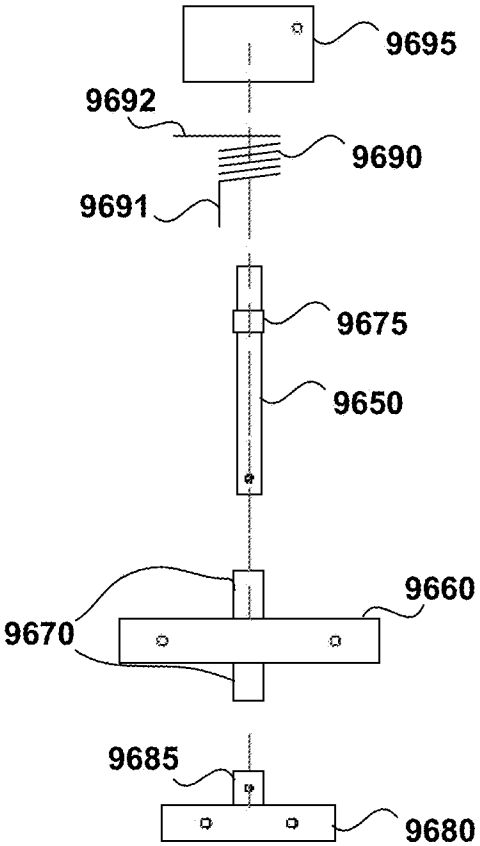

FIG. 204 is an exploded view of a portion of an adjustable lever-arm pivoting mechanism of the biased handlebar apparatus of FIG. 202.

Figure 205B:
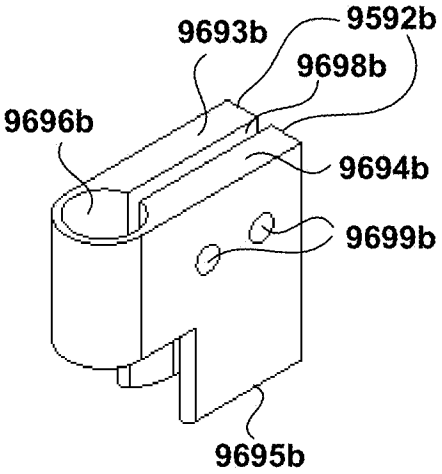
Figure 205:
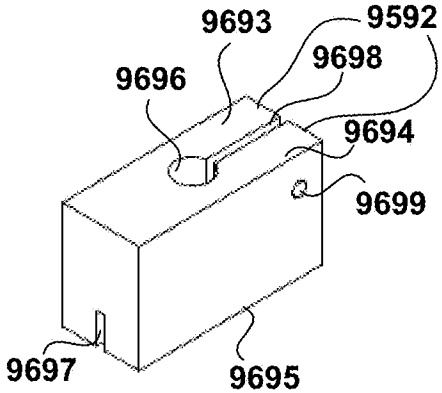

FIG. 205 is a perspective view of a spring bearing of the adjustable lever-arm pivoting mechanism of FIG. 204.

FIG. 205*b* is a perspective view of a spring bearing of the adjustable lever-arm pivoting mechanism of FIG. 204.

Figure 206B:
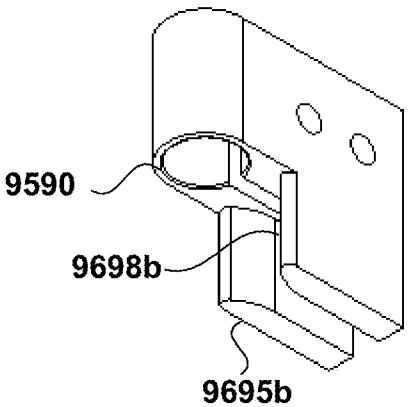
Figure 206:
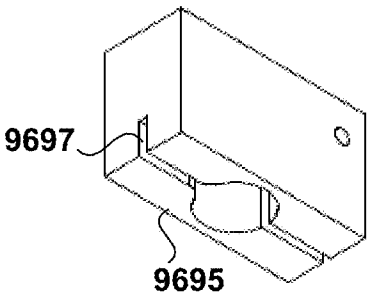

FIG. 206 is a perspective view of a spring bearing of the adjustable lever-arm pivoting mechanism of FIG. 204.

FIG. 206*b* is a perspective view of a spring bearing of the adjustable lever-arm pivoting mechanism of FIG. 204.

Figure 207:
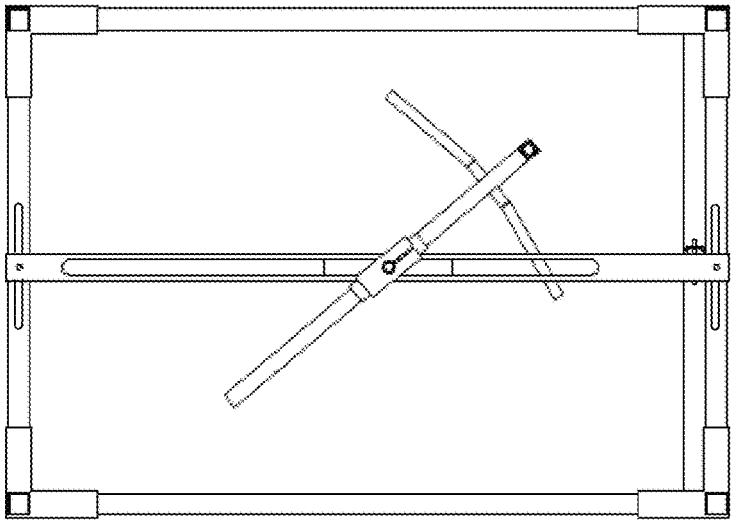

FIG. 207 is a top plan view of the biased handlebar apparatus of FIG. 202 with a lever arm shown in a first position.

Figure 208:
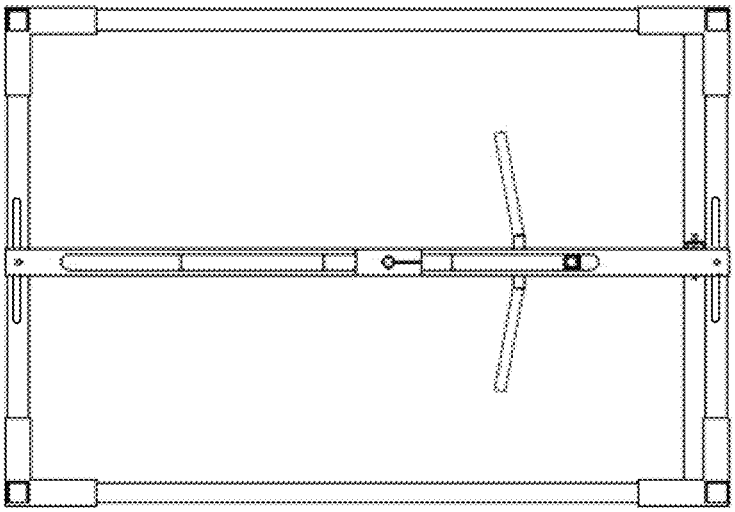

FIG. 208 is a top plan view of the biased handlebar apparatus of FIG. 202 with a lever arm shown in a second position.

Figure 209:
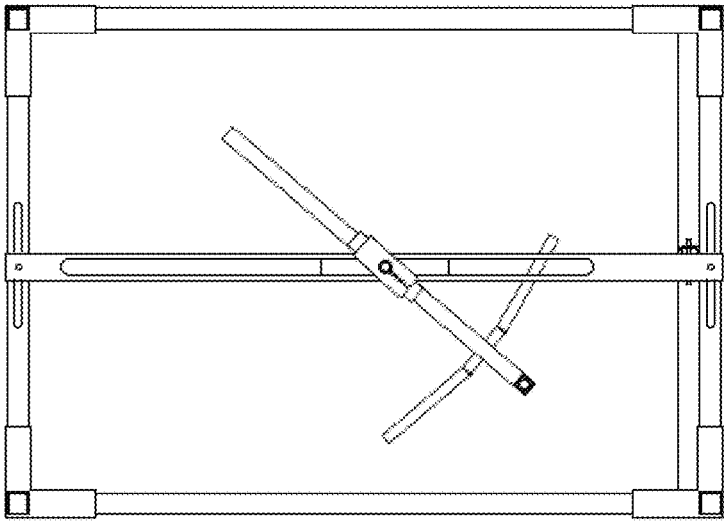

FIG. 209 is a top plan view of the biased handlebar apparatus of FIG. 202 with a lever arm shown in a third position.

Figure 210:
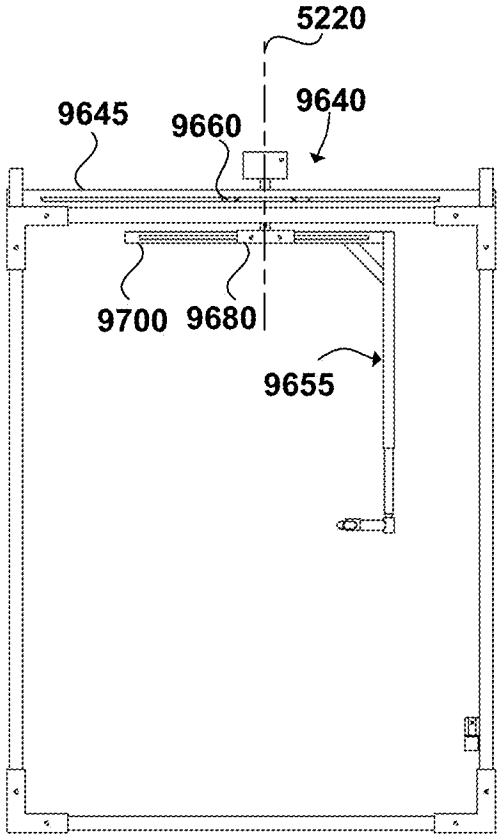

FIG. 210 is side elevational view of the biased handlebar apparatus of FIG. 202 with an adjustable lever-arm pivoting mechanism illustrated in a first configuration.

Figure 211:
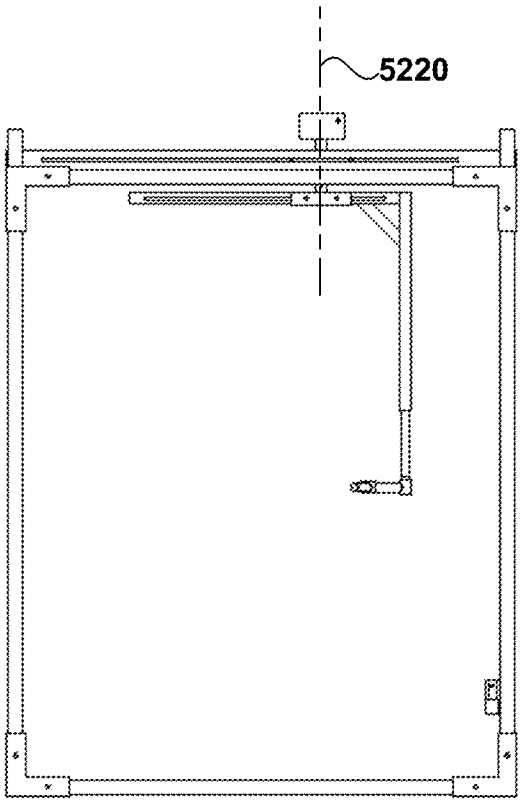

FIG. 211 is side elevational view of the biased handlebar apparatus of FIG. 202 with an adjustable lever-arm pivoting mechanism illustrated in a first configuration.

Figure 212:
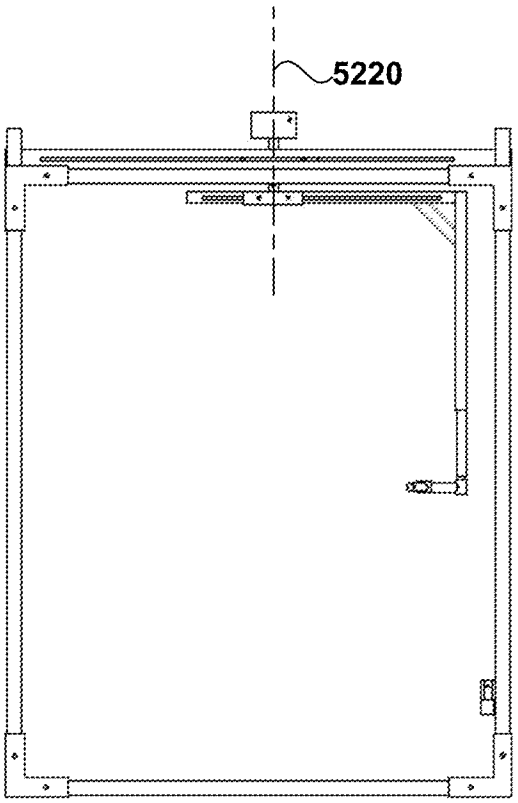

FIG. 212 is side elevational view of the biased handlebar apparatus of FIG. 202 with an adjustable lever-arm pivoting mechanism illustrated in a first configuration.

Figure 213:
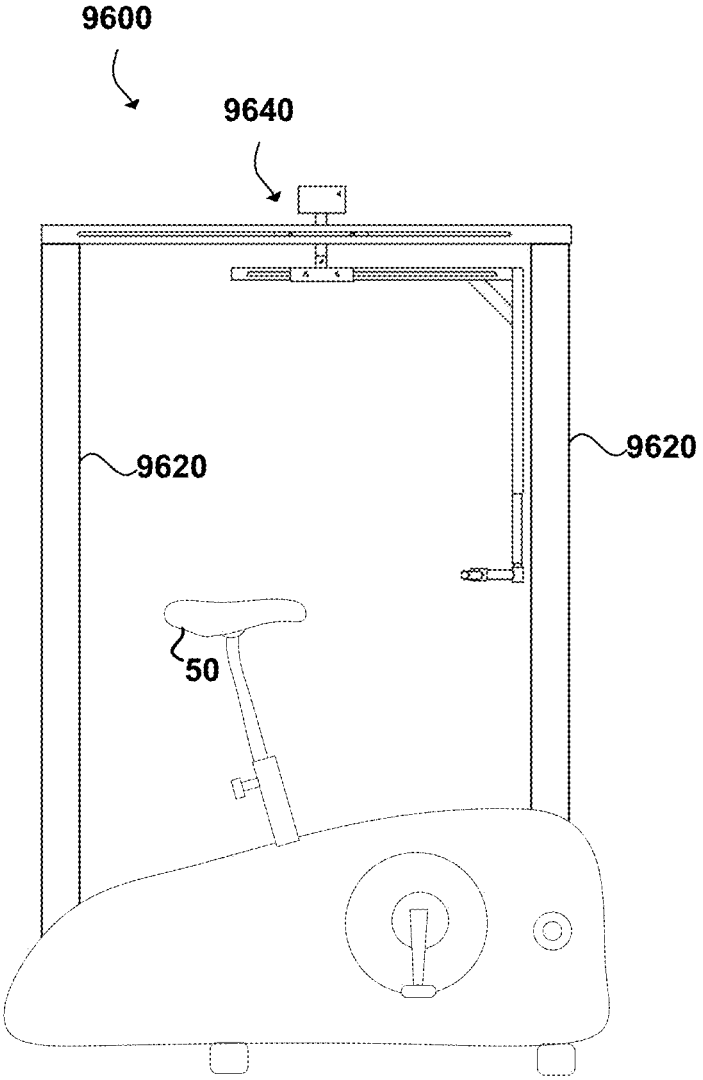

FIG. 213 is a side elevational view of a biased handlebar apparatus according to another embodiment.

Figure 214:
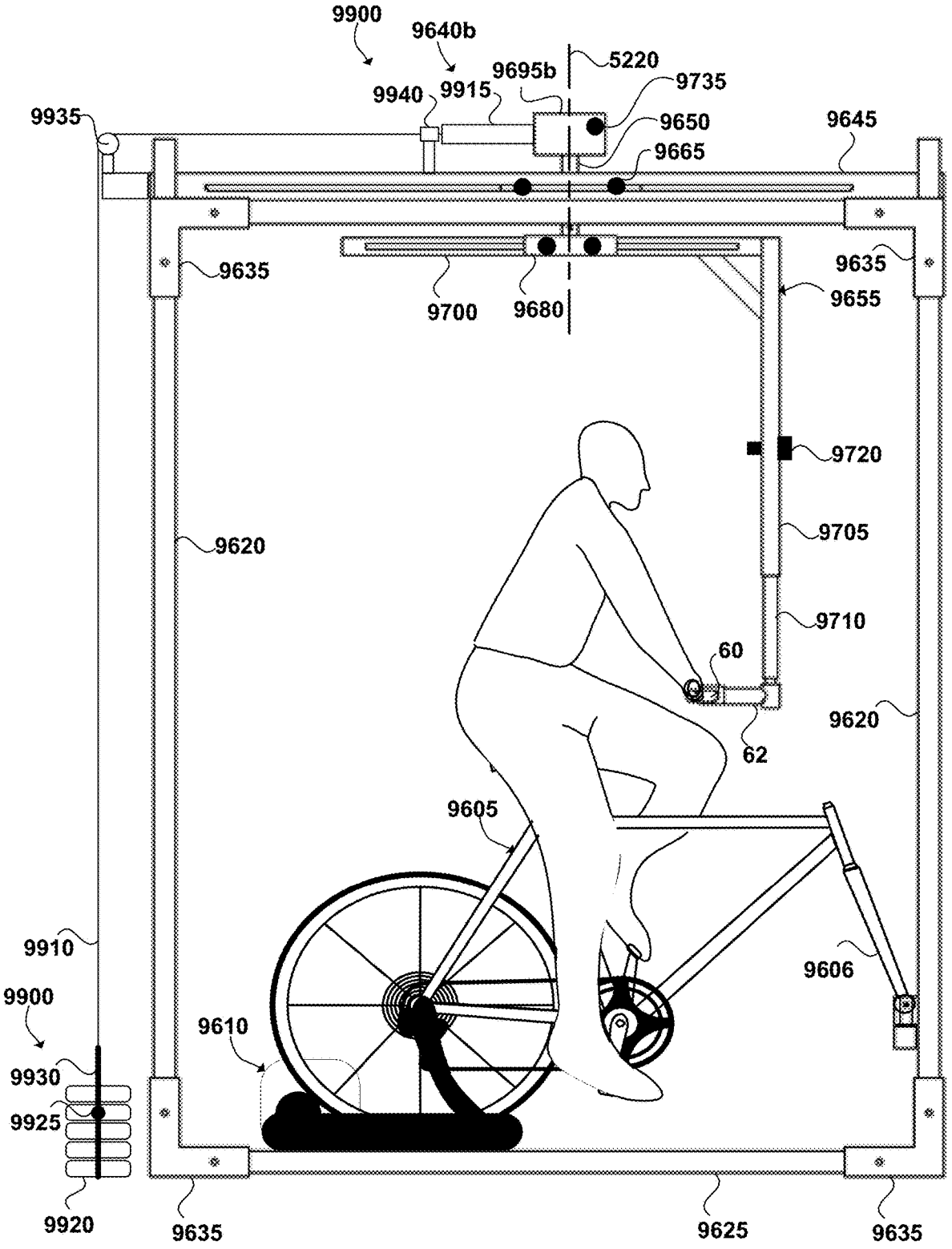

FIG. 214 is a side elevational view of a biased handlebar apparatus according to another embodiment.

Figure 215:
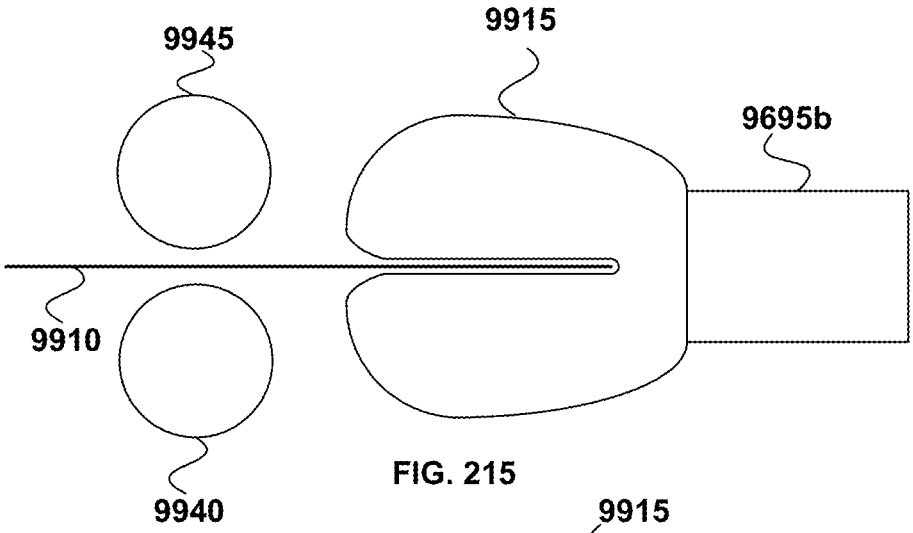

FIG. 215 is a partial plan view of an adjustable lever-arm pivoting mechanism of the biased handlebar apparatus of FIG. 214 illustrated in a first position.

Figure 216:
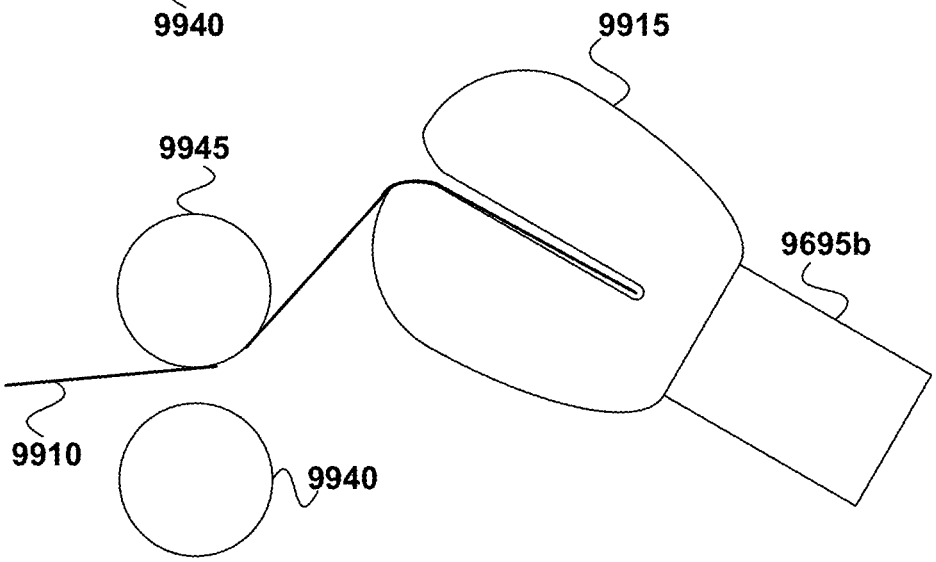

FIG. 216 is a partial plan view of an adjustable lever-arm pivoting mechanism of the biased handlebar apparatus of FIG. 214 illustrated in a second position.

Figure 217:
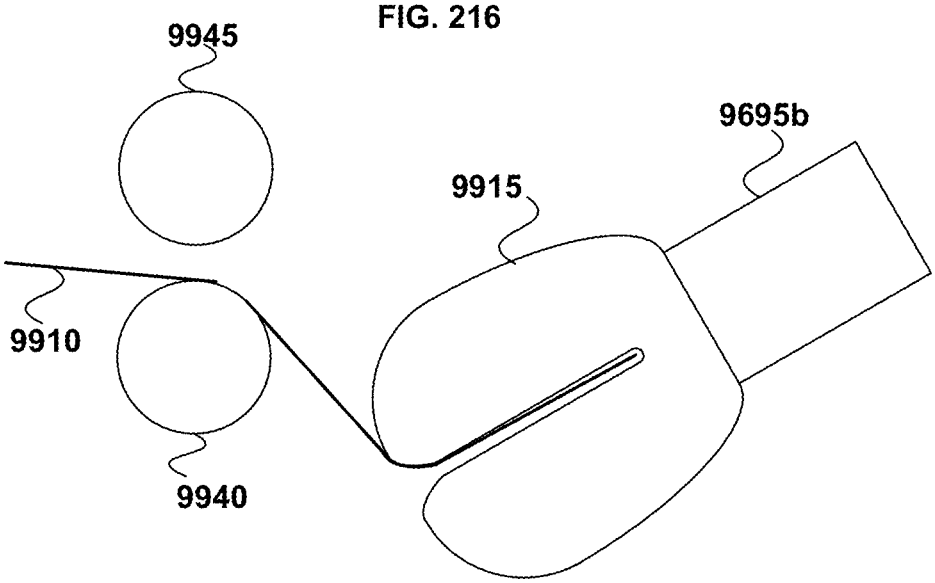

FIG. 217 is a partial plan view of an adjustable lever-arm pivoting mechanism of the biased handlebar apparatus of FIG. 214 illustrated in a third position.

Figure 218:
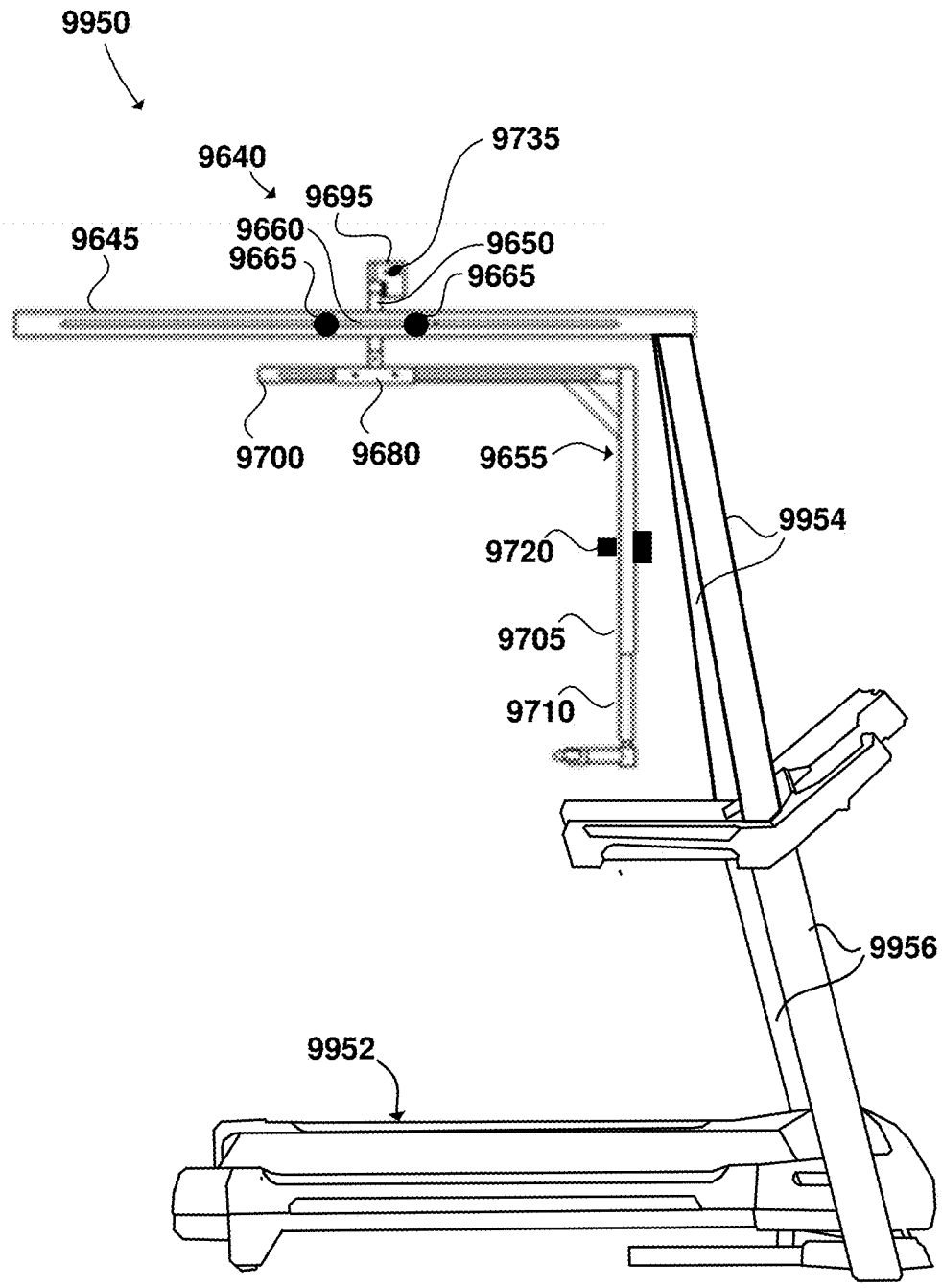

FIG. 218 is a side elevational view of a biased handlebar apparatus according to another embodiment illustrated with a treadmill.

Figure 219:
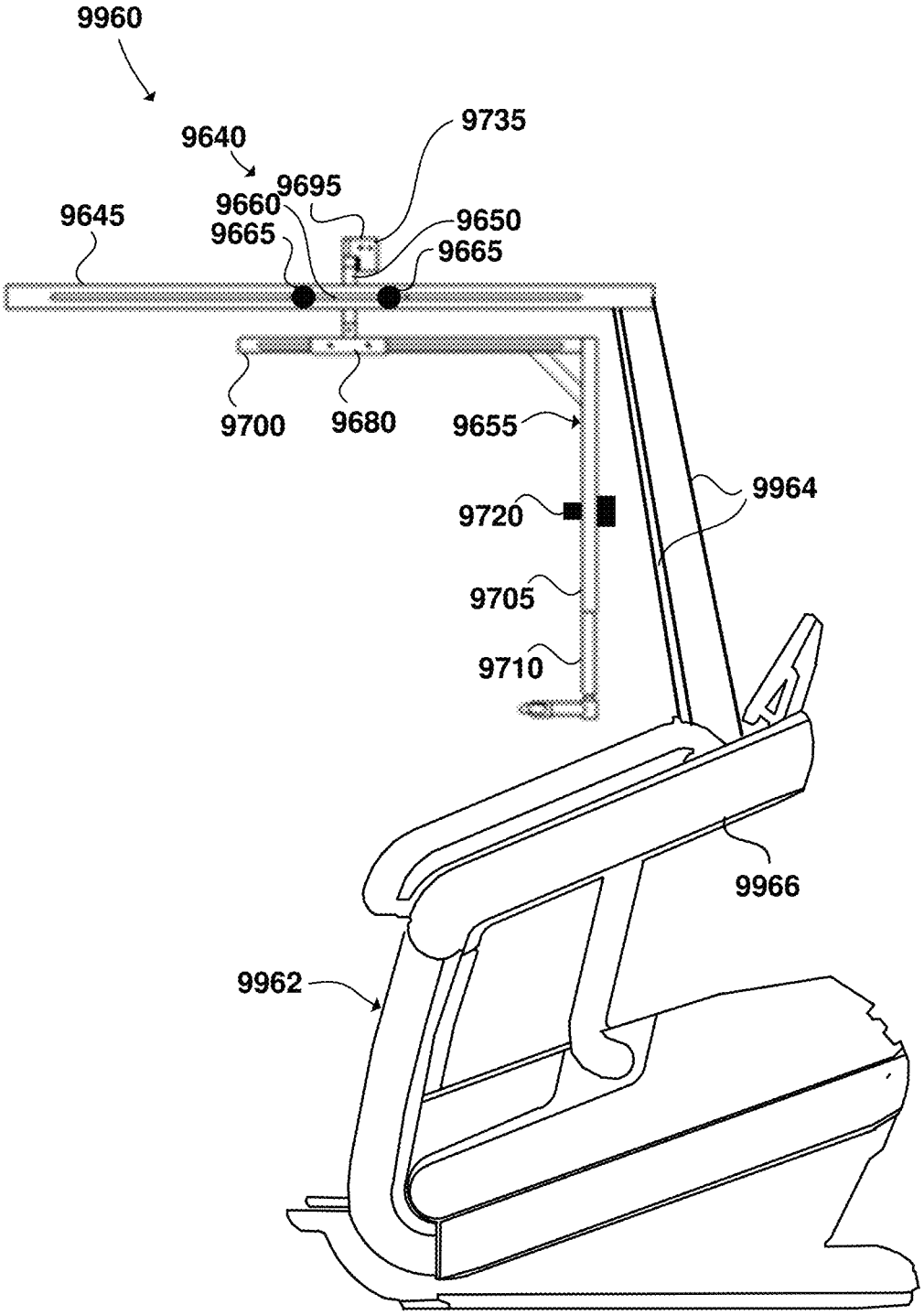

FIG. 219 is a side elevational view of a biased handlebar apparatus according to another embodiment illustrated with a stair climber.

Figure 220:
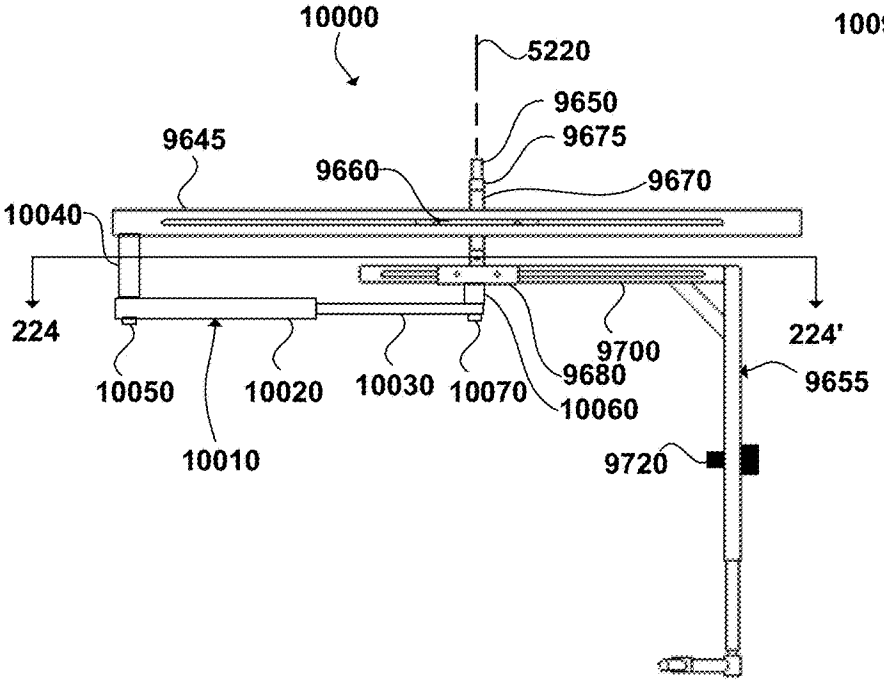

FIG. 220 is a view of an adjustable lever-arm pivoting mechanism according to another embodiment.

Figure 221:
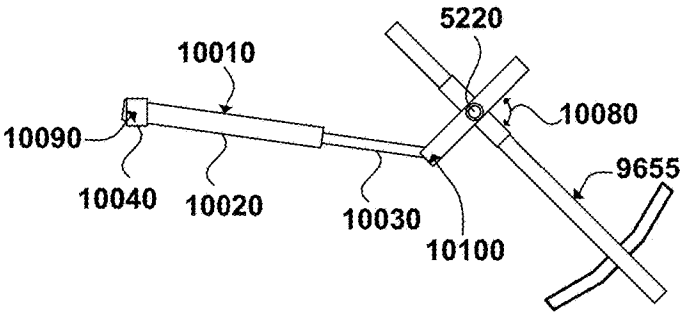

FIG. 221 is a cross-sectional view of the adjustable lever-arm pivoting mechanism shown in a first position of FIG. 220 taken along line 224-224'.

Figure 222:
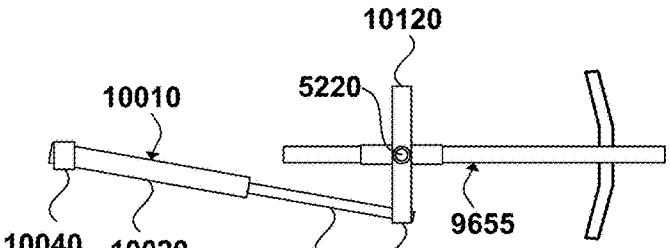

FIG. 222 is a cross-sectional view of the adjustable lever-arm pivoting mechanism shown in a second position of FIG. 220 taken along line 224-224'.

Figure 223:
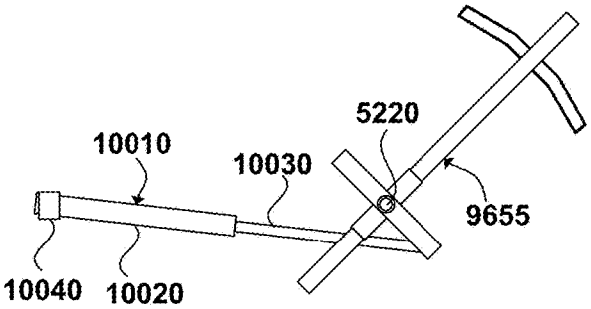

FIG. 223 is a cross-sectional view of the adjustable lever-arm pivoting mechanism shown in a third position of FIG. 220 taken along line 224-224'.

Figure 224:
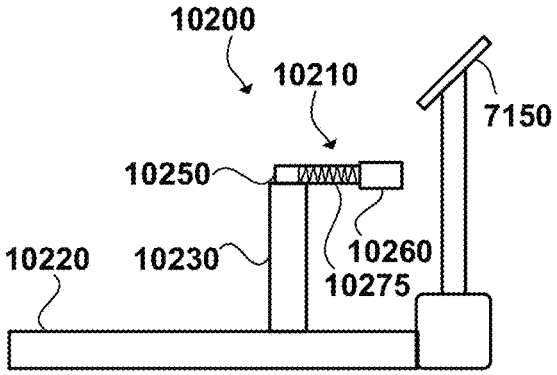

FIG. 224 is a side elevational view of a biased handlebar apparatus according to another embodiment illustrated with a treadmill.

Figure 225:
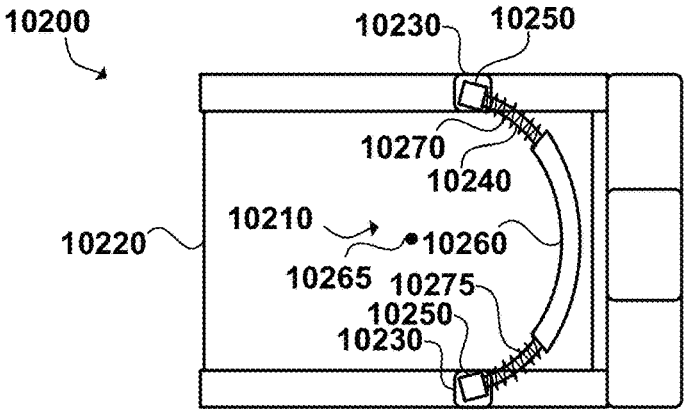

FIG. 225 is a plan view of the biased bar apparatus of FIG. 224 shown in a first position.

Figure 226:
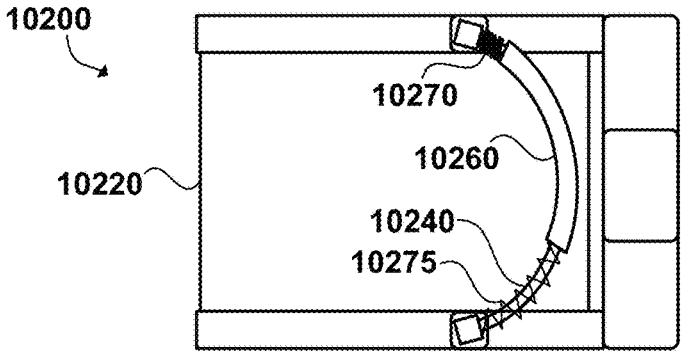

FIG. 226 is a plan view of the biased bar apparatus of FIG. 224 shown in a second position.

Figure 227:
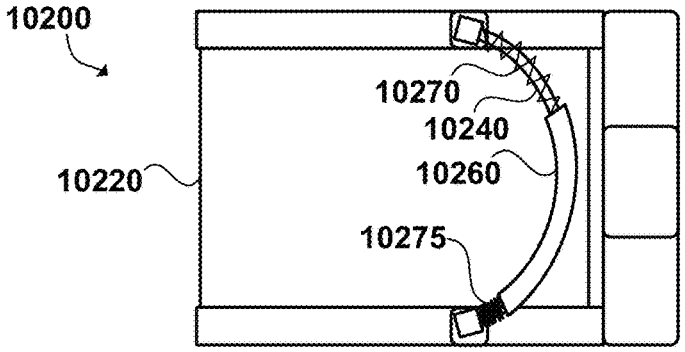

FIG. 227 is a plan view of the biased bar apparatus of FIG. 224 shown in a third position.

Figure 228:
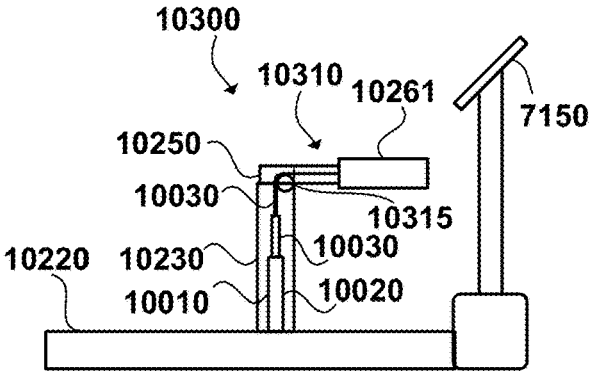

FIG. 228 is a side elevational view of a biased handlebar apparatus according to another embodiment illustrated with a treadmill.

Figure 229:
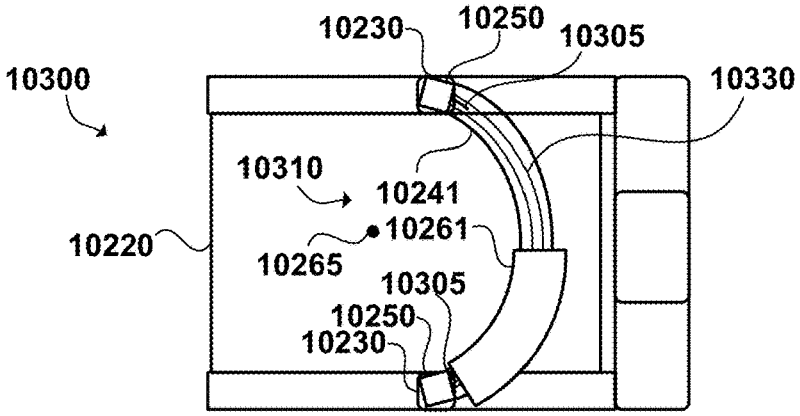

FIG. 229 is a plan view of the biased bar apparatus of FIG. 228 shown in a first position.

Figure 230:
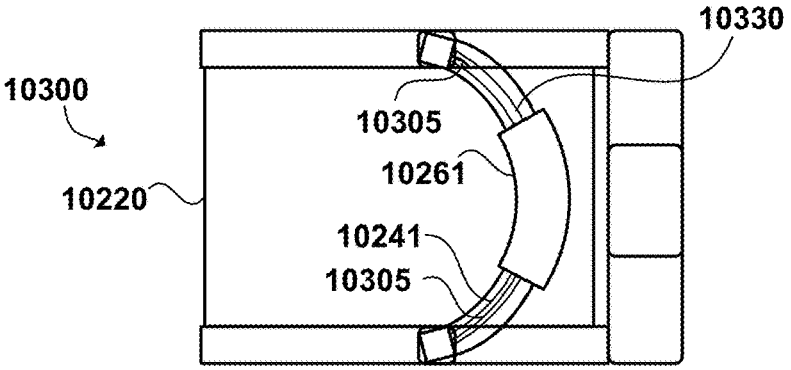

FIG. 230 is a plan view of the biased bar apparatus of FIG. 228 shown in a second position.

Figure 231:
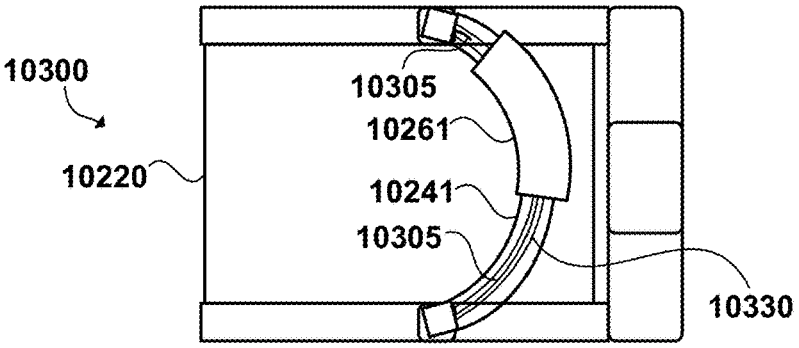

FIG. 231 is a plan view of the biased bar apparatus of FIG. 228 shown in a third position.

DETAILED DESCRIPTION OF PREFERRED EMBODIMENT(S)

Figure 1:
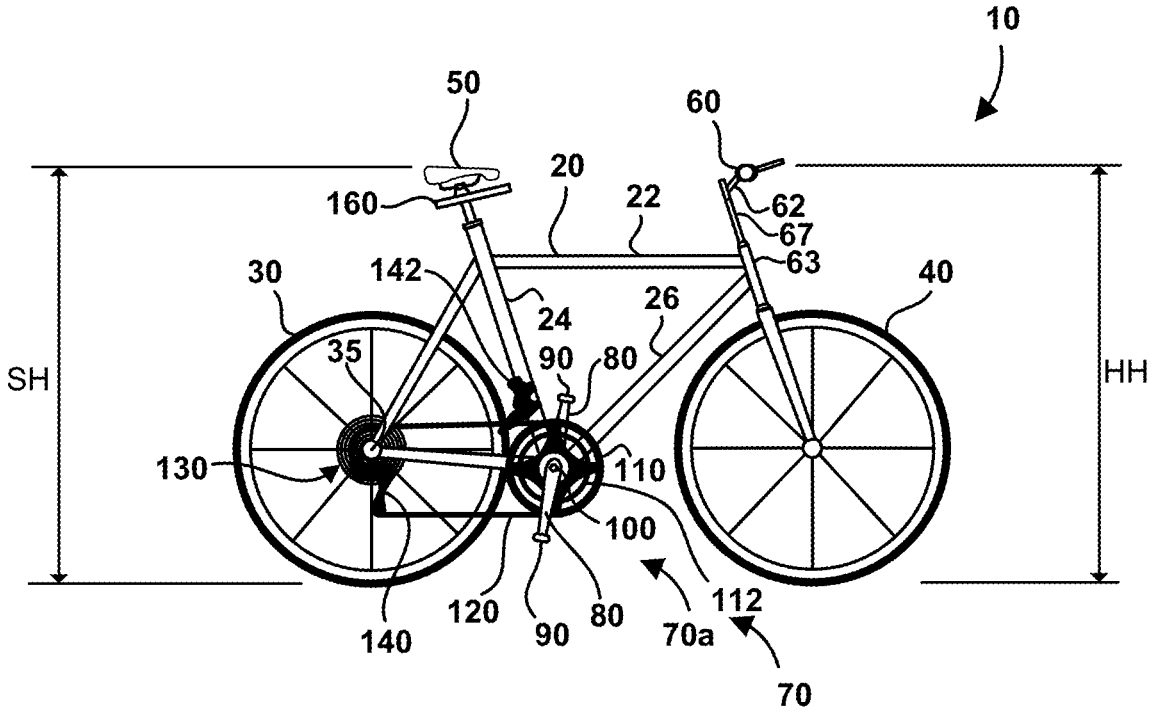
FIG. 1 is a side elevational view of a bicycle apparatus according to a first embodiment.
Figure 2:
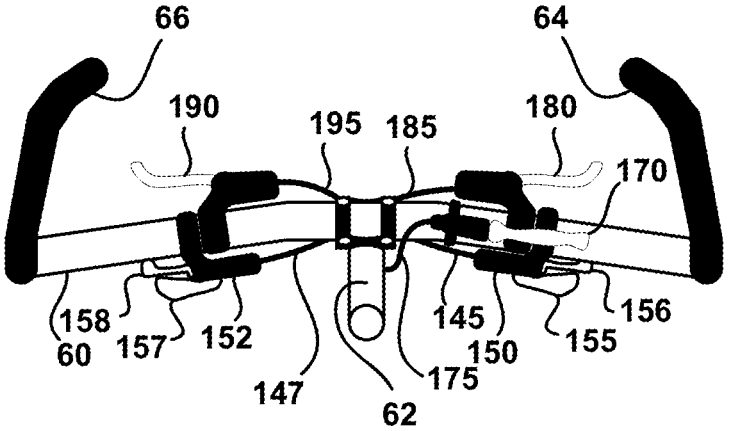
FIG. 2 is a plan view of a handlebar apparatus of the bicycle apparatus of FIG. 1.

Referring to the views of FIGS. 1 and 2, there is shown bicycle apparatus 10 according to a first embodiment. Bicycle apparatus 10 is a bicycle setup having a novel arrangement of components that offers a rider a beneficial cycling experience having unexpectedly good results, and which was heretofore unknown. Frame 20 arranges conventional bicycle components in space with respect to each other including rear wheel 30, front wheel 40, saddle 50, handlebar 60, and drivetrain 70. In the illustrated embodiment frame 20 is a conventional frame characterized by the triangular shape of top tube 22, seat tube 24 and down tube 26; although this particular frame is not a requirement and in other embodiments other types of frames can be employed. Similarly, handlebar 60 is illustrated as a flat-bar type of handlebar, which is not a requirement and in other embodiments other types of handlebars can be employed, such as for example drop handlebars (seen on road bikes), riser handlebars, touring handlebars and triathlon handlebars, as well as other handlebar types. Handlebar 60 is connected with apparatus 10 by handlebar stem 62, which is illustrated connected to head-tube 63 by way of stem riser 67, although alternatively stem 62 can be connected directly to head-tube 63. Handlebar height HH (seen in FIG. 1) is the height of handlebar 60 above ground level and is measured from the top of the handlebar where the rider's hands make contact and are supported by the handlebar. Saddle height SH (also seen in FIG. 1) is the height of saddle 50 above ground level and is measured from the top of the saddle where the rider makes contact and is supported by the saddle. Drivetrain 70 transmits power generated from a rider to rear wheel 30, and includes crankset 70*a* and rear sprocket apparatus 130. Crankset 70*a* is a collection of components that converts the reciprocating motion of a rider's legs into rotational motion that drives chain 120. Crankset 70*a* includes a pair of crankarms 80 that are connected with respective pedals 90 and with sprockets 110 and 112 (also known as chainrings). Although only two sprockets 110 and 112 are shown in the illustrated embodiment, in other embodiments there can be only on sprocket or more than two sprockets connected with crankarms 80. At one end of each crankarm 80 is pedal 90 and the other end of which is connected with bottom bracket 100. Sprockets 110 and 112 are connected with rear sprocket apparatus 130 by way of chain 120. Rear sprocket apparatus 130 includes at least two sprockets and is connected with hub 35 of rear wheel 30. Rear sprocket apparatus 130 can be a freewheel, in which case hub 35 is known as a threaded hub, alternatively the rear sprocket apparatus can be a cassette, in which case hub 35 is known as a freehub. As used herein, sprockets associated with the crankset are referred to as input sprockets, and sprockets associated with the rear hub are referred to as output sprockets. Crankset 70*a* is connected with a rider by pedals 90, with frame 20 by bottom bracket 100 and with rear sprocket apparatus 130 by chain 120. Chain 120 is connected with only one of the sprockets of rear sprocket apparatus 130 at any one time and can be made to change the sprocket it is connected with (and thereby the gear ratio of drivetrain 70) by rear derailleur 140. Similarly, chain 120 is connected with only one of sprockets 110 and 112 at any one time and can be made to change which sprocket it is connected with by front derailleur 142. Rear derailleur 140 is operatively connected with shifter 150 (seen in FIG. 2), by way of transmission mechanism 145, and front derailleur 142 is operatively connected with shifter 152, by way of transmission mechanism 147. Transmission mechanisms 145 and 147 can be cable connections (for example, a Bowden cable), hydraulic connections or electrical connections. Shifter 150 includes levers 155 and 156 for downshifting and upshifting chain 120 respectively over the sprockets on rear sprocket apparatus 130, by way of a chain guide on rear derailleur 140, such that a suitable sprocket can be selected according to the rider's preference. Shifter 152 includes levers 157 and 158 for upshifting and downshifting chain 120 between sprockets 110 and 112, by way of a chain guide on front derailleur 142, such that a suitable sprocket can be selected according to the rider's preference. Although shifters 150 and 152 are illustrated connected to handlebar 60 this is not a requirement, and in other embodiments shifters 150 and 152 can be connected elsewhere on bicycle apparatus 10, such as on downtube 26, handlebar stem 62 or a triathlon aerobar (not shown), for example. Alternatively, the shifters can be grip-shift type shifters in other embodiments, or electrical actuators when electronic shifting is employed. Rear brake lever 180 and front brake lever 190 are operatively connected with rear and front brakes (not shown) respectively by way of respective transmission mechanisms 185 and 195, which can be cable connections, hydraulic connections or electrical connections, for example. In other embodiments, the brake levers can be drop-handlebar type of brake levers, such as on road bikes, and the shifters 150 and 152 can be integrated with respective ones of these brake levers. The rear and front brakes (not shown) can be any type of braking mechanism employed for bicycles. Bar ends 64 and 66 are connected with handlebar 60 at opposite ends. Alternatively, bars 64 and 66 can be connected more towards handlebar stem 62, such as on respective opposite sides of brake levers 180 and 190. The bar ends allow a rider to have an increased variety of grip positions but are not a requirement.

Figure 3:
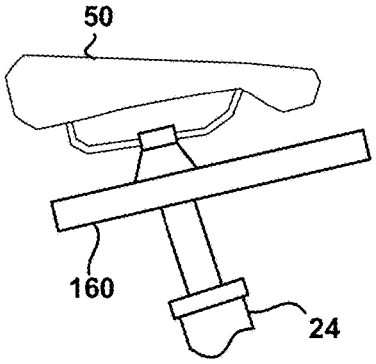
FIG. 3 is a side elevational view of a fore-aft adjustable seat post shown in a first position.
Figure 4:
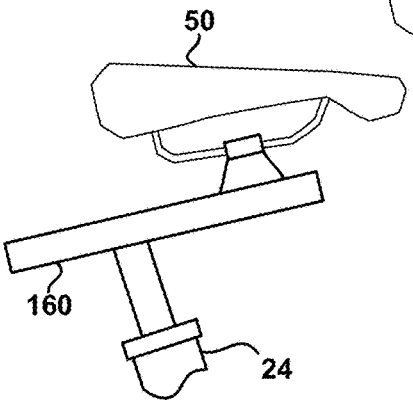
FIG. 4 is a side elevational view of the fore-aft adjustable seat post of FIG. 3 shown in a second position.
Figure 5:
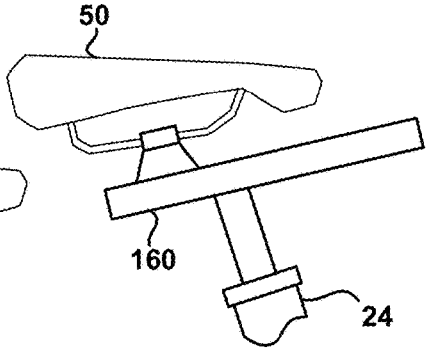
FIG. 5 is a side elevational view of a fore-aft adjustable seat post shown in a first position with setback.

Saddle 50 is connected with frame 20 by way of fore-aft adjustable seat post 160 that allows a rider to change the fore and aft position of saddle 50 with respect to frame 20. With reference to FIGS. 3 and 4, saddle 50 is illustrated in a first position in FIG. 3, and a second position in FIG. 4. The first position is towards the aft of bicycle apparatus 10 compared to the second position, which is more towards the fore of the bicycle apparatus. In the illustrated embodiment, saddle height SH (seen in FIG. 1) increases as saddle 50 moves from the first position to the second position of adjustable post 160 however this is not a requirement. Although only two positions are illustrated in the figures, there can be more than two positions in other embodiments. The first position is illustrated in FIG. 3 directly over a longitudinal axis of seat post tube 24. In other embodiments the first position can be set back from the longitudinal axis as illustrated in FIG. 5, or alternatively more towards a fore position compared to FIG. 3. Returning to FIG. 2, lever 170 is operatively connected with fore-aft adjustable seat post 160, by way of transmission mechanism 175, and allows a rider to adjust the position of saddle 50 while cycling on the fly. Transmission mechanism 175 can be a cable connection, a hydraulic connection or an electrical connection. In an exemplary embodiment, lever 170 is actuated to release a detent mechanism (not shown), or the like, in seat post 160 to allow the saddle to be moved, and when the lever is relaxed the detent mechanism can reengage to lock the saddle in position. In other embodiments, lever 170 can be other types of actuators for actuating adjustable post 160. For example, a grip-shift type of actuating mechanism, where the handlebar grip is rotated to actuate the adjustable seat post and relaxed to allow the adjustable seat post to reengage, can be employed. Alternatively, when drop-handlebar type of brake levers are employed, in other embodiments, the lever for actuating adjustable post 160 can be integrated with this type of brake lever. Fore-aft adjustable seat post 160 can employ compression springs, extension springs or gas springs, for example, to effect movement of saddle 50 when the detent mechanism, or the like, is released. Generally, any type of fore-aft adjustable seat post can be employed in bicycle apparatus 10 that allows the rider to comfortably peddle in a variety of positions. Examples of exemplary fore-aft adjustable seat posts include the one disclosed in U.S. Pat. No. 8,668,261, issued to Paul Schranz on Mar. 11, 2014, and the one disclosed in International Patent Publication No. WO9101245, published to Musto et al. on Feb. 7, 1991.

In other embodiments, bike apparatus 10 can include different combinations of components. For example, rear sprocket apparatus 130 can include only one sprocket, in which circumstance rear derailleur 140 and shifter 150 are not required, although some form of tensioner (which is normally provided by the rear derailleur) for chain 120 is still required. Similarly, crankset 70*a* can include just one sprocket, in which circumstance front derailleur 142 and shifter 152 are not required. In still another embodiment, rear sprocket apparatus 130 and crankset 70*a* can each include only one sprocket, such as in a single speed bike.

Figure 6:
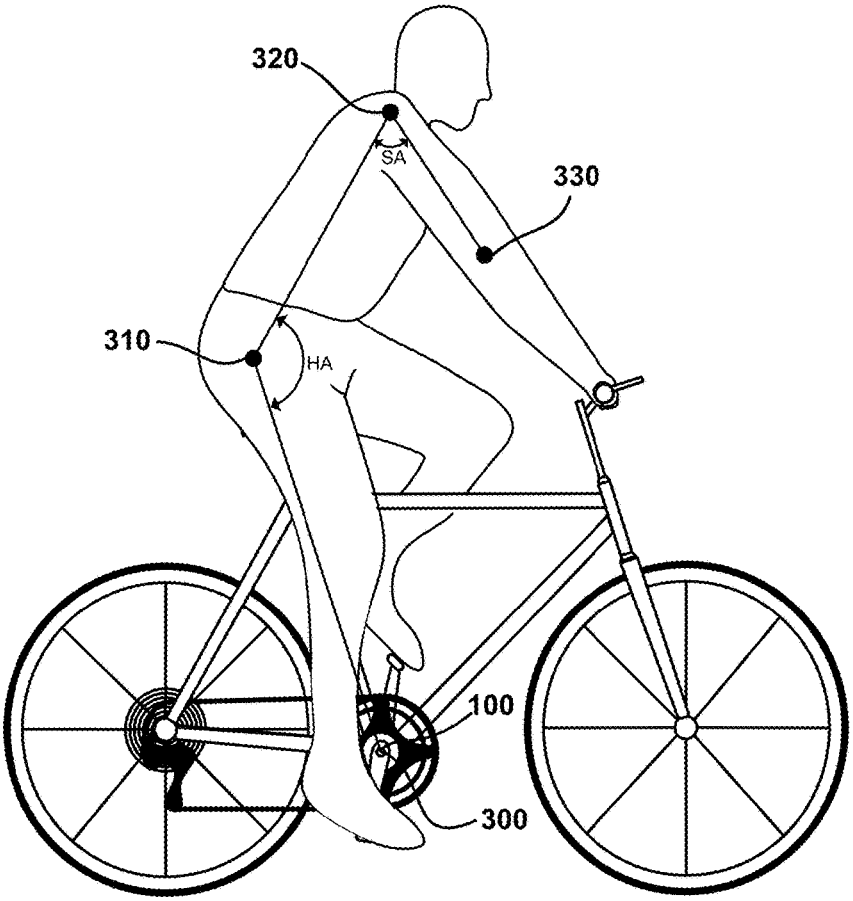
FIG. 6 is a schematic view of a rider on the bicycle apparatus of FIG. 1 with a fore-aft adjustable seat post in the first position of FIG. 3.
Figure 7:
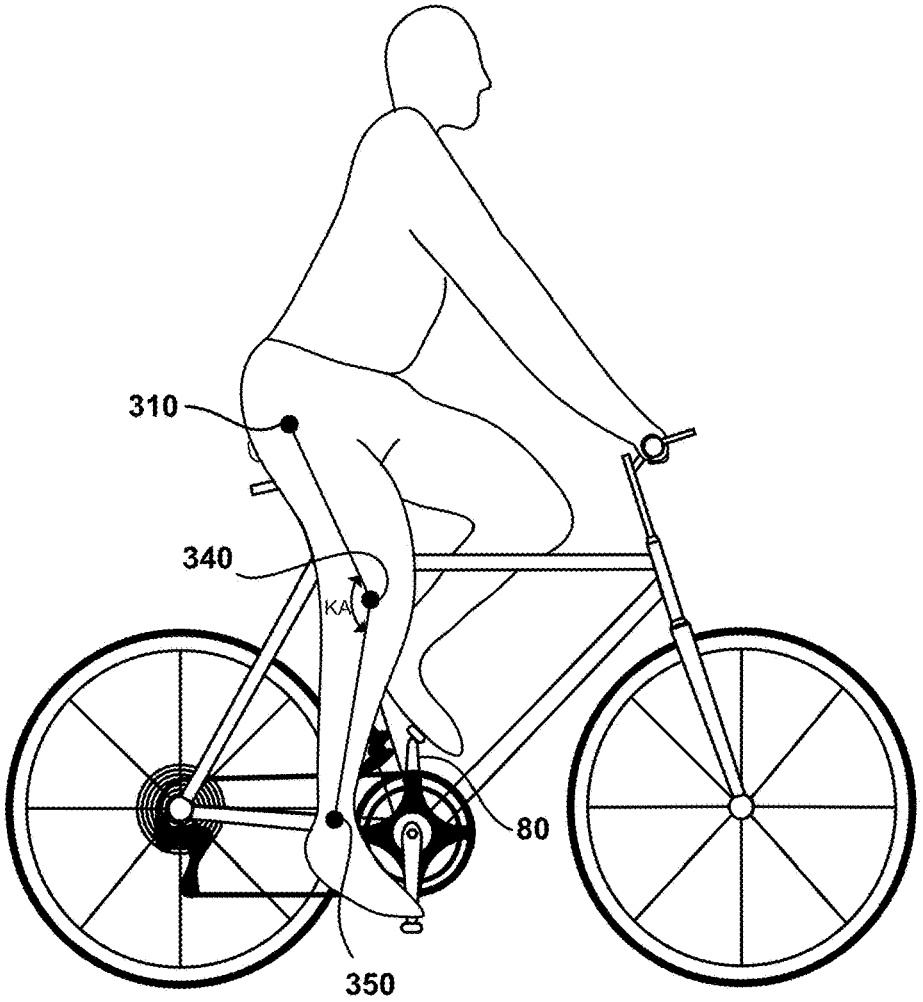
FIG. 7 is a schematic view of a rider on the bicycle apparatus of FIG. 1 with a fore-aft adjustable seat post in the second position of FIG. 4.

Referring now to FIGS. 6 and 7, bike apparatus 10 allows the rider to change hip angle HA by adjusting saddle 50 between the first position (seen in FIG. 6) and the second position (seen in FIG. 7) of fore-aft adjustable seat post 160. The posterior muscle chain of the rider, and in particular the hip extensors, are more advantageously activated in the second position compared to the first position. In an exemplary embodiment, as the saddle is adjusted between the first and second positions, hip angle HA changes by an amount between four (4) and fifteen (15) degrees, and more preferably between six (6) and ten (10) degrees, while maintaining handlebar height HH (seen in FIG. 1) within a range of four (4) inches above and four (4) inches below saddle height SH (seen in FIG. 1), and preferably within a range of three (3) inches above and three (3) inches below saddle height SH, and more preferably within a range of two (2) inches above and two (2) inches below saddle height SH, and most preferably within a range of one (1) inch above and one (1) inch below saddle height SH. In the second position hip angle HA of the rider is at least 132 degrees, and more preferably within a range of 135 degrees and 165 degrees. Hip angle HA illustrated in FIG. 6 is defined herein to be formed by center 300 of bottom bracket 100, the greater trochanter of the hip illustrated by target 310, and the acromion process illustrated by target 320. The acromion process also known as the AC joint, is the middle of the tip of the shoulder. In combination with the change in hip angle HA between the first and second positions, shoulder angle SA (seen in FIG. 6) can change in a range between five (5) and twenty (20) degrees, and more preferably in a range between six (6) and fifteen (15) degrees. In the second position, shoulder angle SA can be in a range of 40 degrees and 55 degrees, and preferably in a range of 43 degrees and 52 degrees. Shoulder angle SA (seen in FIG. 6) is defined herein to be formed by greater trochanter of the hip illustrated by target 310, the acromion process of the shoulder illustrated by target 320, and the lateral epicondyle of the humerus (the elbow) illustrated by target 330. Knee angle maximum KA (seen in FIG. 7) can be in a range of 135 and 150 degrees as saddle 50 is adjusted between the first and second positions. Knee angle maximum KA (seen in FIG. 7) is defined herein to be formed by the greater trochanter illustrated by target 310, the lateral condyle of the femur (knee) illustrated by target 340 and the lateral malleolus of the fibular (ankle) illustrated by target 350, and is measured when the leg is at the bottom of the power stroke of the pedal (when the knee angle is at a maximum), such as the right leg in FIG. 7. As an example, when saddle 50 is adjusted according to the constraints above, hip angle HA can be around 130 degrees in the first position and around 138 degrees in the second position, and shoulder angle SA can be around 64 degrees in the first position and 50 degrees in the second position, and the knee angle maximum KA can be around 145 degrees in both positions. In an exemplary embodiment, knee angle maximum KA is less in the second position compared to the first position, by reducing the distance between target 310 of the greater trochanter and center 300 of the bottom bracket in the second position compared to the first position, which tends to improve hip extensor activation while in the second position. The distance between target 310 and center 300 can be reduced in the second position compared to the first position between a range of one millimeter and fifty millimeters, and preferably between a range of five millimeters and thirty millimeters. Rider's come in all shapes in sizes and naturally the proportions between the various bones in the body will vary, and so too will the hip angle HA, shoulder angle SA and knee angle maximum KA for different riders between the first and second positions.

The posterior muscle chain is activated in both the first and second positions of saddle 50. However, the anterior muscle chain, and in particular the knee extensors, are more easily, or more naturally, activated in the first position (with the seat more towards the aft) and these muscles are more commonly engaged by riders. In the second position (with the seat more towards the fore of the bicycle) the hip extensors are more easily, or more naturally, activated compared to the first position and this allows the riders to engage these muscles more readily and thereby develop them more thoroughly. In the second position, the proportion of the force transferred to the pedals due to the hip extensors is greater compared to in the first position, where the knee extensors more readily activated early on in the power stroke of the pedal. As defined herein the power stroke of the pedal begins when crankarm 80 is substantially at the top of the pedal stroke, such as is illustrated in FIG. 7 with the crankarm associated with the rider's left leg. It is noteworthy that the gluteal muscles (and in particular the gluteus maximus) are typically underdeveloped in people that sit a large amount of time on a weekly basis, since the gluteal muscles are somewhat extended and relaxed while sitting. When those who frequently sit cycle the gluteal muscles to a certain degree are inhibited or under-utilized, especially in those cycling positions that emphasize the quadriceps. It is therefore important that when cycling in the second position the rider concentrate on activating the hip extensors, and particularly the gluteus maximus, instead of their quadriceps, in order ensure that these muscles are firing. This can be done by conscious activation, for example by focusing on the upper part of the femur during the power stroke of the pedal such that the hip extensors can be felt extending the hip. It can also be advantageous to splay the feet (turn the heel in and toes outwards), as this can improve the ability to activate the gluteal muscles, and in particular the gluteus maximus. Additionally, driving or leading the power stroke of the pedal with the heel can also help to activate the hip extensors, and the ability to lead with the heel can be improved by lowering the saddle height thereby decreasing knee angle maximum KA. As the rider performs conscious activation overtime the body builds up a memory of this use pattern and eventually the firing of the hip extensors will happen more naturally and conscious activation will no longer be required. Although conscious activation of the hip extensors can also be done in the first position, the hip angle is such that the knee extensors tend to be more easily and more naturally activated earlier on in the power stroke of the pedal compared to the hip extensors.

A method of cycle is now discussed when fore-aft adjustable post has one or more additional positions between the first and second positions. When saddle 50 is in the first position the rider focuses on expanding the knee angle starting near the top of the power stroke of the pedal, thereby emphasizing the quadriceps. As saddle 50 moves to successive positions in the fore direction, the rider focuses more on activating the hamstring muscles to adjust the proportion of quadriceps, hamstrings and gluteal muscles contributing to the power transferred to the crankarms. The more fore the saddle position the closer the focus of activation is to the gluteal fold. In the second position the rider focuses on activating the muscles around the gluteal fold. By selecting more fore positions and focusing on activating the muscles in this manner the gluteal muscles will be engaged more frequently and over time they will become significantly more developed as compared to cycling only in the first position. This will reduce the overuse of the quadriceps and help to lengthen the hip flexors (such as the psoas muscle), and reduce any back pain previously experienced.

Figure 8:
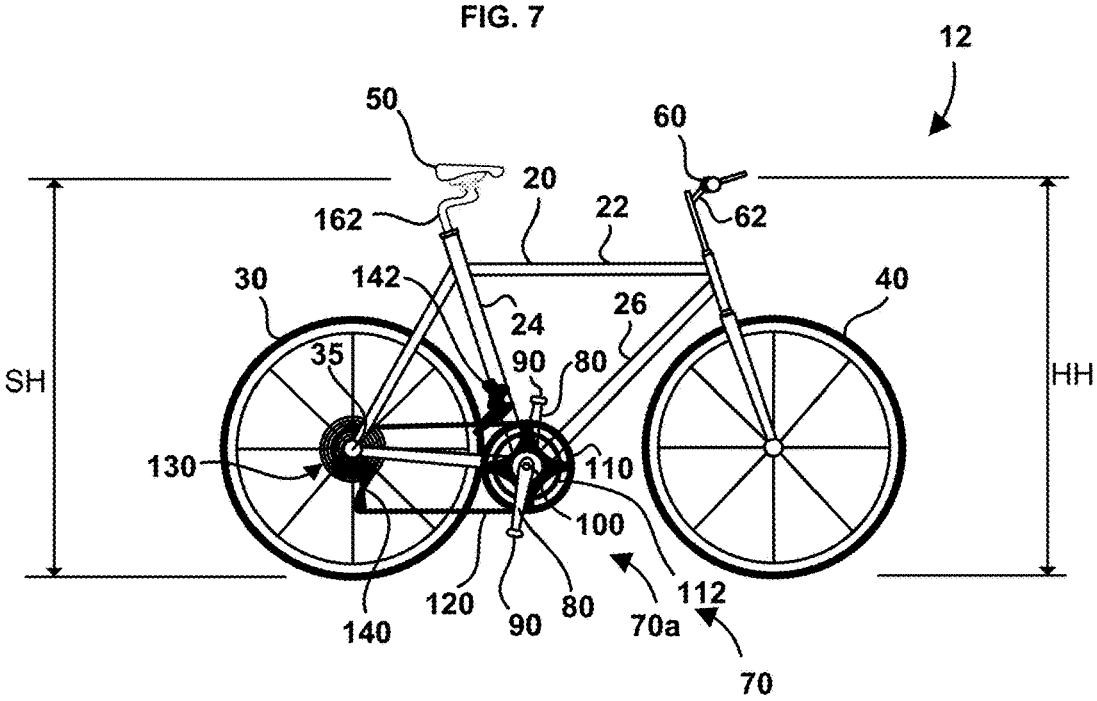
FIG. 8 is a side elevational view of a bicycle apparatus according to a second embodiment.
Figure 9:
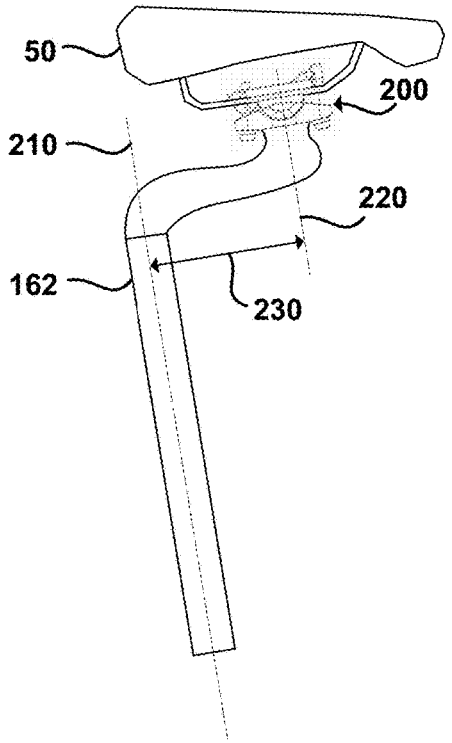
FIG. 9 is a side elevational view of a seat post of the bicycle apparatus of FIG. 8 illustrated assembled with a saddle.

Referring now to FIG. 8 there is shown bicycle apparatus 12 according to a second embodiment where like parts to the first and all other embodiments have like reference numerals and may not be described in detail if at all. The second position for saddle 50 in bike apparatus 10 illustrated in FIG. 4 is particularly advantageous for activating the hip extensors during the power stroke of the pedal. Referring back to FIG. 8, bicycle apparatus 12 maintains saddle 50 in a saddle position like the second position of FIG. 4 by employing seat post 162 that arranges the saddle into this position. Seat post 162 is not an on-the-fly adjustable seat post where the position of the saddle can be adjusted while riding. The saddle position in seat post 162 can be adjusted similar to conventional seat posts by using a tool to loosen clamping mechanism 200 (best seen in FIG. 9) that holds the saddle in place, making fore or aft adjustments to the saddle, and then retightening the clamping mechanism to secure the saddle in position. Similar to the first embodiment, bicycle apparatus 12 also maintains handlebar height HH within a range of four (4) inches above and four (4) inches below saddle height SH, and preferably within a range of three (3) inches above and three (3) inches below saddle height SH, and more preferably within a range of two (2) inches above and two (2) inches below saddle height SH, and most preferably within a range of one (1) inch above and one (1) inch below saddle height SH. Hip angle HA of the rider in the saddle position is at least 132 degrees, and more preferably within a range of 135 degrees and 142 degrees. With reference to FIG. 9, seat post 162 includes post axis 210 and saddle clamp axis 220. When seat post 162 is installed in seat tube 24 the longitudinal axis of the seat tube is in-line (that is, collinear) with post axis 210. Offset 230 between post axis 210 and saddle clamp axis 220 is between a range of one half (½) inch and five (5) inches, and preferably within a range of one (1) inch and four (4) inches, and more preferably within a range of two (2) inches and four (4) inches. The selected offset 230 is dependent upon the angle of seat tube 24, the shallower the angle the greater the offset. It is known for conventional seat posts to have what is known as set-back, where the clamping mechanism is aft of the seat tube axis. Offset 230 can also be called set-forward where clamping mechanism 200 is fore of the seat tube axis. Shoulder angle SA of the rider can be in a range of 40 degrees and 55 degrees, and preferably in a range of 43 degrees and 52 degrees.

Figure 10:
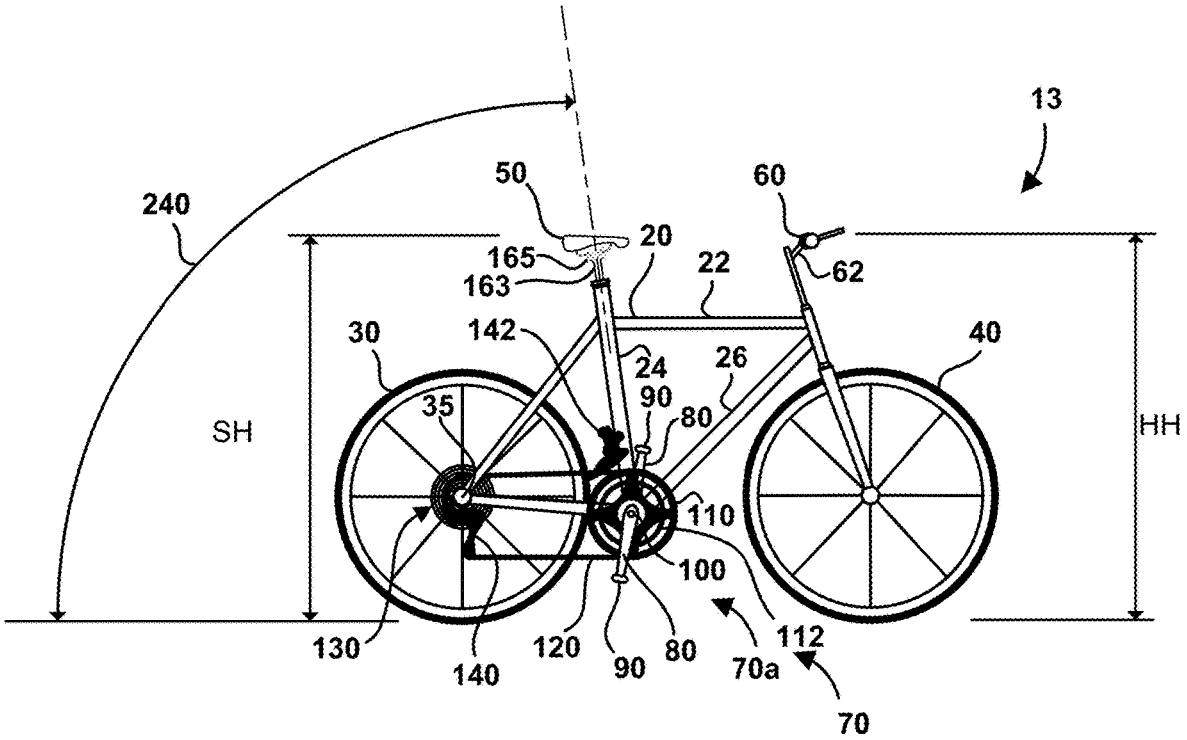
FIG. 10 is a side elevational view of a bicycle apparatus according to a third embodiment.
Figure 11:
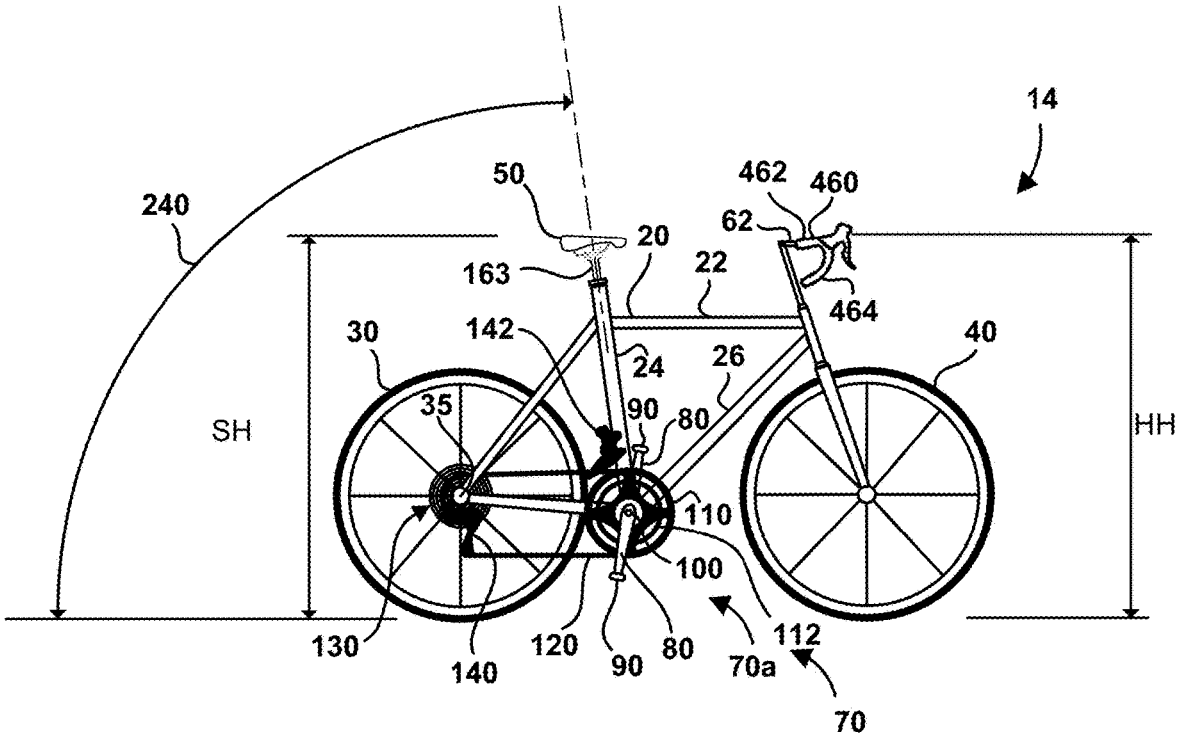
FIG. 11 is a side elevational view of a bicycle apparatus according to a fourth embodiment.
Figure 12:
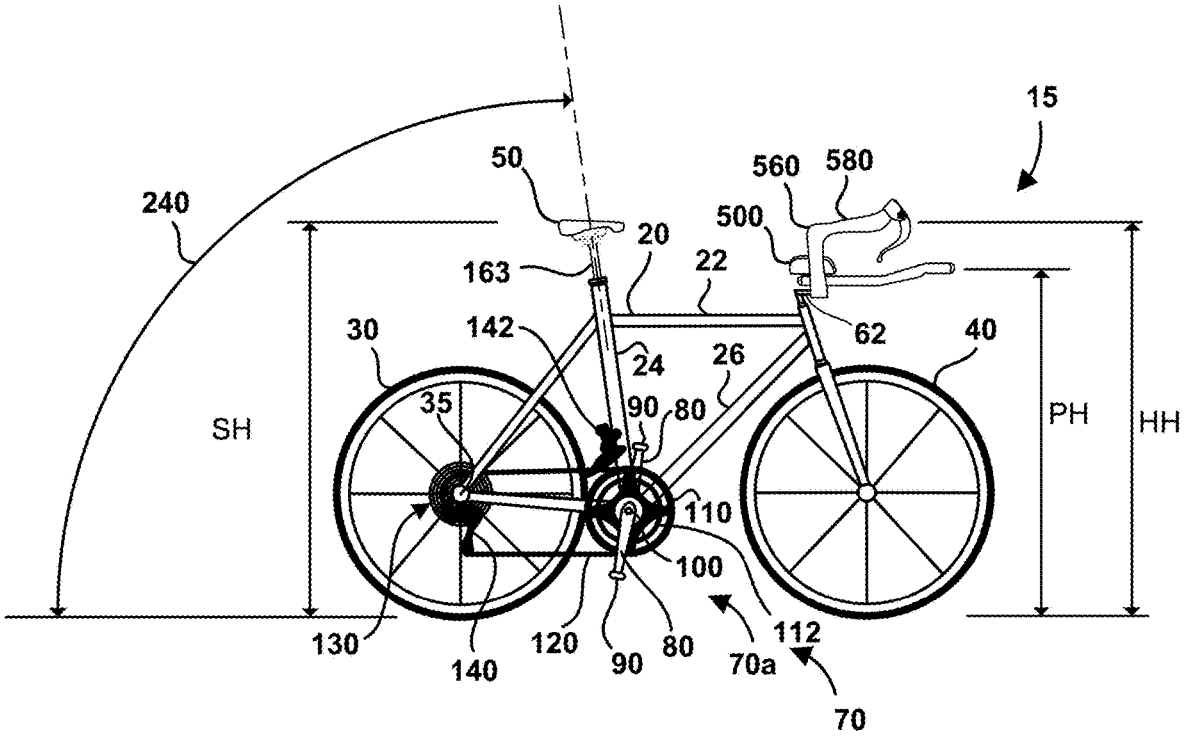
FIG. 12 is a side elevational view of a bicycle apparatus according to a fifth embodiment
Figure 13:
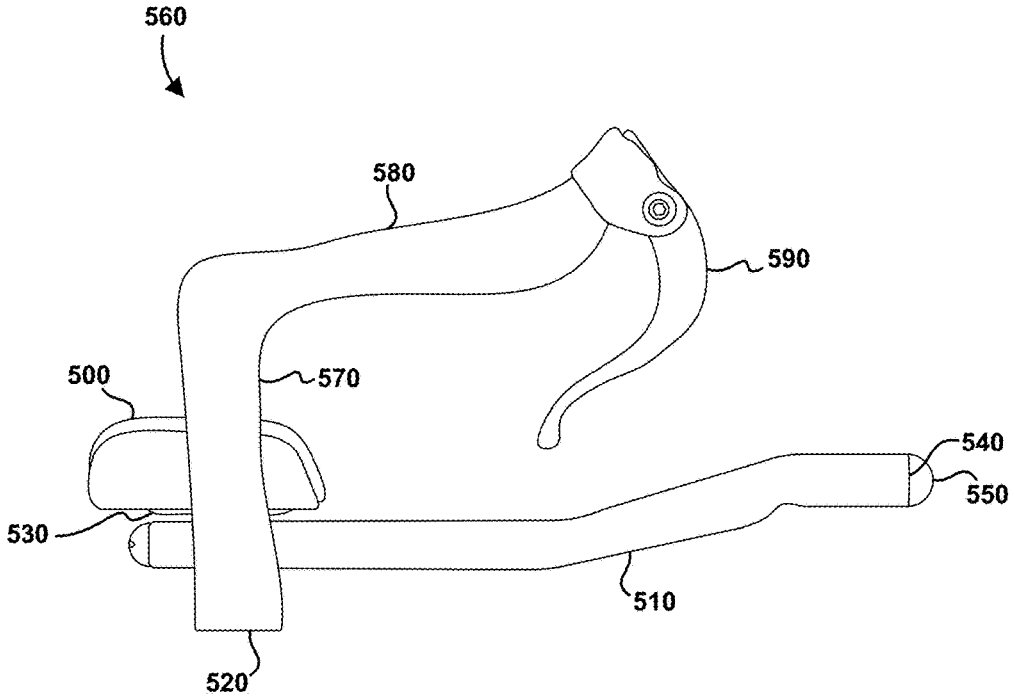
FIG. 13 is a side elevational view of an aero-type handlebar apparatus.
Figure 14:
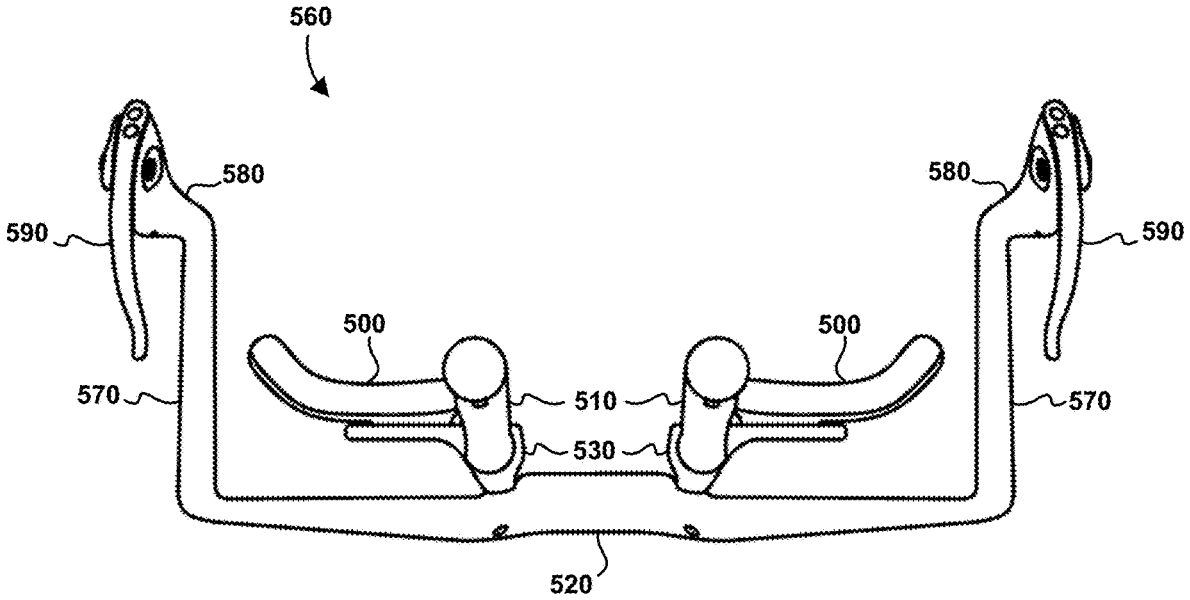
FIG. 14 is a front elevational view the aero-type handlebar apparatus of FIG. 13.

Referring now to FIG. 10 there is shown bicycle apparatus 13 according to a third embodiment that employs conventional seat post 163. Bicycle apparatus 13 maintains saddle 50 in a saddle position like the second position of FIG. 4 by employing seat tube angle 240 of at least 76 degrees, and preferably at least 78 degrees, and more preferably at least 80 degrees. Similar to the first and second embodiments, bicycle apparatus 13 also maintains handlebar height HH within a range of four (4) inches above and four (4) inches below saddle height SH, and preferably within a range of three (3) inches above and three (3) inches below saddle height SH, and more preferably within a range of two (2) inches above and two (2) inches below saddle height SH, and most preferably within a range of one (1) inch above and one (1) inch below saddle height SH. Hip angle HA of the rider in the saddle position is at least 132 degrees, and more preferably within a range of 135 degrees and 142 degrees. Shoulder angle SA of the rider can be in a range of 40 degrees and 55 degrees, and preferably in a range of 43 degrees and 52 degrees. Referring now to FIG. 11 there is shown bicycle apparatus 14 according to a fourth embodiment. Bicycle apparatus 14 is similar to bicycle apparatus 13 except apparatus 14 employs drop handlebars 460. Upper grip portion 462 and seat tube angle 240 together allow the rider to establish hip angle HA disclosed herein when the rider is in a more upright position by gripping the upper grip portion with their hands. A more aerodynamic position is obtained, when this is desired, when the rider grips lower grip portion 464 thereby reducing the frontal cross-sectional area. Referring now to FIG. 12 there is shown bicycle apparatus 15 according to a fifth embodiment. Bicycle apparatus 15 is similar to bicycle apparatuses 13 and 14 except apparatus 15 employs aero-type handlebar apparatus 560. With reference to FIGS. 13 and 14, handlebar apparatus 560 includes a pair of pads 500 associated with respective aero bars 510 that are connected with handlebar portion 520 by respective adaptors 530. Gear shifters (not illustrated) can be connected with ends 540 of aero bars 510, although this is not a requirement, and in some embodiments the gear shifters can be mounted with apparatus 15 in other conventional locations. In the illustrated embodiment end caps 550 are connected with ends 540. Handlebar portion 520 includes a pair of risers 570 that raise respective upper grip portions 580 above pads 500. Brake levers 590 are connected to respective upper grip portions 580. Returning to FIG. 12, pad height PH is defined as the height of pads 500 above the ground with respect to where the rider places their forearms or elbows on the pads. In the illustrated embodiment handlebar height HH is defined as the height of upper grip portions 580 above the ground with respect to where the rider's hand makes contact with the top part of the upper grip portion. The top part of upper grip portion 580 can be inclined, as illustrated in FIG. 12, and in this circumstance handlebar height HH is defined as the mean height with respect to where the rider's hand contacts the upper grip portion. In other embodiments the top part of the upper grip portion can be horizontal with respect to the ground surface. Upper grip portion 580 and seat tube angle 240 together allow the rider to establish hip angle HA disclosed herein when the rider is in a more upright position by gripping the upper grip portion with their hands. A more aerodynamic position is obtained, when this is desired, when the rider rests their forearms or elbows on pads 500 and grips aero bars 510 with their hands thereby reducing the frontal cross-sectional area.

There is less need for the rider to be in the more aerodynamic position when bicycle apparatuses 14 and 15 are travelling in a variety of circumstances, such as when travelling uphill and when accelerating from a standstill and slow speeds, and the rider can benefit from being in the more upright position by gripping upper grip portions 462 and 580 such that the hip extensor muscles can be better utilized. By alternately switching between the more aerodynamic portion and the more upright portion the rider may reduce the occurrence of leg cramps by more efficiently using their muscles, especially by riding in the more upright position since there is an improved balance between the use of the hip extensors and the knee extensors.

The previously described embodiments improve the development of the hip extensor muscles while cycling. The rider alternately pushes the pedals with respective legs while cycling. The applicant has determined that if the rider could simultaneously pull a pedal with one leg, while pushing the other pedal with the other leg, there is improved activation of the core muscles that leads to improved muscular balance over all.

Figure 15:
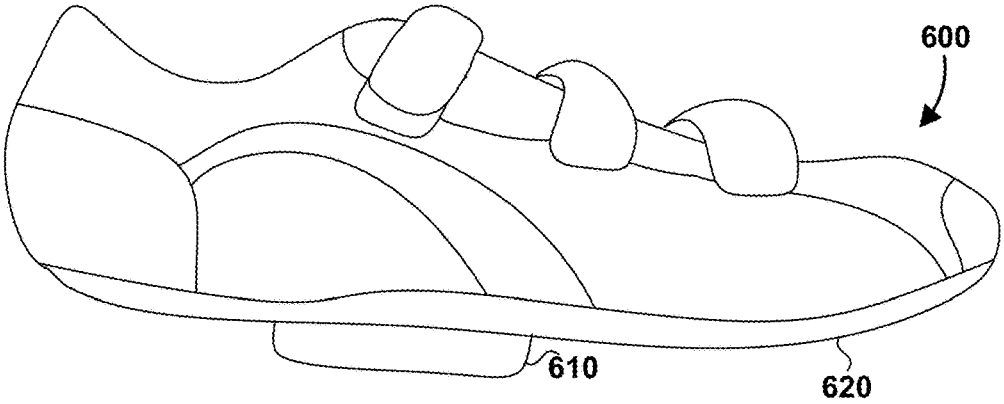
FIG. 15 is a side elevational view of a cycling shoe with a cleat under a midfoot region according to a first embodiment.
Figure 20:
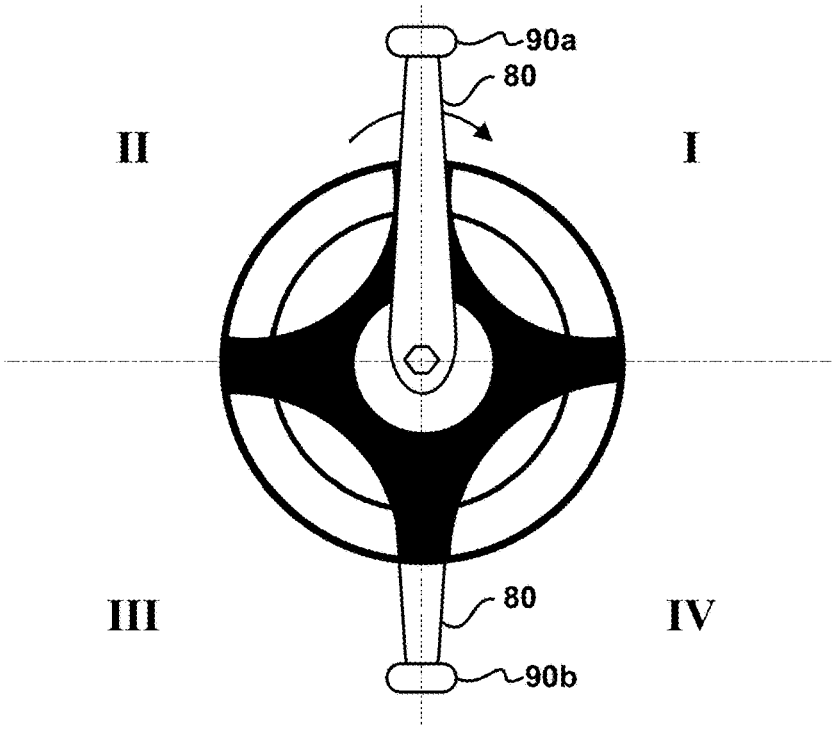
FIG. 20 is a side elevational view of a crankset with one pedal located at the top of an upstroke of a crank.

Referring now to FIG. 15 there is shown cycling shoe 600 according to one embodiment that allows a cyclist to push and pull the pedals alternately while cycling. Shoe 600 includes cleat 610 that is connected to outsole 620 and is meant to engage a clipless pedal for improved transfer of power from the cyclist to the cranks. For example, cleat 610 can connect with pedals 90 as seen in FIGS. 1, 8, 10, 11 and 12 when these pedals are clipless pedals. In clipless pedals, the cleat clips-in or steps-in to the pedal in a positively engaging manner that is typically disengaged by a twisting motion of the foot. The reference to clipless is in contrast to platform pedals that employ a toe-clip with shoe strap for caging the forefoot. Cleat 610 and pedal 90 can be any known type of clipless pedal system, such as the Look system, Speedplay, SPD, Eggbeater. When shoe 600 is worn by a cyclist, cleat 610 is located substantially under the midfoot region of the foot of the cyclist. This placement of the cleat with respect to the foot allows the cyclist to pull up on the pedal from the bottom of the crank stroke (in FIG. 18 pedal 90*a* is at the bottom of the crank stroke) without a tendency to put the foot into plantarflexion, as will be explained in more detail below. Additionally, when the cyclist begins to push on the pedal at or near the top of the crank stroke (in FIG. 20 pedal 90*a* is at the top of the crank stroke) the midsole placement of cleat 610 reduces the likelihood of the tibia and fibula rolling over the ankle and forcing the foot into plantarflexion on the downstroke. Cleat positions on a cycling shoe that are less optimal compared to shoe 600 are discussed below to help describe the advantages of the cleat position on shoe 600.

Figure 23:
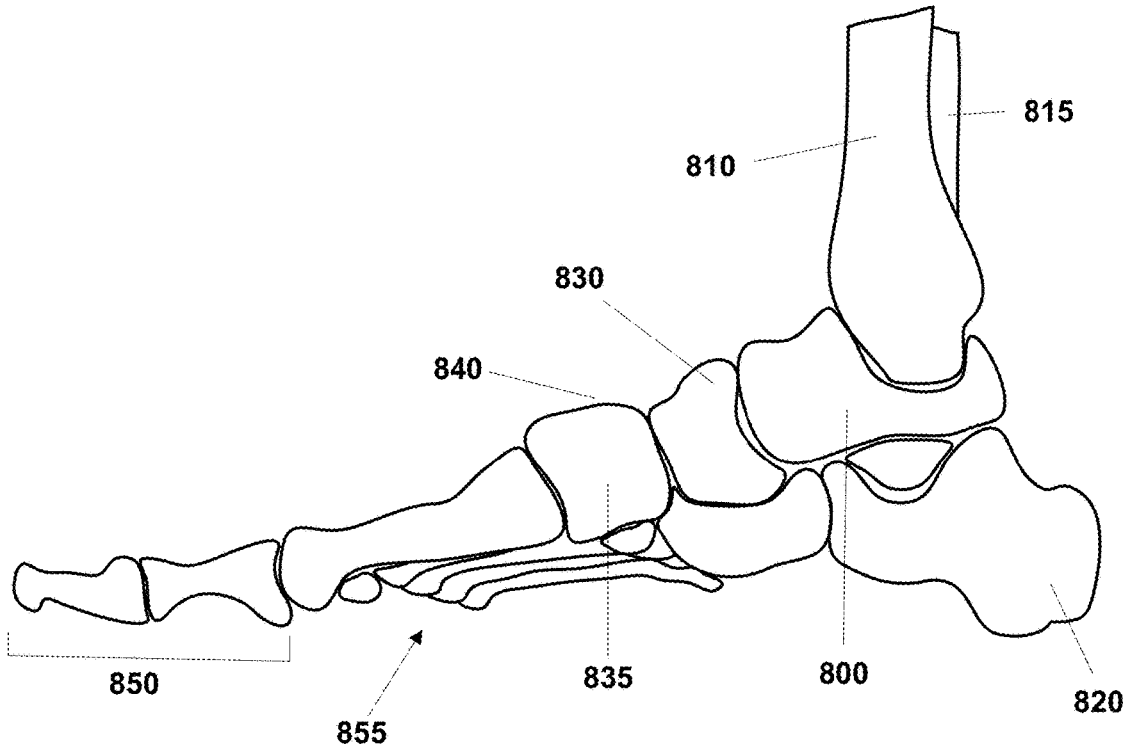
FIG. 23 is a medial view of the bones of the feet and the lower leg.
Figure 24:
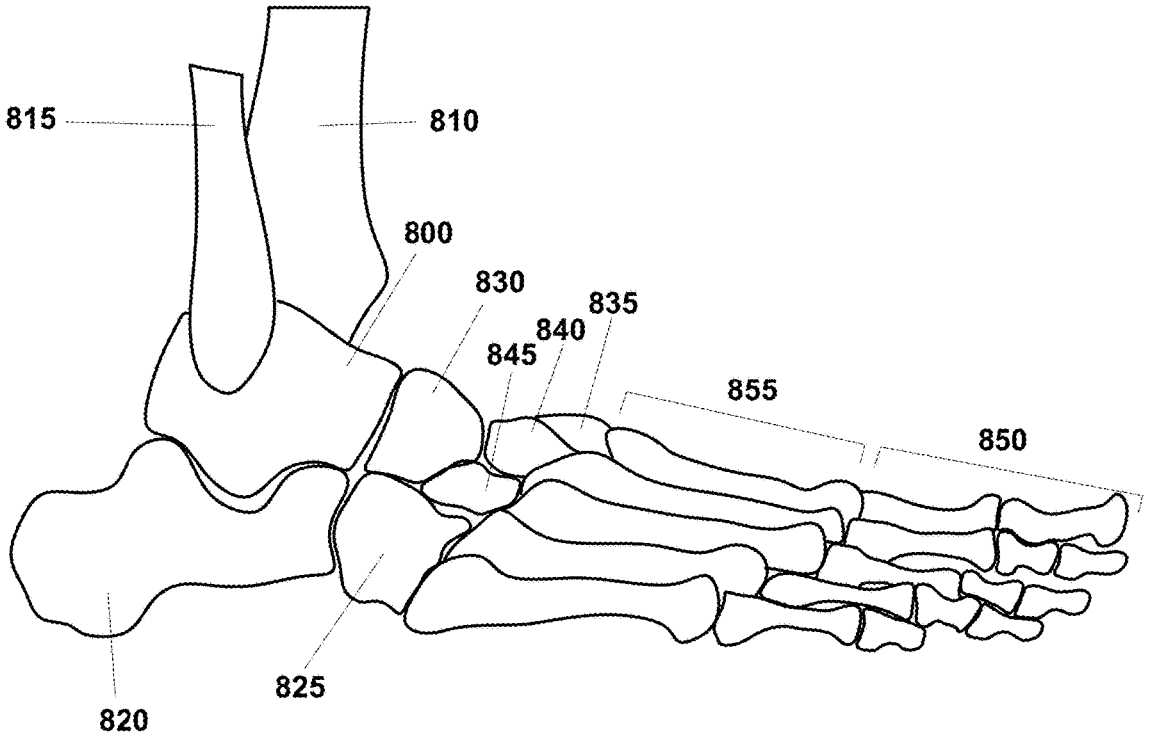
FIG. 24 is a lateral view of the bones of the feet and the lower leg.

With reference to FIGS. 23 and 24, as used herein, the hindfoot is composed of talus 800 (the ankle bone) and calcaneus 805 (the heel bone). The two long bones of the lower leg, tibia 810 and fibula 815, are connected to the top of talus 800 to form the ankle. Calcaneus 820 is connected to the talus at the subtalar joint, and is the largest bone of the foot, and is cushioned underneath by a layer of fat. The midfoot includes five irregular bones, namely cuboid 825, navicular 830, and three cuneiform bones 835, 840 and 845, and these bones form the arches of the foot which serves as a shock absorber. The midfoot is connected to the hind- and fore-foot by muscles and the plantar fascia. The forefoot is composed of five toes (also known as phalanges 850) and the corresponding five proximal long bones forming the metatarsus (also known as metatarsals 855).

Figure 16:
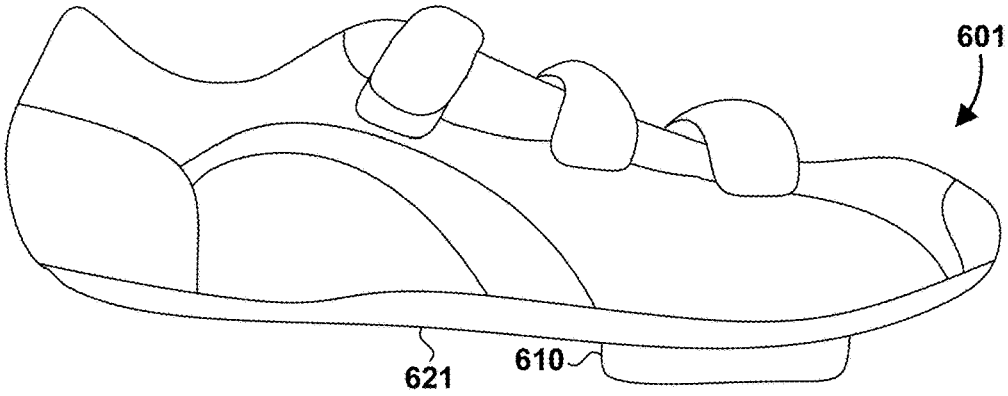
FIG. 16 is a side elevational view of a cycling shoe with a cleat under a forefoot region according to the prior art.

Referring to FIG. 16, cycling shoe 601 is illustrated with cleat 610 connected to outsole 621 under the ball of the foot of the cyclist in the forefoot region, which is a conventional placement for the cleat. When a cyclist wearing shoe 601 completes the downward stroke of pedal 90*a* and begins to pull up on the pedal, if the cyclist does not activate the dorsiflexor muscles the foot will first transition into plantarflexion before any significant force can transferred to pedal 90*a* by hip and knee flexion. For example, the range of motion for plantarflexion available to the cyclist will dictate how long the delay is before any substantial upward pulling force can be transferred to the pedal. During the transition to plantarflexion, the hip and knee flexor muscles are not substantially loaded by resistance of the cranks. A problem with waiting for plantarflexion is that by the time the foot is in plantarflexion the pedal has already travelled significantly into the upward stroke and the more effective part of hip and knee flexion has been bypassed without contributing to the upward motion of the pedal. To reduce the delay in transitioning to plantarflexion the cyclist can raise the seat. However, the seat must be raised relatively significantly for there to be a noticeable reduction in delay, and this typically results in an extraordinary high seat position that puts strain on the perineum. Alternatively, the cyclist can activate their dorsiflexor muscles to lock the foot in position (e.g. in dorsiflexion) as they pull up on pedal 90*a* at the bottom of the crank stroke thereby immediately transferring an upward force to the pedal. Repeatedly using the dorsiflexors of the foot will quickly tire out these muscles after which they are significantly less effective, and effective pulling of the pedals cannot be maintained.

Figure 17:
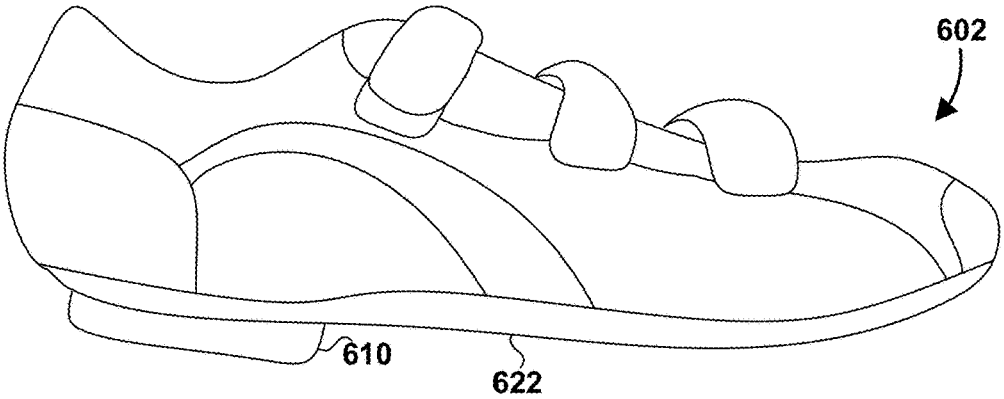
FIG. 17 is a side elevational view of a cycling shoe with a cleat under a hindfoot region.

Referring now to FIG. 17, cycling shoe 602 is illustrated with cleat 610 connected to outsole 622 under the heel of the foot of the cyclist in the hindfoot region. The problem with this placement occurs during the application of force to the pedal during the downward stroke. During the downward stroke the tibia and fibula tend to roll over the ankle forcing the foot into plantarflexion and dramatically reducing the transfer of power to the pedal and cranks. The dorsiflexor muscles can be activated to resist this tendency towards plantarflexion, but these muscles will quickly tire and become less effective.

Returning again to FIG. 15, cleat 610 is located substantially under the midfoot region. In this position, the cyclist can transfer power during the upstroke of the crank from hip and knee flexion to the pedal relatively immediately since there is a reduced moment of force (torque) on the foot relative to the ankle due to the cleat. This dramatically reduces strain on the dorsiflexor muscles of the foot and any delay associated with a locked out or maxed out foot position. Additionally, during the downward stroke the midfoot placement of the cleat significantly reduces (and preferably eliminates) the likelihood of the tibia and fibula from rolling over the ankle forcing the foot in plantarflexion. The cleat placement on shoe 600 allows the cyclist to both push the pedal with one foot while simultaneously pulling the other pedal with the other foot, repetitively with reduced fatigue, for a sustained period of time, and without raising the seat extraordinarily high.

A cyclist can improve their core musculature and core muscle activation when using shoe 600 with bicycle apparatuses 10, 12, 13, 14 and 15, and in turn this can eventually improve muscular balance overall. It is recommended that a larger hip angle HA be employed to improve the balance between pushing and pulling the pedals, and to reduce strain on the perineum, reducing the likelihood of groin numbness. For example, the hip angle HA can be at least 135 degrees, and preferably at least 140 degrees. In an exemplary embodiment the hip angle is between 140 degrees and 165 degrees. In another exemplary embodiment the cyclist has a neutral spine position. In the neutral spine position the multifidus and spinal erector muscles can be effectively activated to stabilize and lengthen the spine. In another exemplary embodiment the hip angle is between 143 degrees and 150 degrees, the shoulder angle SA is between 42 degrees and 48 degrees, the seat tube angle 240 (best seen in FIG. 10) is around 79 degrees and the handlebar height HH is between 2 and 3 inches higher than saddle height SH. When simultaneously pulling and pushing the pedals the deep muscles of the core (for example, the transverse abdominis, the multifidus and the pelvic floor muscles) and the spinal erector muscles are more effectively activated to stabilize the spine against the forces acting on it, either directly or indirectly from the muscles associated with pedaling, for example, the hip and knee extensors and the hip and knee flexors. The improved core muscle and spinal erector activation can lead to improved muscular balance overall in the body. When the hip angle maintains the spine substantially in the neutral position, the multifidus and spinal erector muscles can be activated to lengthen the spine, evening out back muscle length from side to side. This is aided by stabilizing the sit bones (ischial tuberosity) at an even height with the seat of the bicycle. The improved core and back muscle function can lead to improved activation of the gluteus medius that helps to stabilize the head of the femur in the acetabulum, which can lead to improved hip extension power.

The cyclist selects a gear that allows them to load the hip flexor muscles when pulling such that the core stabilizers and spinal erectors are effectively loaded. There generally is more benefit when grinding (a larger gear and slower cadence) as opposed to spinning (smaller gear and higher cadence). Additionally, the hip flexors of one leg work in harmony with the hip extensors of the other leg leading to increased muscle balance across the pelvis. With the midfoot placement of the cleat, when the cyclist pushes the pedal with the foot during the downstroke of the crank the heel has an improved reaction force, compared to the forefoot cleat placement in FIG. 16 where the heel is more spongy due to dorsiflexion of the foot. Cleat 600 is under the midfoot, which forms the arch and is the shock absorber of the foot, to further improve the reaction force response time of pressing the foot against the pedal orthotics or insoles can be used to support the arch. The improved reaction force of the heel against the pushing of the foot improves the activation of the gluteus maximus. Combined with the large hip angle disclosed herein, this setup and the push/pull cycling technique is especially beneficial to those who suffer from back and/or buttock pain, and those with leg length differences where muscle asymmetry has developed between the left and right sides across the median plane of the body (also called the mid-sagittal plane). It is recommended to compensate for leg length difference, such as using shims between the cleat and the shoe of the short leg. Alternatively, different crank arm lengths can also be employed to compensate for leg length difference, although this will result in different crank arm torque from side to side. The pain associated with such ailments may be reduced and hopefully prevented from reoccurring. Conventional bike setups over-emphasize the knee extensor muscles, compared to the hip extensors, and do not substantially use the hip flexor muscles at all. The large hip angle and relatively large effective seat tube angle associated with the embodiments herein allows the cyclist to effectively activate the hip and knee extensors on the downstroke while the hip and knee flexors are activated on the opposite side of the bicycle during the upstroke of the crank, leading to improved muscular balance and symmetry compared to conventional bike setups with smaller hip angles that over-emphasize the quadriceps muscles.

In operation the cyclist can repeatedly push and pull the pedals with opposite legs. Alternatively, the cyclist can push and pull opposite pedals during the first half of the crank stroke and push the pedal (that was previously pulled) during the second half of the crank stroke; and periodically switch which side does the pulling. The cyclist may want to mix in periods where the pedals are only pushed or only pulled. The push/pull technique of cycling is very effective when bicycle apparatuses 10, 12, 13, 14 and 15 are used on a trainer (also called a wind trainer) that allows the bicycle to be used in a stationary position. The degree of resistance provided by the trainer can be selected to effectively train the deep muscles of the core and the spinal erectors, as well as the hip and knee extensors and the hip flexors. Preprogrammed routines of varying resistance can be very effective in accomplishing this as well. By practicing this push-pull technique a cyclist with asymmetrical muscle development may better understand how their muscles are asymmetrical, which can aid them when practicing other movements such as walking. In other embodiments, a conventional stationary bicycle can be adapted to operate with shoe 600 and to allow the cyclist to employ the large hip angles herein described. Alternatively, it is possible for the stationary bicycle to employ a strap(s) that fastens the forefoot and the hind food to the pedal of the stationary bicycle. It may be possible to only use a forefoot strap, but it may need to be fastened excessively tight to prevent the foot from slipping out during the pulling phase of the crank stroke. In still further embodiments the principles discussed herein can be applied to a stair master that can be adapted to allow a user to pull up on one stair with their hip and knee flexor muscles while pushing down on the other stair with their hip and knee extensor muscles. As used herein a stationary cycle is also known as an exercise bicycle, exercise bike, spinning bike, spin bike or exercycle. A stationary bicycle can comprise a mobile bicycle arranged on a wind trainer. A mobile bicycle herein refers to a bicycle that is used for travelling or moving. A wind trainer is also known as a bicycle trainer, and can be of various types categorized by how they provide resistance, such as wind, magnetic, fluid, centrifugal, utilitarian, virtual reality and direct drive.

Figure 18:
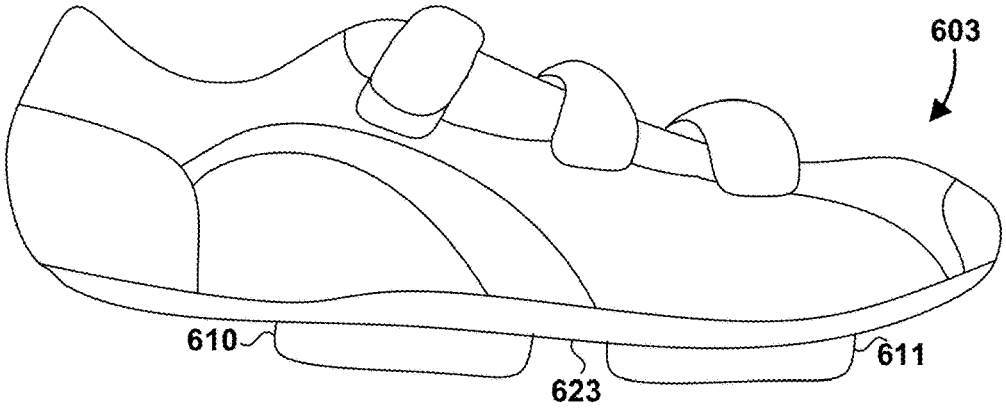
FIG. 18 is a side elevational view of a cycling shoe with a first cleat under a midfoot region and a second cleat under forefoot region according to a second embodiment.
Figure 19:
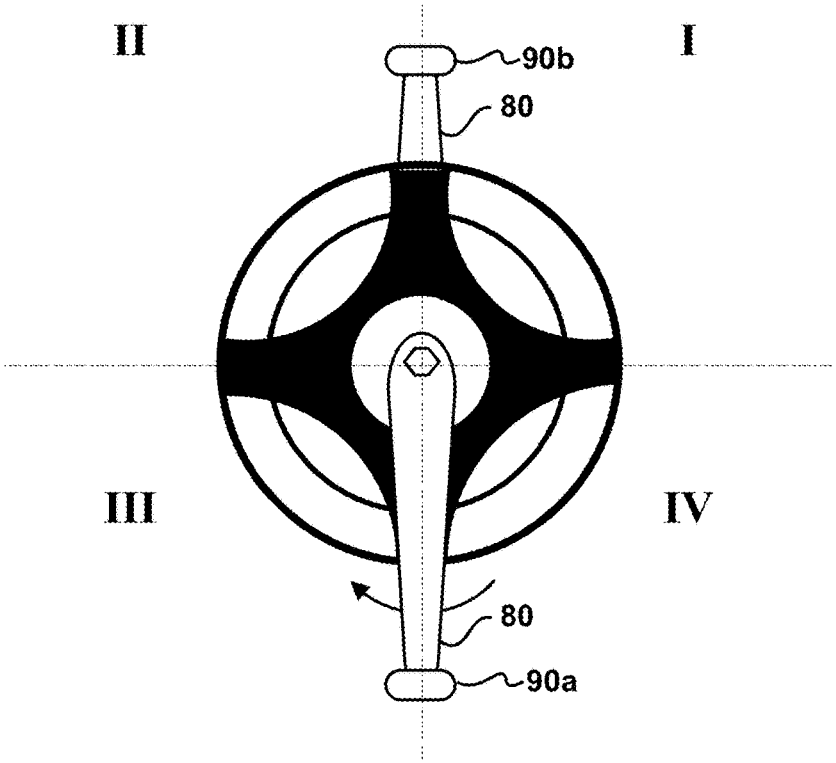
FIG. 19 is a side elevational view of a crankset with one pedal located at the bottom of a downstroke of a crank.

Referring now to FIG. 18, there is shown cycling show 603 according to another exemplary embodiment. Shoe 603 includes two cleats, where cleat 610 located substantially under the midfoot, such as in FIG. 15, and cleat 611 is located in a conventional location under the forefoot, such as in FIG. 16. Shoe 603 can be worn by a cyclist riding bicycle 10, where cleat 611 can be mutually engaged with pedal 90 when adjustable post 160 is in the first position, which resembles a conventional bike fit, and cleat 610 can be mutually engaged with pedal 90 when the adjustable post is in the second position, which allows the technique of pushing and pulling described herein to be practiced. However, either cleat 610 and 611 can be engaged with pedal 90 for the first and second positions of adjustable post 90. Outsole 623 includes nuts arranged in any conventional bolt pattern under the mid-foot and under the forefoot for cleats 610 and 611 respectively.

Figure 21:
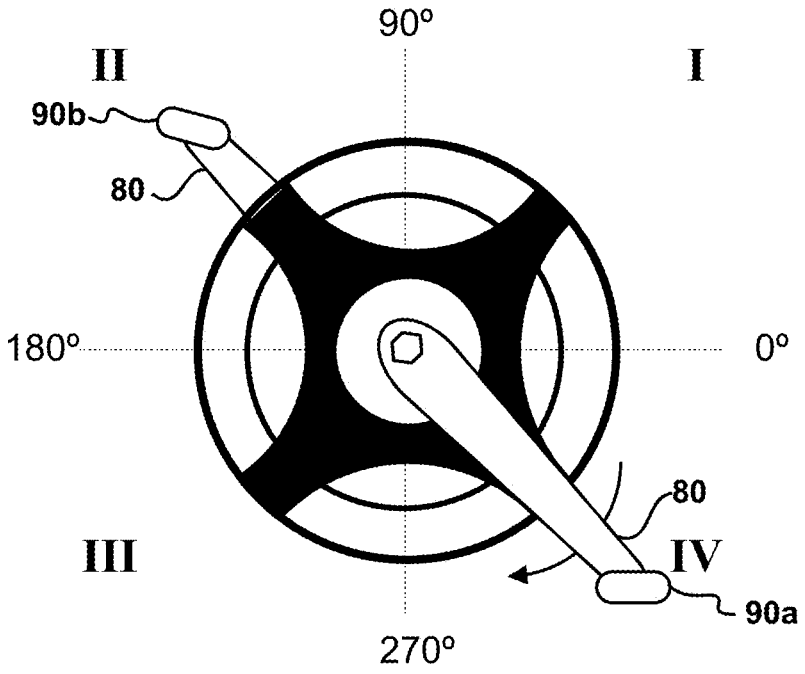
FIG. 21 is a side elevational view of a crankset with one pedal located in a position during the downstroke of the crank.
Figure 22:
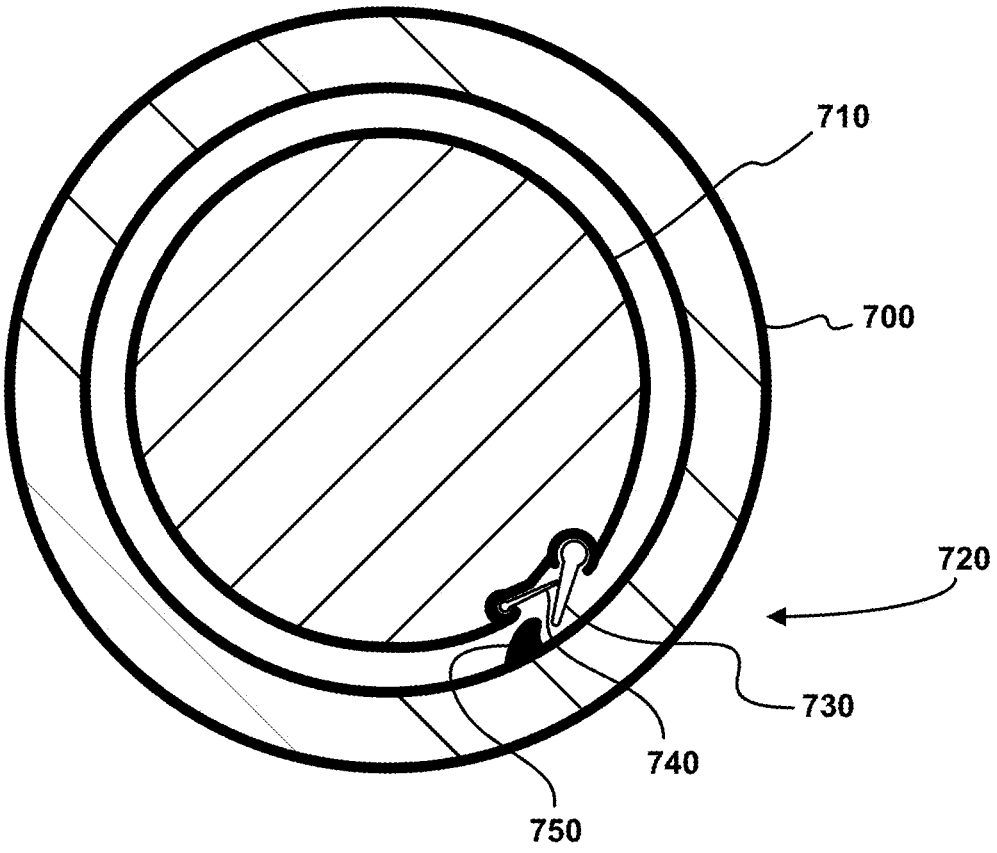
FIG. 22 is a cross-sectional view of a pedal shaft and a pedal spindle with a ratchet mechanism.

The midfoot placement of the cleat, and the large hip angle of the cyclist, emulates a walking or stair climbing motion. To improve the transfer of power to the cranks it would be beneficial to be able to toe-off the pedal in such a manner that force is transferred to the pedal, as it is during walking and stair climbing. With the midfoot placement of cleat 610 for shoe 600 the toes are on a side of a longitudinal axis of the pedal where toeing-off is not possible during the downstroke of the crank since the pedal will simply rotate thereby dissipating any force from toe-off. Force can be transferred to the pedal during toe-off by employing a ratchet mechanism with one tooth that prevents rotation of the pedal, in the same angular direction of the crank, about the pedal's longitudinal axis at least during a portion of the cranks downward movement in quadrant IV as seen in FIG. 21. Referring to FIG. 22 there is shown a cross-section of pedal shaft 700 and pedal spindle 710. Pedal shaft 700 is securely engaged with crank 80 (seen in any one of FIGS. 1, 8, 10, 11 and 12), such that as crank 80 rotates around bottom bracket 100 (also seen in any one of FIGS. 1, 8, 10, 11 and 12) pedal spindle 710 rotates within pedal shaft 700. Ratchet mechanism 720 includes pawl 730 and biasing spring 740 operatively connected with pedal spindle 710, and gear tooth 750 fixed to an inner surface of pedal shaft 700. In operation, as pedal shaft 700 rotates in a clockwise direction, the back side of gear tooth 740 will contact pawl 730 and press it into biasing spring 740 such that the gear tooth can clear and travel past the pawl. As soon as gear tooth 750 passes by pawl 730, biasing spring 740 urges the pawl back towards the inner surface of pedal shaft 700. At this moment, the cyclist can apply a clockwise rotation to pedal spindle 710 such that pawl 730 engages gear tooth 750 thereby preventing the pawl from traveling past the gear tooth. In this way the cyclist can apply a toe-off force to the pedal that will be transferred to the crank towards the bottom part of the downward stroke of the crank. Preferably ratchet mechanism 720 allows the cyclist to toe-off somewhere between 0 degrees (°) and 270° in quadrant IV, and more preferably somewhere between 315° and 270° in quadrant IV, as illustrated in FIG. 21. In other embodiments, the pedal shaft and spindle can be opposite in position to the illustrated embodiment of FIG. 22 (that is the shaft is on the inside and the spindle is on the outside). In all embodiments the pawl and the biasing spring are connected with the pedal spindle and the gear tooth is connected with the pedal shaft. Next, additional embodiments are disclosed that can be employed in combination with the previous embodiments, although this is not a requirement.

Figure 25:
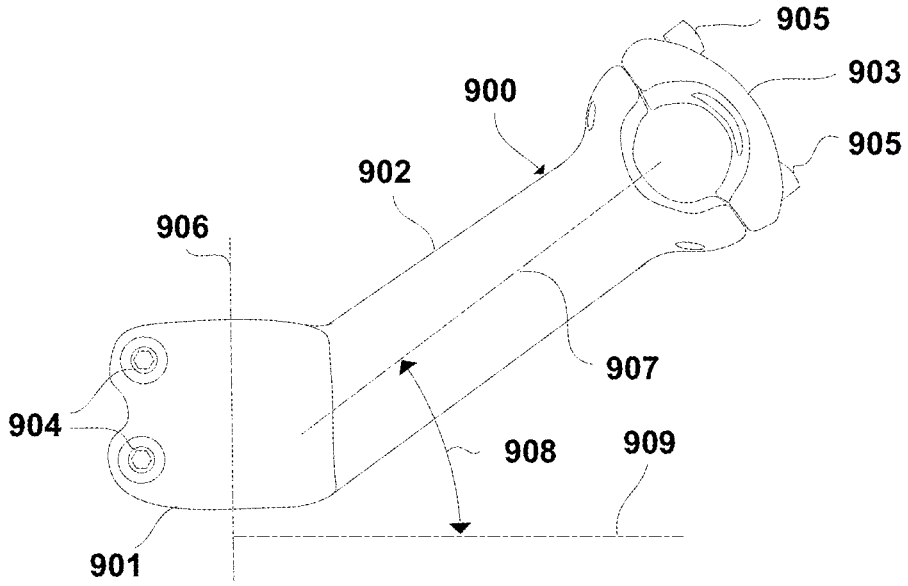
FIG. 25 Prior Art
FIG. 25 is a side elevational view of a prior art handlebar stem.
Figure 26:
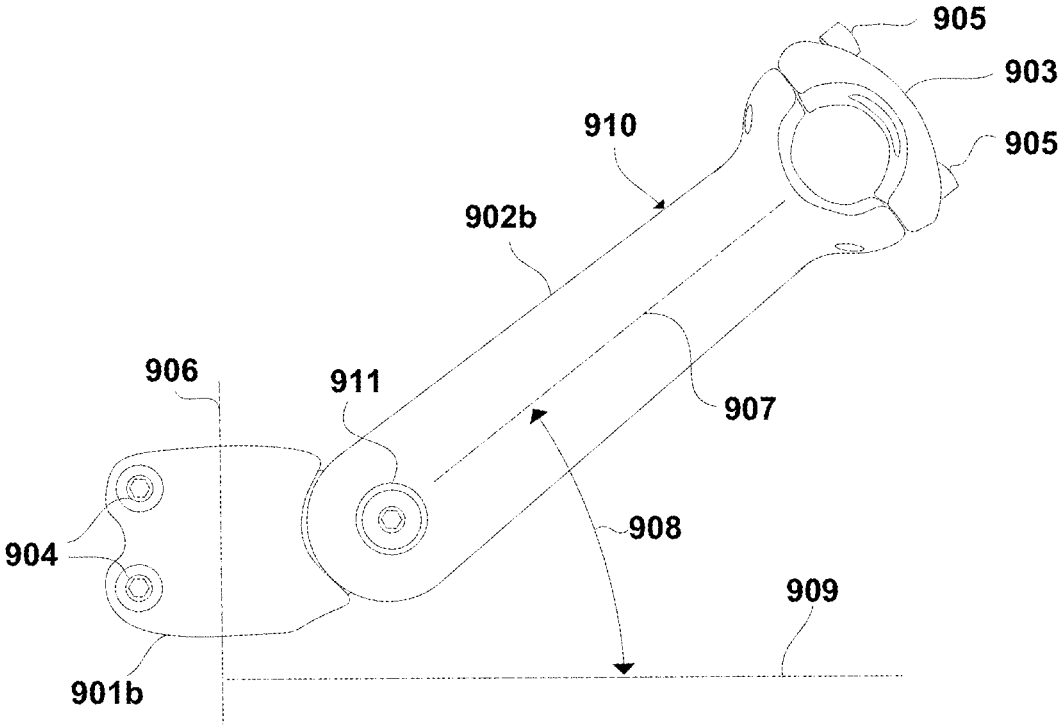
FIG. 26 Prior Art
FIG. 26 is a side elevational view of a prior art adjustable handlebar stem.
Figure 27:
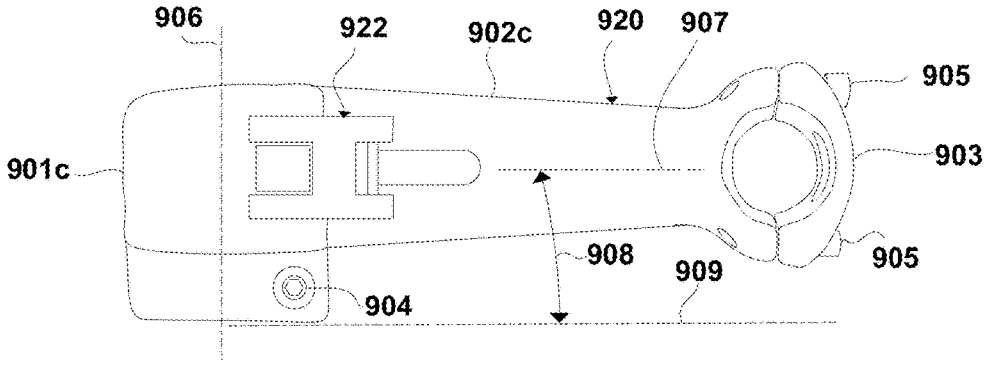
FIG. 27 Prior Art
FIG. 27 is a side elevational view of a prior art adjustable handlebar stem.
Figure 28:
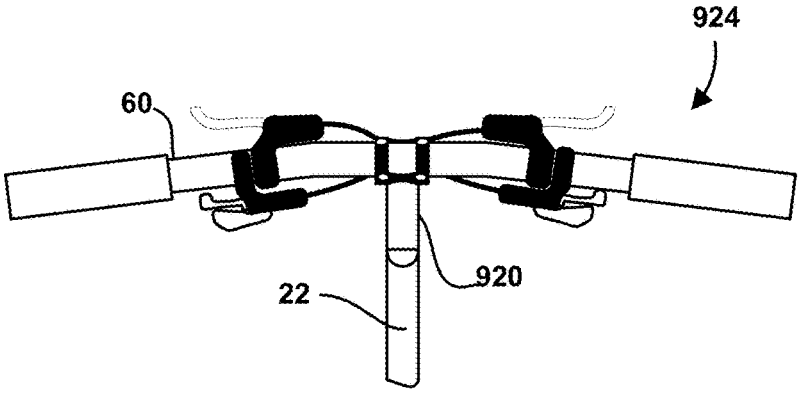
FIG. 28 is a plan view of the adjustable handlebar stem of FIG. 27 and a handle bar illustrated in a riding position relative to a top tube of a bicycle.
Figure 29:
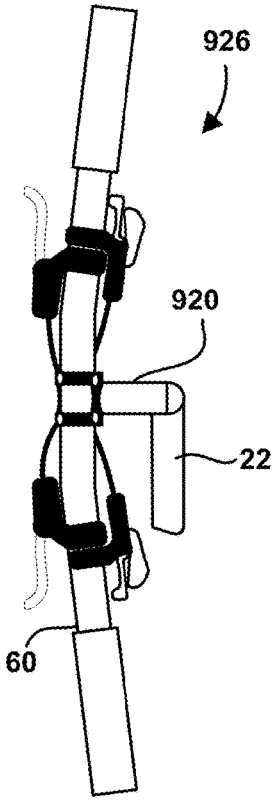
FIG. 29 is a plan view of the adjustable handlebar stem of FIG. 27 and a handle bar illustrated in a storage position relative to a top tube of a bicycle.
Figure 30:
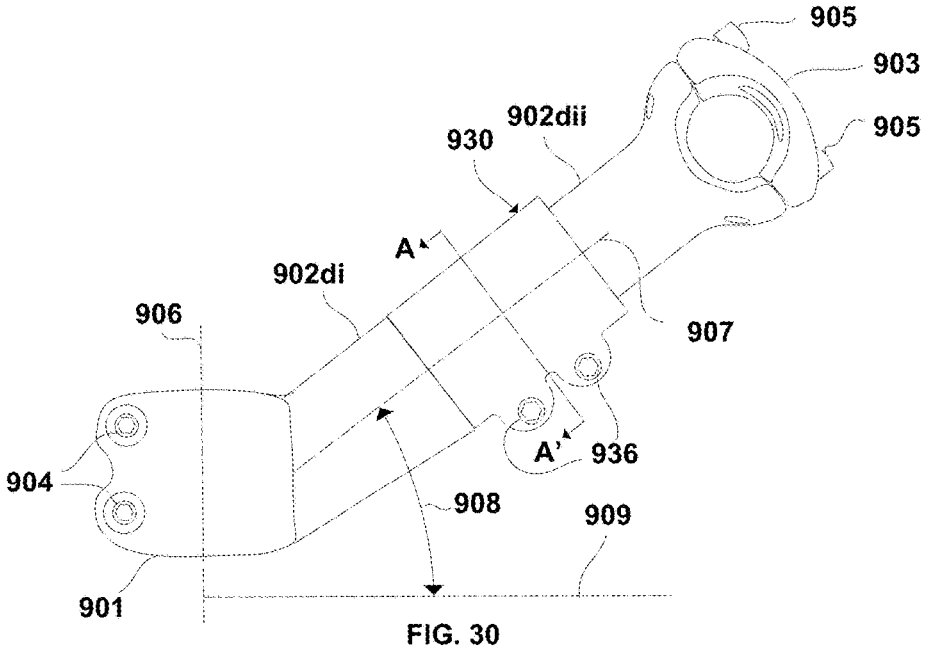
FIG. 30 is a side elevational view of an adjustable handlebar stem according to an embodiment.
Figure 31:
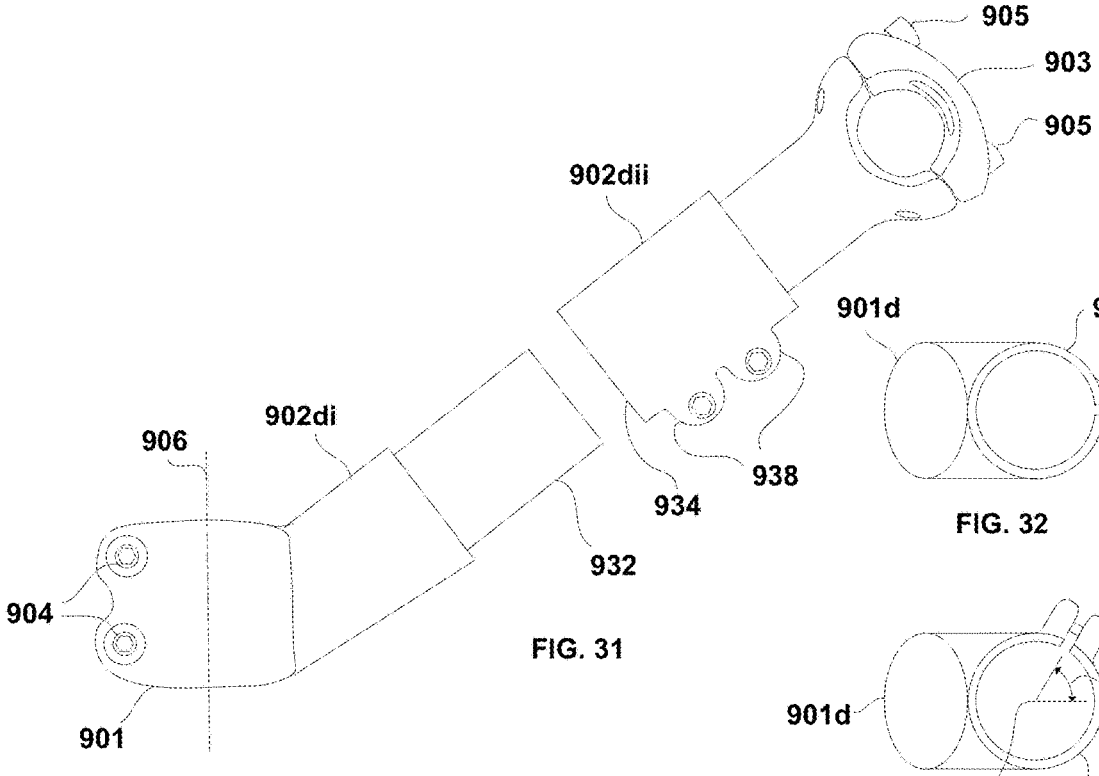
FIG. 31 is an exploded view of the adjustable handlebar stem of FIG. 30.

Referring first to FIGS. 25, 26 and 27, there is shown prior art handlebar stems 900, 910 and 920 that can be used on bicycle apparatus 10 alternatively to handlebar stem 62 in FIG. 1. Stem 900 includes head-tube portion 901, stem portion 902 and clamping portion 903. Head-tube portion 901 is connected with a head tube, such as head-tube 63 or stem riser 67 (both seen in FIG. 1) and secured by fasteners 904. Clamping portion 903 secures a handlebar to a bicycle, such as handlebar 60 (seen in FIG. 1) by inserting the handlebar and fastening bolts 905. Head-tube axis 906 is co-axial with the axis of head-tube 63. Plane 909 is perpendicular to head-tube axis 906. Stem axis 907 forms stem angle 908 with plane 909. Angle 908 can be greater than, less than and equal to zero degrees. Handlebar stem 910 includes head-tube portion 901*b* that is adjustably connected with stem portion 902*b* by joint 911 such that stem angle 908 can be adjusted. In other embodiments there can be more than one joint 911 along stem 902*b*. Handlebar stem 920 includes head-tube portion 901*c* that is adjustably connected with stem portion 902*c* such that when handlebar stem 920 is in riding position 924 (seen in FIG. 28) locking mechanism 922 can be actuated to decouple the stem portion from the head-tube portion whereby the stem portion can be rotated about head-tube axis 906 to storing position 926 (seen in FIG. 29), whereby locking mechanism 922 is actuated for locking. Handlebar stem 920 can be Satori model number SATORI-ET2 AHS.

Figure 32:
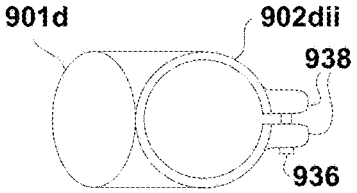
FIG. 32 a cross-sectional view of the adjustable handlebar stem of FIG. 30 taken at line A-A' illustrating the adjustable handlebar stem in a first position.
Figure 33:
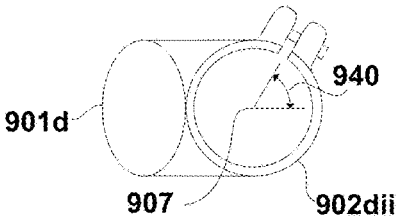
FIG. 33 a cross-sectional view of the adjustable handlebar stem of FIG. 30 taken at line A-A' illustrating the adjustable handlebar stem in a second position.

Referring now to FIGS. 30, 31, 32 and 34, there is shown adjustable handlebar stem 930 according to an embodiment. Stem 930 includes stem portions 902*di* and 902*dii*. Stem portion 902*di* includes cylindrical portion 932 and stem portion 902*dii* includes bore 934 where the outer diameter of the cylindrical portion is less than the inner diameter of the bore such that the bore can receive the cylindrical portion. To secure stem portion 902*dii* to stem portion 902*di*, to restrict and preferably prevent relative movement, fasteners 936 are tightened urging respective mounting lugs 938 together (best seen in FIG. 32) thereby reducing the inner diameter of bore 934 resulting in a press-fit between the bore and cylindrical section 932. In the present embodiment fasteners 936 are illustrated as bolts that are threaded into respective bores in respective mounting lugs 938, as is well known. In other embodiments fasteners 936 can be a quick-release-and-lock-type mechanism as will be described in more detail below. Stem portion 902*dii* is rotatable about stem axis 907, such that a handlebar (for example handlebar 60 in seen in FIG. 1) can be rotated about the stem axis allowing a variety of handlebar positions. These handlebar positions that can have a therapeutic effect upon the cyclist as will be discussed in more detail below. With reference to FIG. 32, which shows a cross-sectional view taken at line A-A' in FIG. 30, stem portion 902*dii* is shown in a conventional position, for example like that for stem 900 in FIG. 25. To rotate stem 902*dii* fasteners 936 are loosened such that stem portion 902*dii* is free to rotate, for example to the position shown in FIG. 33, after which the fasteners are tightened to secure the stem portions together. Stem portion 902*dii* can be rotated with respect to stem portion 902*di* by any angle 940. A bolt (not shown) that extends along stem axis 907 can be used to secure stem portion 902*dii* to stem portion 902*di*, similar to the bolt along head-tube axis 906 that is used to secure conventional handlebar stems to the head tube. The bolt can be tightened enough so secure stem portion 902*dii* in the longitudinal position along axis 907 seen in FIG. 30, but which does not prevent rotation of stem portion 902*dii* about axis 907 when fasteners 936 are loosened. Alternatively, the bolt can be secured such that is requires a tool to loosen to allow rotation of stem portion 902*dii* about axis 907 when fasteners 936 are loosened.

Figure 34:
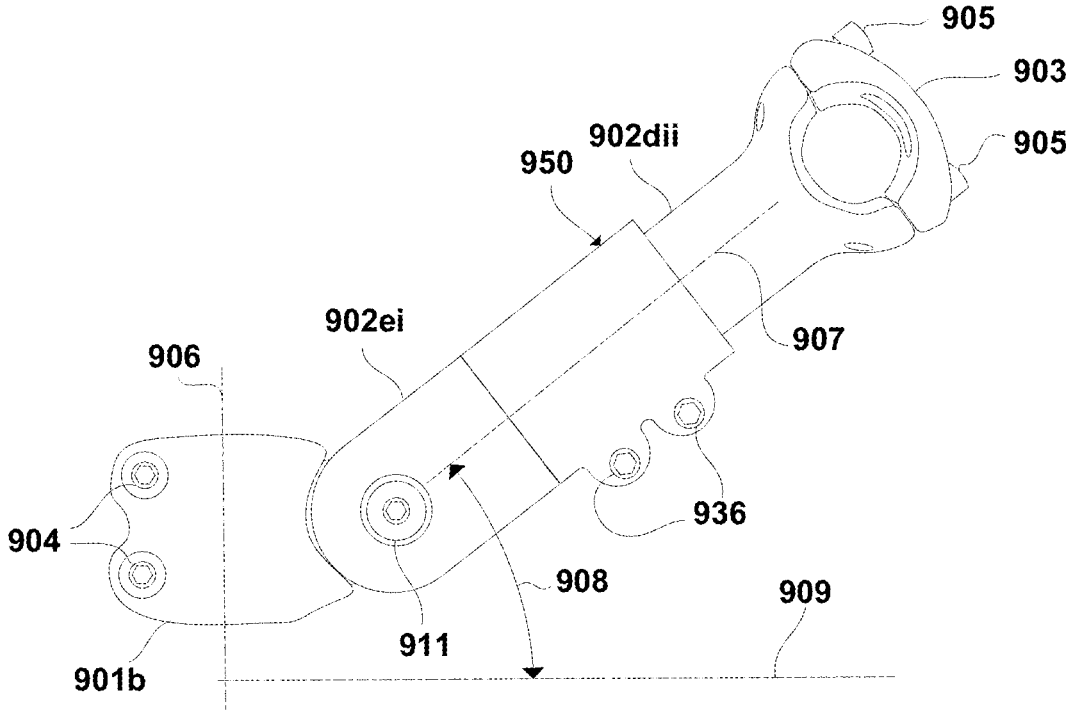
FIG. 34 is a side elevational view of an adjustable handlebar stem according to another embodiment.
Figure 35:
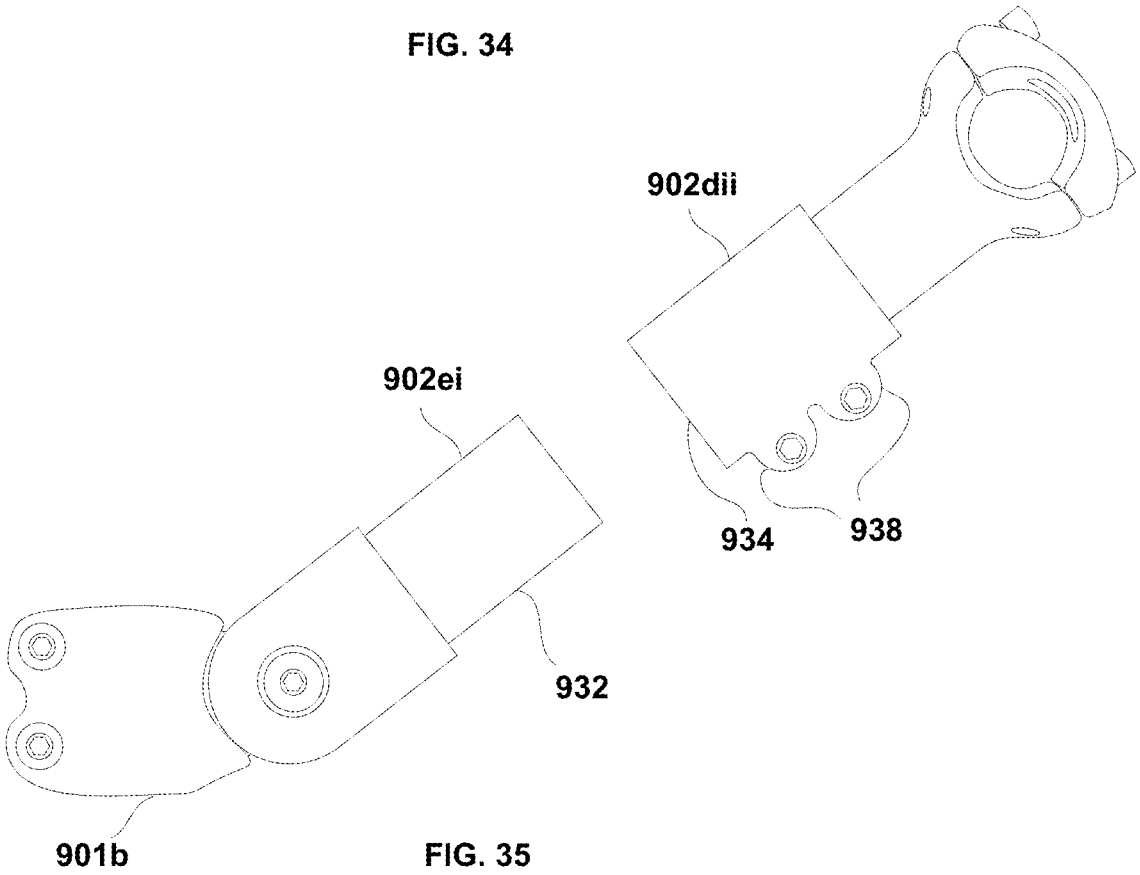
FIG. 35 is an exploded view of the adjustable handlebar stem of FIG. 34.

Referring now to FIGS. 34 and 35, there is shown adjustable handlebar stem 950 according to another embodiment. Stem 950 is a combination of the features of stem 910 and 930. Stem portion 902*ei* is rotatably connected with head-tube portion 901*b* by joint 911 and includes cylindrical section 932 that is received by bore 934 of stem portion 902*dii*. Stem portion 902*dii* can be rotated about stem axis 907 to any desired angle 930 (seen in FIG. 33) and locked in position by fasteners 936. In other embodiments there can be more than one joint 911 along stem portion 902*ei*.

Figure 36:
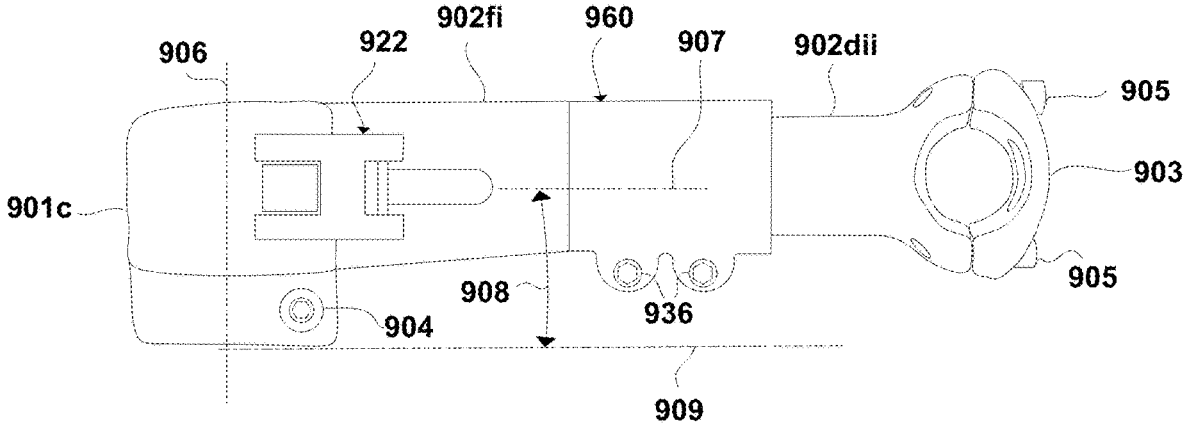
FIG. 36 is a side elevational view of an adjustable handlebar stem according to another embodiment.
Figure 37:
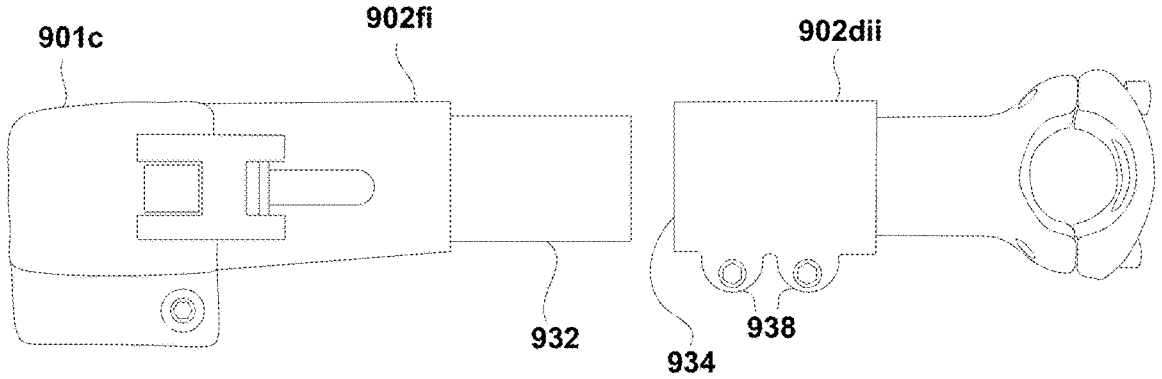
FIG. 37 is an exploded view of the adjustable handlebar stem of FIG. 36.
Figure 38:
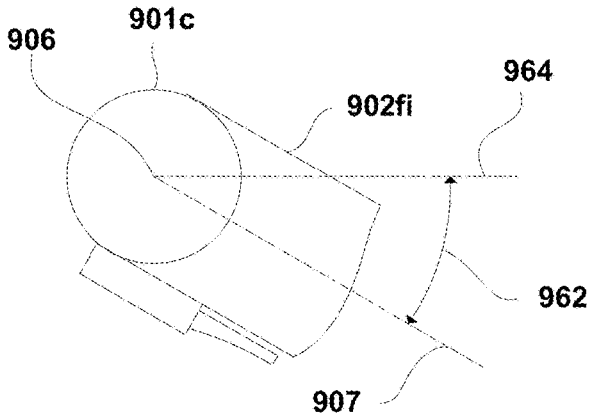
FIG. 38 is partial plan view of the adjustable handle bar stem of FIG. 36 illustrated in a first position where a stem axis of the adjustable handle bar stem forms an acute angle with a top-tube plane of a bicycle where the rear wheel lies in the top plane and when a front wheel lies in the top-tube plane.

Referring now to FIGS. 36, 37 and 38, there is shown adjustable handlebar stem 960 according to another embodiment. Stem 960 is a combination of the features of stem 920 and 930. Stem portion 902*fi* is secured with head-tube portion 901*c* by locking mechanism 922 and includes cylindrical section 932 that is received by bore 934 of stem portion 902*dii*. Stem portion 902*dii* can be rotated about stem axis 907 to any desired angle 930 (seen in FIG. 33) and locked in position by fasteners 936. Unlike stem portion 902*c* in stem 920, stem portion 902*fi* is rotated about head-tube axis 906 to any desired angle 962 and locked in position by locking mechanism 922. Top-tube plane 964 is the plane that top tube 22 and rear wheel 30 (seen in FIG. 1) lie in, and when the bicycle is upright is a vertical plane. Angle 962 is the angle between stem axis 907, projected onto plane 909, and top-tube plane 964.

Figure 39:
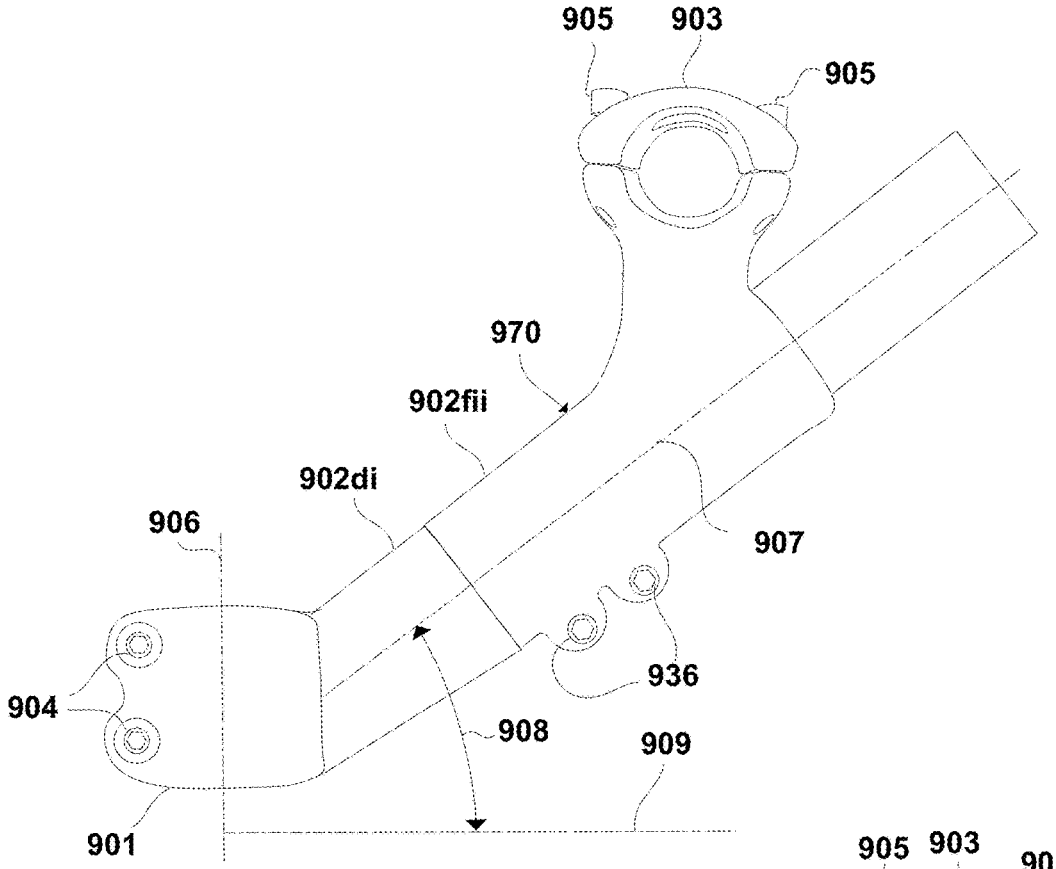
FIG. 39 is a side elevational view of an adjustable handlebar stem according to another embodiment illustrated in a first position.
Figure 40:
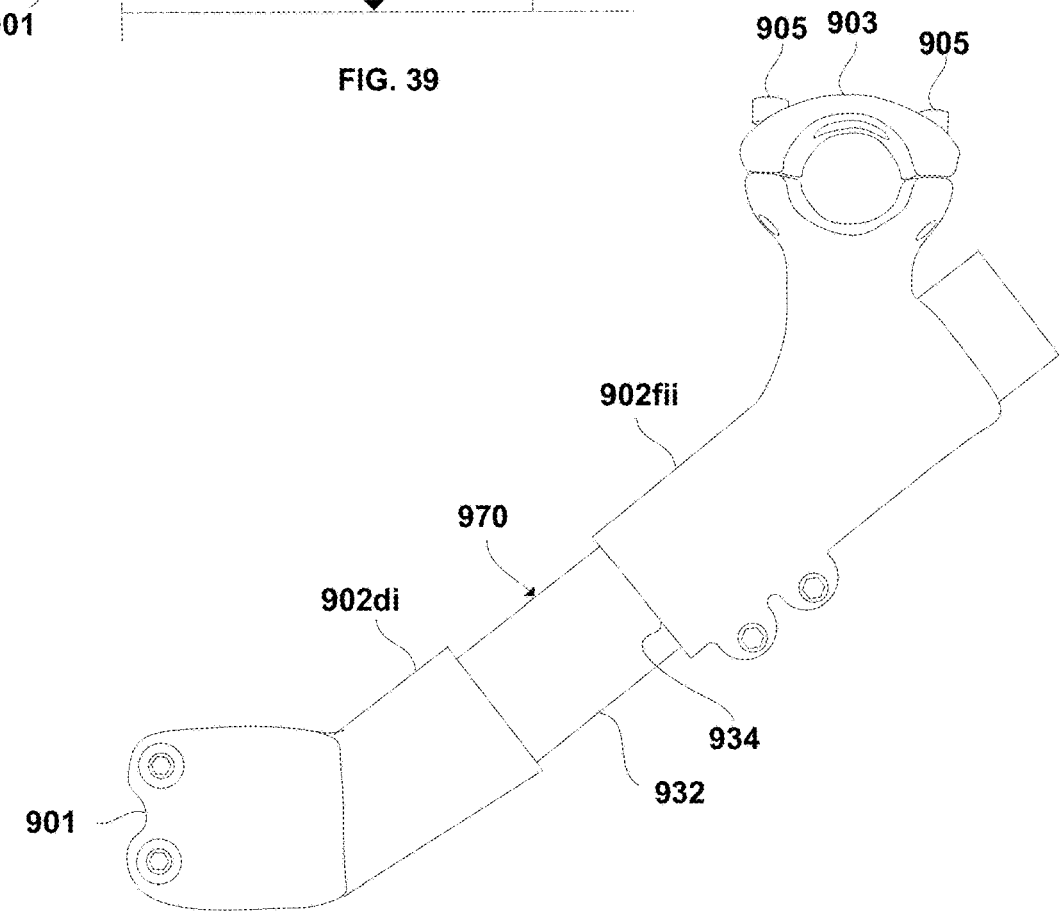
FIG. 40 is a side elevational view of the adjustable handlebar stem of FIG. 39 illustrated in a second position.

Referring now to FIGS. 39 and 40, there is shown adjustable handlebar stem 970 according to another embodiment. Stem 970 includes head-tube portion 901 and stem portion 902*di*, similar to that shown in FIG. 30, except in this embodiment cylindrical portion 932 is longer. Stem portion 902*fii* includes clamping portion 903 extending away from stem axis 907 and bore 934 extending all the way through stem portion 902*fii*, such that stem portion 902*fii* is moved to any position along cylindrical portion 932 and locked in place by fasteners 936. As an example, stem portion 902*fii* is shown in a first position in FIG. 39 and a second position in FIG. 40. As in the embodiment of FIG. 30, stem portion 902*fii* can additionally be rotated about stem axis 907. In other embodiments stems 930 and 950, with longer cylindrical sections 932, can employ stem portion 902*fii*.

Figure 41:
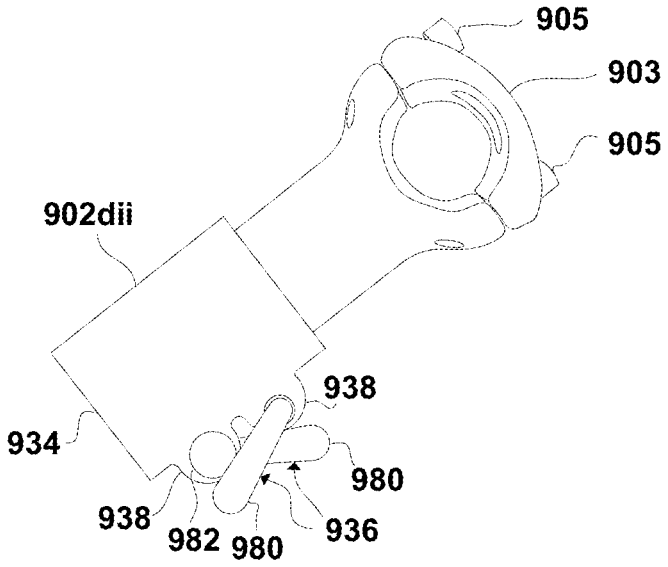
FIG. 41 is a side elevational view of a stem portion of the adjustable handlebar stems of FIG. 30, FIG. 34 and FIG. 36 according to another embodiment.

Referring now to FIG. 41 there is shown stem portion 902*dii* where fasteners 936 are a quick-release-and-lock-type mechanism similar to the wheel quick release used for securing bicycle wheels to the frame of the bicycle. The quick-release-and-lock-type mechanism includes levers 980, a rod (not shown), caps 982 (only one shown) and in some circumstances a pair of springs (not shown) for each fastener 936. In other embodiments only one fastener 936 can be use used. Cap 982 is threaded onto the rod such that lever 980 and the cap are tight against mounting lugs 938, and the lever is then rotated to press the lugs together securing stem portion 902*dii* to cylindrical portion 932 seen in the previous embodiments. Additionally, in the embodiments herein fasteners 904 can be bolts or quick-release-and-lock-type mechanisms.

Figure 42:
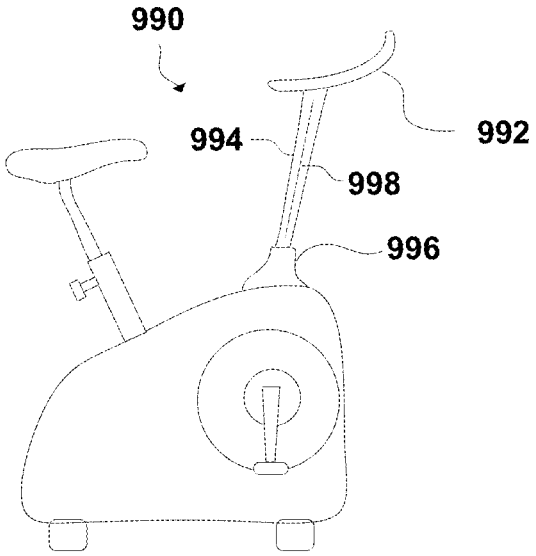
FIG. 42 is a side elevational view of an exercise bicycle according to an embodiment.

Referring now to FIG. 42 there is shown exercise bike 990 according to another embodiment. Exercise bike 990 includes handle bar 992 and handle bar support 994. Adjustable joint 996 allows handle bar 992 to be rotated about handle-bar-support axis 998. Although the height of the seat of exercise bike 990 is illustrated to be adjustable, the seat can also be adjusted fore and aft in other embodiments.

Figure 43:
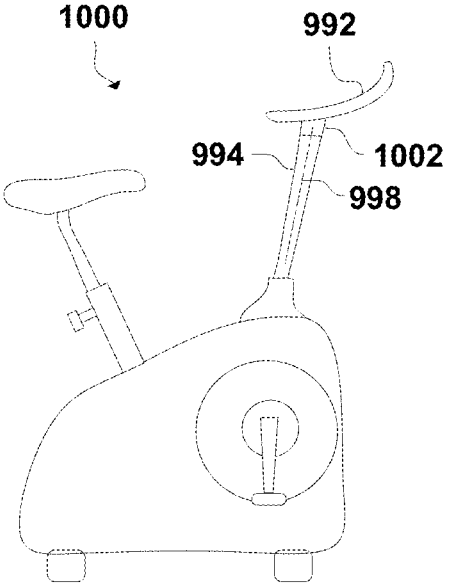
FIG. 43 is a side elevational view of an exercise bicycle according to another embodiment.

Referring now to FIG. 43 there is shown exercise bike 1000 according to another embodiment. Exercise bike 1000 includes adjustable joint 1002 that can be a ball joint or a handle bar stem according to one of the embodiments herein, that allows handle bar 992 to be adjusted with respect to handle bar support 994.

Figure 44:
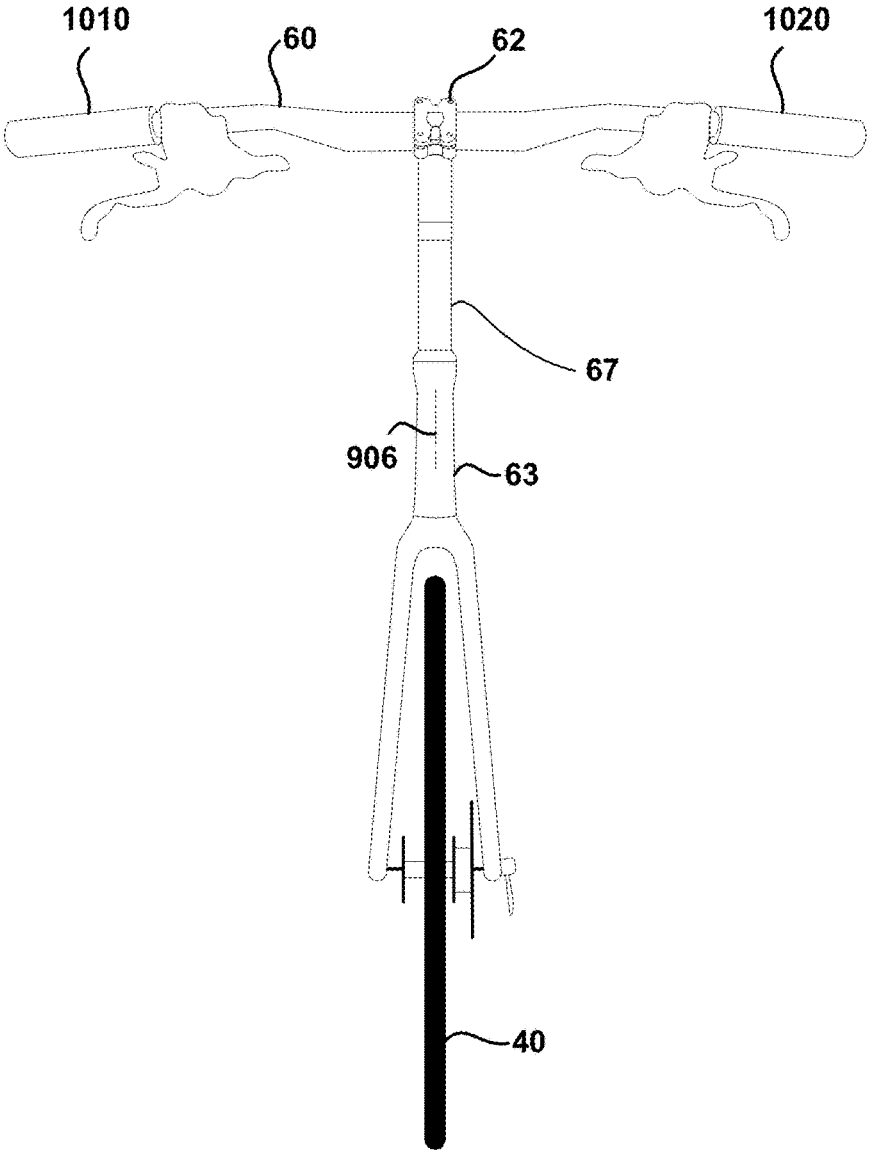
FIG. 44 is a front elevational view of a bicycle illustrated in a conventional configuration.
Figure 45:
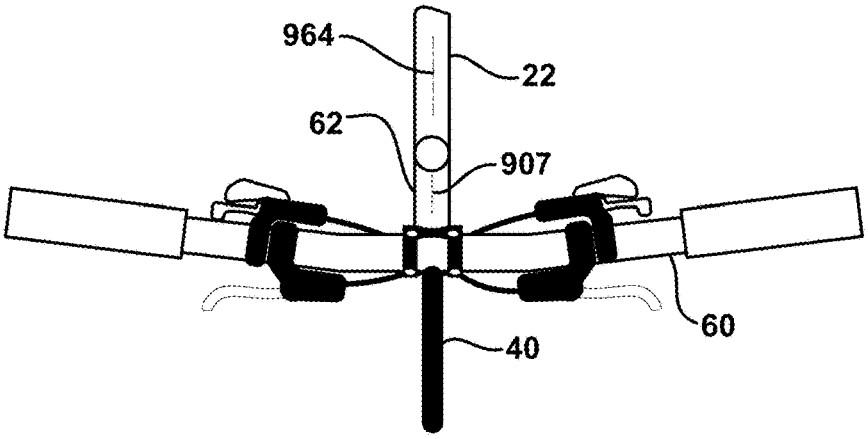
FIG. 45 is a partial plan view of a handlebar and handlebar stem of the bicycle of FIG. 44.
Figure 46:
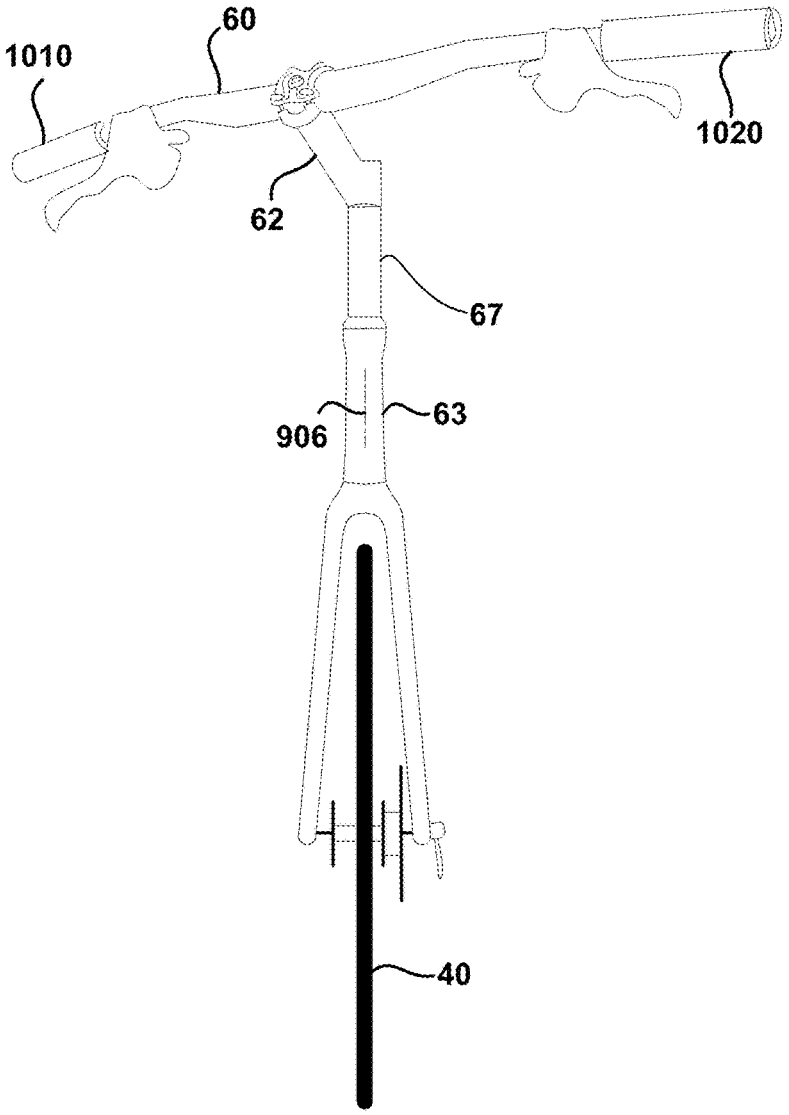
FIG. 46 is a front elevational view of a bicycle illustrated in a configuration for physical therapy according to an embodiment.
Figure 47:
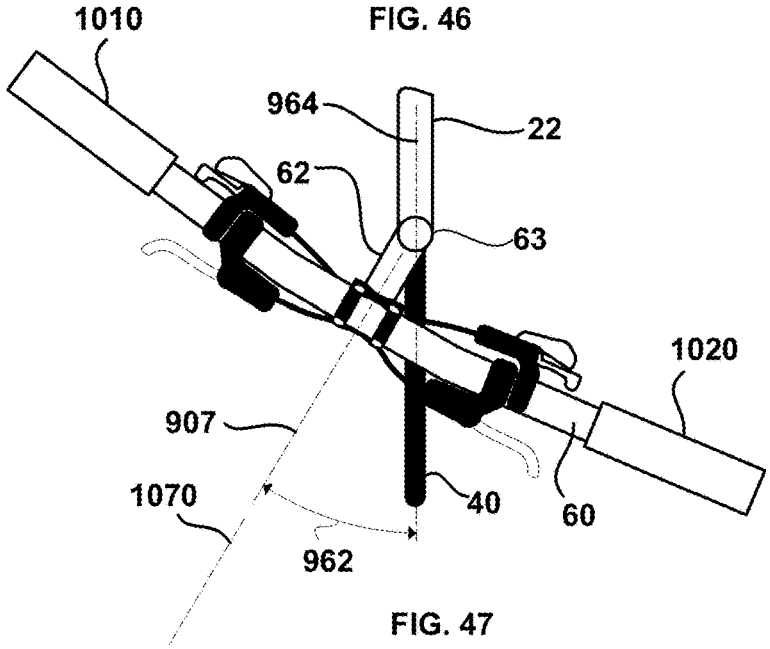
FIG. 47 is a partial plan view of a handlebar and handlebar stem of the bicycle of FIG. 46.
Figure 48:
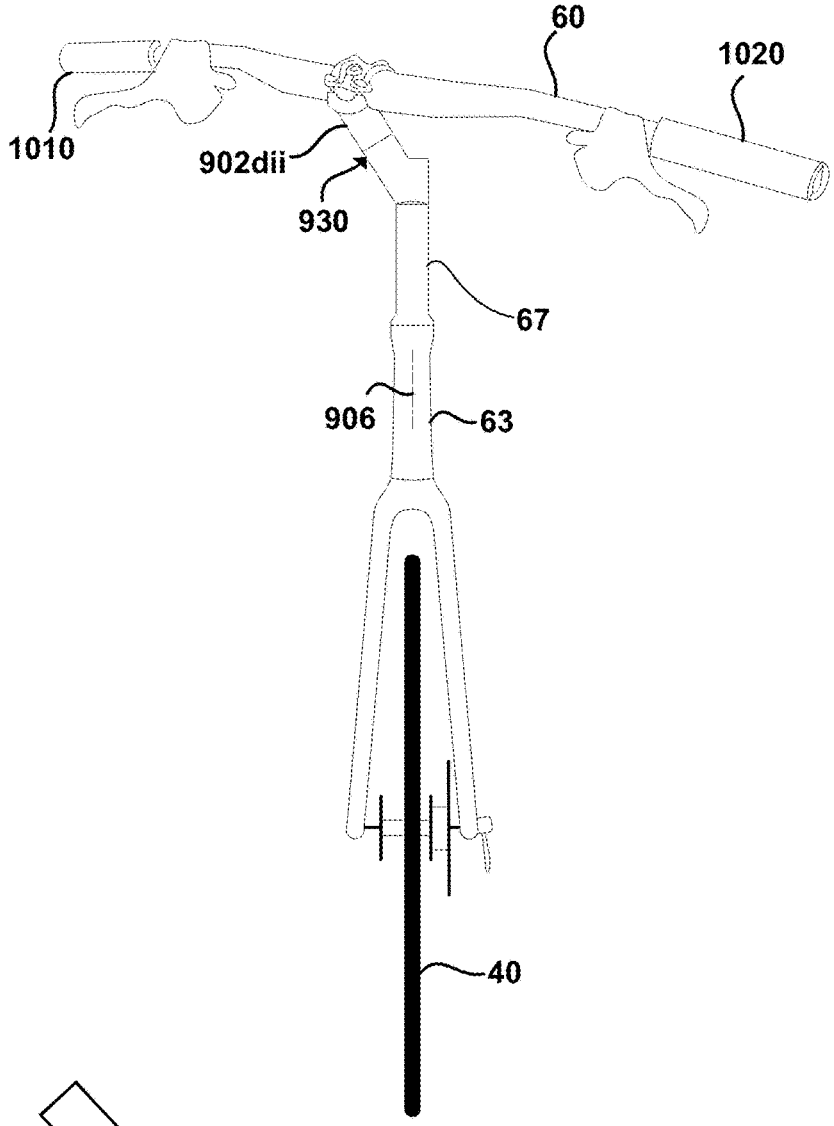
FIG. 48 is a front elevational view of a bicycle illustrated in a configuration for physical therapy according to another embodiment.
Figure 49:
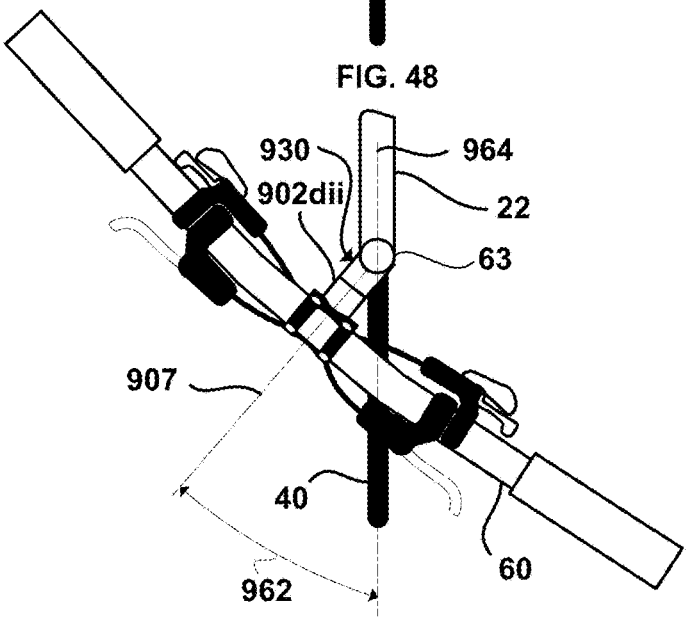
FIG. 49 is a partial plan view of a handlebar and handlebar stem of the bicycle of FIG. 48.
Figure 50:
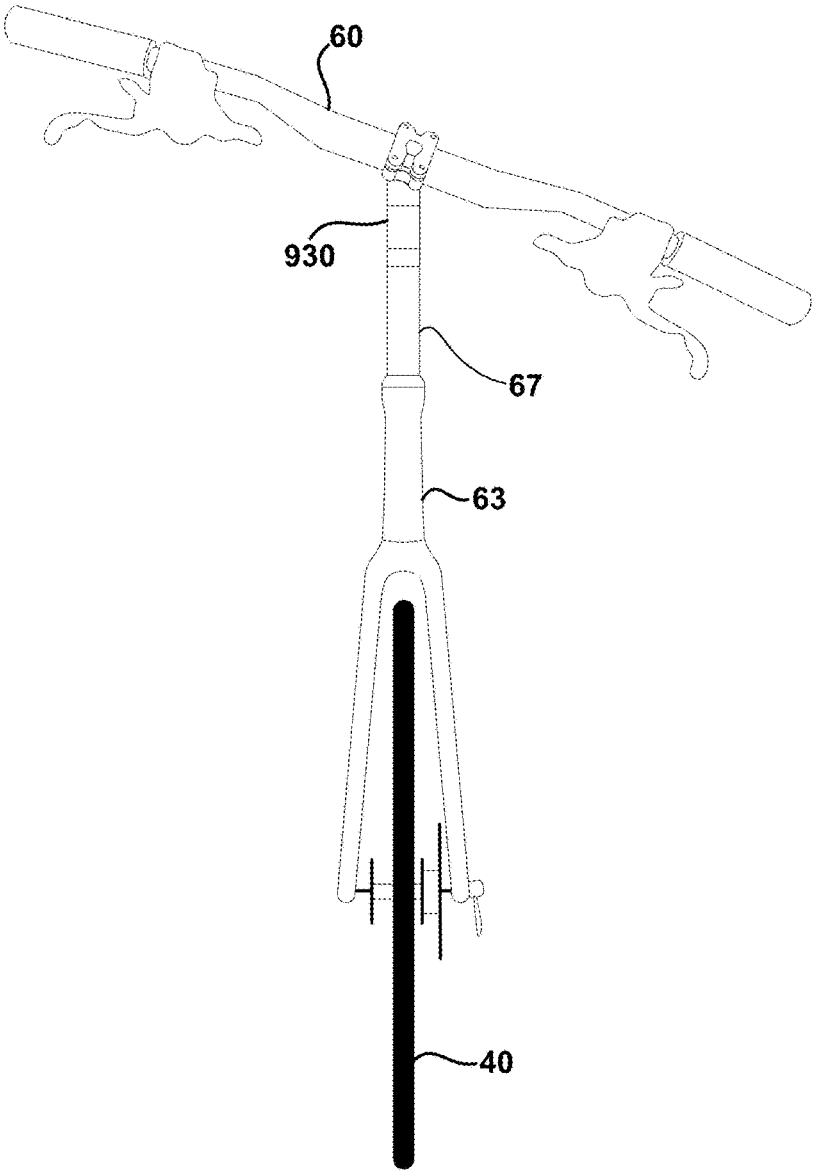
FIG. 50 is a front elevational view of a bicycle illustrated in a configuration for physical therapy according to another embodiment.
Figure 51:
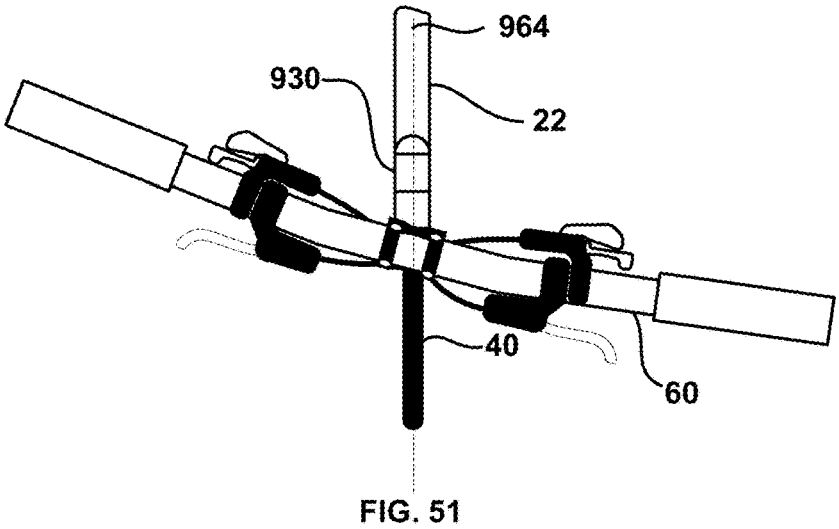
FIG. 51 is a partial plan view of a handlebar and handlebar stem of the bicycle of FIG. 50.

Referring now to FIGS. 44 to 51, a method of physiotherapy employing the handlebar stem embodiments disclosed herein is now discussed. FIGS. 44 and 45 illustrate a conventional handlebar setup for a bicycle. When front wheel 40 lies in top-tube plane 964 (herein referred to as the neutral position for a bike), stem axis 907 of handlebar stem 62 also lies in the top-tube plane. In these figures, stem 62 is similar to stem 900 seen in FIG. 25. In this configuration the rider reaches substantially an equal length with their right and left arms to grip right and left grips 1010 and 1020 respectively without twisting the upper body relative to the lower body when the sit bones are placed in corresponding positions on the saddle. With reference to FIGS. 46 and 47, handlebar stem 62 can be secured to head tube 63 such that angle 962 between top-tube plane 964 and stem axis 907 is not equal to zero. In this configuration the rider needs to reach further for left grip 1020 (from the rider's perspective) compared to right grip 1010, and may twist the upper body in order to accomplish this. Since head-tube axis 906 is not at right angles relative to the horizontal (that is the ground), when handlebar 60 is rotated about head-tube axis 906 one of right grip 1010 and left grip 1020 will rise above the other depending on which way the handlebar is rotated. In FIG. 47 handlebar 60 has been rotated in a clockwise direction and left grip 1020 has risen above right grip 1010. With reference to FIGS. 48 and 49, handlebar stem 930 is employed instead of stem 62. Stem portion 902*dii* has been rotated about stem axis 907 such that left grip portion 1020 has dropped below right grip portion 1010. With reference to FIGS. 50 and 51, angle 962 (best seen in FIGS. 49 and 51) between stem axis 907 and top-tube plane is equal to zero. Stem portion 902*dii* has been rotated about stem axis 907 such that angle 940 (best seen in FIG. 33) is not equal to zero, such that left grip 1020 has dropped below right grip 1010. The rider needs to reach further for left grip 1020 than right grip 1010 and may rotate the upper body in order to keep the arms at equal extension. By adjusting at least one of angle 940 (best seen in FIG. 33) and angle 962 (seen in FIGS. 47 and 49) in combination with stem angle 908 (best seen in FIG. 30), the longitudinal position of stem portion 902*dii* along the length of cylindrical portion 932 (seen in FIGS. 39 and 40), the position of saddle 50 (seen in FIGS. 3, 4 and 5), saddle height SH and handlebar height HH (seen in FIG. 1), as well as other conventional bicycle component adjustemnts, the rider can achieve various angles and amounts of twist of the upper body relative to the lower body (for example, the pelvis). The relative twist between the upper body and the pelvis lengthens some muscles and shortens others, especially in the upper body muscles. This can be beneficial, for example, to those who have an asymmetrical muscle pattern brought on by a leg length difference as well as other anomalies or maladies. A twist due to angles 940 and 962 that have non-zero values can be to counteract a twist that develops due to the leg length difference, and cycling with this counteracting twist can help to balance out muscle development between the left and right sides of the body across the median plane. For example, when a leg length difference is compensated by providing a lift under a shoe or a cleat, while walking or cycling, the skeleton (especially the pelvis) may be put into a symmetrical position across the median plane, but the musculature may still not be symmetrical, or the pathways of active musculature that fire during movement may not be symmetrical across the median plane, due to the history of the person walking with an asymmetrical skeletal framework across the median plane. It may happen that when walking or cycling under these conditions the musculature does not balance between the left and right sides of the body, or the rate of the musculature becoming balanced takes too long. By providing a twist as described herein while cycling the rate of balancing the left and right sides of the body can increase compared to not twisting. In some circumstances muscles new muscle pathways are formed that lead to improved musculature balance and activation across the median plane. The method of physical therapy includes twisting the upper body relative to the lower body and maintaining the twist while cycling. A variety of different amounts and directions of twist can be experimented with to achieve a therapeutic effect for the patient, which can be perceived as a more balanced musculature across the median plane, and improved gate function and athletic performance. Typically more than one session is required to achieve a desired level of therapeutic effect.

Figure 52:
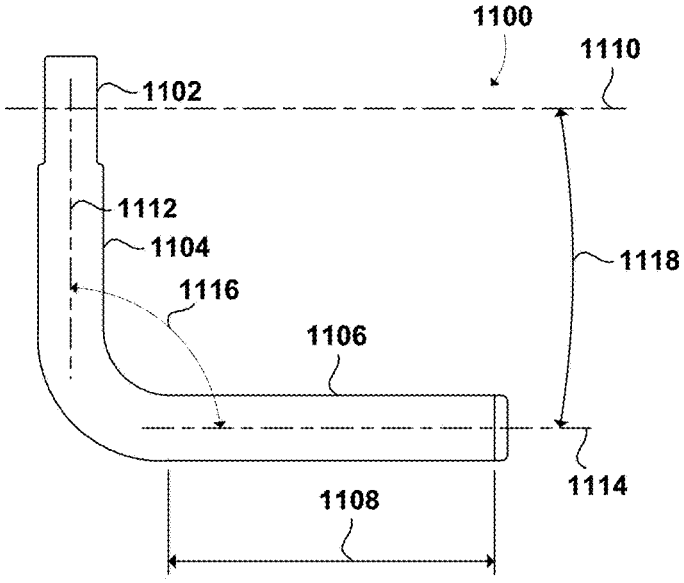
FIG. 52 is a plan view of a bar extension according to an embodiment.
Figure 53:
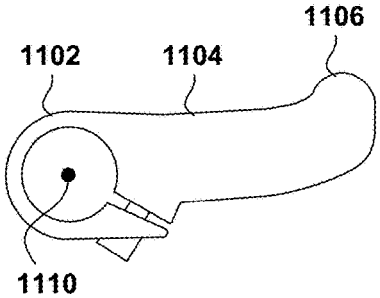
FIG. 53 is side view of the bar extension of FIG. 52.
Figure 54:
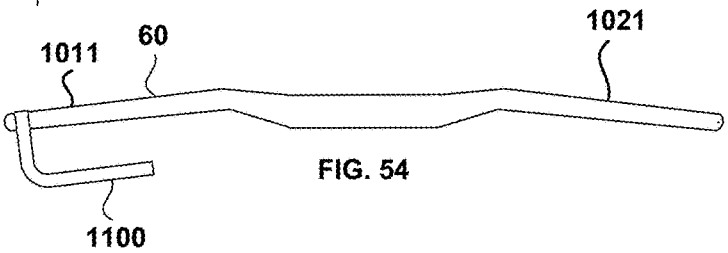
FIG. 54 is front view of the bar extension of FIG. 52 configured with a handlebar.

Referring now to FIGS. 52 to 54 there is shown bar extension 1100 according to an embodiment that can be employed with handlebar 60 to practice the method of physical therapy disclosed herein. Clamping portion 1102 secures bar extension 1100 to handlebar 60. Offset portion 1104 offsets hand portion 1106 from handlebar 60. Hand portion 1106 has length 1108 that allows a user to comfortably rest their hand. Clamping axis 1110 is co-axial with the longitudinal axis through handlebar end 1011 when bar extension is mounted on handle bar 60. Offset axis 1112 is perpendicular to clamping axis 1110. Hand-portion axis 1114 is the longitudinal axis of hand portion 1106. Angle 1116 is the angle between offset axis 1112 and hand-portion axis 1114. Angle 1118 is the angle between clamping axis 1110 and hand-portion axis 1114. Angle 1116 is less than 105 degrees, and preferably less than 100 degrees, and more preferably less than 105 degrees, and most preferably substantially 90 degrees. Angle 1116 is preferably selected such that hand portion 1106 has a similar angular relationship to the rider as handlebar end 1011. Depending upon the offset of hand portion 1106 from handlebar end 1011, and the angular orientation of handlebar end 1101, in some embodiments angle 1116 can be less than 90 degrees, thereby forming an acute angle between offset portion 1104 and hand portion 1106. Angle 1118 is negative when angle 1116 is greater than 90 degrees, and positive when angle 1116 is less than 90 degrees. Bar extension 1100 allows the rider to reach beneath the handle bar with their right hand while placing the left hand on handlebar end 1021 creating a twisting motion of the upper body relative to the lower body, which has the effect of lengthening some muscles and shortening others. Bar extension 1100 is illustrated as a right-side bar extension (from the rider's perspective), it is under stood that there is a similar left-side bar extension that can be used to create the opposite twist.

Figure 55:
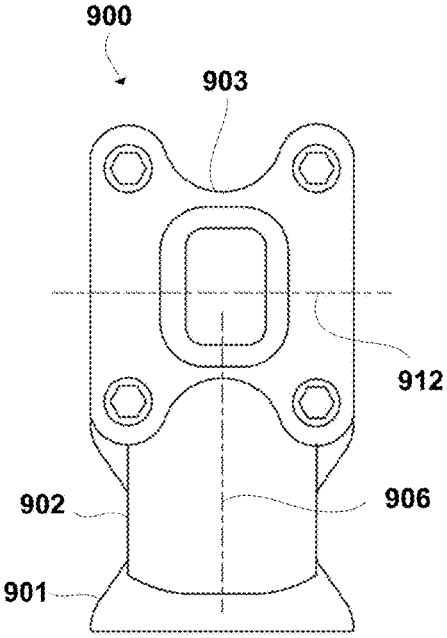
FIG. 55 is a front elevational view of the handlebar stem of FIG. 25.
Figure 56:
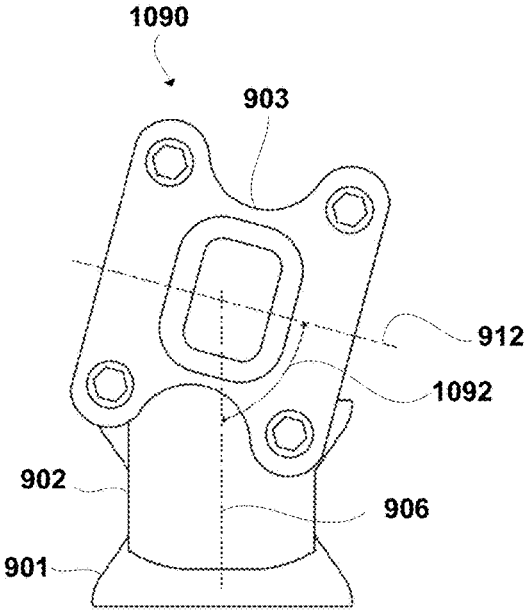
FIG. 56 is a front elevational view of a handlebar stem according to an embodiment.
Figure 57:
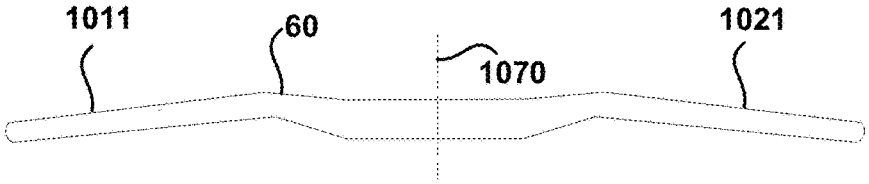
FIG. 57 is a front elevational view of a handlebar.
Figure 58:
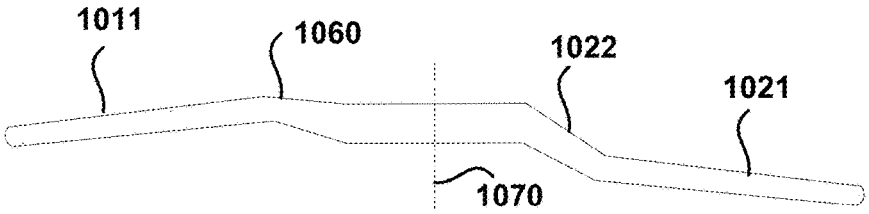
FIG. 58 is a front elevational view of a handlebar according to an embodiment.
Figure 59:
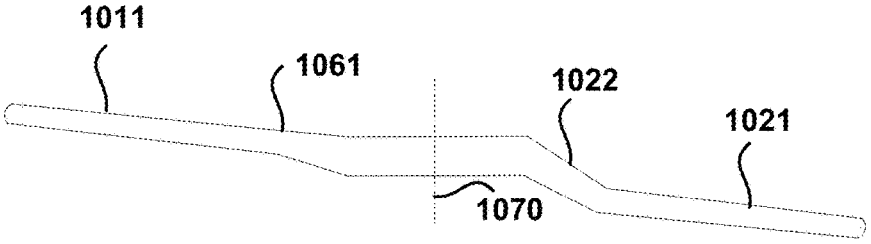
FIG. 59 is a front elevational view of a handlebar according to another embodiment.
Figure 60:
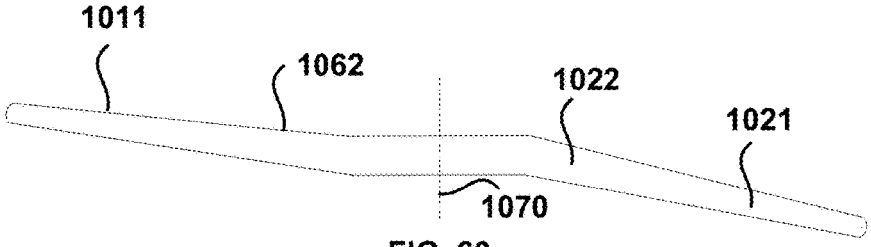
FIG. 60 is a front elevational view of a handlebar according to another embodiment.

Referring now to FIGS. 55 and 56, and first to FIG. 55, there is illustrated handlebar stem 900 (also shown in FIG. 25) with clamping axis 912 that is at right angles to heat-tube axis 906. Clamping axis 912 is coaxial with a longitudinal axis of that portion of handlebar 60 that is clamped by clamping portion 903. Handlebar stem 1090 is illustrated according to another embodiment, where clamping axis 906 is not at a right angle with head-tube axis 906, but where clamping portion 903 is not rotatable relative to stem portion 902 (that is it is fixed). When a handlebar is installed and secured by clamping portion 903 of stem 1090, and the front wheel is in the position illustrated in FIG. 44 (the neutral position), one end of the handlebar will be elevated compared to the opposite end, and when the rider grips opposite ends of the handlebar with their hands respectively the upper body will twist compared to the lower body. Angle 1092 is the angle between clamping axis 912 and head-tube axis 906 for stem 1090, and is less than or greater than 90 degrees. For example, angle 1092 can be less than 85 degrees and greater than 95 degrees, or less than 80 degrees and greater than 100 degrees, or less than 75 degrees and greater than 105 degrees. When angle 1092 is less than 90 degrees the right end of a handlebar (from the rider's perspective) rises above the left end, and when it is greater than 90 degrees the left end of the handlebar rises above the right end. Note that the fixedly rotated clamping portion 903 can be combined with adjustable handlebar stems 910 and 920 in other embodiments. Handlebar stem 1090 may be beneficial to a rider who wants to set their handlebar into a "sweet spot" position that improves their power generation.

Referring to FIGS. 57 through 60, there is shown conventional flat-bar type handlebar 60, and flat-bar type handlebars 1060, 1061 and 1062 according to another embodiment. In conventional handlebars, such as handlebar 60, the handlebars are symmetrical about mid-handlebar plane 1070, such that handlebar end 1011 and 1021 are at equal height above ground level when the bike is in the neutral position (as illustrated in FIG. 44). Plane 1070 is at the mid-point of handlebar 60, and is in the middle of the handlebar-stem clamp when the handlebar is secured to the stem. Handlebars 1060, 1061 and 1062 are not symmetrical about plane 1070, and in the illustrated embodiments left end 1021 (from the rider's perspective) falls below right end 1011. In other embodiments the right end can fall below the left end. When the rider grips opposite ends of the handlebar with their hands respectively the upper body will twist compared to the lower body. In other embodiments other types of handlebars can be used, where they are not asymmetrical about a corresponding plane 1070, and the asymmetry allows one side of the handlebar to be elevated compared to the other side uniquely because of the asymmetry, for example when opposite hands are placed in corresponding positions on opposite sides of the handlebar.

Referring back to FIG. 47 stem axis 907 lies within plane 1070. In this configuration when the rider reaches for the handlebars the twist predominantly happens in the upper part of the spine, such as in the thoracic spine. It would be beneficial for the twist to begin in or include the lower part of the spine, for example in the lumbar spine. Such a motion of the rider may involve flexion, axial rotation and lateral flexion of the spine. Such a twisting motion may also cause the pelvis to rotate or tilt. Such a rotation or tilt of the pelvis may counteract a pre-existing tilt and asymmetry of the pelvis (caused for example by a leg length difference). The counteracting rotation or tilt may even go beyond a symmetrical skeletal position into an asymmetrical skeletal position in the opposite direction, which may allow inhibited muscles to become facilitated and develop. The muscles of the back and pelvis may develop in a more balanced manner reducing muscular asymmetry while cycling in the position where the twist happens in both the lower and upper parts of the spines. This may improve joint function in the hips, knees and ankle where the muscle balance across these joints improves. It is noteworthy to mention that the range of motion of the spine with respect to its various movements (e.g. flexion, axial rotation and lateral flexion) vary in the lumbar, thoracic and cervical spines. For example, an average range of axial rotation in the lumbar spine is 5 degrees, in the thoracic spine is 35 degrees, and in the cervical spine is 50 degrees.

Figure 61:
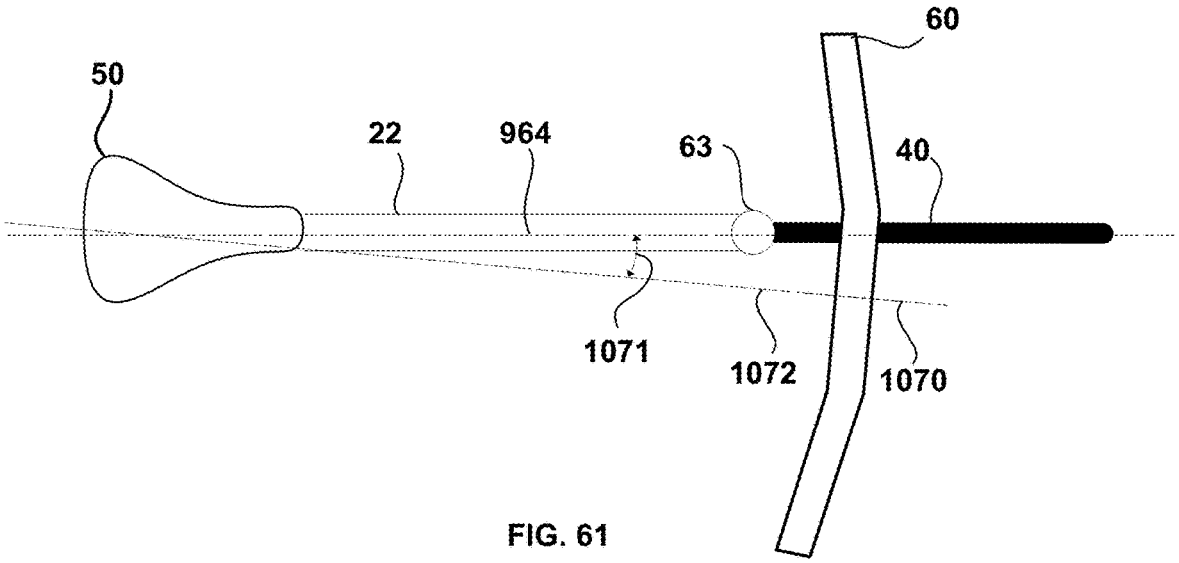
FIG. 61 is a partial top view of a bicycle apparatus according to another embodiment.

Referring now to FIG. 61 there is shown an embodiment where a handlebar position causes a twist to begin in or include the lower part of the spine of the rider. Mid-handlebar plane 1070 of handlebar 60 intersects top-tube plane 964 behind head tube 63 when the bicycle is in the neutral position (that is, with front wheel 40 in the top-tube plane). Although handlebar 60 is illustrated as a flat-bar type handlebar, it is not a requirement and in other embodiments other types of handlebars can be employed, such as for example drop handlebars (seen on road bikes), riser handlebars, touring handlebars and triathlon handlebars, as well as other handlebar types. Stem axis 907 (such as seen in FIGS. 45, 47 and 49) would not lie in plane 1070 as illustrated in FIG. 61. In an exemplary embodiment plane 1070 intersects top-tube plane 964 in the vicinity of the base of the lumber spine of the rider, for example around seat 50, as illustrated in FIG. 61. In another exemplary embodiment plane 1070 intersects top-tube plane 964 at location directly underneath a portion of the spine, such as the lumbar spine, the thoracic spine or the cervical spine, when the rider is seated on the bicycle and gripping the handlebar with both hands. In other embodiments plane 1070 can intersect top-tube plane 964 in various locations behind head tube 63. For example, plane 1070 can intersect top-tube plane 964 at a location that less than ⅞ the distance from the seat clamp to the top of the head-tube, or alternatively less than ⅚ the distance, or alternatively less than ⅝ the distance, or alternatively less than ⅘ the distance, or alternatively less than ⅜ the distance, or alternatively less than ⅖ the distance, Angle 1071 can be any angle where the rider feels a beneficial stretch. For example, the magnitude of angle 1071 can be less than 90 degrees, or less than 45 degrees, or less than 30 degrees, or less than 15 degrees. Each intersecting location of plane 1070 along top-tube 964 can be combined with various magnitudes of angle 1071. Mid-hand-position plane 1072 is coplanar with plane 1070 in the illustrated embodiment and is defined as the plane at the mid-point position between the hands when the rider is gripping the handlebar and substantially perpendicular to the handlebar longitudinal axis at this position. In other embodiments mid-handlebar plane 1070 is not necessarily co-planer with mid-hand-position plane 1072. The same criteria for plane 1070 intersecting top-tube plane 964 described above also applies to plane 1072. When a handlebar is arranged to satisfy the above criteria, for which one example is illustrated in FIG. 61, it is said to be arranged in a twisted intervention handlebar position, and when a rider grips the handlebar the rider is said to be in the twisted invention position.

Figure 62:
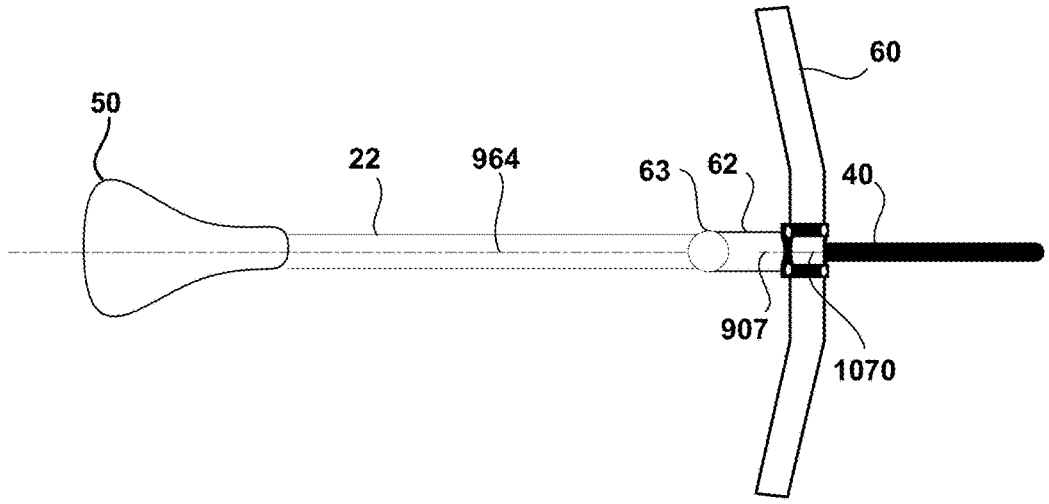
FIG. 62 is a partial top view of a bicycle apparatus in a conventional configuration.
Figure 63:
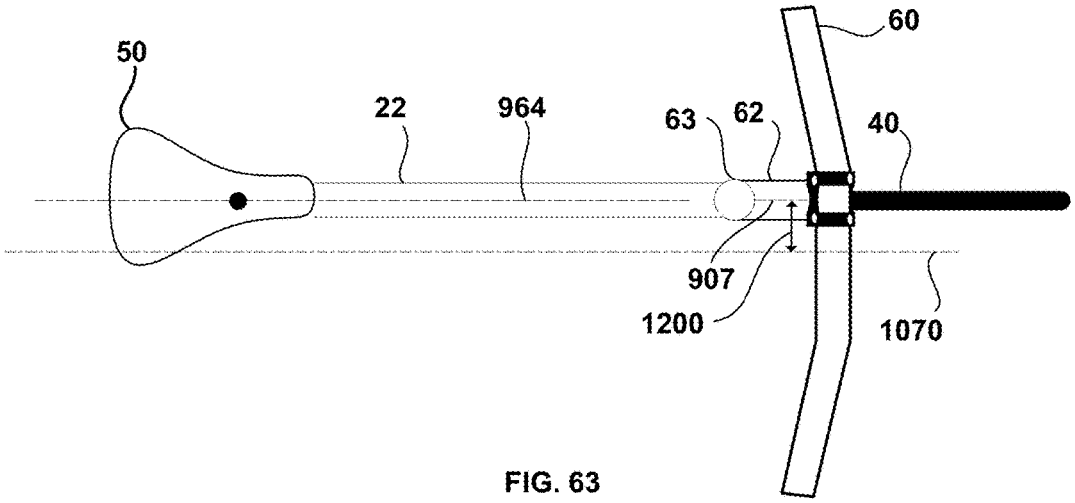
FIG. 63 is a partial top view of the bicycle apparatus of FIG. 61 with an adjusted handlebar position.
Figure 64:
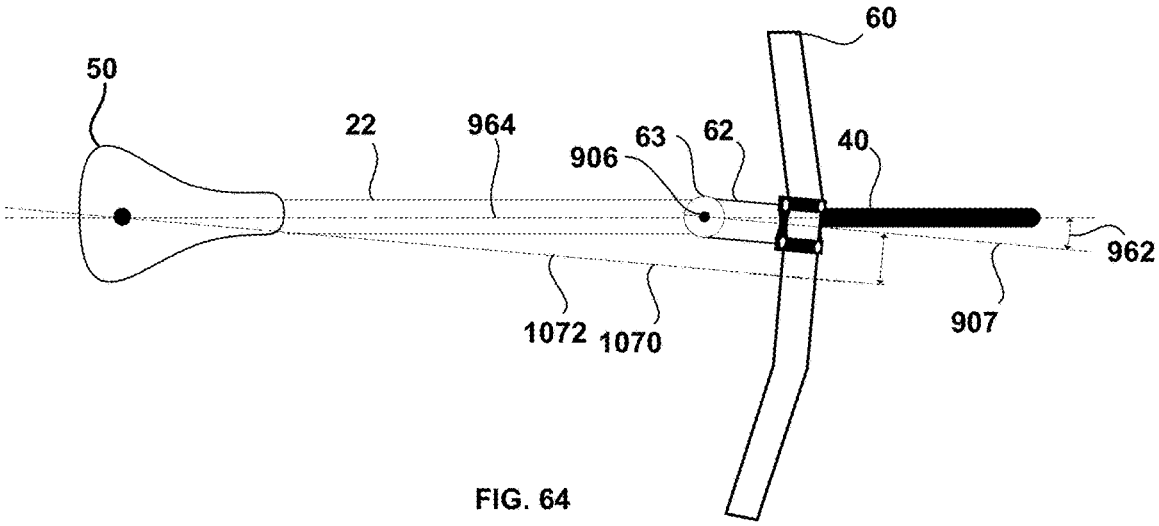
FIG. 64 is a partial top view of the bicycle apparatus of FIG. 63 with a rotated handlebar stem yielding a configuration according the bicycle apparatus of FIG. 61.

Referring now to FIGS. 62, 63 and 64 a technique of arranging a handlebar on a bicycle in the twisted intervention handlebar position is described. A conventional handlebar set-up is illustrated in FIG. 62 where handlebar stem axis 907 lies in mid-handlebar plane 1070. In FIG. 63 handlebar 60 is adjusted in the clamp of stem 62 such that there is offset 1200 between stem axis 907 and plane 1070. In FIG. 64 stem 62 is rotated about head-tube axis 906 until plane 1070 intersects top-tube plane 964 at the desired location satisfying the twisted intervention position criteria. This technique is limited by the maximum size of offset 1200, which is limited by finite portion of handle bar 60 that can securely engage the clamp of stem 62. It would be advantageous if this limitation were not present in some circumstances.

Figure 65:
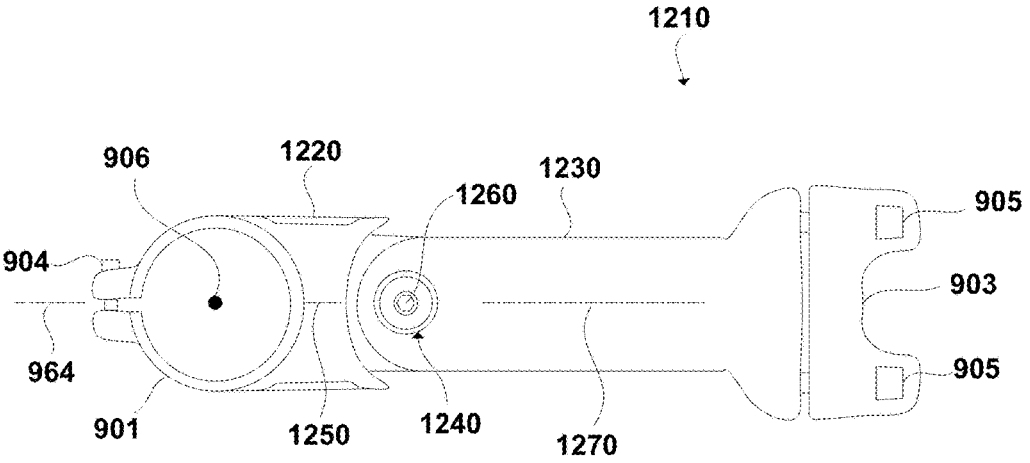
FIG. 65 is a top view of an adjustable handlebar stem according to another embodiment.
Figure 66:
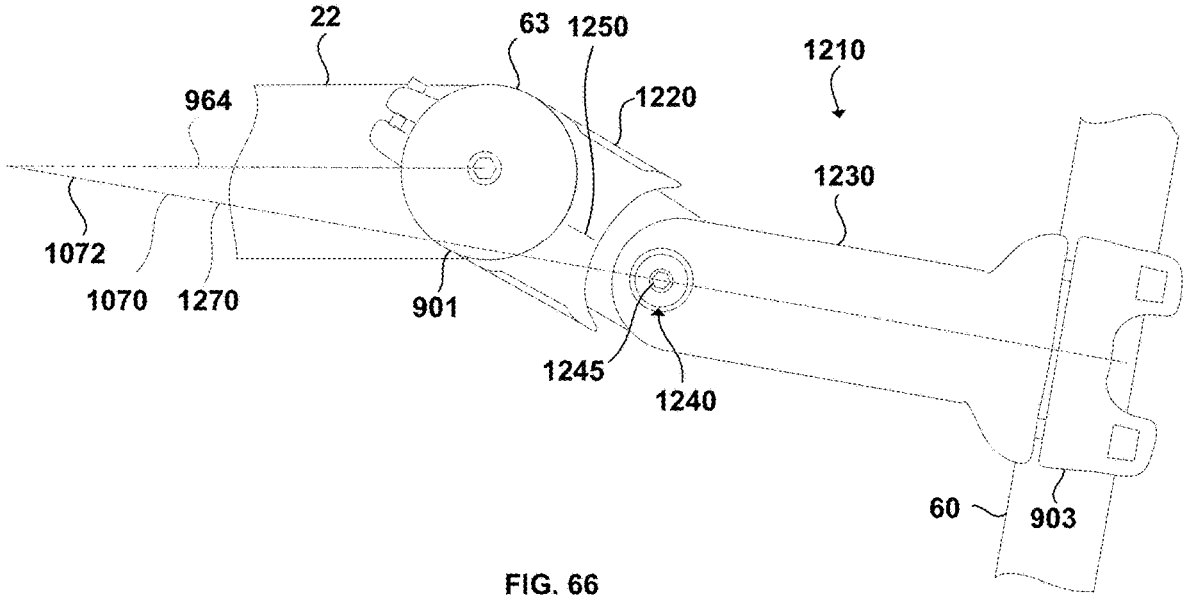
FIG. 66 is a partial top view of a bicycle apparatus with the adjustable handlebar stem of FIG. 64 configured with a handlebar in the position of the embodiment of FIG. 61.

Referring now to FIGS. 65 and 66 there is shown adjustable handlebar stem 1210 according to another embodiment that allows a handlebar to be configured in the twisted intervention handlebar position. Stem 1210 includes stem portions 1220 and 1230 connected at joint 1240. Joint 1240 allows transverse adjustment of adjustable handlebar stem 1210 (e.g. stem portion 1230) with respect to top-tube plane 964. When longitudinal axis 1250 of stem portion 1220 lies in top-tube plane 964, joint 1240 then also lies in the top-tube plane and allows stem portion 1230 to be adjusted about joint axis 1260. Fastener 1245 fixes joint 1240 such that the stem portions are secured in position relative to each other. As illustrated in FIG. 66, stem portion 1220 can be adjusted about head-tube axis 906 such that its longitudinal axis 1250 does not lie in top-tube plane 964 and stem portion 1230 can be adjusted about joint axis 1260 such that longitudinal axis 1270 of stem portion 1230 intersects top-tube plane 964 behind head tube 63. When longitudinal axis 1270 lies in mid-handlebar plane 1070 then the plane also intersects top-tube plane 964 behind head-tube 63.

Figure 67:
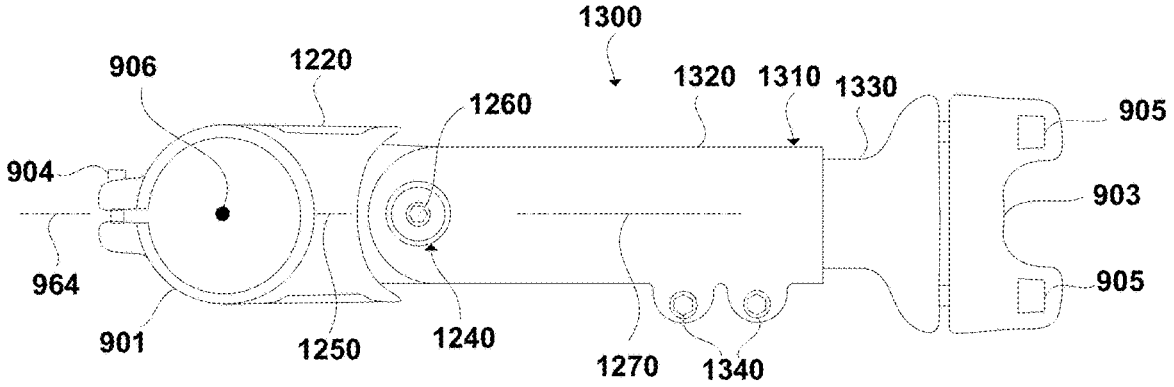
FIG. 67 is a top view of an adjustable handlebar stem according to another embodiment including a telescoping portion.
Figure 68:
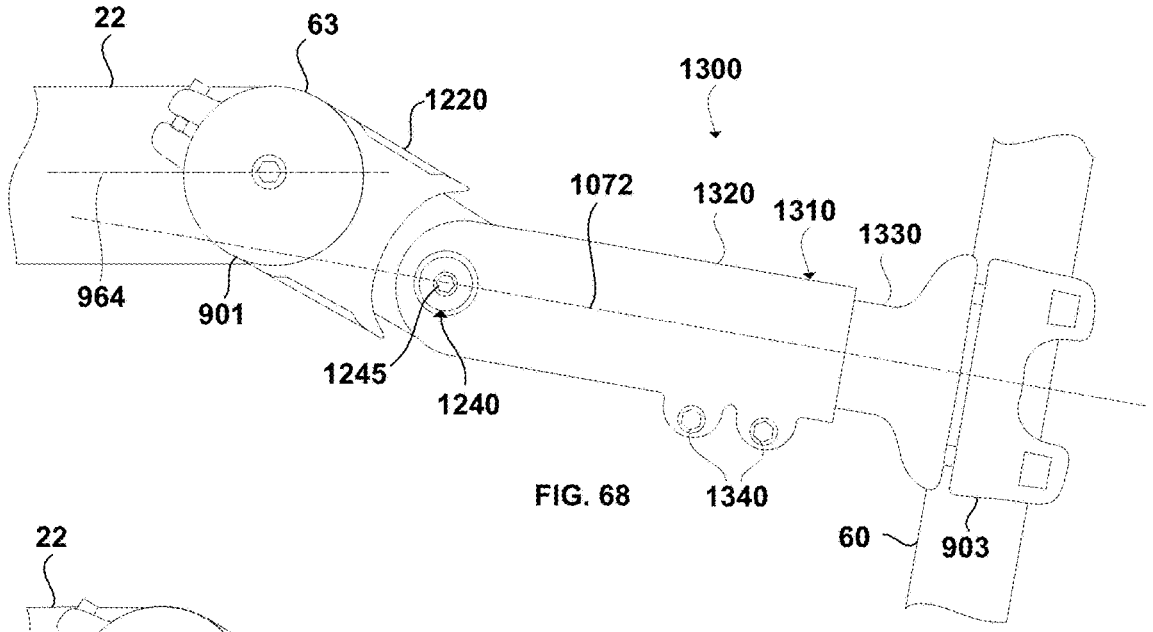
FIG. 68 is a partial top view of a bicycle apparatus with the adjustable handlebar stem of FIG. 67 with the telescoping portion in a first position configured with a handlebar in the position of the embodiment of FIG. 61.
Figure 69:
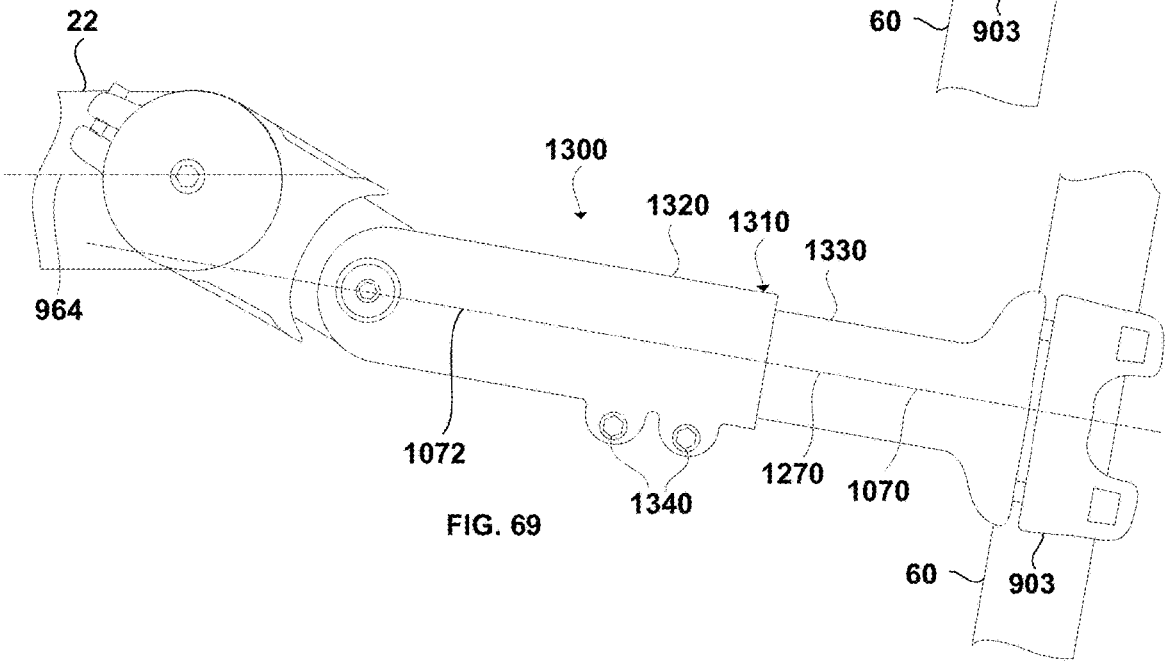
FIG. 69 is a partial top view of the bicycle apparatus of FIG. 68 with the telescoping portion in a second position.

Referring now to FIGS. 67, 68 and 69 there is shown adjustable handlebar stem 1300 according to another embodiment that is similar to the embodiment of FIGS. 65 and 66, and allows a handlebar to be configured in the twisted intervention handlebar position. Stem 1300 includes telescoping portion 1310 having stem portion 1320 and stem portion 1330. When fasteners 1340 are loosened, stem portion 1330 can move longitudinally along axis 1270 into or out of stem portion 1320, as well as rotate about axis 1270. This allows a greater degree of flexibility to find a beneficial riding position. When fasteners 1340 are tightened stem portion is fixed in place relative to stem portion 1320. Stem portion 1330 is illustrated in a first position in FIG. 68 and a second position in FIG. 69.

Figure 70:
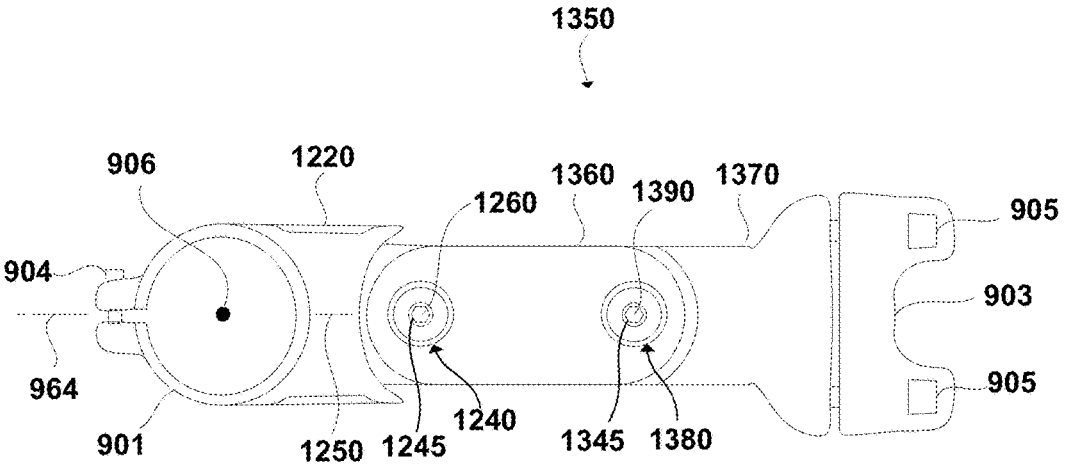
FIG. 70 is a top view of an adjustable handlebar stem according to another embodiment.
Figure 71:
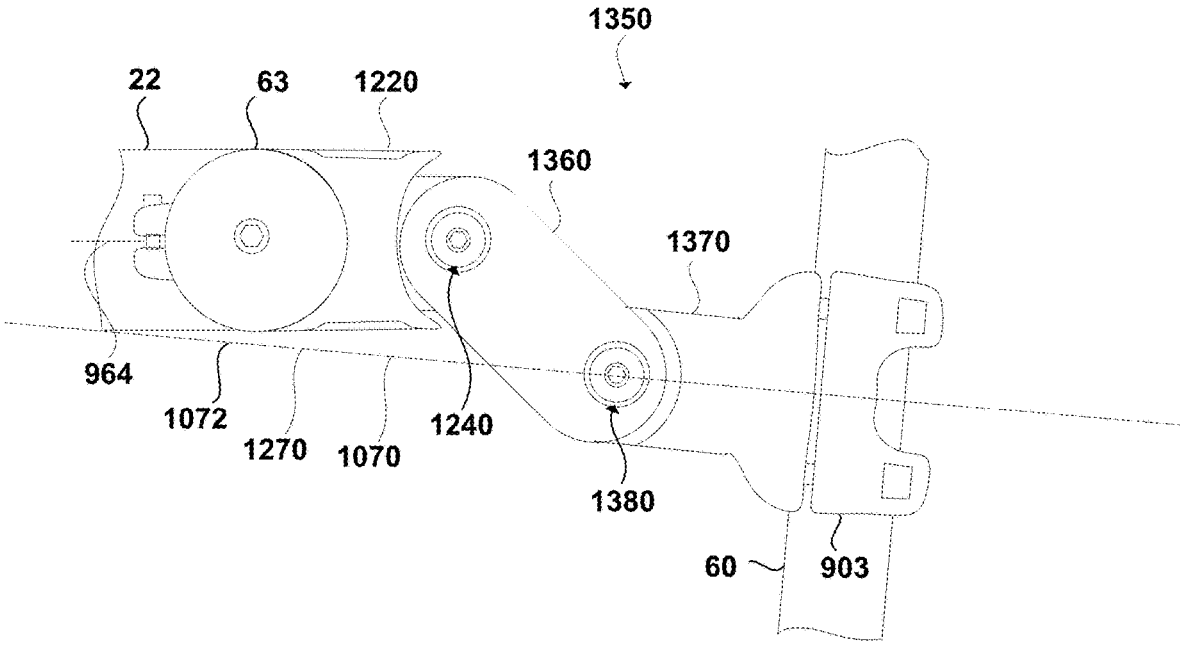
FIG. 71 is a partial top view of a bicycle apparatus with the adjustable handlebar stem of FIG. 70 configured with a handlebar in the position of the embodiment of FIG. 61.

Referring now to FIGS. 70 and 71 there is shown adjustable handlebar stem 1350 according to another embodiment that is similar to the embodiment of FIGS. 65 and 66, and allows a handlebar to be configured in the twisted intervention handlebar position. Stem 1350 includes stem portions 1360 that is adjustably connected with stem portion 1220 at joint 1240, and also adjustably connected with stem portion 1370 at joint 1380. Joint 1380 allows transverse adjustment of adjustable handlebar stem 1210 (e.g. stem portion 1370) with respect to top-tube plane 964. Joint 1380 allows stem portion 1370 to be rotated about joint axis 1390. Fasteners 1245 and 1345 secure joints 1240 and 1380 respectively such that stem portion 1360 is secured to stem portions 1220 and 1370.

Figure 72:
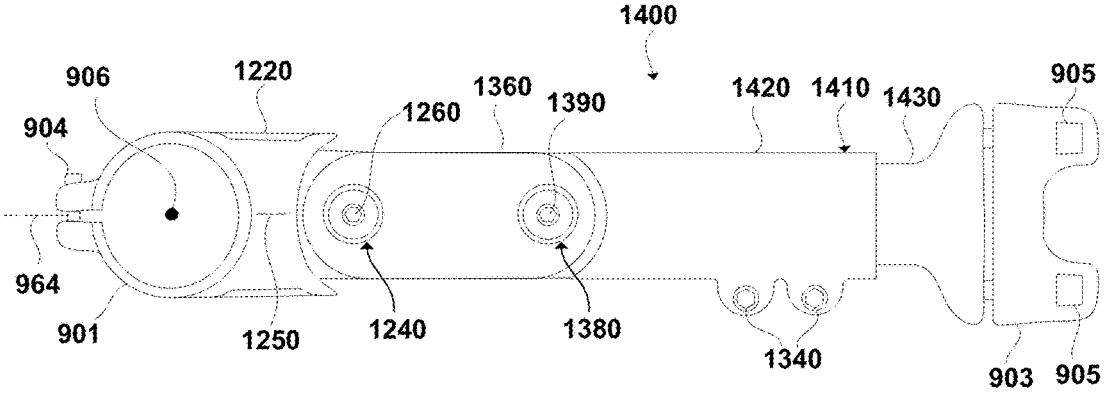
FIG. 72 is a top view of an adjustable handlebar stem according to another embodiment including a telescoping portion.
Figure 73:
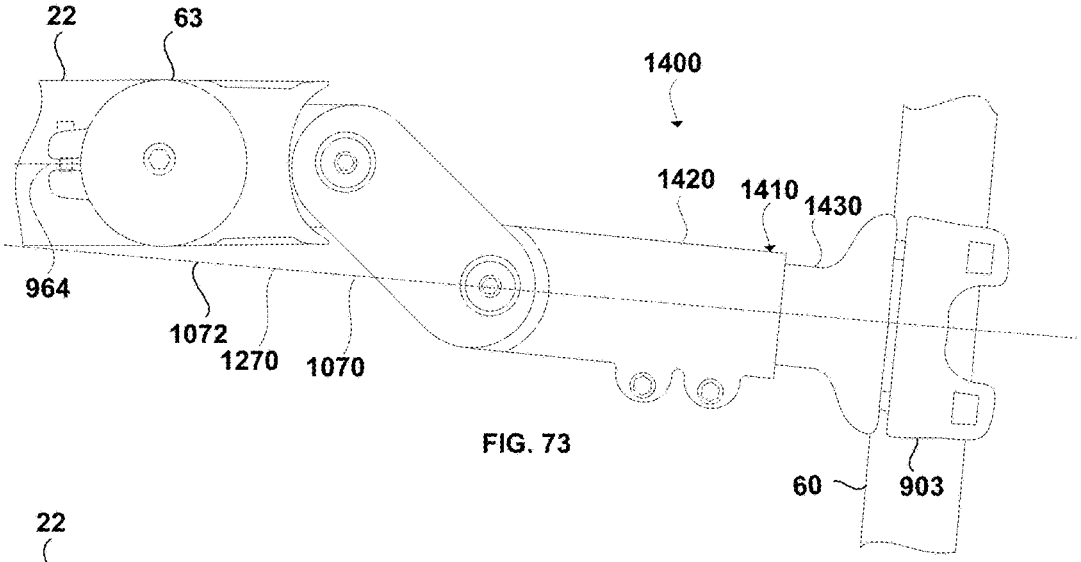
FIG. 73 is a partial top view of a bicycle apparatus with the adjustable handlebar stem of FIG. 74 with the telescoping portion in a first position configured with a handlebar in the position of the embodiment of FIG. 61.
Figure 74:
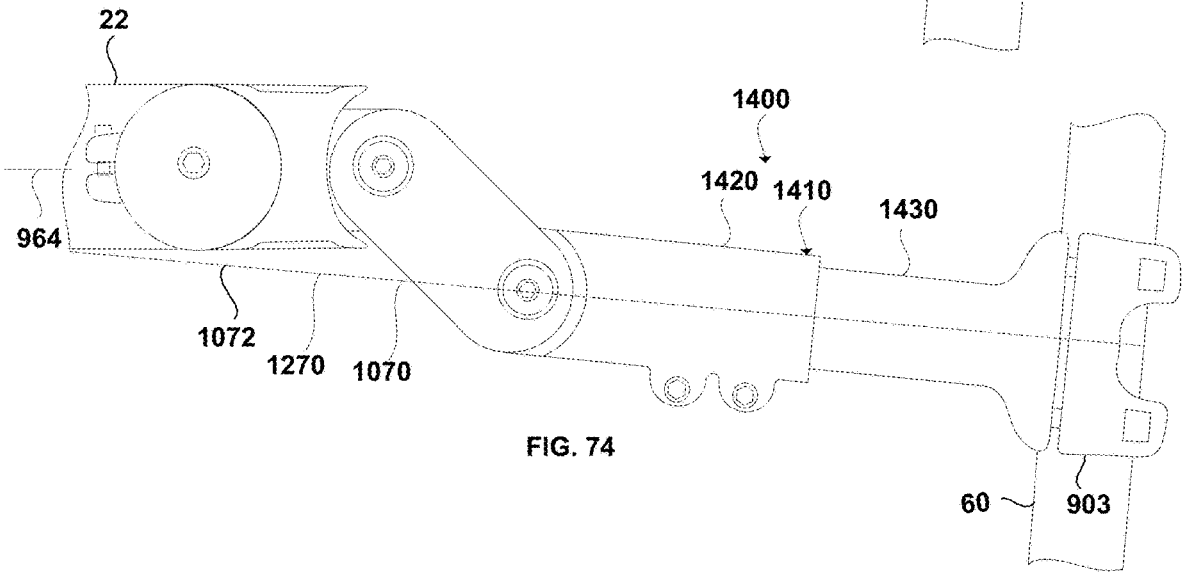
FIG. 74 is a partial top view of the bicycle apparatus of FIG. 73 with the telescoping portion in a second position.

Referring now to FIGS. 72, 73 and 74 there is shown adjustable handlebar stem 1400 according to another embodiment that is similar to the embodiments of FIGS. 67 and 70, and allows a handlebar to be configured in the twisted intervention handlebar position. Stem 1400 includes telescoping portion 1410 having stem portion 1420 and stem portion 1430. Telescoping portion functions in a similar manner to telescoping portion 1310 of FIG. 67.

Figure 75:
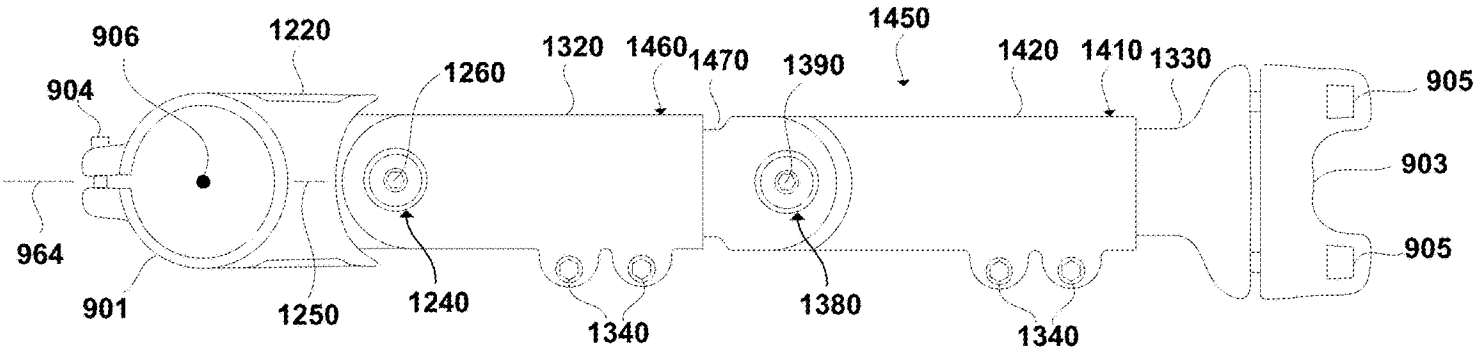
FIG. 75 is a top view of an adjustable handlebar stem according to another embodiment including two telescoping portions in first positions.
Figure 76:
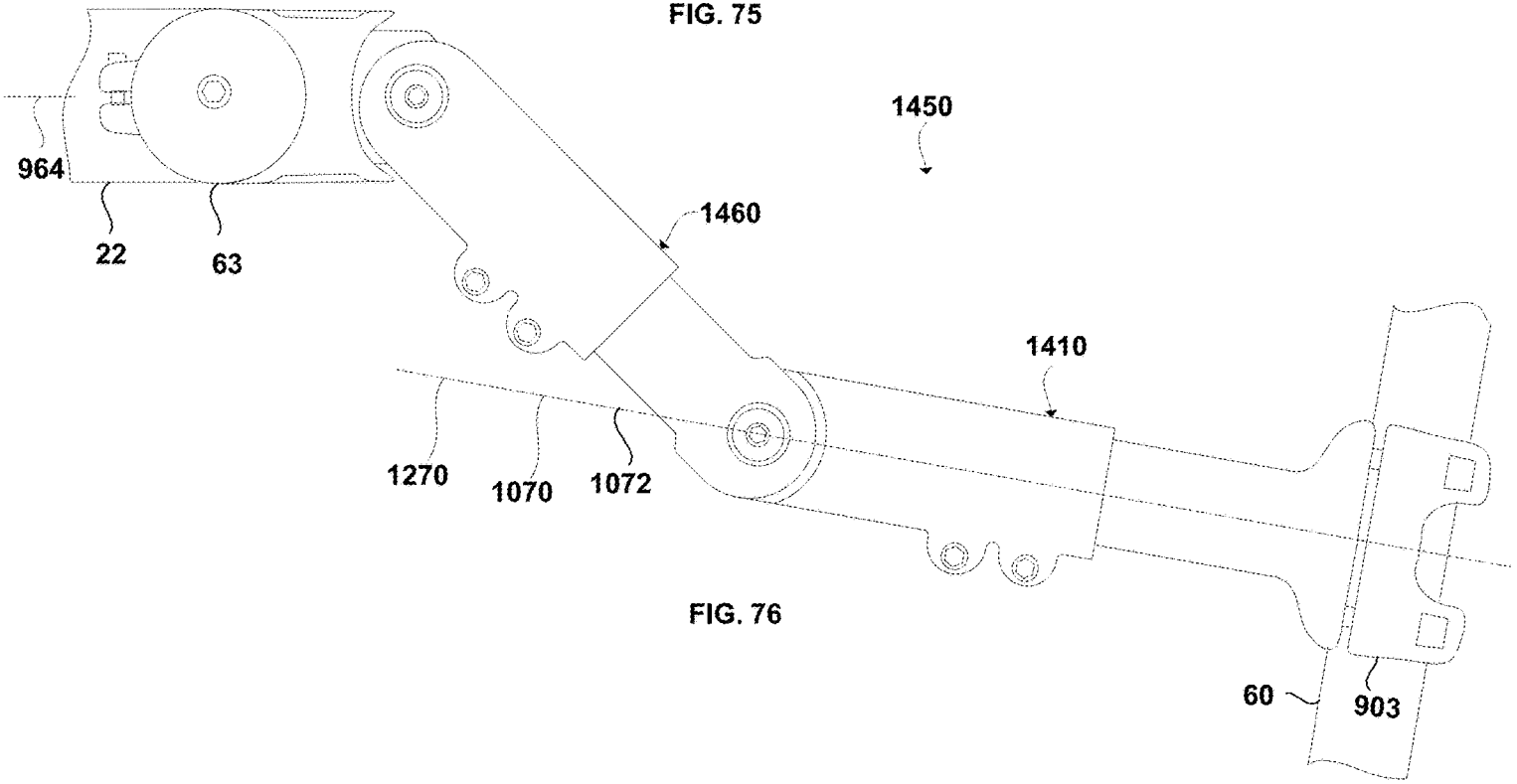
FIG. 76 is a partial top view of a bicycle apparatus with the adjustable handlebar stem of FIG. 75 with the telescoping portions in second positions configured with a handlebar in the position of the embodiment of FIG. 61.

Referring now to FIGS. 75 and 76 there is shown adjustable handlebar stem 1450 according to another embodiment that is similar to the embodiments of FIGS. 67 and 70, and allows a handlebar to be configured in the twisted intervention handlebar position. Stem 1450 includes telescoping portion 1410 like FIG. 70, and telescoping portion 1460 having stem portions 1320 and 1470. Telescoping portions 1460 functions in a similar manner to telescoping portion 1310 of FIG. 67.

Figure 77:
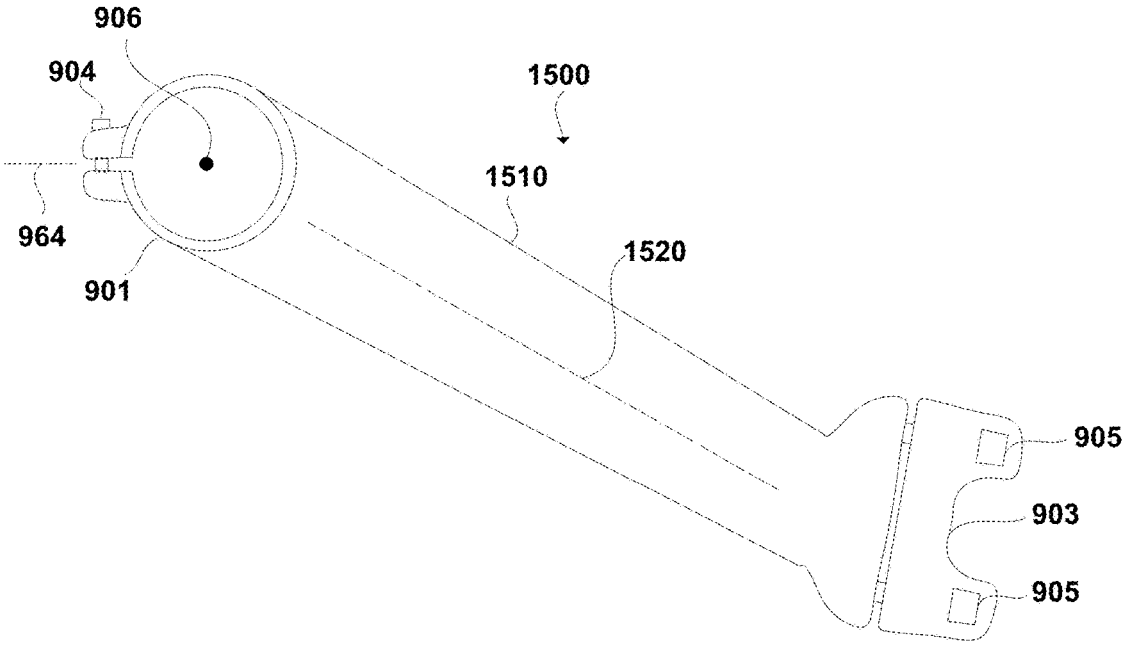
FIG. 77 is a top view of a handlebar stem according to another embodiment.
Figure 78:
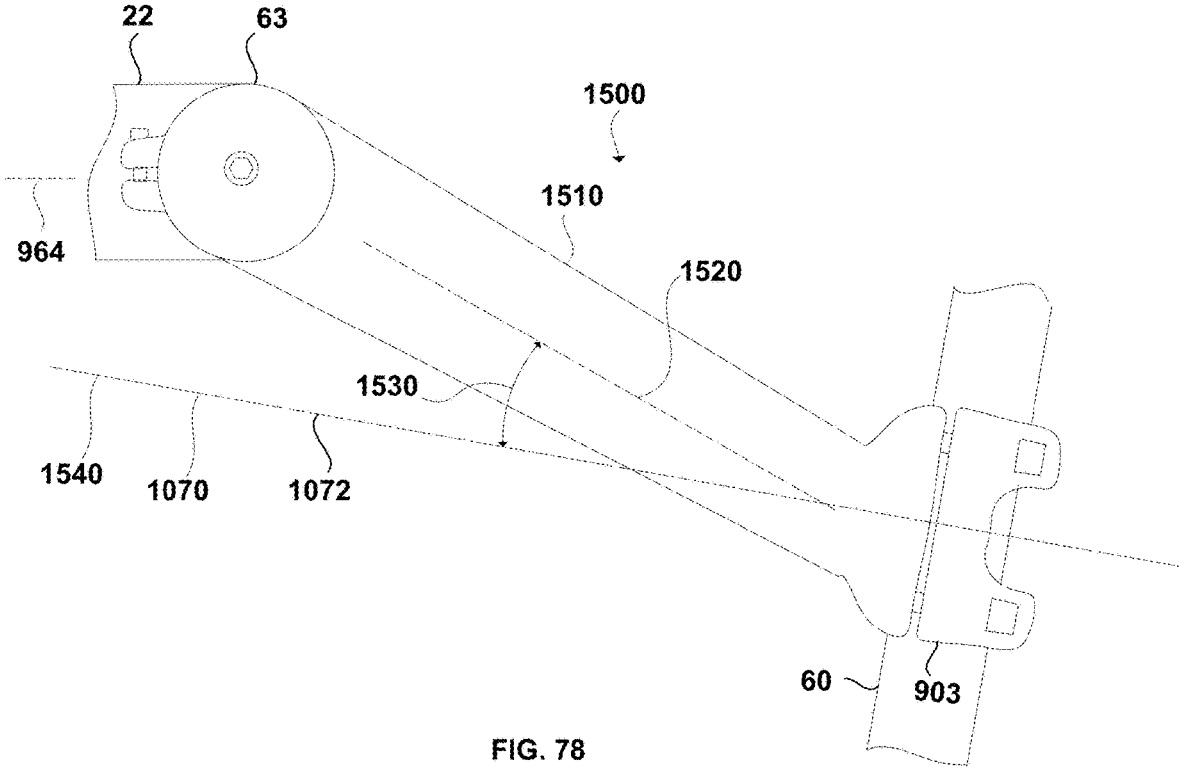
FIG. 78 is a partial top view of a bicycle apparatus with the handlebar stem of FIG. 77 with a handlebar in the position of the embodiment of FIG. 61.
Figure 79:
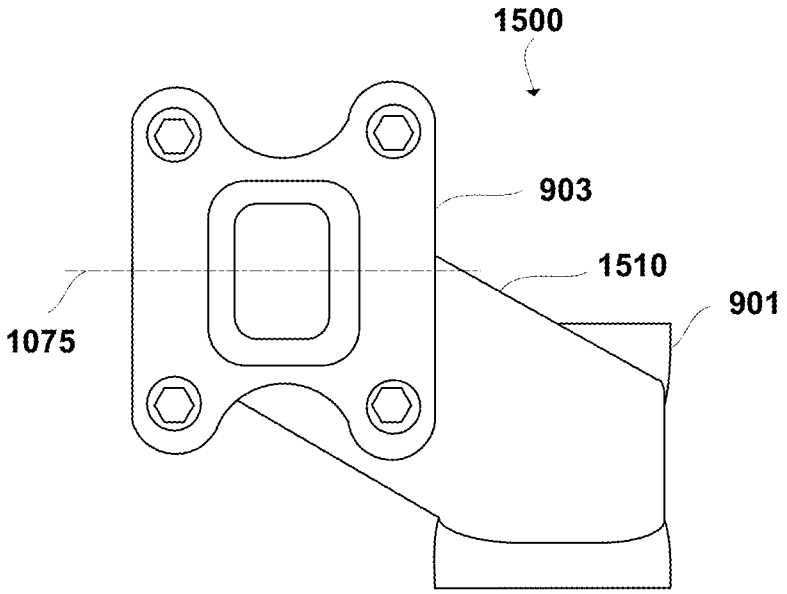
FIG. 79 is an elevational front view of the handlebar stem of FIG. 77.
Figure 80:
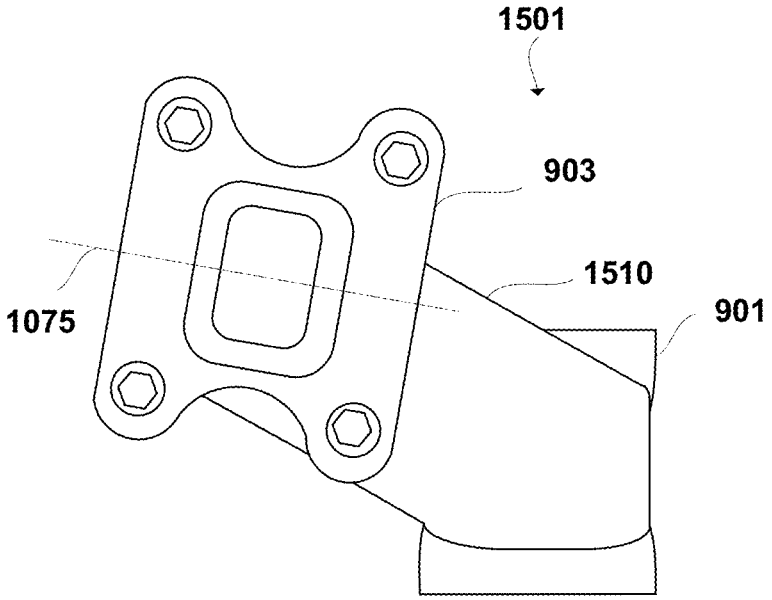
FIG. 80 is an elevational front view of an alternative embodiment of the handlebar stem of FIG. 77.

Referring now to FIGS. 77 and 78 there is shown handlebar stem 1500 according to another embodiment that allows a handlebar to be configured in the twisted intervention handlebar position. Stem 1500 includes stem portion 1510 that is fixed in position relative to head-tube portion 901 and clamping portion 903. Angle 1530 between longitudinal axis 1520 of stem portion 1510 and central axis 1540 of clamping portion 903 is greater than zero. Central axis 1540 lies in mid-handlebar plane 1070 such that plane 1070 intersects top-tube plane 964 behind head-tube 63. The lugs of fasteners 904 can be arranged symmetrically about longitudinal axis 1520. Stem angle 908 (seen in FIG. 25) can be a variety of angles, for example between 75 degrees and −75 degrees. With reference to FIG. 79, there is shown an elevational front view of stem 1500. Handlebar axis 1075 through clamping portion 903 is parallel to the ground (horizontal). With reference to FIG. 80, in an alternative embodiment, handlebar axis 1075 through clamping portion 903 of handlebar stem 1501 forms an acute angle with the ground (horizontal), that is it is not parallel the ground, such that when a handlebar is installed one grip of the handlebar will be elevated compared to the opposite grip.

Figure 81:
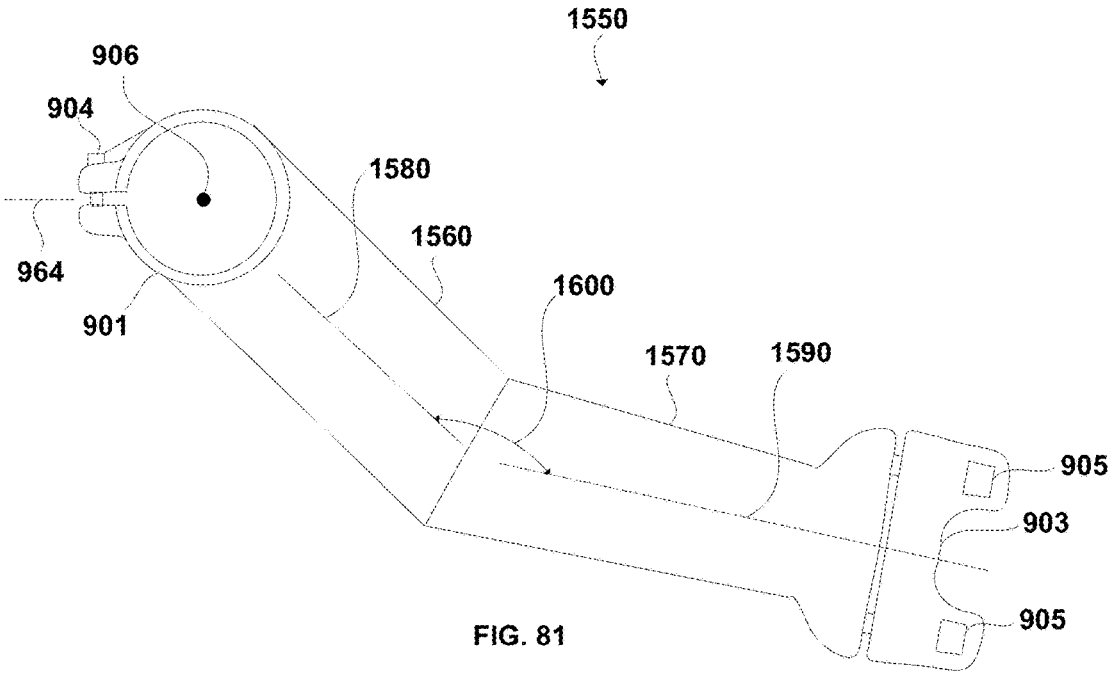
FIG. 81 is a top view of a handlebar stem according to another embodiment.
Figure 82:
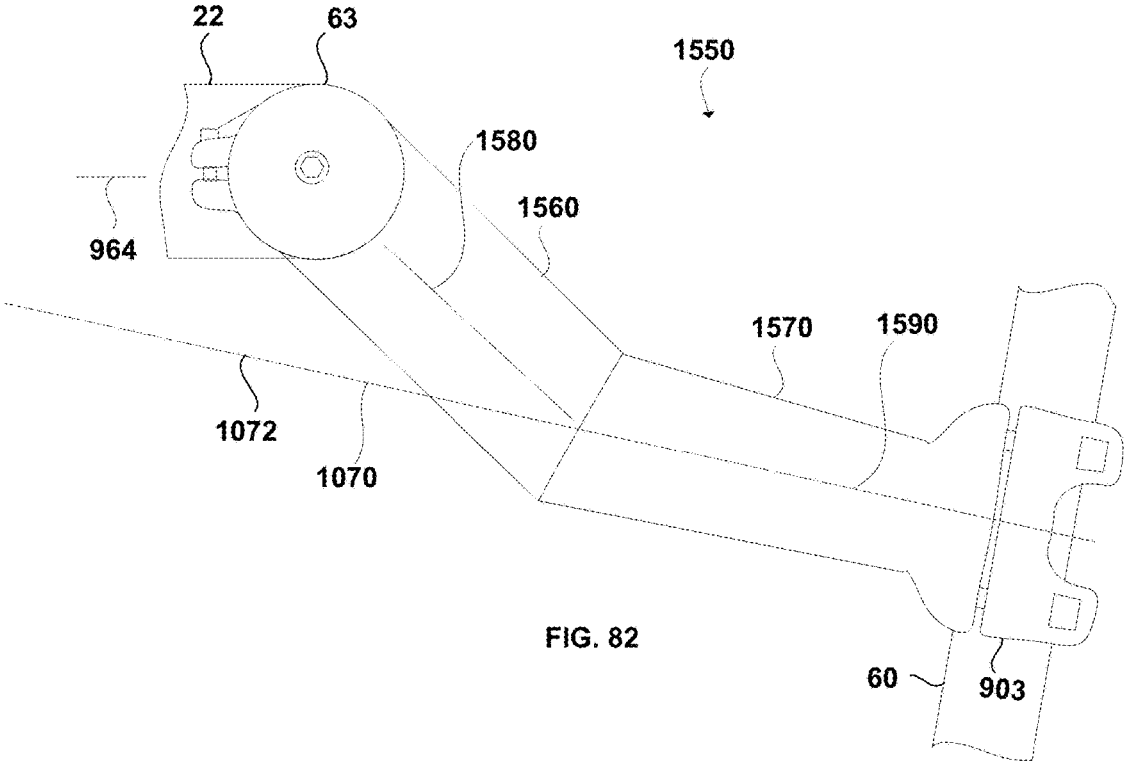
FIG. 82 is a partial top view of a bicycle apparatus with the handlebar stem of FIG. 81 with a handlebar in the position of the embodiment of FIG. 61.

Referring now to FIGS. 81 and 82 there is shown handlebar stem 1550 according to another embodiment that is similar to the embodiment of FIGS. 77 and 78, and allows a handlebar to be configured in the twisted intervention handlebar position. Stem 1550 includes stem portions 1560 and 1570 that are fixed relative to head-tube portion 901 and clamping portion 903 respectively, and with respect to each other. Angle 1600 between longitudinal axis 1580 of stem portion 1560 and longitudinal axis 1590 of stem portion 1570 is fixed and greater than zero. Longitudinal axis 1590 lies in mid-handlebar plane 1070 such that plane 1070 intersects top-tube plane 964 behind head-tube 63.

Figure 83:
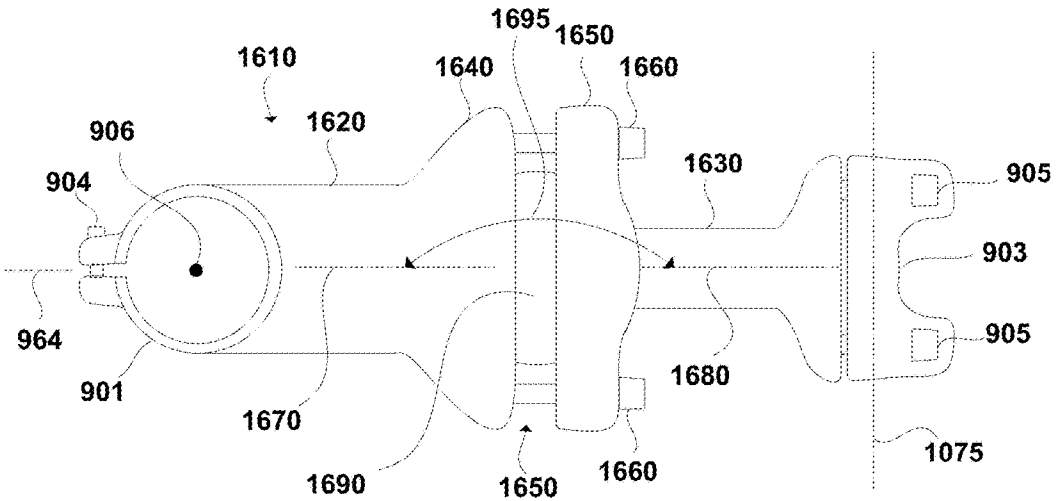
FIG. 83 is a top view of an adjustable handlebar stem according to another embodiment.
Figure 85:
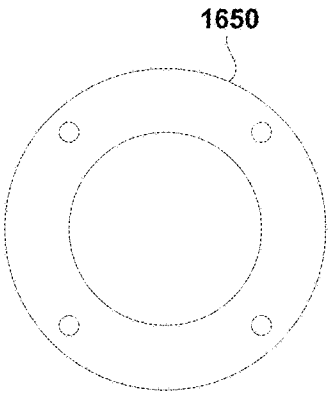
FIG. 85 is an elevational view of a fastening portion of the handlebar stem of FIG. 83.
Figure 86:
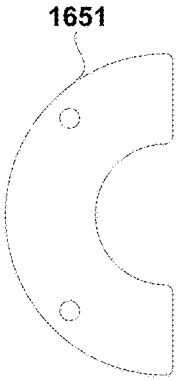
FIG. 86 is a elevational view of a fastening portion of the handlebar stem of FIG. 83.
Figure 84:
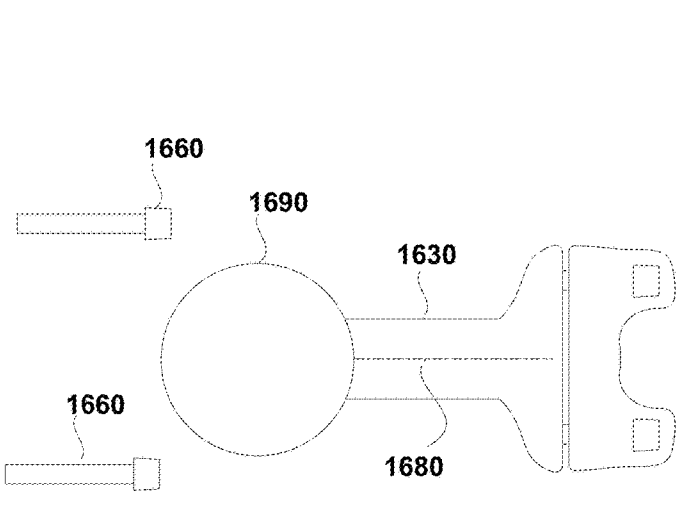
FIG. 84 is an exploded view of the adjustable handlebar stem of FIG. 83.
Figures 83, 87:
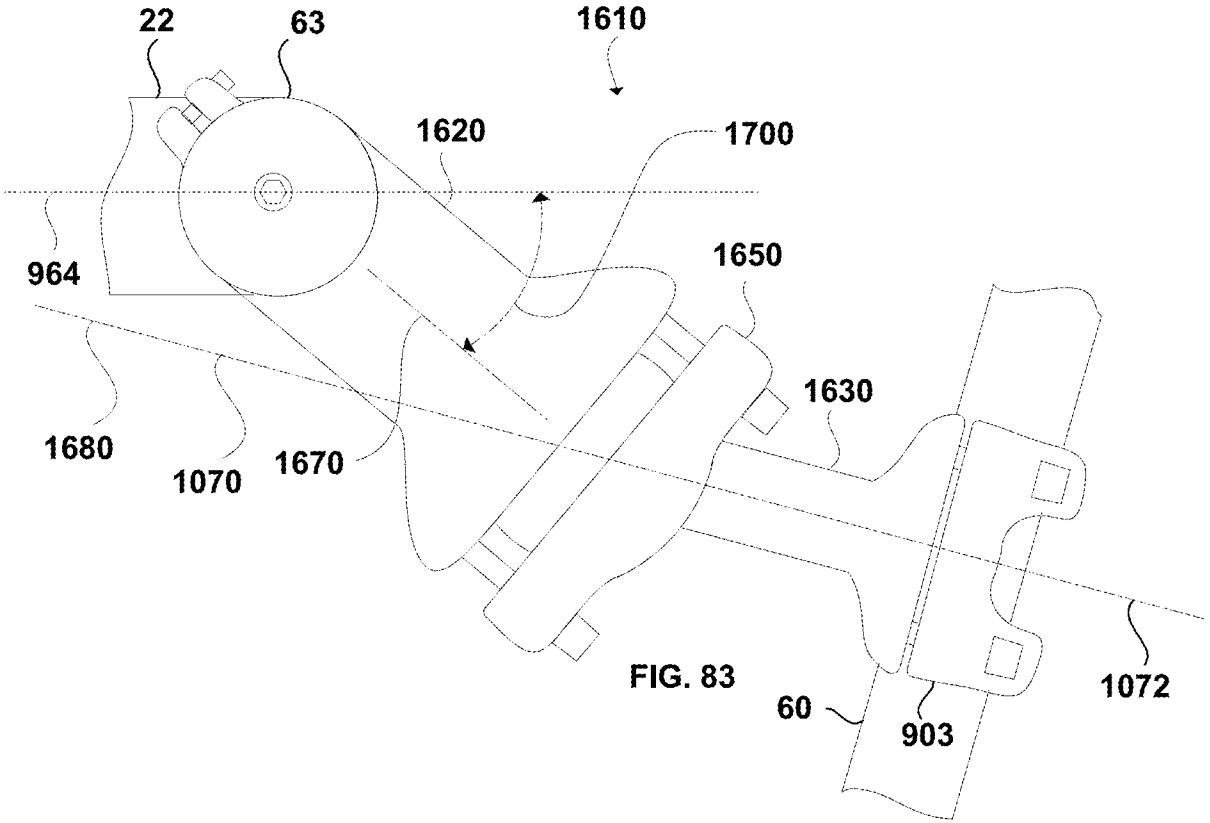
FIG. 87 is a partial top view of a bicycle apparatus with the adjustable handlebar stem of FIG. 83 with a handlebar in the position of the embodiment of FIG. 61.
Figure 87:
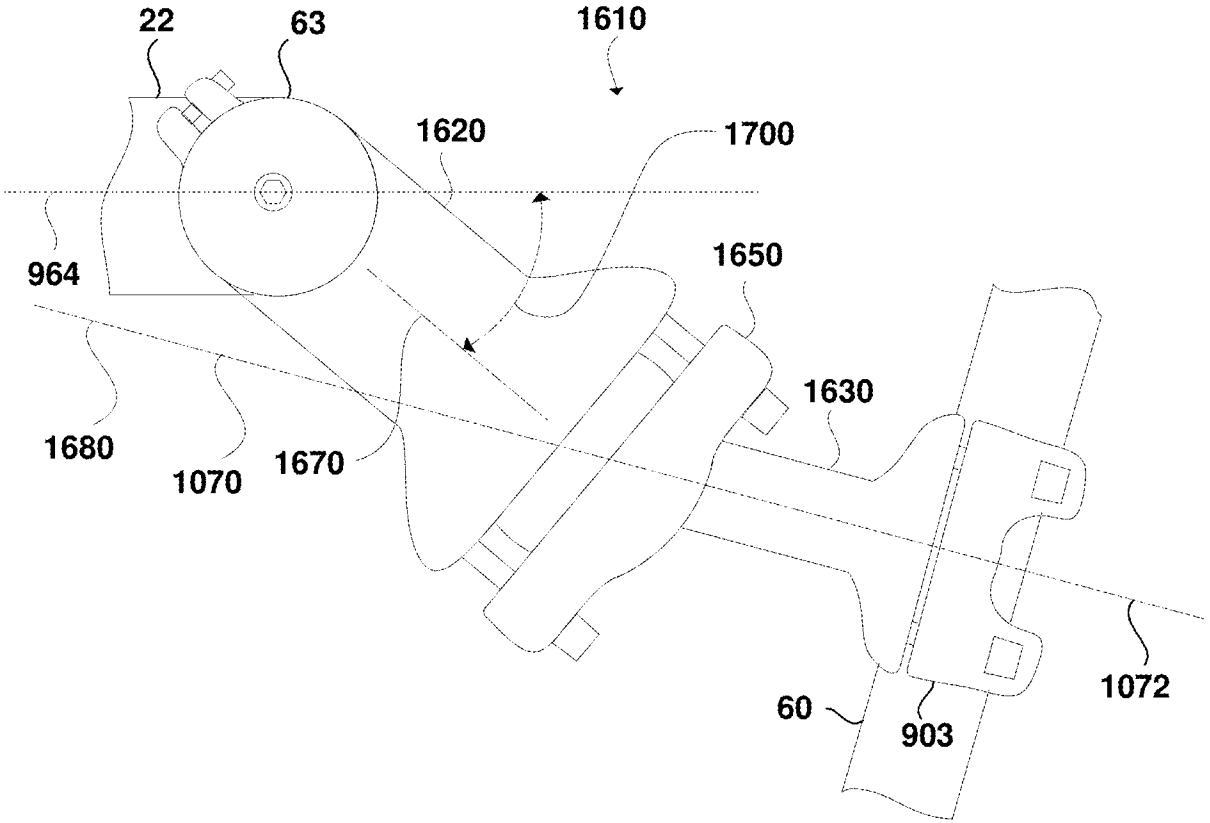
Figure 88:
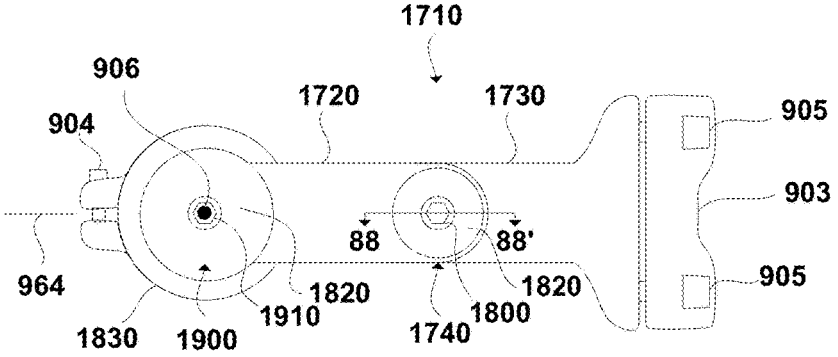
FIG. 88 is a top view of an adjustable handlebar stem according to another embodiment.
Figure 89:
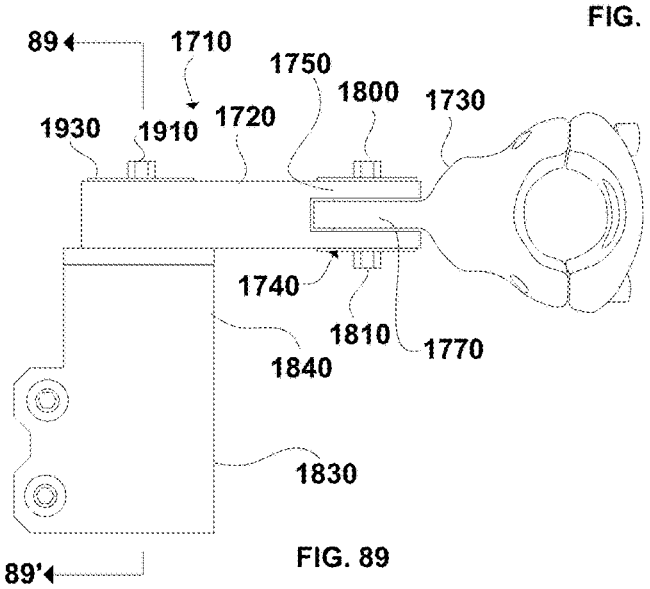
FIG. 89 is a side elevational view of the adjustable handlebar stem of FIG. 88.
Figure 90:
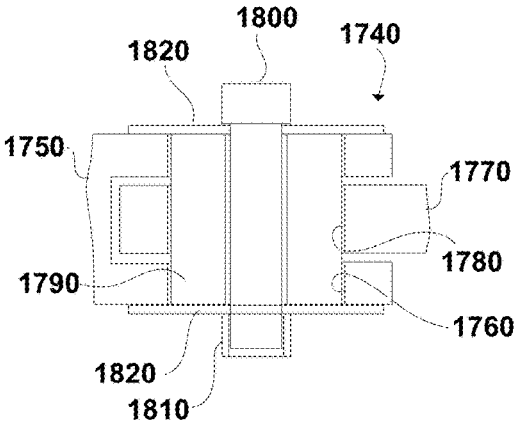
FIG. 90 is a cross-sectional detailed view of an adjustable and securable joint taken at line 88-88' of FIG. 88.

Referring now to FIGS. 83 and 84 there is shown adjustable handlebar stem 1610 according to another embodiment that allows a handlebar to be configured in the twisted intervention handlebar position. Stem 1610 includes universal joint 1615 having stem portion 1620 and stem portion 1630. Universal joint 1615 allows transverse and longitudinal adjustments of stem portion 1630 relative to top-tube plane 964. Stem portion 1620 includes concave portion 1640 at an end opposite head-tube portion 901. Stem portion 1630 includes spherical portion 1690 at an end opposite clamping portion 903. Spherical portion 1690 engages concave portion 1640 and is secured thereto when fasteners 1660 are tightened thereby pressing fastening portion 1650 against the spherical portion into the concave portion. Angle 1695 between longitudinal axis 1670 of stem portion 1620 and longitudinal axis 1680 of stem portion 1630 can be equal to and less than 180 degrees by adjusting stem portion 1630 relative to stem portion 1620. This is due to the nature of the spherical relationship between spherical portion 1650 and concave portion 1640. Additionally, the angle between handlebar axis 1075 and the horizontal (ground) can be adjusted by adjusting stem portion 1630 relative to stem portion 1620. With reference to FIG. 85, fastening portion 1650 is illustrated with a disc shape. With reference to FIG. 86, fastening portion 1651 can alternatively be a half disc to allow increased freedom of movement of stem portion 1630 relative to stem portion 1620. Referring now to FIG. 87, angle 1700 between longitudinal axis 1670 of stem portion 1620 and top-tube plane 964 can be greater than and less than zero (i.e. the magnitude of angle 1700 is greater than zero), and stem portion 1630 is adjusted such that longitudinal axis 1680 of stem portion 1630 and mid-handlebar plane 1070 form a desired angle with top-tube plane 964 that meets the criteria of the twisted intervention handlebar position.

Figure 92:
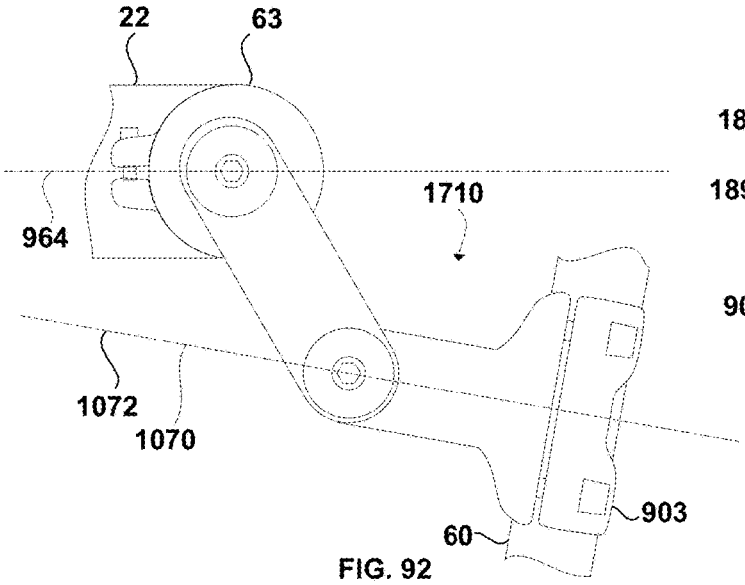
FIG. 92 is a partial top view of a bicycle apparatus with the adjustable handlebar stem of FIG. 88 with a handlebar in the position of the embodiment of FIG. 61.
Figure 91:
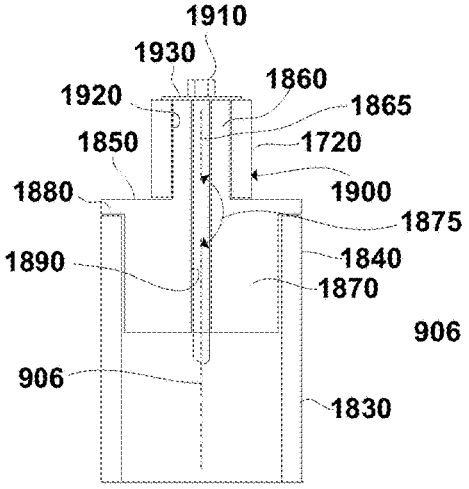
FIG. 91 is a cross-sectional detailed view of an adjustable and securable joint taken at line 89-89' of FIG. 89.

Referring now to FIGS. 88, 89, 90, 91 and 92 there is shown adjustable handlebar stem 1710 according to another embodiment that allows a handlebar to be configured in the twisted intervention handlebar position. Stem 1710 includes elongate stem portions 1720 and 1730 adjustably and securably connected with each other at joint 1740. Joint 1740 is a fork-type joint in the illustrated embodiment, also known as a clevis joint or clevis fastener, that allows transverse adjustment of stem portion 1730 with respect to top-tube plane 964. Stem portion 1720 includes fork portion 1750 having bore 1760. Stem portion 1730 includes pin portion 1770 having bore 1780. Pin portion 1770 mutually engages fork portion 1750 such that tubular bearing 1790 extends through bores 1760 and 1780. Joint 1740 is secured by tightening fastener 1800 with nut 1810 to compress washers 1820 towards each other thereby compressing fork portion 1750 onto pin portion 1770. Stem portions 1720 and 1730 are rotatable about bearing 1790 when fastener 1800 is loosened. In other embodiments bearing 1790 is not required and instead fastener 1800, or the like, can operate as a bearing. However, having a bearing with a larger diameter compared to fastener 1800 improves the stability of stem 1710 when joint 1740 is in a loosened state. Head-tube portion 1830 is similar to head-tube portion 901 (seen in FIG. 34) and additionally includes an upper portion 1840. Bearing cap 1850 includes tubular bearing portion 1860, tubular support 1870 and flange portion 1880. Bore 1890 extends through bearing cap 1850. Upper portion 1840 is mutually engageable with tubular support 1870. Stem portion 1720 is adjustably and securably connected with bearing cap 1850 at joint 1900 that is secured by fastener 1910. Stem portion 1720 includes bore 1920 that is rotatable about bearing portion 1860 when fastener 1910 is loosened. Fastener 1910 engages a threaded bore in the steering tube (not shown) of a bicycle and when tightened compresses washer 1930 onto stem portion 1720 and bearing portion 1860. Longitudinal axis 1865 of bearing portion 1860 is illustrated as co-axial with head-tube axis 906; however, in other embodiments axes 1865 and 906 do not need to be coaxial and angle 1875 between axis 1865 and 906 can be less than 180 degrees. Note that both joints 1740 and 1900 may have textured surfaces to reduce the likelihood of rotation when in a secured state. In operation, as seen in FIG. 92, stem portion 1720 can be rotated about joint 1900 and stem portion 1730 can be rotated about joint 1740 such that mid-handlebar plane 1070 intersects top-tube plane 964 behind head-tube 63.

Figure 93:
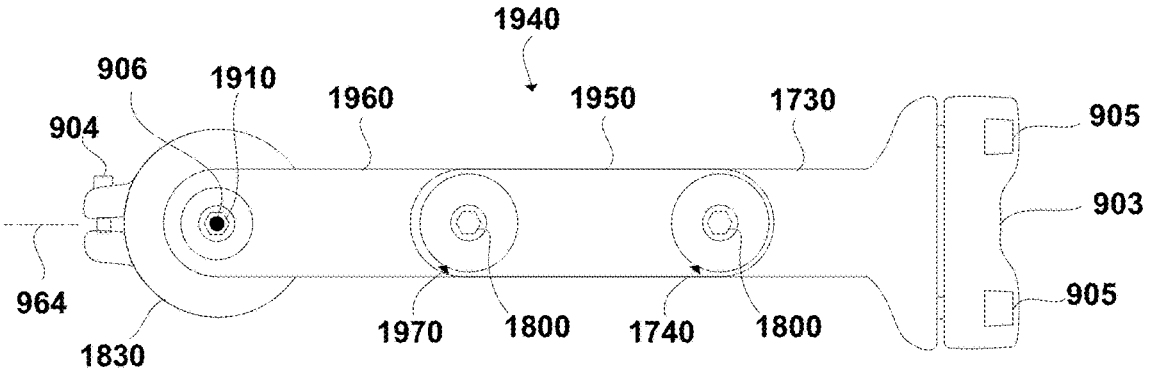
FIG. 93 is a top view of an adjustable handlebar stem according to another embodiment.
Figure 94:
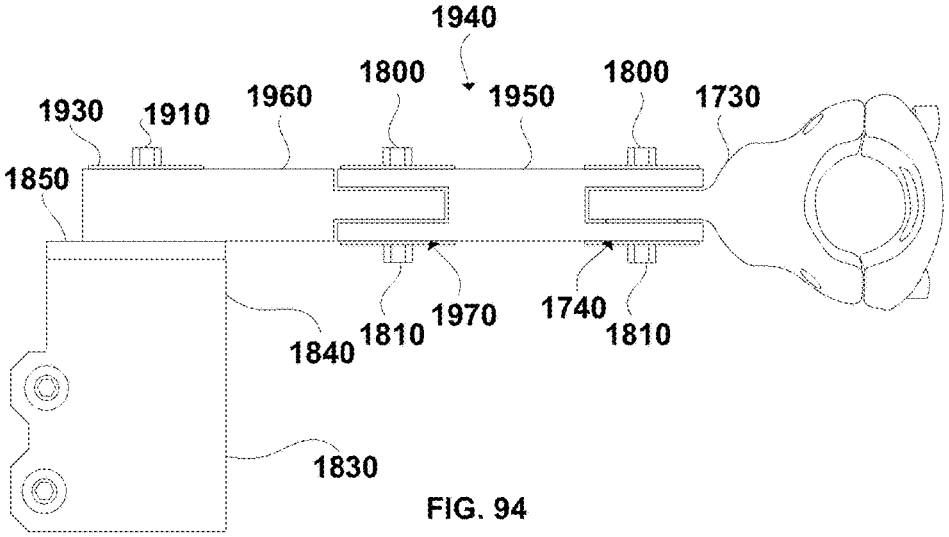
FIG. 94 is a side elevational view of the adjustable handlebar stem of FIG. 93.
Figure 95:
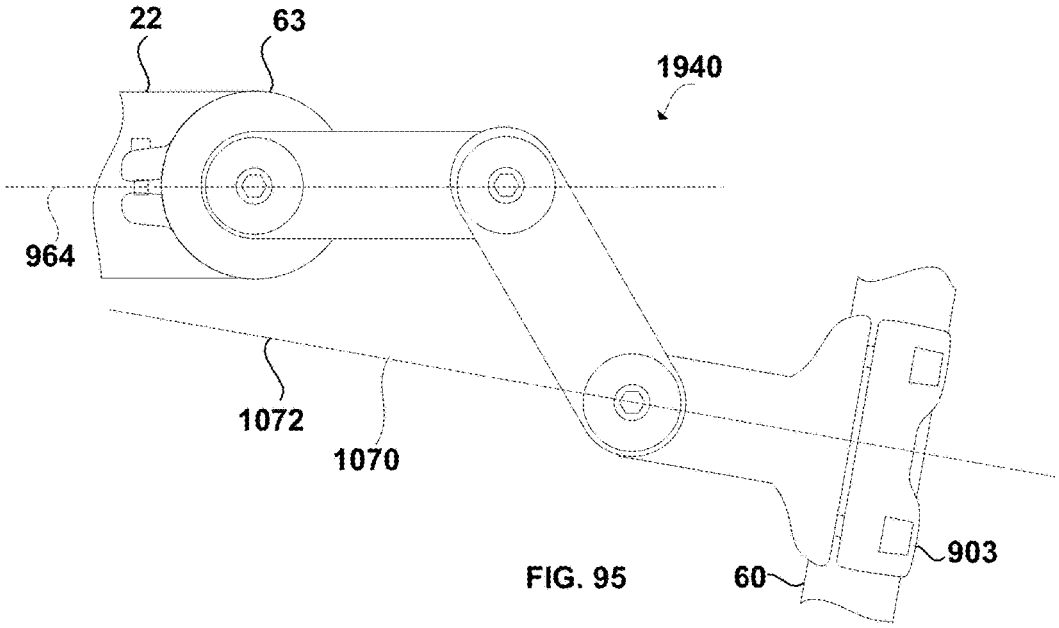
FIG. 95 is a partial top view of a bicycle apparatus with the adjustable handlebar stem of FIG. 93 with a handlebar in the position of the embodiment of FIG. 61.

Referring now to FIGS. 93, 94 and 95 there is shown adjustable handlebar stem 1940 according to another embodiment that allows a handlebar to be configured in the twisted intervention handlebar position. Stem 1940 is similar to stem 1710 in FIG. 88 and only the differences are discussed. Stem 1940 includes stem portions 1730, 1950 and 1960. Stem portions 1730 and 1950 are adjustably and securably connected at joint 1740 that allows transverse adjustments with respect to top tube plane 964. Stem portions 1950 and 1960 are adjustably and securably connected at joint 1970, which is like joint 1740, allowing transverse adjustments with respect to top-tube plane 964. Stem portion 1960 can be secured to bearing cap 1850 in either a rotatable (like joint 1900) or a non-rotatable manner (where portion 1960 and bearing cap 1850 can be an integrated component).

Figure 96:
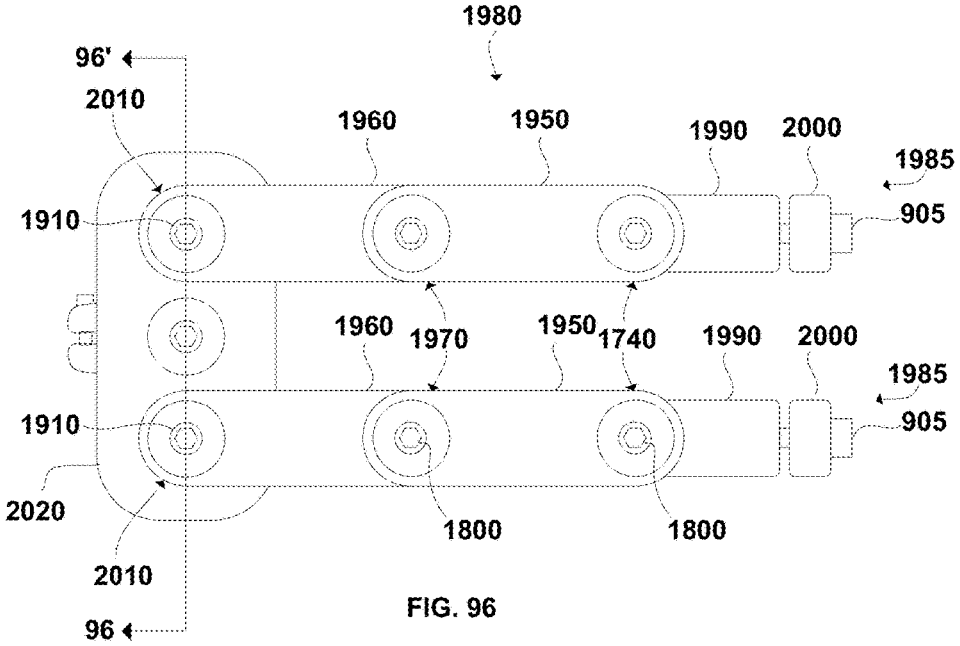
FIG. 96 is a top view of an adjustable handlebar stem according to another embodiment.
Figure 97A:
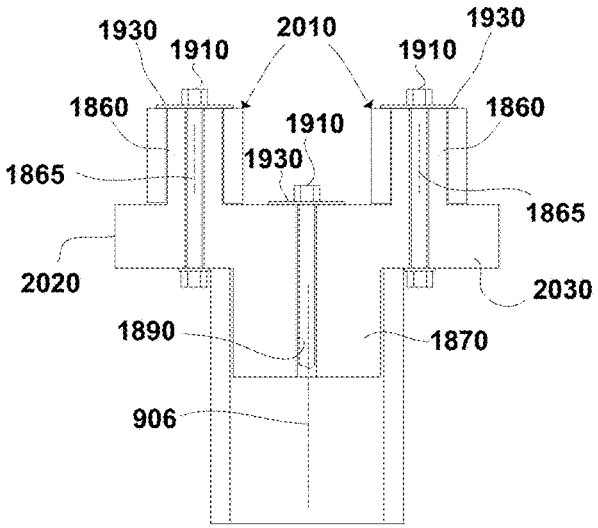
FIG. 97*a* is a cross-sectional elevational view of the adjustable handlebar stem of FIG. 96 taken at line 96-96'.
Figure 97B:
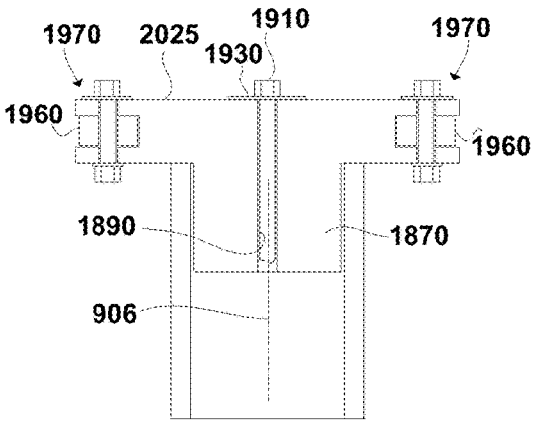
FIG. 97*b* is a cross-sectional elevational view of the adjustable handlebar stem of FIG. 96 taken at line 96-96'.
Figure 98A:
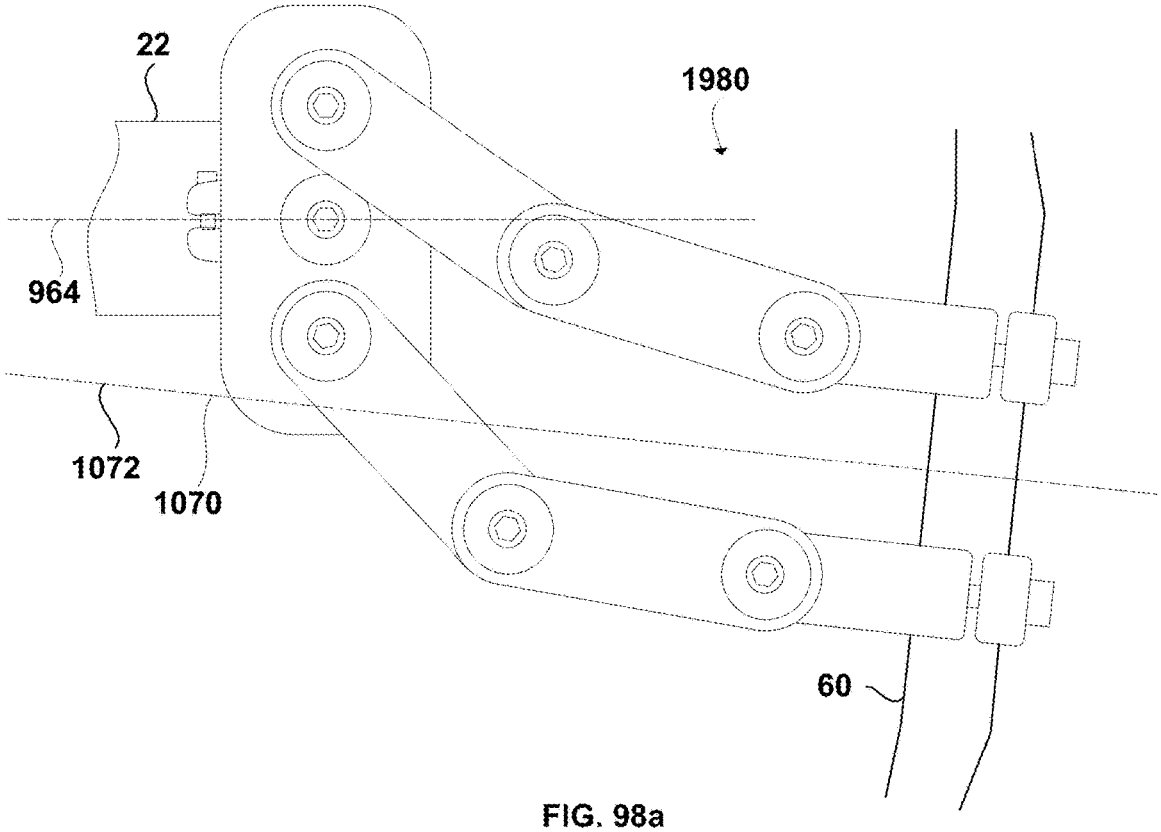
FIG. 98*a* is a partial top view of a bicycle apparatus with the adjustable handlebar stem of FIG. 96 with a handlebar in the position of the embodiment of FIG. 61.
Figure 98B:
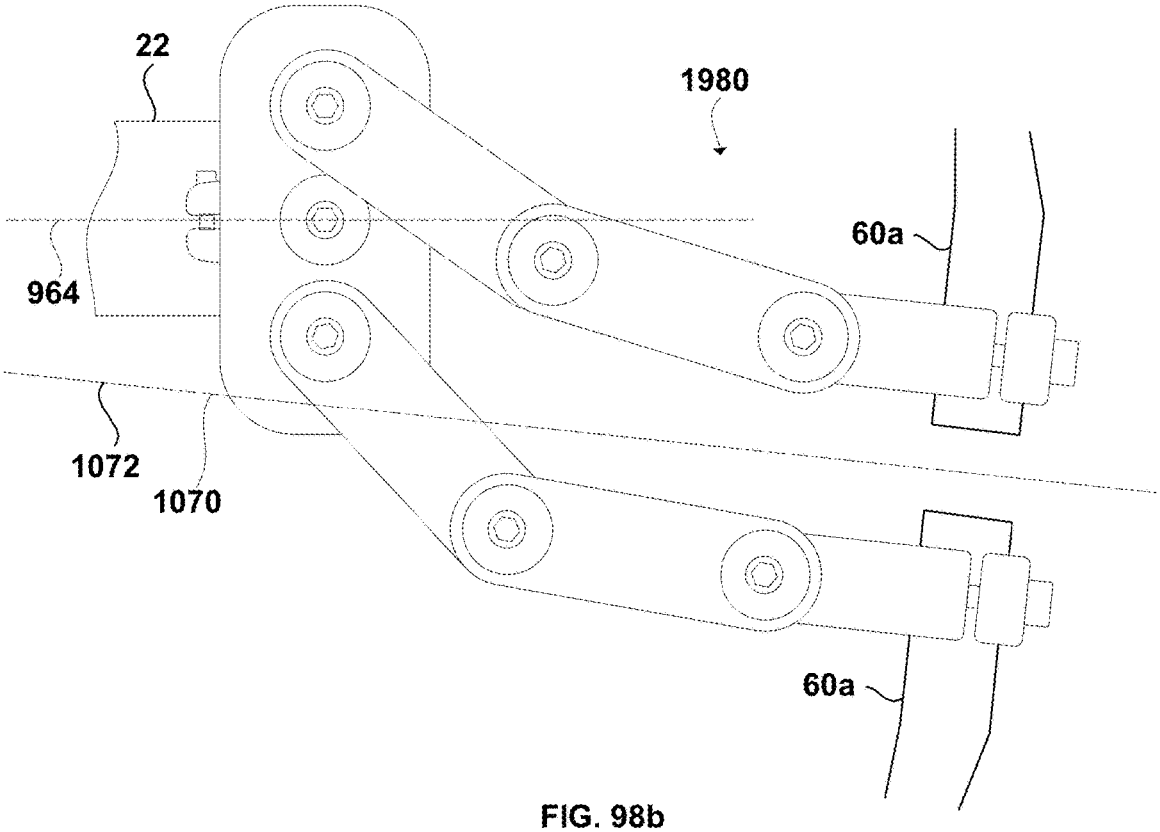
FIG. 98*b* is a partial top view of a bicycle apparatus with the adjustable handlebar stem of FIG. 96 with a split handlebar pair in the position of the embodiment of FIG. 61.

Referring now to FIGS. 96, 97*a* and 98*a* there is shown adjustable handlebar stem 1980 according to another embodiment that allows a handlebar to be configured in the twisted intervention handlebar position. Stem 1980 includes adjustable arms 1985. Each adjustable arm 1985 includes stem portions 1950, 1960 and 1990. Stem portion 1950 is connected with stem portions 1960 and 1990 at joints 1970 and 1740 respectively. Stem portion 1990 includes a pin portion (not shown) at joint 1740 and clamping portion 2000. Clamping portion 2000 is similar to clamping portion 903 except that it uses two bolts 905 instead of four bolts 905 used by clamping portion 903. Stem portion 1960 is adjustably connected with bearing cap 2020 at joint 2010. Joints 1740, 1970 and 2010 can all be secured with fasteners. However, only joint 1970 is required to be secured by fastening to restrict the movement of a handlebar. Bearing cap 2020 includes tubular support 1870, tubular bearing portions 1860 and flange 2030. With reference to FIG. 97*b*, bearing cap 2025 can be employed alternatively to bearing cap 2020. Bearing cap 2025 employs joints 1970 instead of joint 2010. With reference to FIG. 98*b*, split handlebar pair 60*a* can be employed instead of handlebar 60 to provide more flexibility in setting the position of each arm of the rider for improved biomechanical and physiotherapeutic effect.

Figure 99:
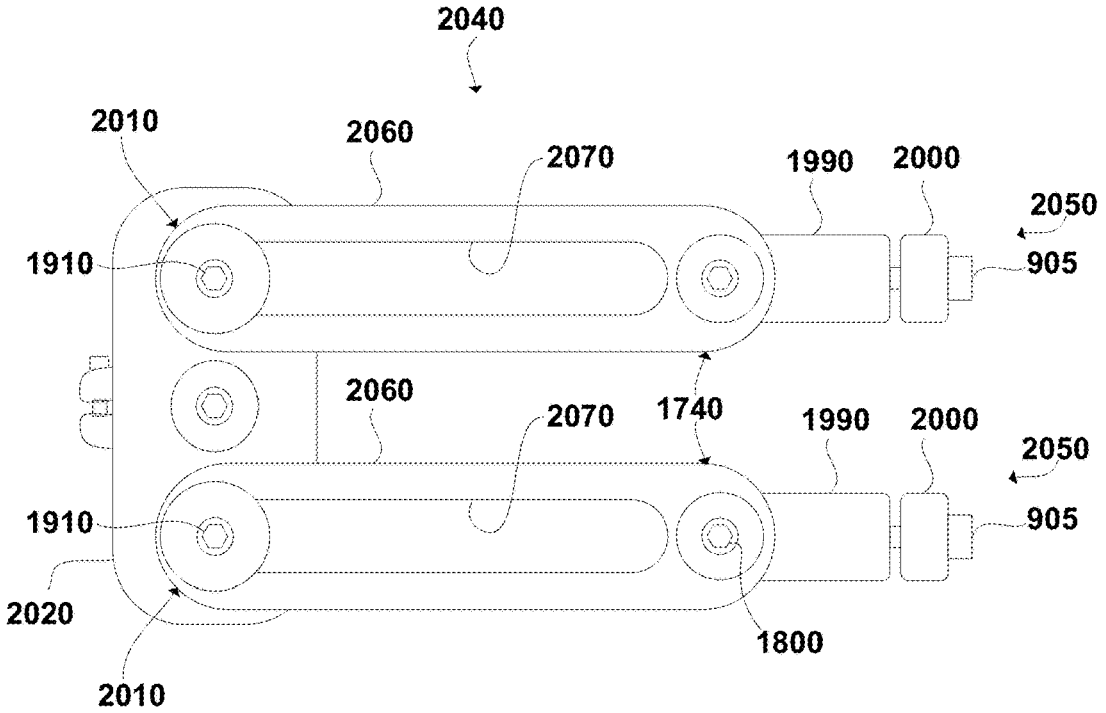
FIG. 99 is a top view of an adjustable handlebar stem according to another embodiment.
Figure 100:
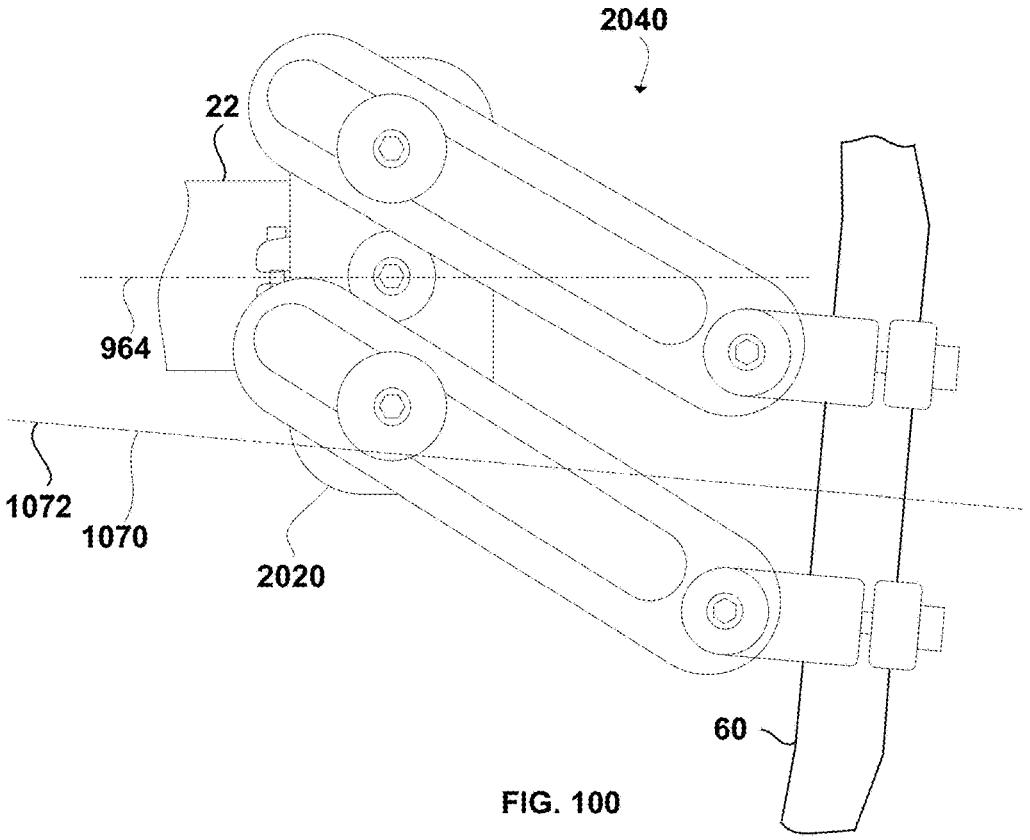
FIG. 100 is a partial top view of a bicycle apparatus with the adjustable handlebar stem of FIG. 99 with a handlebar in the position of the embodiment of FIG. 61.

Referring now to FIGS. 99 and 100 there is shown adjustable handlebar stem 2040 according to another embodiment that allows a handlebar to be configured in the twisted intervention handlebar position. Stem 2040 includes adjustable arms 2050. Each adjustable arm 2050 includes elongate stem portion 2060 having slot 2070. When fastener 1910 is loosened, slot 2070 can be translated along tubular bearing portion 1860 (seen in FIG. 91) in joint 2010, and stem portion 2060 can be rotated about the tubular bearing portion.

Figure 101:
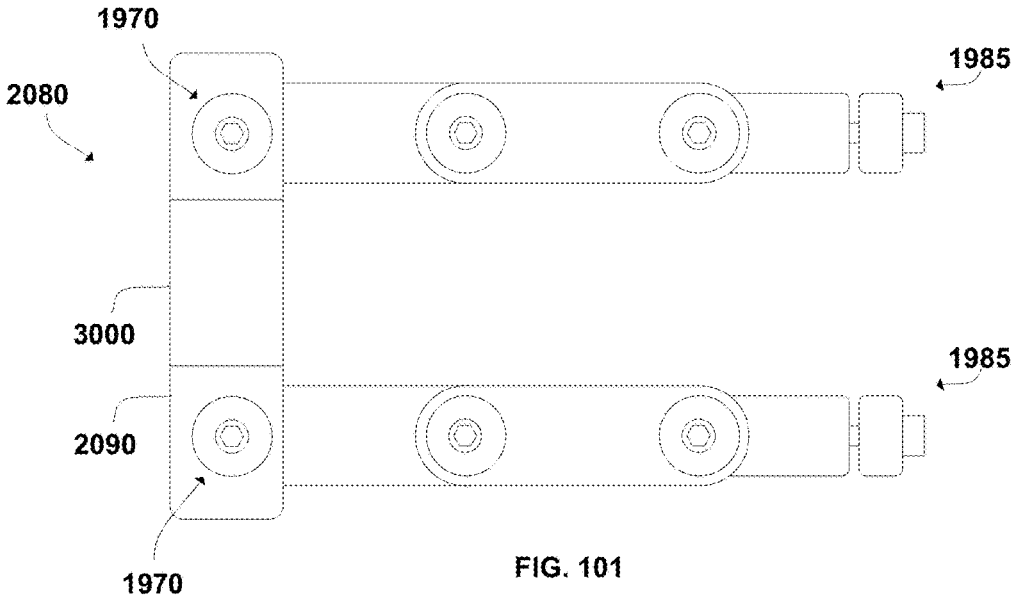
FIG. 101 is a top view of an adjustable handlebar stem according to another embodiment.
Figure 103A:
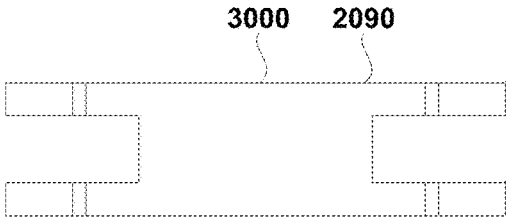
FIG. 103*a* is a cross-sectional elevational view of a bearing portion of the adjustable handlebar stem of FIG. 101.

Referring now to FIGS. 101 and 103*a* there is shown adjustable handlebar stem 2080 according to another embodiment that allows a handlebar to be configured in the twisted intervention handlebar position. Stem 2080 is similar to stem 1980, but instead of engaging a steering tube of a bicycle, stem 2080 engages a clamp of a conventional handlebar stem mounted on a steering tube of a bicycle. Bearing portion 2090 includes cylindrical portion 3000 for connecting with the clamp of the conventional handlebar stem.

Figure 102:
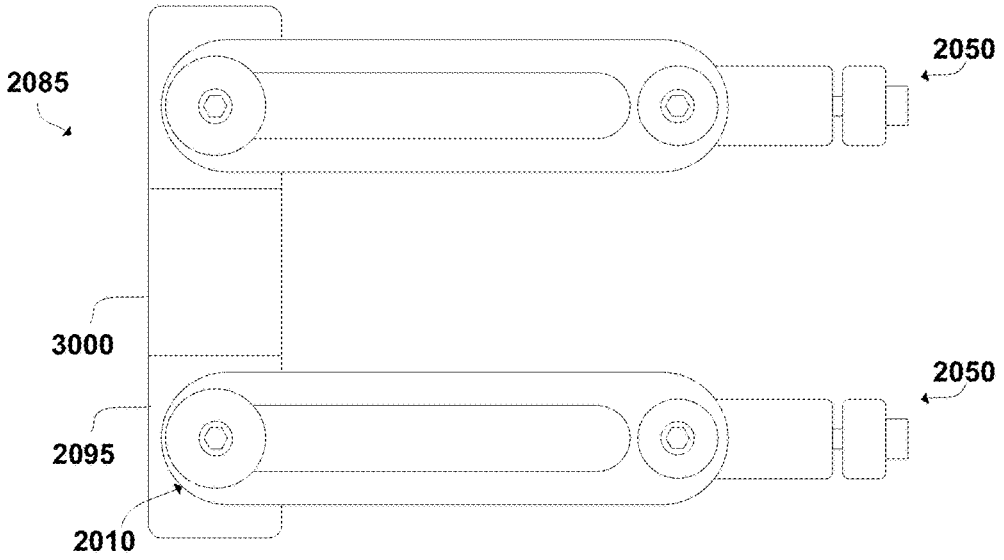
FIG. 102 is a top view of an adjustable handlebar stem according to another embodiment.
Figure 103B:
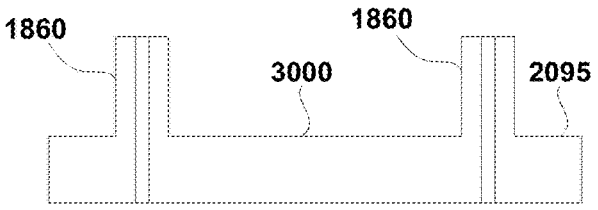
FIG. 103*b* is a cross-sectional elevational view of a bearing portion of the adjustable handlebar stem of FIG. 102.

Referring now to FIGS. 102 and 103*b* there is shown adjustable handlebar stem 2085 according to another embodiment that allows a handlebar to be configured in the twisted intervention handlebar position. Stem 2085 is similar to 2040, but instead of engaging a steering tube of a bicycle, stem 2085 engages a clamp of a conventional handlebar stem mounted on a steering tube of a bicycle. Bearing portion 2095 includes cylindrical portion 3000 for connecting with the clamp of the conventional handlebar stem.

Figure 104:
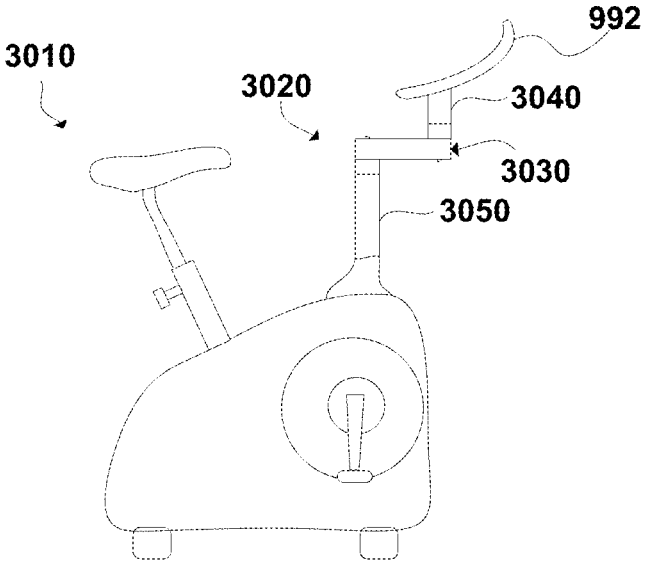
FIG. 104 is a side elevational view of an exercise bicycle according to another embodiment.
Figure 105:
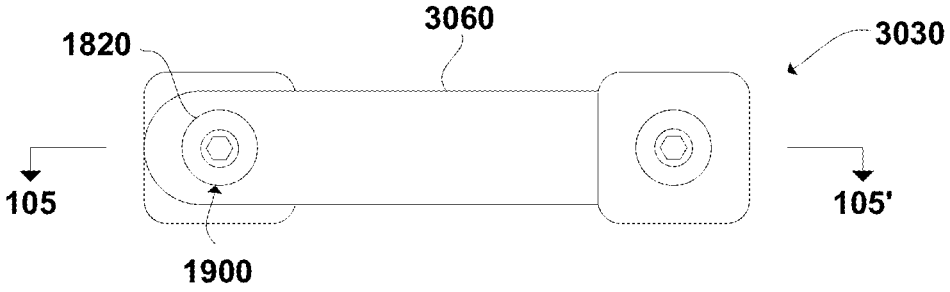
FIG. 105 is a top view of a handlebar adjustment apparatus for the bicycle of FIG. 104.
Figure 106:
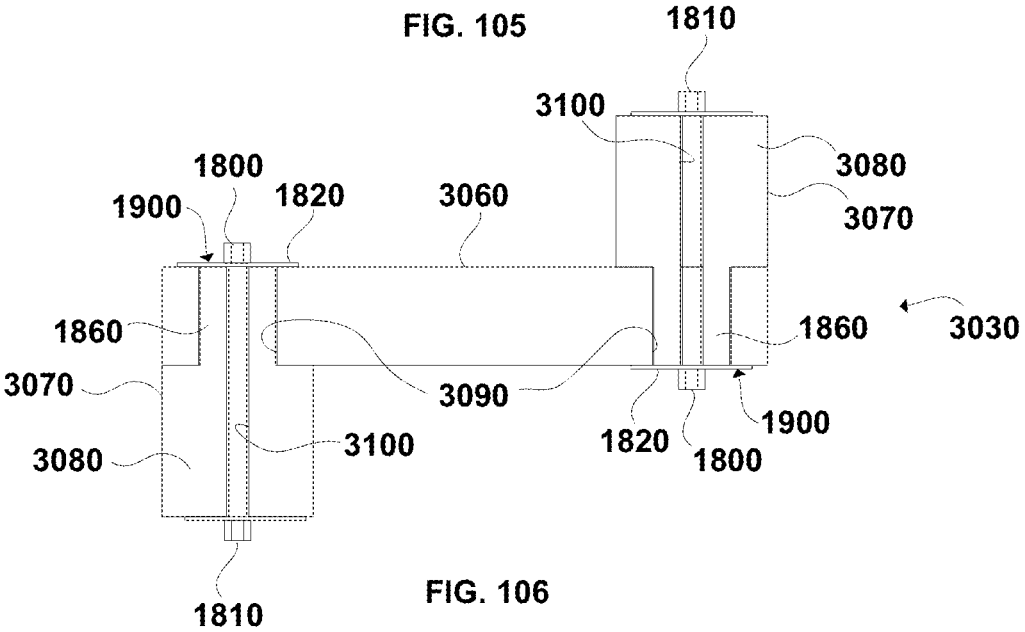
FIG. 106 is a cross-sectional side view of the handlebar adjustment apparatus of FIG. 105 taken along line 105-105'.
Figure 113:
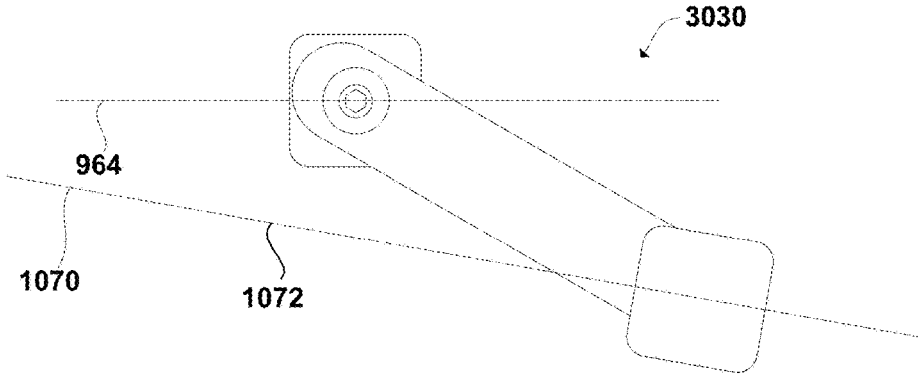
FIG. 113 is a partial top view of an exercise bicycle with the handlebar adjustment apparatus of FIG. 104 setup such that a handlebar is in the position of the embodiment of FIG. 61.

Referring now to FIG. 104 there is shown exercise bike 3010 according to another embodiment. Exercise bike 3010 includes handlebar 992 and handle bar support 3020. Handlebar support 3020 includes elongate portions 3040 and 3050 that are adjustably and securably connected with each other by adjustable handlebar apparatus 3030. With reference to FIGS. 105 and 106, adjustable handlebar apparatus 3030 includes elongate portion 3060 that is adjustably and securably connected with bearing members 3070 at joints 1900. Each bearing member 3070 includes tubular bearing portion 1860 and support portion 3080 and has bore 3100 therethrough. Elongate portion 3060 includes bores 3090 that receive tubular bearing portion 1860. When fasteners 1800 are loosened, elongate stem portion 3060 can be rotated about joints 1900 such that handlebar 992 can be configured in the twisted intervention handlebar position, such as illustrated in FIG. 113.

Figure 107:
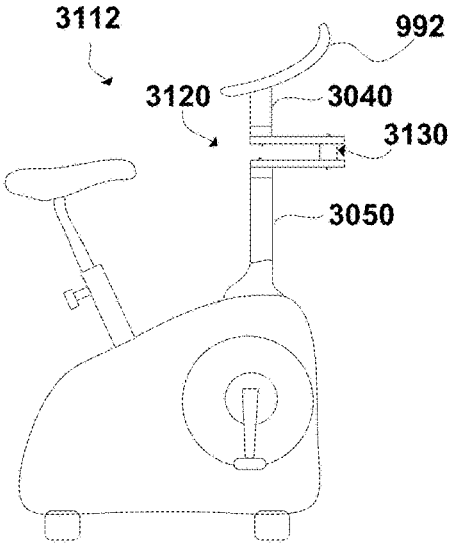
FIG. 107 is a side elevational view of an exercise bicycle according to another embodiment.
Figure 108:
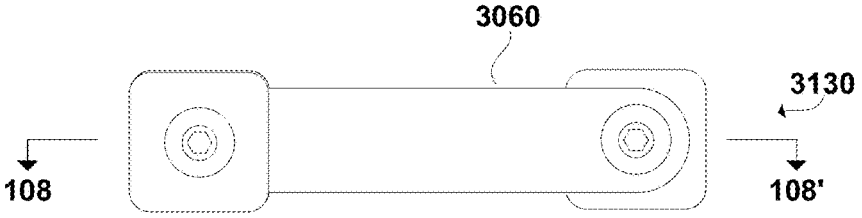
FIG. 108 is a top view of a handlebar adjustment apparatus for the bicycle of FIG. 107.
Figure 109:
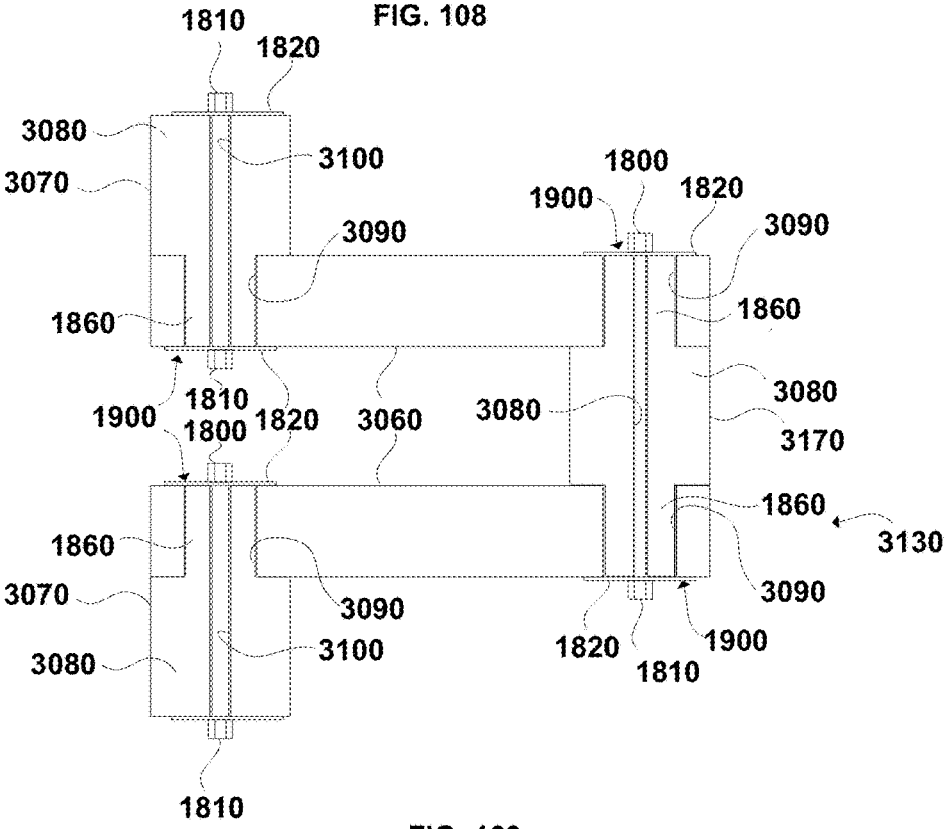
FIG. 109 is a cross-sectional side view of the handlebar adjustment apparatus of FIG. 108 taken along line 108-108'.
Figure 114:
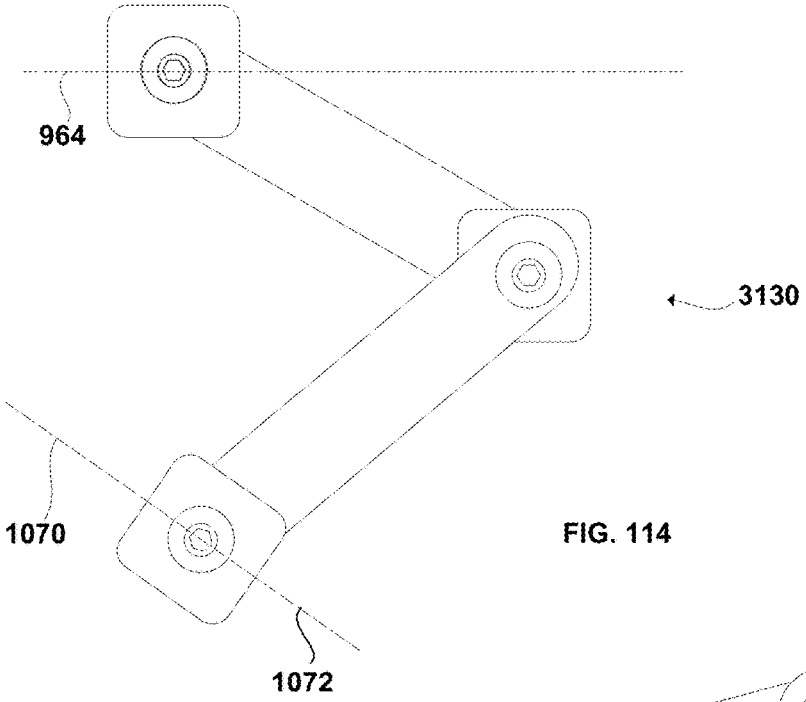
FIG. 114 is a partial top view of an exercise bicycle with the handlebar adjustment apparatus of FIG. 107 setup such that a handlebar is in the position of the embodiment of FIG. 61.

Referring now to FIG. 107 there is shown exercise bike 3112 according to another embodiment. Exercise bike 3012 includes handlebar 992 and handle bar support 3120. Handlebar support 3120 includes elongate portions 3040 and 3050 that are adjustably and securably connected with each other by adjustable handlebar apparatus 3130. With reference to FIGS. 108 and 109, adjustable handlebar apparatus 3130 includes elongate portions 3060 that are adjustably and securably connected with bearing members 3070 and 3170 at joints 1900. Each bearing member 3070 includes tubular bearing portion 1860 and support portion 3080 and has bore 3100 therethrough. Bearing member 3170 includes tubular bearing portions 1860 and support portion 3080 and has bore 3180 therethrough. Elongate portion 3060 includes bores 3090 that receive tubular bearing portion 1860. When fasteners 1800 are loosened, elongate stem portions 3060 can be rotated about joints 1900 such that handlebar 992 can be configured in the twisted intervention handlebar position, such as illustrated in FIG. 114.

Figure 110:
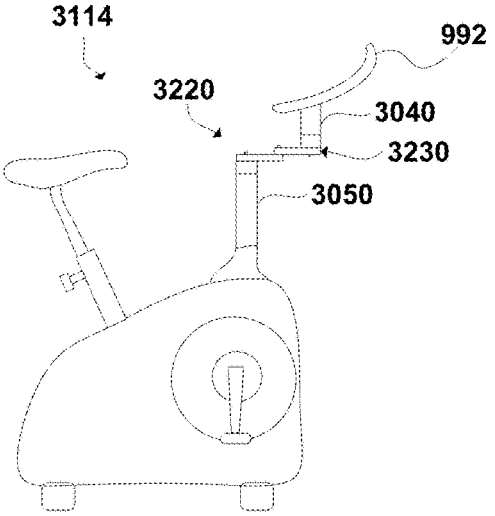
FIG. 110 is a side elevational view of an exercise bicycle according to another embodiment.
Figure 111:
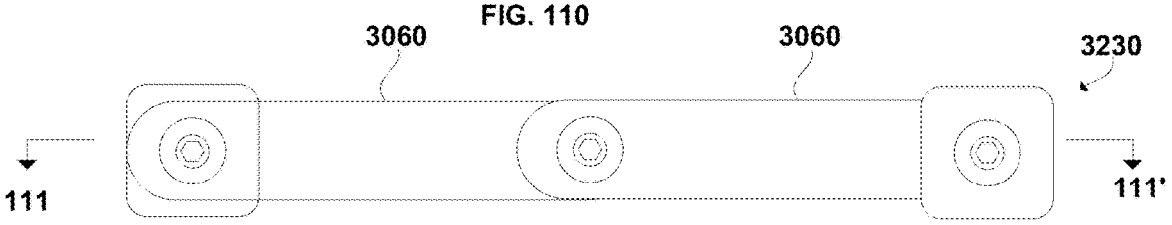
FIG. 111 is a top view of a handlebar adjustment apparatus for the exercise bicycle of FIG. 110.
Figure 112:
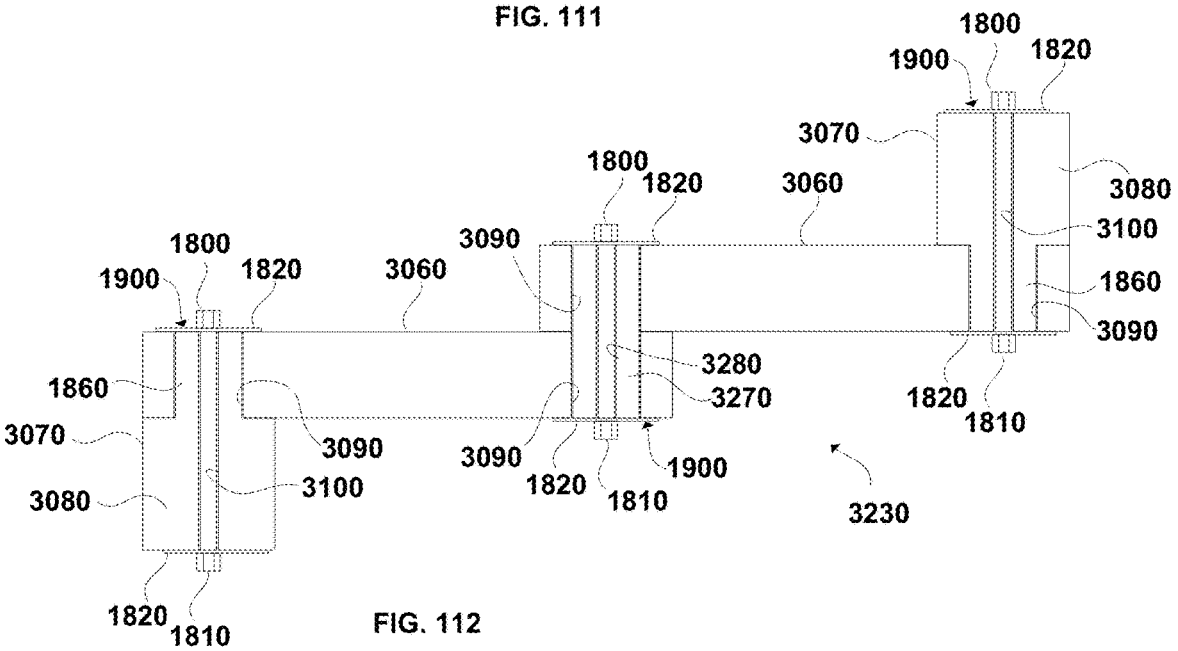
FIG. 112 is a cross-sectional side view of the handlebar adjustment apparatus of FIG. 111 taken along line 111-111'.
Figure 115:
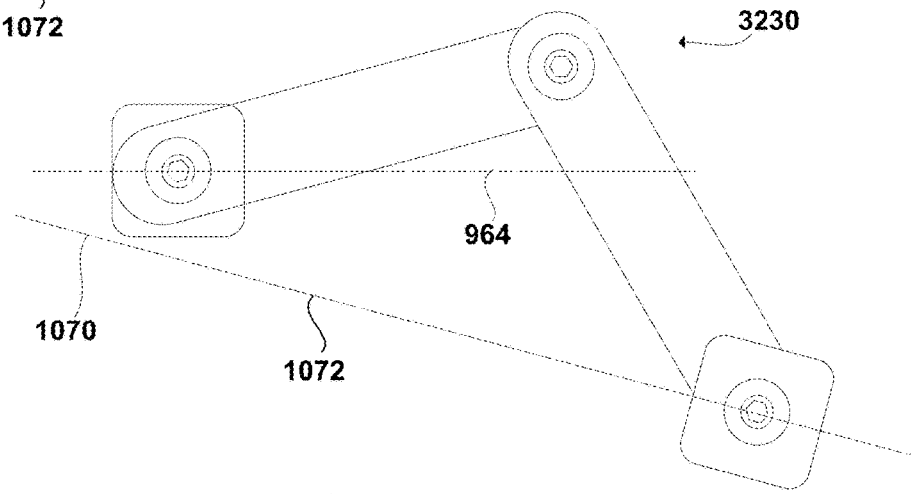
FIG. 115 is a partial top view of an exercise bicycle with the handlebar adjustment apparatus of FIG. 110 setup such that a handlebar is in the position of the embodiment of FIG. 61.

Referring now to FIG. 110 there is shown exercise bike 3114 according to another embodiment. Exercise bike 3014 includes handlebar 992 and handle bar support 3220. Handlebar support 3220 includes elongate portions 3040 and 3050 that are adjustably and securably connected with each other by adjustable handlebar apparatus 3230. With reference to FIGS. 111 and 112, adjustable handlebar apparatus 3230 includes elongate portions 3060 that are adjustably and securably connected with bearing members 3070 and 3270 at joints 1900. Each bearing member 3070 includes tubular bearing portion 1860 and support portion 3080 and has bore 3100 therethrough. Bearing member 3270 includes bore 3280 therethrough. Elongate portion 3060 includes bores 3090 that receive tubular bearing portion 1860. When fasteners 1800 are loosened, elongate stem portions 3060 can be rotated about joints 1900 such that handlebar 992 can be configured in the twisted intervention handlebar position, such as illustrated in FIG. 115.

Figure 116:
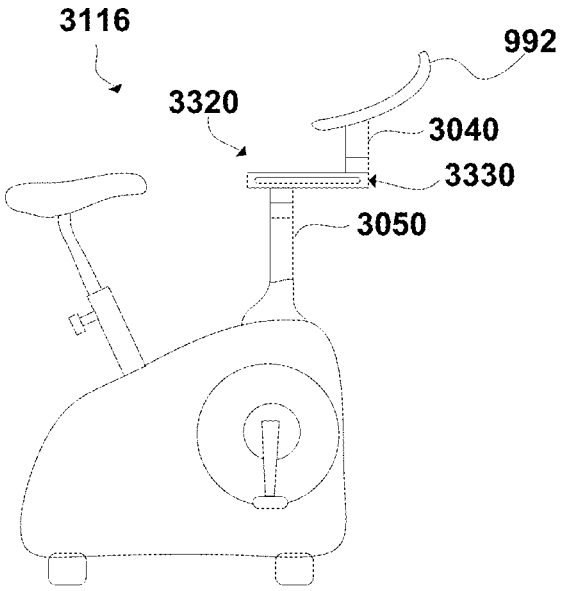
FIG. 116 is a side elevational view of an exercise bicycle according to another embodiment.
Figure 117:
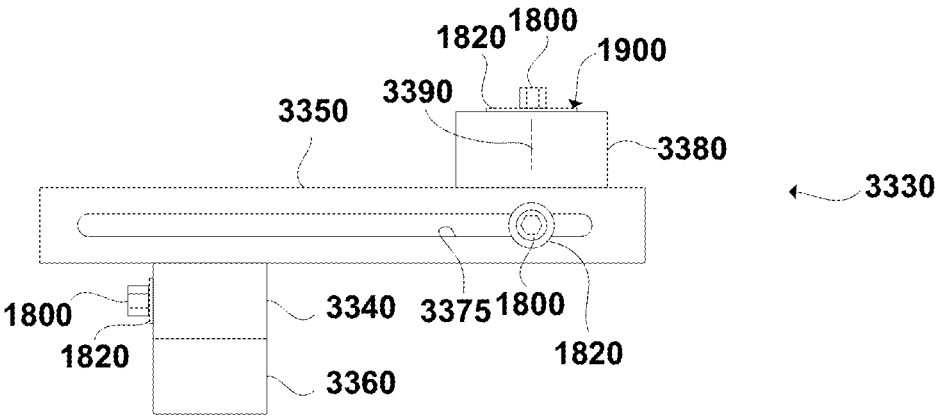
FIG. 117 is a side elevational view of an adjustable handlebar apparatus for the exercise bicycle of FIG. 116.
Figure 118:
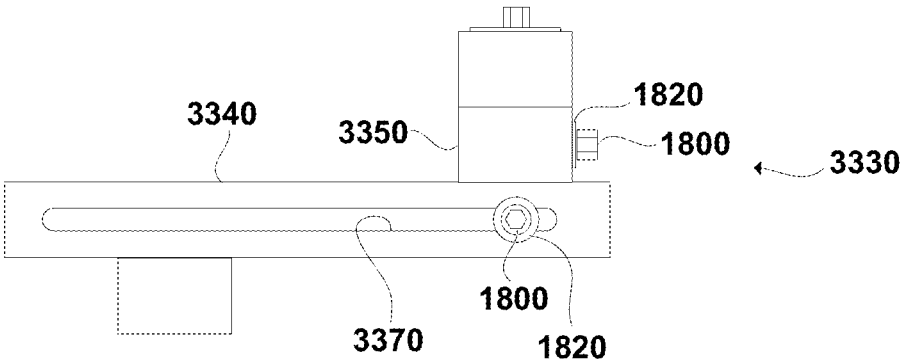

Referring now to FIG. 116 there is shown exercise bike 3116 according to another embodiment. Exercise bike 3116 includes handlebar 992 and handle bar support 3320. Handlebar support 3320 includes elongate portions 3040 and 3050 that are adjustably and securably connected with each other by adjustable handlebar apparatus 3330. With reference to FIGS. 117 and 118, adjustable handlebar apparatus 3330 includes elongate portions 3340 and 3350. Elongate portion 3340 is secured to bearing 3360, and bearing 3360 is securely received by elongate portion 3050. Elongate portion 3350 is adjustable along the longitudinal axis of elongate portion 3340 and is secured in position by fastener 1800, which slides along slot 3370. Similarly, handlebar support bearing 3380 is adjustable along the longitudinal axis of elongate portion 3350 and is secured in position by fastener 1800, which slides along slot 3375. Elongate portions 3340 and 3350 are tubular members with slots 3370 and 3375 respectively there along. Handlebar support bearing 3380 allows handlebar 992 to be rotated about axis 3390. Adjustable handlebar support apparatus 3330 allows handlebar 992 to be configured in the twisted intervention handlebar position.

Figure 119:
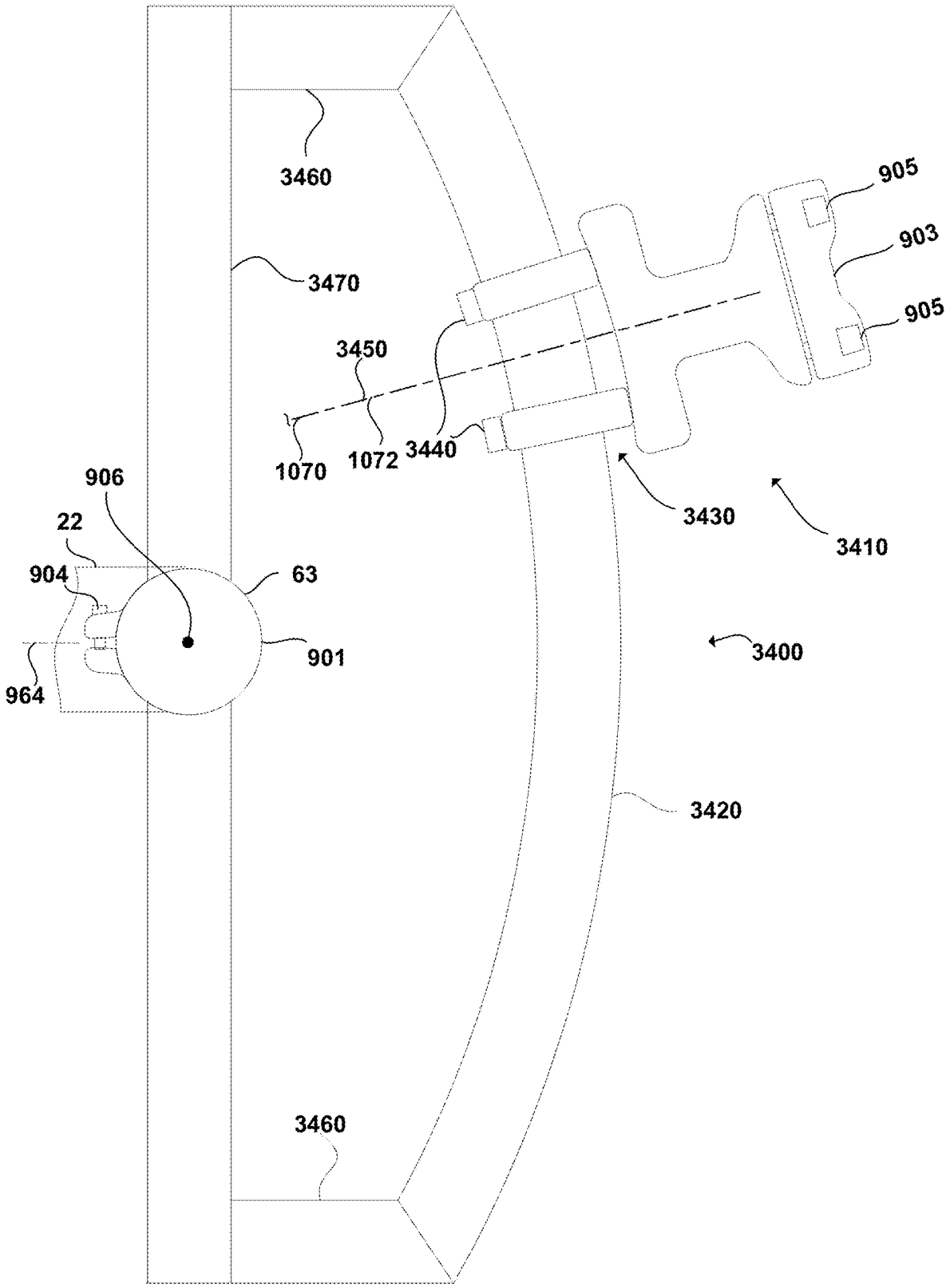

Referring now to FIG. 119 there is shown handlebar stem 3400 according to another embodiment that allows the twisted intervention handlebar position. Stem 3400 includes clamping apparatus 3410 that is adjustable along elongate curved portion 3420. Clamping apparatus 3410 includes clamping portion 903 for securing a handlebar, and clamping portion 3430 for securing apparatus 3410 to elongate curved portion 3420. Clamping portion 3430 includes quick release fasteners 3440. Radius of curvature 3450 of elongate curve portion 3420 allows mid-handlebar plane 1070 to intersect top-tube plane 964 behind head-tube 63. Elongate curved portion 3420 is connected with head-tube portion 901 by portions 3460 and 3470.

Figure 120:
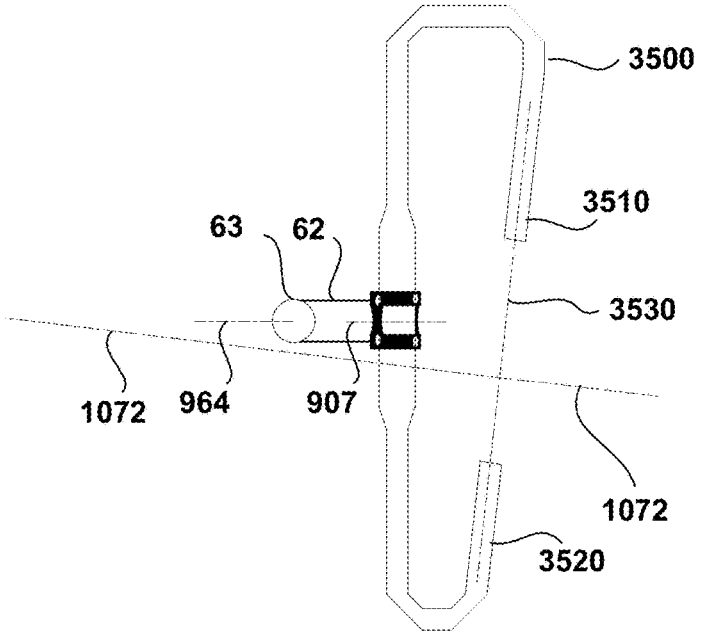

Referring now to FIG. 120 there is shown handlebar 3500 according to another embodiment. Handlebar 3500 includes grip portions 3510 and 3520 that when gripped by a rider result in mid-hand-position plane 1072 being in the twisted intervention handlebar position. In the illustrated embodiment plane 1072 is defined with respect to longitudinal axis 3530 of handlebar 3500.

Figure 121:
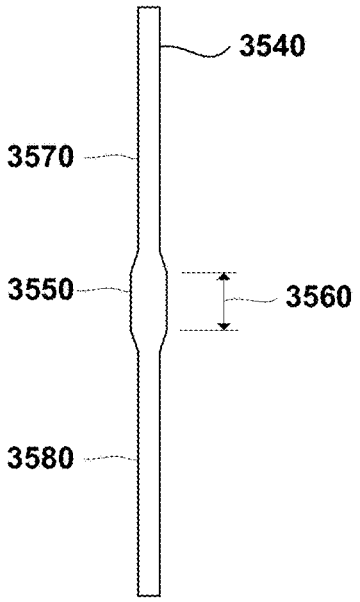
Figure 122:
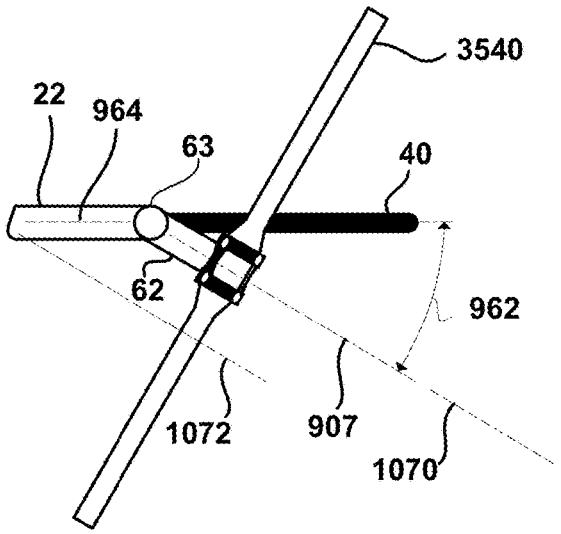

Referring now to FIG. 121 there is shown handlebar 3540 according to another embodiment. Handlebar 3540 has stem-clamp engagement portion 3550 having length 3560 that is substantially the size of the clamping portion of a handlebar stem. In exemplary embodiments, length 3560 is less than 2 inches, and preferably less than 1.5 inches. Grip portions 3570 and 3580 have a diameter less than the diameter of portion 3550 and are long enough such that a rider can grip in a variety of positions. For example, when handlebar 3550 is connected with a bicycle by conventional handlebar stem 62, and the stem is rotated to lie outside top-tube plane 964, a rider can select hand positions such that mid-hand-position plane 1072 (seen in FIG. 122) intersects top-tube plane 964 behind head-tube portion 64 even though mid-handlebar plane 1070 intersects the head-tube portion. The rider can select a grip position with one hand that is immediately adjacent the handlebar stem clamp and with the other hand a grip position that is further away from the handlebar stem clamp such that the rider is in the twisted intervention position.

Figure 123:
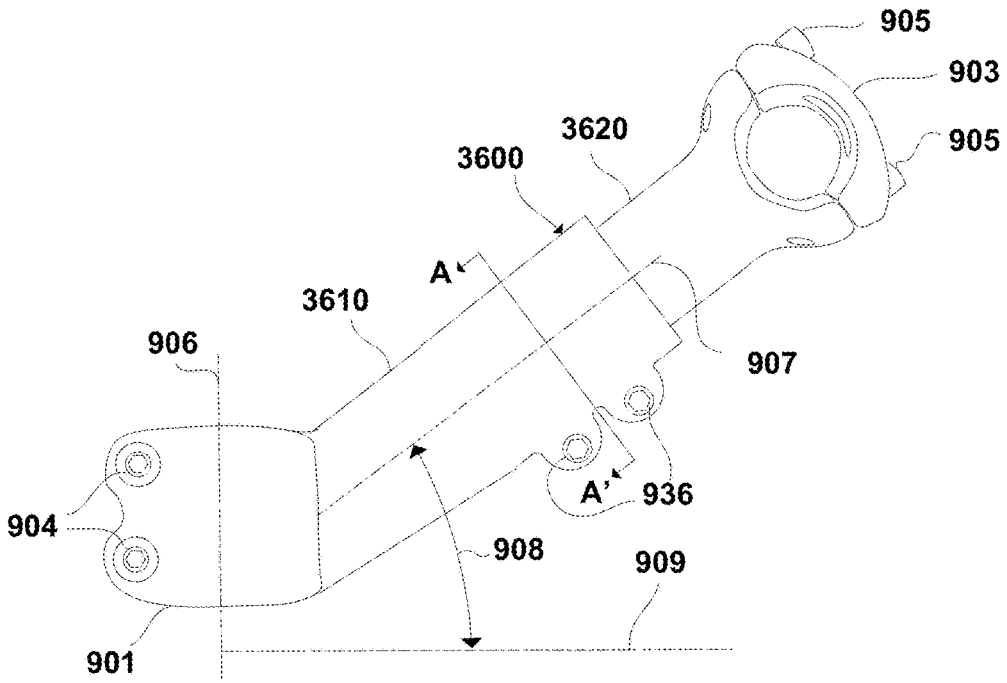
Figure 124:
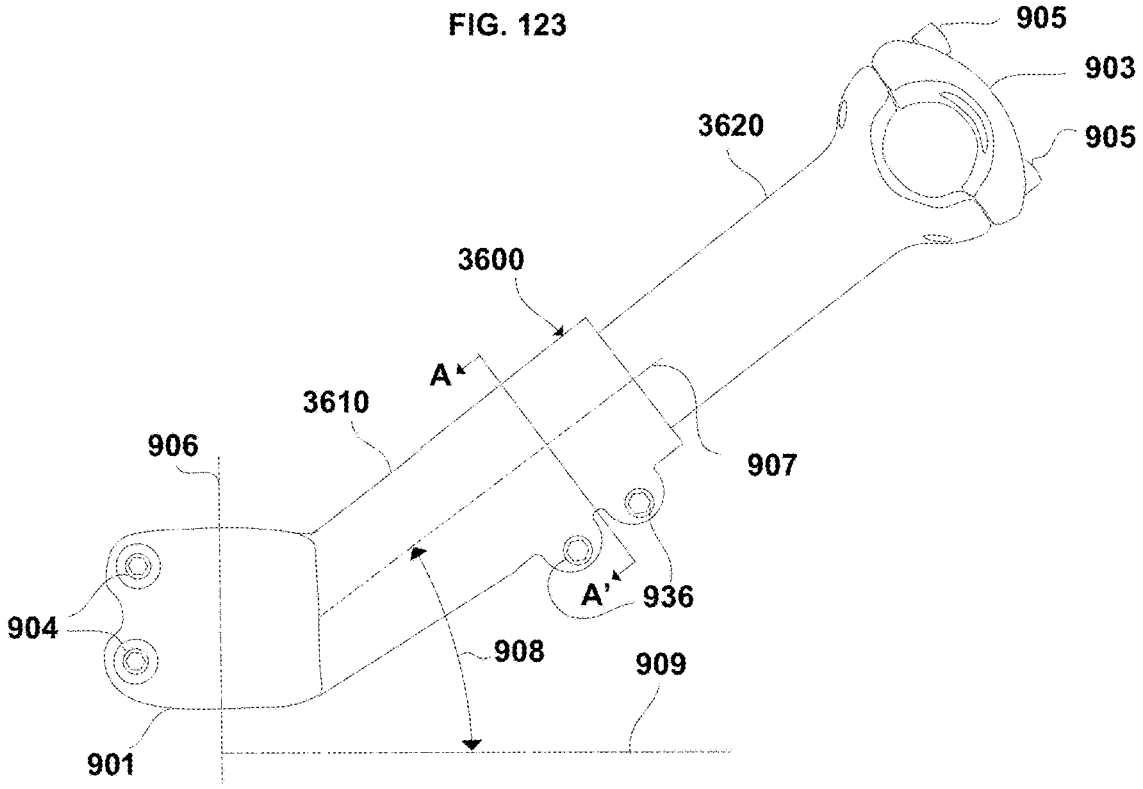

Referring now to FIGS. 123 and 124 there is shown adjustable handlebar stem 3600 according to another embodiment. Stem 3600 is a telescoping stem with stem portion 3620 telescoping within and with respect to stem portion 3610. Stem portion 3620 is illustrated in a first position in FIG. 123 and in a second position in FIG. 124. As is the case for all embodiments herein, stem angle 908 can be any desired stem angle unless otherwise specified. Stem 3600 can be employed with the embodiments of FIGS. 62, 63, 64, 120, 121 and 122 to adjust the height from the ground of opposite ends of the handlebars. Stem 3600 is intended to be configured with the steering tube of a bicycle, unlike previous telescoping stems that are configured with a forward seat post in a tandem bike such that the rear handlebar can be configured for the rear tandem cyclist.

Figure 125:
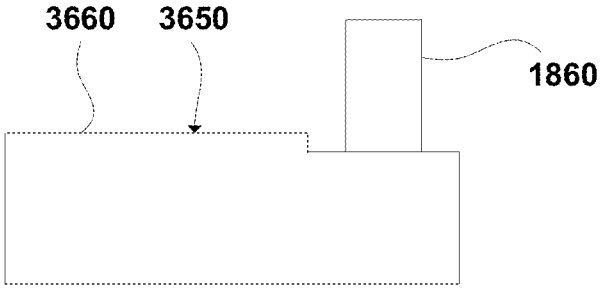
Figure 126:
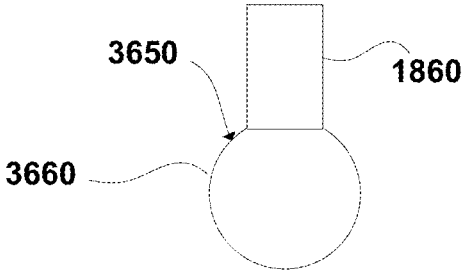

Referring now to FIGS. 125 and 126 there is shown bearing 3650 including cylindrical bearing portion 3660 and tubular bearing portion 1860. Bearing 3650 can be employed to connect elongate stem portion 1720 of handlebar stem 1710 (seen in FIG. 89) to stem portion 3610 of handlebar stem 3600 (seen in FIG. 123), that is, instead of using stem portion 3620. Bore 1890 (not shown) of tubular bearing portion 1860 can extend through bearing 3650 such that stem portion 1720 can be secured thereto. Similarly, bearing 3650 can connect stem portion 1960 of handlebar stem 1940 (seen in FIG. 94) to stem portion 3610 of handlebar stem 3600.

Figure 127:
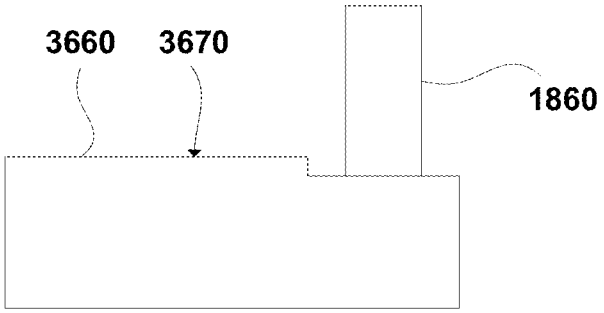
Figure 128:
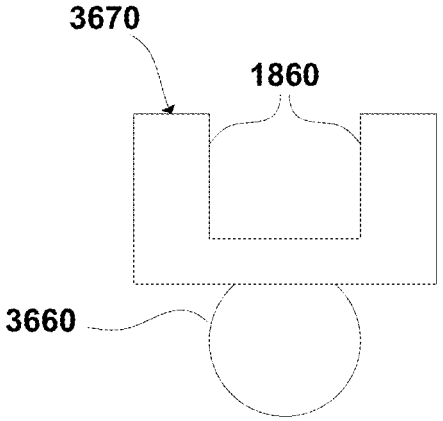

Referring now to FIGS. 127 and 128 there is shown bearing 3670 including cylindrical bearing portion 3660 and two tubular bearing portions 1860. Bearing 3650 can be employed to connect elongate stem portions 1960 of handlebar stem 1980 (seen in FIG. 96) to stem portion 3610 of handlebar stem 3600 (seen in FIG. 123), that is, instead of using stem portion 3620. Bores 1890 (not shown) of tubular bearing portions 1860 can extend through bearing 3670 such that stem portions 1960 can be secured thereto. Similarly, bearing 3670 can connect stem portion 2060 of handlebar stem 2040 (seen in FIG. 99) to stem portion 3610 of handlebar stem 3600.

Figure 129:
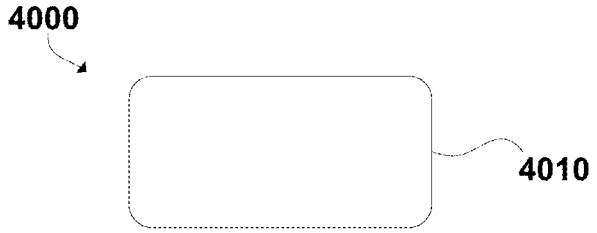

Referring now to FIG. 129 there is shown a method of physiotherapy 4000. In step 4010 a patient cycles on a bicycle apparatus where mid-handlebar plane 1070 and/or mid-hand-position plane 1072 intersects top-tube plane 964 such that the rider is in the twisted intervention position. The patient reaches for a handlebar by bending towards one side of the bicycle apparatus. When gripping the handlebar, each hand is an equal height about the ground.

Referring now to FIG. 130 there is shown a method of physiotherapy 4020. In step 4030 a patient cycles on a bicycle apparatus where mid-handlebar plane 1070 and/or mid-hand-position plane 1072 intersects top-tube plane 964 such that the rider is in the twisted intervention position. The patient reaches for a handlebar by bending towards one side of the bicycle apparatus. When gripping a handlebar of the bicycle apparatus, the hand closer to top-tube plane 964 is elevated with respect to the ground compared to the hand further away from the top tube plane.

Referring now to FIG. 131 there is shown a method of physiotherapy 4040. In step 4050 a patient cycles on a bicycle apparatus where mid-handlebar plane 1070 and/or mid-hand-position plane 1072 intersects top-tube plane 964 such that the rider is in the twisted intervention position. The patient reaches for a handlebar by bending towards one side of the bicycle apparatus. When gripping a handlebar of the bicycle apparatus, the hand closer to top-tube plane 964 is lowered with respect to the ground compared to the hand further away from the top tube plane.

Methods 4000, 4020 and 4040 can be beneficial for cyclists with leg length differences to find their "sweet spot" body position for improved biomechanical cycling performance. For example, for a cyclist whose right leg is shorter than the left leg, such as but not exclusively between 0.5 and 1 inch, the right hip falls forward, bringing the right shoulder with it, and the righting reflex compensates by bringing the right shoulder back such that the person's forward vision is brought back in line. This creates an arrangement of right hip, the spine and the shoulder that is considered normal for this person, especially if this arrangement was maintained for the early part of their life (that is no leg length compensation). Later on in life if this person begins compensating for the leg length difference to correct the skeletal asymmetry, the previous inherent disposition of the right hip, the spine and the right shoulder with respect to the muscle asymmetry is very difficult to overcome. When this person stands without compensating for the leg length difference the right sitz bone is lower and more forward than the left sitz bone and the right shoulder is twisted backwards with respect to the right hip. When this person mounts a bicycle both their sitz bones are at equal height on the saddle, which has the consequence to naturally bring the right shoulder backwards so that the shoulder, spine and the hip have their normal alignment. However, when the cyclist reaches for the handle bars the right shoulder and spine is brought forward outside of its normal arrangement with the right hip. The result is that the cyclist cannot generate as much power since this is not an optimal position for them in their current situation.

Referring now to FIG. 132 there is shown a method of physiotherapy 4060. In step 4070 a patient cycles on the bicycle apparatus where mid-handlebar plane 1070 and/or mid-hand-position plane 1072 intersects top-tube plane 964 such that the rider is in the twisted intervention position. The patient reaches for a handlebar by bending towards one side of the bicycle apparatus. In step 4080 the patient cycles on the bicycle apparatus where mid-handlebar plane 1070 and/or mid-hand-position plane 1072 intersects top-tube plane 964 such that the rider is again in the twisted intervention position, but in this step the patient reaches for the handlebar by bending towards an opposite side of the bicycle apparatus compared to the one side in step 4070. Method 4060 can be beneficial to help cyclists with leg length differences (such as the one mentioned above with a shorter right leg) to overcome their inherent muscular disposition of their normal arrangement of the right hip, the spine and the right shoulder. That is the cyclist can cycle in a variety of positions with different angles 1071 (seen in FIG. 61). This can help to stretch and strengthen muscles while be loaded in a functional manner to bring their body back into a symmetrical alignment both skeletally (with leg length compensation) and muscularly to improve the feeling of vitality.

Referring now to FIG. 133 there is shown a method of physiotherapy 4090 where in step 4100 a cyclist uses, while cycling on a bicycle apparatus, a midfoot position for a first cleat on a first cycling shoe for one foot, such as illustrated for cleat 610 in FIGS. 15 and 18, and a forefoot position for a second cleat on a second cycling shoe for the other foot, such as illustrated for cleat 610 in FIG. 16 and cleat 603 in FIG. 18. In an exemplary embodiment for cyclists with leg length differences, the first cycling shoe is employed on the longer leg and the second cycling shoe is employed on the shorter leg. This causes the hip of the longer leg to come forward and the hip of the shorter leg to go backwards, to counter a common preexisting pelvic tilt for people with leg length discrepancies. Shims can be used between the second cleat and the second cycling show to compensate for leg length differences. This technique can be employed with all the embodiments herein.

Method 4090 can be employed simultaneously with methods 4000, 4020, 4040 and 4060. Alternatively, the cycling shoes of both feet can use a midfoot position for the cleats in methods 4000, 4020, 4040 and 4060. Alternatively still, the cycling shoes of both feet can use a forefoot position for the cleats methods 4000, 4020, 4040 and 4060. Methods 4000, 4020, 4040, 4060 and 4090 can be used with any combination of hip angle HA, shoulder angle SA and knee angle KA. A variety of combinations of these angles, including those discussed herein and other conventional angles can be biomechanically beneficial for using muscles in a variety of body positions. In methods 4000, 4020, 4040, 4060 and 4090 the cyclist can activate their back extensor muscles while in the twisted intervention position by beginning to lift out of the position while all the while remaining in the position. This helps to strengthen and lengthen the back extensor muscles.

Referring now to FIGS. 134 and 135 there is shown handlebar 5000 according to another embodiment. In the illustrated embodiment handlebar 5000 is circular and angle 5010 (the angle swept by the handlebar from top-tube plane 964) is 90 degrees. In other embodiments handlebar 5000 can be portions of curves from conic sections, such curves can be elliptical, parabolic or hyperbolic. With reference to FIG. 136, in an exemplary embodiment handlebar 5001 is elliptical with semi-major axis 5020 and semi-minor axis 5030. Referring back to FIG. 134, in still further embodiments, angle 5010 can be a variety of angles. For example, angle 5010 (for any type of curve of the conic section) can be greater than 15 degrees, or greater than 30 degrees, or greater than 45 degrees, or greater than 60 degrees or greater than 75 degrees. Referring again to FIG. 134, handlebar 5000 allows a rider to instantaneously twist to both the left and the right of top-tube plane 964 while riding and to have a variety of mid-hand-position planes 1072. This may allow the rider to better understand whether they have a predisposition to twisting to one side versus the other. This may also allow the rider to stretch their back muscles in multiple directions while cycling, and when lifting out of the twisted intervention position while all the while remaining in the position to also activate and strengthen specific back muscles. People with leg length differences typically have an increased tissue density between the spine and the pelvic girdle on the short leg side, and the twisting then loading nature of cycling with handlebar 5000 may improve mobility. This may also allow the rider to target different fibers of their gluteal muscles. This may also allow the rider to activate different muscles chains to different degrees depending on the amount of twist. Although handlebar 5000 is illustrated with a wheeled bicycle apparatus, the handlebar can also be employed with stationary exercise bicycles. When used on a wheeled bicycle in a mobile application, a smaller swept angle is preferable for safety and mobility reasons.

The twisted intervention position is most effective when used on stationary bicycles, such as exercise bicycles without wheels and wheeled bicycles on bicycle trainers. On stationary bicycles, the rider does not need to be concerned with safety and accordingly can engage in extreme twisting positions and does not need to vigilantly look forward to see where they are headed.

Referring now to FIG. 137 there is shown biased handlebar apparatus 5100 according to another embodiment. Handlebar apparatus 5100 includes steering wheel 5115 rotatable about axis 5105 operatively connected with exercise bicycle 5110. The position of handlebar apparatus 5100 can be adjusted along longitudinal axis 5125 of elongate support 5120, although this is not a requirement and in other embodiments handlebar apparatus 5100 can be statically supported by support 5130. Although not illustrated the saddle of bicycle 5110 can also be adjusted forward and back as well as up and down. With reference to FIG. 138, handlebar 5115 of apparatus 5100 is shown in a neutral position at rest where there the handlebar is unbiased, that is there is no torque acting on the handlebar. The reference letters F (front) and B (back) illustrate the orientation of handlebar 5115 with respect to exercise bicycle 5110. In the illustrated embodiment, when handlebar 5115 is rotated in a clockwise direction from the neutral position in FIG. 138 the handlebar will experience a torque resulting from biasing device 5140 (such as a torsion spring for example) in the counterclockwise direction that will act to return the handlebar to the neutral position. Biasing device 5140 is configured operatively between handlebar 5115 and steering column 5160. Similarly, when handlebar 5115 is rotated in a counterclockwise direction from the neutral position in FIG. 138 the handlebar will experience a torque resulting from biasing device 5150 in the clockwise direction that will act to return the handlebar to the neutral position. In alternative embodiments other types of biasing devices and mechanism can be employed, such as spiral wound springs, electric motors and rotary solenoids. Biasing device 5150 can provide a passive bias between elongate member 5290 and member 5260, such as provided by a spring. Alternatively, biasing device 5150 can provide an active bias between elongate member 5290 and member 5260, such as provided by an electric motor or a rotary solenoid. A device that provides a passive bias does so when it is mechanically loaded. A device that provides an active bias does so when it is energized with electricity. A biasing device can also include electromagnets and/or permanent magnets. Alternatively or additionally to biasing device 5150, there can be an interference fit between member 5260 and 5270 that provides resistance to pivoting; there can also be a material between these members such as rubber or a polymer that provides pivot resistance. In still further other embodiments, handlebar apparatus 5100 can include only one of the above described torques, for example one of springs 5140 and 5150. A method of cycling with the handlebar of apparatus 5100 is now described. With reference to FIG. 139, the rider grips handlebar 5115 at positions 5170 and 5175 and rotates the handlebar such that the rider's hands and arms are symmetrical across the midsagittal (median) plane of the body, as illustrated in FIG. 140. In this position the rider is counteracting the torque generated by spring 5140 operating in the counterclockwise direction, thereby loading the muscles of the body and particularly of the torso in order to do this. While maintaining this position the rider cycles. With reference to FIG. 141, alternatively, the rider grips handlebar 5115 at positions 5180 and 5185 and rotates the handlebar such that the rider's hands and arms are symmetrical across the midsagittal (median) plane of the body, as illustrated in FIG. 142. In this position the rider is counteracting the torque generated by spring 5150 operating in the clockwise direction, thereby loading the muscles of the body, and particularly of the torso in order to do this. While maintaining this position the rider cycles. The preloading of the muscles in this manner can help people who have an asymmetrical muscular predisposition, for example it may help them balance out the muscles symmetrically across the body. With reference to FIGS. 143 and 144, there is shown other hand positions that can be employed other than those illustrated in FIGS. 140 and 142. It still further embodiments the method can employ asymmetrical hand positions across the midsagittal plane. Biased handlebar apparatus 5100 can also be employed with a mobile bicycle when used with a bicycle trainer in a stationary cycling mode, as illustrated in FIG. 153.

Referring now to FIG. 145 there is shown biased handlebar apparatus 5200 operatively connected with exercise bicycle 5210 according to another embodiment. Apparatus 5200 allows handlebar 60 to be rotatable about pivot axis 5220, and allows distance L1, which is the distance axis 5220 is from handlebar stem axis 65 to be adjusted, and allows the position of axis 5220 with respect to the rider along longitudinal axis 5230 to be adjusted as will be explained in more detail below. In other embodiments axis 5220 can be in a fixed and non-adjustable position. In still further embodiments axis 5220 can be behind the rider (behind seat 50) such that a lever arm extends over the rider. Any type of handlebar can be employed in other embodiments, including those disclosed herein, such as drop handlebars and triathlon handlebars. Apparatus 5200 includes elongate support 5240 that is tubular in the illustrated embodiment and fixed in place by supports 5250 and 5255. In alternative embodiments support 5240 can be connected with and supported by upper surface 5212 of bicycle 5210. Elongate support 5240 includes slot 5241 along at least a portion of top surface 5242 (seen in FIGS. 146 and 147). The lateral cross-section of support 5240 can have a circular, square, rectangular or other type of geometric shape. Member 5260 is T-shaped (best seen in FIG. 145*b*) with portion 5262 slidably adjustable and securable along longitudinal axis 5230 to elongate support 5240, for example by a screw or a pin, and portion 5264 extending away from portion 5262. In other embodiments member 5260*c* seen in FIG. 145*c* can be employed instead of member 5260. Pivot axis 5220*c* of member 5260*c* forms an angle 5228 to vertical axis 5227 that can vary between 0 degrees and 90 degrees and more preferably between 0 degrees and 45 degrees. Member 5260 is shown secured in a first position in FIG. 145 and secured in a second position in FIG. 146. Pivot axis 5220 is moved for each secured position of member 5260. In other embodiments portion 5262 can be a tube clamp that clamps around elongate support 5240 and slides along the exterior surface of support 5240, instead of sliding within support 5240 along the interior surface. An exemplary tube clamp is the OD Tube Clamp from Ballistic Fabrication, although there are numerous such tube clamps from many different manufacturers. Elongate member 5270 is tubular in the illustrated embodiment and receives portion 5264 at one end and connects with T-shaped receptacle 5280 at an opposite end. Portion 5264 acts as a support for member 5270. Elongate member 5270 can be secured to receptacle 5280 by way of a fastener (such as a screw), or alternatively it can be welded. Elongate member 5290 is slidably adjustable through receptacle 5280 and is secured in position therealong by a fastener (not shown). Member 5290 is shown secured in a first position in FIG. 145 and secured in a second position in FIG. 146. Height BH can be a variety of heights above the floor/ground, for example to provide clearance for at least a portion of elongate member 5290 above the legs of the rider, or not T-shaped member 5300 receives member 5290 that can be detachably connected thereto (e.g. by a fastener) or permanently connected (e.g. welded). Elongate member 5310 is slidably adjustable through T-shaped member 5300 and can be secured in position therealong by a fastener (not shown). The fasteners for T-shaped members 5280 and 5300 operate to compress and clamp members 5290 and 5310 respectively therein. Elongate member 5310 receives handlebar stem 62, which can be any conventional handle bar stem. The height of handlebar 60 above the ground can be adjusted by changing the position of handlebar stem 62 along member 5310, and/or by changing the position of member 5310 within member 5300. In other embodiments elongate member 5290 can have a handlebar clamp at the end that is connected to member 5300 in the illustrated embodiment, instead of having members 5300 and 5310. In other embodiments elongate member 5270 can be a telescoping tubular member such that the height of the handlebar can be adjusted above the ground.

Biased handlebar apparatus 5200 includes lever arm 5292 that pivots about pivot axis 5220 at joint 5291, which is preferably a biased joint, such as a spring loaded joint, as will be described in more detail below. In the illustrated embodiment, lever arm 5292 is defined by a portion of elongate member 5290, T-shaped member 5300, elongate member 5310, handlebar stem 62 and handlebar 60, and in other embodiments the lever arm can be a single integrated component. In the illustrated embodiment lever 5292 and elongate member 5270 are separated from the ground, unlike a conventional bicycle where a handlebar is connected to (and turns) a wheel on the ground through a stem, a steering tube and a fork. Lever arm 5292 is characterized by length L2 extending between axis 5220 and axis 5222. More generally length L2 is defined as the perpendicular distance between pivot axis 5220 (i.e. the fulcrum) and the point of application of force on lever arm 5292. Axis 5222 is parallel with axis 5220, and lies in plane 964B defined by axis 5220 and longitudinal axis 5230 in the illustrated embodiment (similar to top-tube plane 964 previously defined), and extends from the center of a portion of handlebar 60 that is clamped by handlebar stem 62. Plane 964B is a vertical plane and is the mid-plane with respect to exercise bicycle 5210. Generally, when a rider is positioned on exercise bicycle 5210 the mid-sagittal plane of the rider is substantially aligned with plane 964B. In the illustrated embodiment longitudinal axis 5230 lies in plane 964B; however this is not a requirement and in other embodiments longitudinal axis 5230 can intersect plane 964B. Axis 5220 is referred to herein as a pivot axis for lever arm 5292. In general L2 is defined as the length of the lever arm connecting the pivot axis to the point of force application. Axis 5224 is parallel with axis 5220, lies in plane 964B and extends through either the middle of seat clamp 165 or a mid-point of saddle 50. Axis 5226 is parallel to axis 5220 and lies in plane 964B and extends through the center of the portion of saddle 50 that supports the sitz bones (that is, the ischial tuberosity). Length L3 is the perpendicular distance between pivot axis 5220 and axis 5224, where axis 5224 in the illustrated embodiment is a vertical axis extending through a mid-point of saddle 50. L4 is the length between axis 5220 and axis 5226. A variety of lengths can be employed for L1, L2, L3 and L4. In one preferred embodiment the ratio between L3 and L2 (L3/L2), or alternatively the ratio between L4 and L2 (L4/L2) is less than 5. In another preferred embodiment the ratio between L3 and L2 (or alternatively the ratio between L4 and L2) is less than 4. In yet another preferred embodiment the ratio between L3 and L2 (or alternatively the ratio between L4 and L2) is less than 3. In still another preferred embodiment the ratio between L3 and L2 (or alternatively the ratio between L4 and L2) is less than 2. In yet still another preferred embodiment the ratio between L3 and L2 (or alternatively the ratio between L4 and L2) is less than 1. In yet a further preferred embodiment the ratio between L3 and L2 (or alternatively the ratio between L4 and L2) is less than 0.5. In yet still a further preferred embodiment the ratio between L3 and L2 (or alternatively the ratio between L4 and L2) is less than 0.4. In yet still again another preferred embodiment the ratio between L3 and L2 (or alternatively the ratio between L4 and L2) is less than 0.3. In another preferred embodiment L3 (or L4) is less than 16 inches. In yet another preferred embodiment L3 (or L4) is less than 14 inches. In still another preferred embodiment L3 (or L4) is less than 12 inches. In yet still another preferred embodiment L3 (or L4) is less than 10 inches. In yet again another preferred embodiment L3 (or L4) is less than 8 inches. In still again another preferred embodiment L3 (or L4) is less than 6 inches. In yet still again another preferred embodiment L3 (or L4) is less than 4 inches. In a further preferred embodiment L3 (or L4) is less than 2 inches. In another preferred embodiment L3 (or L4) is 0 inches. In other embodiments similar to the illustrated embodiment of FIG. 145 disclosed herein there are corresponding lengths L1, L2, L3 and L4 that are either explicitly disclosed or implicitly disclosed according to the definitions herein.

Angle 5234 is the angle between pivot axis 5220 and longitudinal axis 5232 of elongate member 5290. In the illustrated embodiment angle 5234 is 90°. However, in other embodiments angle 5234 can be greater or less than 90°. With reference to FIG. 150*b*, elongate member 5290 when rotated about pivot axis 5220 (seen in FIG. 145) is swept through plane 5221 that forms angle 5223 with plane 964B (or the vertical plane). In the illustrated embodiment plane 5221 is a horizontal plane and angle 5223 is 90 degrees. In other embodiments angle 5223 can be other angles, and as a non-limiting example angle 5223 can be between a range of 0 degrees and 180 degrees, and preferably between a range of 45 degrees and 135 degrees, and more preferably between a range of 60 degrees and 120 degrees, and even more preferably between a range of 75 degrees and 105 degrees, and yet even more preferably between a range of 85 degrees and 95 degrees. With reference to FIGS. 195 through 197, angle 5223 can be adjusted, for example, by rotating elongate support 5240 about longitudinal axis 5230. This can be accomplished by connected elongate support to supports 5250 and 5250 by way an adjustable tubular clamp that can be loosened to rotate support 5240 about axis 5230 and tightened to fix support 5240 in position. Alternatively, when portion 5262 is itself a tube clamp it can loosened to rotate member 5260 about longitudinal axis 5230 and tightened to fix member 5260 in position. Referring to FIGS. 145 and 150*b*, pivot axis 5220 forms angle 5229 with the horizontal plane 5221. In the illustrated embodiment angle 5229 is 90° degrees, and in other embodiments angle 5229 can be between a range of 45 degrees and 90 degrees, and preferably between a range of 60 degrees and 90 degrees, and more preferably between a range of 75 degrees and 90 degrees, and even more preferably between a range of 85 degrees and 90 degrees. In an exemplary embodiment pivot axis 5220 lies within the mid-sagittal plane of a user of exercise bicycle 5210 when the user is sitting up straight and looking forward; however, it is understood that when the user is pedaling the mid-sagittal plane may wobble. Alternatively, in the illustrated embodiment pivot axis 5220 forms an angle with vertical plane 964B or the mid-sagittal plane of a user of 0 degrees, and in other embodiments the angle can be between a range of 0 degrees and 45 degrees, and preferably between a range of 0 degrees and 30 degrees, and more preferably between a range of 0 degrees and 15 degrees, and even more preferably between a range of 0 degrees and 5 degrees. The angle between pivot axis 5220 and vertical plane 964B is similar to angle 5228 seen in FIG. 145*c* between pivot axis 5220*c* and vertical axis 5227.

With reference now to FIG. 147, biased handlebar apparatus 5200 is illustrated in a neutral position where longitudinal lever arm 5292 is rotated about pivot axis 5220 and angularly spaced apart from longitudinal axis 5230 of elongate support 5240 by angle 5330. In the neutral position there is no torque acting on lever arm 5292 about axis 5220; that is it is at rest. Alternatively, there may be a bias torque ($T_B$) operating to rotate lever arm 5292 in a clockwise direction in the illustrated embodiment in the neutral position but a positive stop (not shown) that prevents it from travelling in this direction. Lever arm 5292 is biased with respect to portion 5264 of member 5260 (seen in FIG. 145) such that torque ($T_R$) applied by rider in the counter-clockwise direction is required to rotate the lever arm about pivot axis 5220 in the counter-clockwise direction against bias torque ($T_B$). When the rider torque ($T_R$) is greater than the bias torque ($T_B$) the lever arm rotates in the counter-clockwise direction. When the rider torque ($T_R$) equals the bias torque ($T_B$) the lever arm is stationary. When the rider torque ($T_R$) is less than the bias torque ($T_B$) the lever arm rotates in the clockwise direction. When rider toque ($T_R$) is removed the lever arm is rotated about pivot axis 5220 in the clockwise direction by bias torque ($T_B$) to return it to the neutral position. With reference to FIG. 148, there is shown an exemplary riding position where longitudinal axis 5320 is in-line with longitudinal axis 5230; however in other embodiments there can be a variety of neutral positions and angular riding positions from the "12" o'clock indicator seen in FIG. 147 through "3" o'clock, "6" o'clock, "9" o'clock to "12" o'clock. The "3" o'clock position is also the zero (0) degree position, and the "12" o'clock position is the ninety (90) degree position, and the "9" o'clock position is the one hundred and eighty (180) degree positions, and the "6" o'clock position is also the two hundred and seventy (270) degree position. In some embodiments it is advantageous to have the lever arm 5292 sweep an angle from "3" o'clock, through "12" o'clock to "9" o'clock against a bias torque, and more particularly an angle from "2" o'clock, through "12" o'clock to "10" o'clock, even more particularly an angle from "1" o'clock, through "12" o'clock to "11" o'clock; and when the bias torque is in the opposite direction (counter-clockwise), the angles swept are reversed (e.g. an angle between "11" o'clock through "12" o'clock to "1" o'clock). With reference to FIG. 149, there is shown biasing device 5340, such as for example a spiral spring that biases tubular member 5270 with respect to portion 5264 of member 5260 and acts to return the tubular member to the neutral position. In other embodiments the neutral position can be in an opposite location compared to that illustrated in FIG. 147, such as shown in FIG. 150, and biasing device 5340 can operate to apply a bias torque (TB) that rotates handlebar 60 in the counter-clockwise about axis 5220. This can be accomplished, for example, by reversing the orientation of biasing device 5340. In other embodiments in the neutral position angle 5330 can be any value between 0 and 360 degrees, and biasing device 5340 can bias handlebar 60 in either the clockwise or counter-clockwise directions. A method of cycling is now discussed.

A rider rotates handlebar 60 away from the neutral position to a position where there is a torque acting on elongate member 5290, and while in this position the rider cycles. This loads muscles of the body and particularly the torso which as described in the embodiment of FIG. 137 can have a therapeutic effect. Alternatively, the rider can repeatedly rotate handlebar 60 about axis 5220 in an arc in a pulsing manner, for example in coordination with pedaling. As an example, when handlebar 60 is biased in the clockwise direction, the rider can move handlebar 60 in the counterclockwise direction (that is resisting the bias) while power stroking the left pedal with the left foot, and then let the bias move the handlebar in the clockwise direction while power stroking the right pedal with the right foot, and repeating this sequence. In exemplary embodiments, lever arm 5292 is pulsed through a relative angle between 5 degrees and 60 degrees, that typically crosses the "12" o'clock position in FIG. 147 but generally this relative angle lies somewhere between the "3", "12 and "9" o'clock positions, in coordination with pedaling between 20 revolutions per minute (rpm) and 140 rpm, and more preferably between 30 rpm and 100 rpm, and more preferably between 40 rpm and 90 rpm. That is, the lever arm pulsing frequency equals the pedaling frequency (also known as cadence). In other embodiments the lever arm can be pulsed for each down stroke of both the left and right legs thereby doubling the lever arm frequency compared to the pedaling frequency. As another example, when handlebar 60 is biased in the clockwise direction, the rider can move handlebar 60 in the counterclockwise direction (that is resisting the bias) while power stroking the right pedal with the right foot, and then let the bias move the handlebar in the clockwise direction while power stroking the left pedal with the left foot, and repeating this sequence. As another example, when handlebar 60 is biased in the counterclockwise direction, the rider can move handlebar 60 in the clockwise direction (that is resisting the bias) while power stroking the left pedal with the left foot, and then let the bias move the handlebar in the counterclockwise direction while power stroking the right pedal with the right foot, and repeating this sequence. As another example, when handlebar 60 is biased in the counterclockwise direction, the rider can move handlebar 60 in the clockwise direction (that is resisting the bias) while power stroking the right pedal with the right foot, and then let the bias move the handlebar in the counterclockwise direction while power stroking the left pedal with the left foot, and repeating this sequence. In another step the rider can adjust the position of axis 5220 along longitudinal axis 5230 to target various muscles of the torso (e.g. the spinal flexors and extensors, torso rotators and lateral flexion muscles of the spine and torso). For example, lower back and pelvic muscles may be emphasized the closer axis 5220 is to saddle 50 of the bicycle and upper back muscles may be emphasized the further axis 5220 is from the saddle. The height of handlebar 60 can also be adjusted in coordination with the position of axis 5220 along axis 5230 to emphasize muscles in a variety of ways. The position of saddle 50 and handlebar 60 can be adjusted to a variety of positions. For example, a first set-up may place the rider's torso in a substantially vertical position, in which case the torso rotator muscles are emphasized when rotating lever arm 5292 about pivot axis 5220. In a second set-up the rider's torso may be placed in a substantially horizontal position, such as in an aero or triathlon position, in which case the spinal/torso lateral flexion muscles are emphasized when rotating lever arm 5292 about pivot axis 5220. In a third set-up the rider can be in a recumbent cycling position, such as illustrated in FIG. **172*b* where recumbent exercise bicycle 5210*b* employs biased handlebar apparatus 5207*b***. In those positions between the first, second and third set-ups, various combinations of torso rotators and spinal/torso lateral flexion muscles are emphasized.

When a rider has a leg length difference it is advantageous to employ different locations for pivot axis 5220 with respect to axes 5224 and 5226. For example, when the right leg is shorter than the left leg, and elongate member 5290 is biased in a counter-clockwise direction it is advantageous to employ a ratio between length L3 and L2 (or alternatively, between length L4 and L2) that facilitates or emphasizes a lumbar twist to move the handlebar in the clockwise direction, for example to the position in FIG. 148, or before or after this position, or in a pulsing motion. An exemplary range of motion for the lumber twist when the right leg is shorter than the left leg is between "12" o'clock and "3" o'clock, and more particularly between "12" o'clock and "2" o'clock. This motion tends to move the pelvis back into alignment since the lumbar spine cannot rotate much and when rotated will soon cause the pelvis to twist. It is also helpful to think of bringing the left hip forward. The lumber twist can be accomplished emphasizing the muscles of the torso in a variety of ways, for example by selectively emphasizing the left-side external oblique muscles, the right-side internal oblique muscles, and the spinal rotators. When the right leg is shorter than the left leg, and elongate member 5290 is biased in a clockwise direction it is advantageous to employ a ratio between length L3 and L2 (or alternatively, between length L4 and L2) that emphasizes a thoracic twist to move the handlebar in the counter-clockwise direction, for example to the position in FIG. 148 or before or after this position, or in a pulsing motion. Generally, for a person whose right leg is shorter than the left leg and who does not compensate for leg length difference, their right pelvis rotates forward, and the right shoulder counters this by rotating back such that the vision is maintained in a forward direction in what is called the righting reflex, and the upper torso may drift towards the left leg. When countering the clockwise-direction bias of member 5290, the thoracic twist helps to align the rib cage over the pelvis and counteract the twist caused by the righting reflex. Additionally, it is helpful for the thoracic twist to become a lumbar twist while at the same time preventing the right hip/pelvic from coming forward. The opposite of the above is employed when the left leg is shorter than the right leg. Generally, a lumbar twist is facilitated when the pivot axis 5220 is close enough to axis 5224 and 5226 (as a non-limiting example L3 or L4 less than 8 inches), and a thoracic twist is facilitated when the pivot axis is far enough away from axes 5224 and 5226, and the pivot axis is closer to axes 5224 and 5226 for a lumbar twist than for a thoracic twist. However, a rider can perform either a lumber twist or a thoracic twist even when pivot axis 5220 is in a position that facilitates a lumber twist, and alternatively performing a thoracic twist and lumber twist with such a pivot axis location can be therapeutic. When the torque resulting from the biasing device 5345 is sufficiently large, it can be advantageous to let the torso lead the arms when rotating lever arm 5292 about pivot axis 5220 such that at least one of the arms reaches the end of its range of motion in the shoulder joint, thereby reducing the muscle strain on the shoulders. With the above in mind, it is helpful to employ a variety of ratios between L3 and L2, with both the counter-clockwise and clockwise bias, since each body may compensate in a unique way and by employing a variety of ratios the likelihood of a beneficial therapeutic response increases, and promote overall muscular balance.

For persons with inhibited gluteal muscles, a leg length difference, lower crossed syndrome (also known as pelvic crossed syndrome or distal crossed syndrome) it may be that the lumber multifidus muscles are not being employed significantly during movement. The multifidus acts as a stabilizer and includes a vertical force vector and a relatively smaller horizontal force vector. The principle action of the multifidus is expressed by its vertical force vector. Each fascicle of multifidus, at every level, acts virtually at right angles to its spinous process of origin. Thus, using the spinous process as a lever, every fascicle is ideally disposed to produce posterior sagittal rotation of its vertebra. The right-angle orientation precludes any action as a posterior horizontal translator. Therefore, the multifidus can only exert the 'rocking' component of extension of the lumber spine or control this component during flexion. The principle muscles that produce rotation of the thorax are the oblique abdominal muscles. The horizontal component of their orientation is able to turn the thoracic cage in the horizontal plane and thereby impart axial rotation to the lumbar spine. However, oblique abdominal muscles also have a vertical component to their orientation. Therefore, if they contract to produce rotation they will also simultaneously cause flexion of the trunk, and therefore of the lumbar spine. To counteract this flexion, and maintain pure axial rotation, extensors of the lumbar spine must be recruited, and this is how the multifidus becomes involved in rotation. The role of the multifidus in rotation is not to produce rotation but to oppose the flexion effect of the abdominal muscles as they produce flexion. Further reference is directed to "Chapter 9 The Lumbar Muscles and Their Fasciae" at www.radiologykey.com. With this in mind, for persons with leg length differences the thorax is naturally rotated with respect to the pelvis in a default position. Thus oblique abdominal muscles are shortened on one side and lengthened on the other due to the body adjusting under gravity to a stable position and the righting reflex. This causes aberration in the function of the multifidus, and particularly the lumbar multifidus, and consequently the gluteal muscles and other pelvic muscles. By employing the biased handlebar apparatuses disclosed herein to employ the oblique muscles in rotation of the thorax, both in clockwise and counter-clockwise rotations of the lever arm under counter-clockwise and clockwise biasing torques respectively, the multifidus muscles can be activated in a manner that helps to correct preexisting aberrations of the multifidus in addition to aberrations of the gluteal muscles and other muscles associated with the pelvis, and thereby strengthen all these muscles and improve their firing sequence during motion. From the inventor's experience a multifidus that has a lesion or is inhibited in some way also effects the proper function of the gluteal muscles and other pelvic muscles. Any person with inhibited gluteal muscles may benefit from employing the lever arm of the biased handlebar apparatuses disclosed herein to load the oblique muscles during rotation of the thorax to activate the multifidus muscle in stabilization. When the lumbar spine is stabilized properly the larger muscles that attach to the pelvis can be more efficiently activated; and improved balance can then occur between and amongst the hip extensor and flexor muscles, the knee extensor and flexor muscles, and ankle extensor and flexor muscles, thereby improving hip joint, knee joint and ankle joint function. Even persons that do not have significant imbalances or dysfunction in the multifidus can employ this technique to strengthen their multifidus and the extensor and flexor muscles of the hip, knee and ankle joints. A variety of lengths L1, L2, L3 and L4, and handlebar heights HH can be employed to locate any particularly acute dysfunction in the multifidus and oblique muscles. For people with leg length differences the long-leg side is also the side with the shortened oblique muscles, which may cause dysfunction somewhere along the short-leg side multifidus since the shortened oblique muscle is not activating as it should be during motion, such as walking, and therefore portions of the multifidus on the short-leg side may be inhibited. As an example, consider the case when a rider has a shorter right leg, for example 1 to 2 centimeters. As previously discussed, the left hip moves backwards and the right hip forwards to compensate for the leg length difference, and the right shoulder moves back due to the righting reflex. A person with this precondition may develop imbalanced gluteal muscles, for example the fibers of the left gluteus maximus may be more medially developed and the fibers of the right gluteus maximus may be more laterally developed. This may be a result of the way the body stabilizes the spine and pelvis in order to generate power during motion. Due to the above described compensation the right lumbar multifidus and right medial erector spinae muscles function abnormally, for example they may have a lesion in at least some of the fascicles, and as a result the body may not naturally employ these muscles as significantly to generate power, and may instead employ more lateral erector spinae muscles more significantly to stabilize and generate power, thereby developing more lateral fibers of the right gluteus maximus muscles. When performing the exercises described herein it is advantageous to consciously create the stability of the motion with the right lumbar and right medial erector spinae muscles while performing the lever arm rotations (that is when rotating the lever arm to consciously anchor the motion in this area of the body). With reference to FIG. 147, an additional exercise is described. When the lever arm is biased in the counter-clockwise direction, it is advantageous to pulse the lever arm clockwise for each pedal down stroke of the right and left legs, for example between an angular range of 60° and 120°, and more preferably between an angular range of 75° and 105°, such that if the rider is cycling at 40 rpm the lever arm frequency is at 80 rpm. And for each pulse the rider will consciously anchor the motion in the right lumber and medial erector spinae muscles, and consciously activate the more medial fibers of the right gluteus maximus muscles. Similarly, when the lever arm is biased in the clockwise direction, it is advantageous to pulse the lever arm counter-clockwise for each pedal down stroke of the right and left legs through a similar angular range while also anchor the motion of the lever arm in the right lumbar and right medial erector spinae muscles. The bias torque within the angular range can be adjusted (for example, by changing the spring rate or anchor point of the spring) to match the ability of the right lumber and medial erector spinae muscles to create the stability needed for the movement of the lever arm against the bias. The other exercises described herein can be performed similarly by anchoring the motion of the lever arm in the right lumber and medial erector spinae muscles. When the left leg is shorter the motion of the lever arm is then anchored in the left lumbar and left medial erector spinae muscles.

Referring now to FIG. 151 there is shown biased handlebar apparatus 5205 according to another embodiment that is similar to apparatus 5200 and only the differences are discussed. Apparatus 5205 is employed with a mobile bicycle when setup on a bicycle trainer for stationary cycling, as illustrated in FIG. 151 (the bicycle trainer not shown). Bracket 5351 secures front wheel 40 to down tube 26 of the frame to prevent rotation. Elongate member 5360 extends from tube clamp 5350 and is similar to portion 5264 of member 5260 in FIG. 145. Member 5360 is received by tubular member 5270 whereby member 5270 is rotatable about member 5260 and axis 5220. Tube clamp 5350 is insertable and removable from and slidably adjustable and securable along top tube 22, and can be secured in position with fasteners (not shown). An example of such a tube clamp includes two semi-circular portions that wrap around opposite halves of the top tube and that are secured together with fasteners. In the illustrated embodiment longitudinal axis 5230 is the longitudinal axis of top tube 22.

Referring now to FIG. 152 there is shown biased handlebar apparatus 5202 according to another embodiment that is similar to apparatuses 5200 and only the differences are discussed. Elongate tubular member 5266 receives elongate member 5270 on an inside thereof. Biasing device 5345 is a torsion spring biasing elongate member 5290 with respect to elongate member 5266 such that handlebar 60 is rotatable about axis 5220. In other embodiments biasing device can be an electric motor or a rotary solenoid operable to apply a torque to elongate member 5290, for example when energized. Apparatus 5202 can be used with exercise bicycle 5210, where portion 5262 is adjustable and securable within elongate member 5240 along longitudinal axis 5230. In other embodiments apparatus 5202 and other similar apparatuses herein can comprise yet another biasing device (not shown) similar too and that can be co-axial with biasing device 5345 but providing a bias in the opposite direction such that the neutral position is as illustrated in FIG. 148.

Referring now to FIG. 152*b* there is shown biased handlebar apparatus 5204 according to another embodiment that is similar to apparatuses 5202 and only the differences are discussed. Elongate member 5266 is connected with tube clamp 5350. Apparatus 5204 can be used with mobile bicycle 14 (seen in FIG. 151) while mounted on a bicycle trainer, where tube clamp 5350 is adjustable and securable with top tube 22 along longitudinal axis 5230.

Referring now to FIGS. 154 through 156 there is shown biased handlebar stem 5400 according to another embodiment. Biased handlebar stem 5400 includes head-tube portion 5410, stem portion 5420 and clamping portion 903. Head-tube portion 5410 includes clamping portion 5430 that connects with a steering tube of a bicycle similarly to conventional handlebar stems or stem risers, and rotatable portion 5440 that is rotatable about head-tube axis 906, for example on bearings 5445. Clamping portion 5430 includes an extension portion 5480. Biasing device 5450 biases rotatable portion 5440 such that longitudinal axis 5460 of stem portion 5420 is angular spaced apart (by angle 5470) from top-tube plane 964. Biasing device 5450 can be, for example, a torsion spring that is connected between extension member 5480 and rotatable portion 5440. Biased handlebar stem 5400 can be used similarly to biased handlebar apparatus 5200. For example, a rider can rotate handlebar 60 such that it is in the position illustrated in FIG. 156 (in other embodiments other angular positions are contemplated) while cycling to preload the muscles of the body and in particular the torso. In other embodiments biasing device 5450 can bias rotatable portion 5430 in an opposite direction compared to that illustrated in FIG. 155. In further embodiments, biased handlebar stem 5400 can include another biasing device similar to device 5450 but that provides a bias in the opposite angular direction. The default position for the handlebar can be the twelve o'clock position and respective biasing devices provide respective biases as the handlebar is rotated clockwise and counter-clockwise respectively. In other embodiments any type of handlebar can be employed with biased handlebar stem 5400. In other embodiments stem portion 5420 can include a joint such as joint 1240 in FIG. 70 that is biased with a biasing device, such as a torsion spring. In this way the effective axis of rotation of biased handlebar stem 5400 can be set anywhere along the longitudinal axis of top tube 22 (or top-tube plane 964). In other embodiments stem portion 5420 can be a biased telescoping stem portion with a biasing device such as spring providing an axial bias in one or both axial directions.

Referring now to FIG. 157 there is shown biased handlebar stem apparatus 5500 according to another embodiment. Apparatus 5500 includes handlebar stem 5510, stem riser 5520 and biasing device 5530. In the illustrated embodiment biasing device 5530 is a torsion spring. Stem riser 5520 is similar to conventional stem risers and includes tab 5540 for fixing a first end of biasing device 5530. The first end of biasing device 5530 can be fixed in a variety of other ways, such as against or through one of fastener bores 5550 (that with a fastener serve to fasten stem riser 5520 to a steering tube of the bicycle), in a hole drilled in a sidewall of stem riser 5520, as well as other mechanical fastening means. Fasteners 5560 and 904 are tightened to a degree such that handlebar stem 5510 can still be rotated about head-tube axis 906. Biasing device 5530 biases handlebar stem 5510 to a neutral position, for example as illustrated in FIG. 155, and which can be in an opposite angular direction in other embodiments. Biased handlebar stem apparatus 5500 operates similar to biased handlebar stem 5400 in FIG. 154. With reference to FIG. 158 handlebar 5000 can be employed with biased handlebar stem 5400 or with biased handlebar stem apparatus 5500. In other embodiments, instead of handlebar stem 5510, handlebar stem 1210 (seen in FIG. 65) can be employed with biased handlebar apparatus 5500, and joint 1240 can be biased with a biasing device, such as a torsion spring, as described for the embodiment of FIG. 154. Similarly, the other adjustable handlebar stems disclosed herein can be employed with apparatus 5500, and the joints in these adjustable handlebar stems can be biased with biasing devices, such as torsion springs.

Referring now to FIGS. 159 and 160 there is shown exercise bicycle 5600 including biased handlebar apparatus 5605 according to another embodiment. Handlebars 5610 and 5620 are rotatable about axis 5670 (perpendicular to the page) and are biased with biasing devices 5630 (only one such device is illustrated) such that they are moved to the neutral position illustrated in FIG. 159 where there is no torque acting on the handlebars and they are at rest. When the rider pulls handlebar 5610 towards them and pushes handlebar 5620 away from them to the position illustrated in FIG. 160, where the handlebars are aligned across median (midsagittal) plane 5675, there is torque 5650 acting on handlebar 5610 and torque 5660 acting on handlebar 5620 that act to return the handlebars to their respective positions in FIG. 159. The rider moves the handlebars to the position illustrated in FIG. 160, or any position where there is a torque acting on the handlebars to return them to the neutral position, to preload the muscles of the torso before and while riding. In an exemplary embodiment biasing devices 5630 are torsion springs. Knob 5640 operates to vary the preload of the torsion springs to vary the torque acting on the handlebars at respective angular positions. When biasing devices 5630 are torsion springs they can be replaced with oppositely wound springs such that the neutral position is opposite (handlebar 5610 is closer to the rider and handlebar 5620 is further away) and the torques operating on the handlebars in FIG. 160 are reversed.

Referring now to FIGS. 161 and 162 there is shown biased handlebar apparatus 5206 according to another embodiment that is similar to biased handlebar apparatus 5202 in FIG. 145 and only the differences are discussed. Elongate member 5310 is connected with tube clamp 5700. Tube clamp 5700 is similar to tube clamp 5350 (seen in FIG. 151) and is adjustable along and securable to elongate member 5290. Elongate member 5290 is connected to elongate member 5270, for example by a weld. In other embodiments receptacle 5280 (seen in FIG. 145) can be employed to connect these members, however handlebar position with respect to axis 5220 is adjusted by moving tube clamp 5700 along member 5290. In the illustrated embodiment, lever arm 5292 is defined by a portion of elongate member 5290, tube clamp 5700, elongate member 5310, handlebar stem 62 and handlebar 60. Apparatus 5206 is illustrated in a first position in FIG. 161 and in a second position in FIG. 162. As previously discussed, biasing device 5345 biases elongate member 5290 with respect to tubular member 5266.

Referring now to FIGS. 163 and 164*a* there is shown biased handlebar apparatus 5207 according to another embodiment that is similar to biased handlebar apparatuses 5206 and only the differences are discussed. Elongate member 5266 is connected with tube clamp 5350.

Referring now to FIG. 164*b*, there is shown lever arm 5292*b* that is similar to lever arm 5292 and only the differences are discussed. Lever arm 5292*b* can be used in place of 5292 in the embodiments disclosed herein. Lever arm 5292*b* includes spacer 5290*b* that spaces elongate member 5290 apart from elongate member 5270, such that axis 5220 can be located under saddle 50 (for example, as seen in FIG. 161 or 163) and elongate member 5290 can be situated higher than at least a portion of the rider's legs when they are respectively at the highest point in their respective pedal strokes. In the illustrated embodiment spacer 5290*b* includes (horizontal) elongate member 5290*c* and (vertical) elongate member 5290*d*.

Referring now to FIGS. 165 and 166 there is shown biased handlebar apparatus 5208 according to another embodiment that is similar to biased handlebar apparatus 5207 and only the differences are discussed. Elongate member 5266 is connected to elongate member 5710, for example by a weld, and member 5710 is connected to steering tube clamp 5720. In other embodiments member 5266 can be connected to clamp 5350 such that the clamp can be adjustable along elongate member 5710 and securable thereto. Clamp 5720 is secured to steering tube 5730 (seen in FIG. 163) of mobile bicycle 14 in a similar manner as a conventional handlebar stem. Elongate member 5710 can be adjustably securable telescoping tubes to such that the position of axis 5220 can be set in a variety of positions along top tube 22.

Referring now to FIGS. 167 and 168 there is shown biased handlebar apparatus 5209 according to another embodiment that is similar to biased handlebar apparatus 5208 and only the differences are discussed. Elongate member 5710 extends all the way to seat post clamp 5740. The stability of member 5710 is improved when it is secured between steering tube clamp 5720 and seat post clamp 5740. Elongate member 5266 is connected to clamp 5350 and the clamp is adjustable along member 5710 and securable thereto. Elongate member 5710 can be adjustably securable telescoping tubes such that the member can accommodate a variety of lengths of top tube 22.

Referring now to FIGS. 169 and 170 there is shown biased handlebar apparatus 5211 according to another embodiment. Elongate member 5290 is connected with seat-post bearing 5750. Bearing 5750 includes tubular member 5760 through which extends seat post 163 and where end 5770 abuts seat post clamp 164. Tubular member 5760 can be secured to seat post 163 by way of a fastener that clamps it to the seat post. Portion 5780 extends through rotatable member 5800 that abuts against 5790. Rotatable member 5800 is rotatable about portion 5780. Biasing device 5345 biases elongate member 5290 with respect to tubular member 5760 to rotate about axis 5220. Pivot axis 5220 is the longitudinal axis of seat tube 24 in the illustrated embodiment. The determination of L1, L2, L3 and L4 is carried out using effective pivot axis 5220*e*. Effective pivot axis 5220*e* is a vertical axis that intersects pivot axis 5220 at the intersection between longitudinal axis 5232 and pivot axis 5220. Note that it is possible that effective pivot axis 5220*e* can be further away from axis 5222 than axis 5224 and even axis 5226 depending on the location of saddle 50 on clamp 165. Similarly, in the other embodiments herein pivot axis 5220 can be further from axis 5222 than axis 5224 and even axis 5226 depending upon the location of saddle 50, especially when using adjustable seat post 160 (seen in FIG. 1) that can place the saddle in a variety of positions. In other embodiments biased handle bar apparatus 5211 can be employed with a stationary exercise bicycle, that is apparatus 5211 can connect with, or be adapted to connect with, a seat post of the exercise bicycle.

Referring now to FIG. 171 there is shown biased handlebar apparatus 5900 according to another embodiment, which is similar to biased handlebar apparatus 5207 (seen in FIG. 164) and only the differences are discussed. Tubular, seat-post support 5910 receives seat post 163 and can be secured thereto by fasteners (not shown). Support 5920 is connected with support 5910 and supports tubular member 5266. The position of tubular member 5266 on support 5290 can be adjustable.

Referring now to FIG. 172 there is shown biased handlebar apparatus 5950 according to another embodiment, which is similar to biased handlebar apparatus 5900 (seen in FIG. 171) and only the differences are discussed. Biasing device 5345 is a rotary solenoid or an electric motor and provides an active bias between elongate member 5270 and tubular elongate member 5266 (or alternatively support 5290). For example, a stator of biasing device 5345 can be connected with member 5266 (or support 5290) and a rotor can be connected with member 5270. Similar arrangements can be employed with other embodiments herein.

Referring now to FIGS. 173 and 174 there is shown biased handlebar apparatus 6000 according to another embodiment. Apparatus 6000 includes grip 6010, spring 6020, and abutment 6030 (for example a washer). Abutment 6030 is fixed to handlebar 60. Spring 6020 is arranged between grip 6010 and abutment 6030. Grip 6010 is slidable along handlebar 60 such that spring 6020 can be compressed. A rider can selectively slide grip 6010 towards abutment 6030 a varying amount such that muscles along the side of the body (in the illustrated embodiment the left side of the body) are engaged varying amounts. Handlebar apparatus 6000 is shown in a neutral, first position in FIG. 173 and in a second position with grip 6010 moved closer to abutment 6030 in FIG. 174. Engaging muscles along one side of the body can have the effect to induce a pelvic realignment and/or improve muscle balance in an imbalanced body. In other embodiments handlebar 60 can have a telescoping side with an internal spring therein, and with a grip attached to one portion of the telescoping side.

Referring now to FIGS. 175 through 178 there is shown treadmill 7000 according to another embodiment of the invention. Treadmill 7000 includes biased bar apparatus 7010. Apparatus 7010 includes lever arm 7020 that is rotatably biased about axis 5220 by biasing device 5345, which in the illustrated embodiment is a torsion spring. As an example, with reference to FIG. 178 biased bar apparatus 7010 is illustrated in a neutral position (at rest) where there is no net torque acting on lever arm 7020. In this context, with reference to FIG. 177 lever arm 7020 is illustrated in a biased position where there is a torque acting on the lever arm to rotate, for example, in a clockwise direction. Biased bar apparatus 7010 allows a user of the treadmill to pre-load the muscles of torso, for example the torso rotators muscles and the spinal flexor muscles, while walking, for similar reasons explained for the previously described biased handlebar apparatuses (5200, 5205, 5206, 5207, 5208, 5209, 5211, 5900). Biased bar apparatus 7010 includes lever arm 7020, tubular member 7030, and spring 5345. Lever arm 7020 includes elongate member 7040 and u-shaped member 7050. U-shaped member 7050 includes a cross-beam in the form of elongate member 7060 and vertical supports in the form of elongate members 7070. Lever arm 7020 also includes horizontal supports 7080 and grips 7090. Biased bar apparatus 7010 is supported by support or frame 7100, which is u-shaped in the illustrated embodiment. Frame 7100 includes a cross-beam in the form of elongate member 7110 and vertical supports in the form of elongate members 7120. Treadmill 7000 includes tread 7130, handrails 7140 and display and control panel 7150. In the illustrated embodiment u-shaped member 7050 is vertically oriented; however, in other embodiments u-shaped member 7050 can be horizontally oriented with grips 7090 generally in front of the user and cross-beam member 7060 behind the user. Axis 5220 can be positioned in a variety of positions relative to the spine of the user. Elongate members 7060 and elongate members 7080 can be telescoping members. Members 7080 can be rotated about the longitudinal axis of vertical supports 7060.

Referring now to FIGS. 179 to 182 there is shown biased handlebar apparatus 8000 according to another embodiment. Apparatus 8000 includes biased pivotable joint 8010 that is rotatable about axis 8020. Joint 8010 is a pivot-type joint including yoke members 8030 and 8040 pivoting about bolt 8050, which also serves to hold the members in space in cooperation with nut 8060. Yoke members 8030 and 8040 include protruding portions 8035 and 8045 respectively. Torsion spring 8070 biases member 8040 with respect to member 8030. Yoke member 8030 can be rotated about axis 8080 by adjusting pivot joint 8090. Pivot joint 8090 includes circular members 8100 and 8110, with circular portions pressed against each other by bolt 8020 and a nut (not shown). By rotating member 8030 about axis 8080 it allows elongate member 5290 to be swept through a variety of planes as illustrated in FIG. 150*b*. Circular members 8100 and 8110 include protruding members 8105 and 8115 respectively. Protruding member 8105 is received by elongate tubular member 5266 such that circular member 8100 is secured thereto (for example, by a press-fit, a weld or an adhesive type connections). Protruding member 8115 is connected with yoke member 8030. In other embodiments pivot joint 8090 is not required and yoke member 8030 can be connected with elongate tubular member 5266 and secured thereto. Axis 8020 is a pivot axis and lever arm 8292 comprises those components between the pivot axis and where the lever arm is operated by a rider and in the illustrated embodiment includes yoke member 8040, elongate member 5290, tube clamp 5700, elongate member 5310, handlebar stem 62 and handlebar 60. Handlebar apparatus 8000 is illustrated in an unbiased, neutral position in FIGS. 180 and 182 and in a biased position in FIGS. 179 and 181 where spring 8070 urges yoke member 8040 and elongate member 5290 towards the neutral position. The abdominal muscles of a person are emphasized when moving lever arm 8292 from the neutral position to the biased position. Alternatively, in other embodiments spring 8070 can provide the opposite bias such that the neutral position is illustrated in FIGS. 179 and 181 and the biased position is illustrated in FIGS. 180 and 182. The back extensor muscles of a person are emphasized when moving lever arm 8292 from this neutral position to this biased position.

The applicant has developed exercises for those with leg length differences. For example, consider the case when the user has a shorter right leg compared to the left leg. In one exercise, the lever arm of the biased handlebar apparatus (5200, 5205, 5206, 5207, 5208, 5209, 5211, 5900, 8000) is biased in a clockwise direction such that the user applies a torque to the lever arm to move it in the counter-clockwise direction against the bias. It is advantageous that angle 5223 between plane 5221 and plane 964B (as seen in FIG. 150*b*) be within a range of 90 and 180 degrees such that when the user is rotating the lever arm in the counter-clockwise direction, for example as seen in FIG. 147, the lever arm is on a downward trajectory across the midline of the bicycle, such as plane 964 (seen in FIG. 61) or 964B (seen in FIG. 145). This downward motion activates the torso/thorax flexor and rotator muscles, and especially on the right side of the body, while the multifidus muscle gets activated in response to support the spine, and especially the lumbar spine. For people with a shorter right leg the lumbar multifidus tends to be inhibited due to the compensation pattern of the body due to the leg length difference (in absence of any corrective measures). Additionally, for people with a shorter right leg the spinal flexors on the right side of the body get shortened and the spinal extenders on the right side of the body (e.g. abdominal muscles) get lengthened due to the righting-reflex bringing the shoulder back in response to the pelvic going forward. In another exercise, the spring biased is reversed such that the bias moves the lever arm in a counter-clockwise direction, and the user applies a torque to the lever arm to move it in the clockwise direction against the bias. It is advantageous that angle 5223 between plane 5221 and plane 964B (as seen in FIG. 150*b*) be between 90 and 180 degrees such that when the user is rotating the lever arm in the clockwise direction, for example as seen in FIG. 150, the lever arm is on an upward trajectory across the midline of the bicycle, such as plane 964 (seen in FIG. 61) or 964B (seen in FIG. 145). When the rider puts emphasis on bring the left hip forward and the right hip back the torso muscles on the left side of the body get activated to stabilize the pelvis in this position.

Referring now to FIG. 183 there is shown a leg press machine 8500 including a biased handle bar apparatus 8510 anchored between the users legs that can be one of the biased handlebar apparatuses disclosed here (5200, 5205, 5206, 5207, 5208, 5209, 5211, 5900, 8000). Referring now to FIG. 184 there is shown a leg curl machine 8600 including a biased handle bar apparatus 8610 anchored between the users legs that can be one of the biased handlebar apparatuses disclosed here ((5200, 5205, 5206, 5207, 5208, 5209, 5211, 5900, 8000). In other embodiments leg curl machine 8600 can be a leg extension machine that includes the opposite bias of the leg curl machine. The persons illustrated in FIGS. 183 and 184 are shown with their hands in a conventional position to use conventional machines, whereas in these embodiments they would be grasping the handlebar of the lever arm to move it towards the position as illustrated. In general, any exercise machine or equipment where the leg muscles are used to move an object against a resistance can be equipped with one of the bias handlebar apparatuses described herein when the biased handlebar apparatus can be placed in front of the person such that while using the exercise machine or equipment the user can move the lever arm as described in the various embodiments in this disclosure. Another example of such a machine is a calf press machine.

Referring now to FIG. 185 there is shown lever arm 5292*b* according to another embodiment that can be employed in place of lever arm 5292 in the biased handlebar apparatus embodiments disclosed herein. Lever arm 5292 is a biased telescoping lever arm including telescoping elongate members 5293 and 5294. Spring 5295 is a compression spring that can, but is not required, to bias member 5294 with respect to member 5293 along the longitudinal axis thereof. Alternatively, or additionally, spring 5295 can be a torsion spring biasing member angularly about the longitudinal axis thereof. In other embodiments lever arm 5292*b* can simply be a telescoping arm with member 5270 fixed to a bicycle apparatus such that it does not pivot about axis 5220, and, for example, oriented with respect to the bicycle to activate the oblique muscles. In other embodiments members 5293 and 5293 and spring 5205 can be part of a biased-telescoping handlebar stem.

Referring now to FIGS. 186 to 187 there is shown biased handlebar apparatus 9000. Biased handlebar apparatus 9000 includes lever arm 9010 that is biasedly pivotable in joint 9020. Lever arm 9010 includes elongate member 9030 and pivot member 9040, and in the illustrated embodiment the lever arm also includes handlebar 60 and handlebar stem 62. Handlebar stem 62 can be slid along elongate member 9030 and secured in position by fasteners (not shown). Elongate member 9030 has longitudinal axis 9050. In the illustrated embodiment joint 9020 is a ball-and-socket type joint (also known as a universal joint) including ball or pivot member 9040 and socket member 9060. Socket member 9060 includes hemisphere portion 9070 and capping portion 9080. Hemisphere portion 9070 is connected with elongate member 9075 that is slidably securable within elongate support 5240. Capping portion 9080 is annular in shape and slides along elongate member 9030 until it abuts against pivot member 9040 and is secured to hemisphere portion 9070 by bolt 9090 and nut 9100. In other embodiments other types of joints can be employed, for example a yoke-type joint; however this type of joint provides reduced degrees of motion. Biasing device 9110 is a coil spring in the illustrated embodiment, and in particular a barrel-type coil spring. Biasing device 9110 operates to maintain lever arm 9010 in a neutral position as illustrated in FIGS. 188 and 189 where longitudinal axis 9050 of elongate member 9030 aligns with axis 9120. In the illustrated embodiment biasing device 9110 is co-axial with elongate member 9030 in the neutral position. A user can move lever arm 9010 such that it pivots in joint 9020 against the bias provided by biasing device 9110, for example to the position illustrated in FIG. 190. The user can employ their muscles associated with the trunk, for example the trunk rotator muscles, to move lever arm 9010 in coordination with pedaling as previously described herein.

Referring now to FIGS. 191 and 192 there is shown a biased handlebar apparatus according to another embodiment that includes elliptical trainer 9200 adapted to employ lever arm 9010*b*. Lever arm 9010*b* is similar to lever arm 9010 except it does not include elongate member 9075 (see FIG. 187) and where hemisphere portion 9070 is fixed to support 9210. In other embodiments elongate tubular member 5240 can be arranged between steps 9220 and 9230 and lever arm 9010 can include elongate member 9075 that is slidably securable along member 5240. In still further embodiments biased handlebar apparatus 5207*c*, seen in FIG. 193, with lever arm 5292*c*, can be arranged between steps 9220 and 9230. Elongate member 5290 is disposed at angle 5225 that is less than 90 degrees in the illustrated embodiment. In other embodiments angle 5225 can be between 90 degrees and −90 degrees, and more particularly, between 45 degrees and −45 degrees. Biased handlebar apparatus 5207*c* can also be employed with stepper 9130 as seen in FIG. 190*b*. The previously described biased handlebar apparatus (5200, 5205, 5206, 5207, 5208, 5209, 5211, 5900, 8000) also have angle 5225 that can vary accordingly With reference to FIG. 194, in yet further embodiments elliptical trainer 9300 employs a pair of lever arms 9010*c* that are disposed to be operated by respective hands of a user. Lever arms 9010*c* are similar to lever arm 9010*b* except that they include grips 9310 and do not include handlebar 60 and handlebar stem 62. Socket members 9060 is connected with support 9320 (only one of which is illustrated).

Referring now to FIGS. 198 and 199, there is shown biased handlebar apparatus 9400 according to another embodiment. Apparatus 9400 includes pivot joint 8900 connected with tube clamp 5350 (or alternatively it can be connected with portion 5262 seen in FIG. 145*b*) and with elongate tubular member 5266 (that receives lever arm 5292). Biasing device 5345 (not shown) is operatively connected between tubular member 5266 and lever arm 5292.

Referring now to FIGS. 200 and 201, there is shown biased handlebar apparatus 9500 according to another embodiment that employs coil spring 9540, such as a helical compression spring or a helical expansion spring. Lever arm 9560 is pivotable about pivot 9510 Linkage 9530 connected with spring 9540 at one end and is pivotable about pivot 9520 at the other end. Pivot 9520 is part of lever arm 9560. Elongate support 9550 supports spring 9540 and pivot 9510. Apparatus 9500 is illustrated in a neutral position in FIG. 200 and a second position in FIG. 201. In the neutral position lever arm 9560 is pushed by a user such that it rotates about pivot 9510 against the force of spring 9540 towards the second position. When the user lets go of lever arm 9560 or stops resisting the force of spring 9540 in a controlled manner the lever arm returns to the neutral position.

Referring now to FIGS. 202 and 203 there is shown biased handlebar apparatus 9600 operatively connected with bicycle 9605. Bicycle 9605 is operatively connected with bicycle trainer 9610 for stationary cycling and is similar to bicycle apparatus 10 but with a conventional saddle. In the illustrated embodiment bicycle 9605 is shown with the handlebar removed; however, this is not a requirement. In other embodiments, biased handlebar apparatus 9600 can be operatively configured and/or connected with other exercise equipment instead and in place of bicycle 9605, for example, a treadmill, a stair-climbing machine, the other exercise equipment disclosed herein or yet other exercise equipment. Apparatus 9600 includes support structure 9615 in the form of a cage including vertical members 9620, horizontal members 9625 and horizontal members 9630 connected with each other at corner joints 9635 respectively and secured in place by fasteners, such a nuts and bolts. In other embodiments corner joints 9635 are not required and instead vertical members 9620 can be secured directly to horizontal members 9625 and 9630, Fork 9606 of bicycle 9605 is connected with axle 9732, which is suspended above horizontal member 9725 by support 9730. Structure 9615 supports adjustable lever-arm pivoting mechanism 9640 including elongate tubular support member 9645, biased pivoting tubular member 9650 and lever arm 9655. Elongate tubular support member 9645 can be selectively secured along slots 9632 in horizontal members 9630. Alternatively, instead of slots 9632 there can be a single bore in each member 9630 or a plurality of bores space apart. With reference to FIGS. 202, 203 and 204, piston 9660 is slidably adjustable within elongate tubular support member 9645 and securable in place by fasteners 9665. Piston 9660 is tubular in the illustrated embodiment and includes circular tubular member 9670 extending therethrough. Tubular member 9650 includes collar 9675 and extends through tubular member 9670 until collar 9675 abuts an end of member 9670. Tubular member 9680 includes circular tubular member 9685 that receives and is securably connected with tubular member 9650, for example by a fastener such as a nut and bolt (not shown). Tubular member 9650 is rotatable about pivot axis 5220 within tubular member 9670. Biasing device 9690 is in the form of a torsion spring with legs 9691 and 9692. Leg 9691 extends through a bore (not shown) in piston 9660 that prevents the rotation of the leg around pivot axis 5220. Leg 9692 is secured to tubular member 9650 by spring bearing 9695. Spring bearing 9695 includes stepped bore 9696 (with a smaller diameter portion shown in FIG. 205 and a larger diameter portion shown in FIG. 206) through which tubular member 9650 extends. Spring 9690 extends into the larger diameter portion of bore 9696 and leg 9692 extends through slot 9697 where it is retained. Slot 9698 extends from bore 9696 through to an end of spring bearing 9695. Bore 9699 extends all the way through spring bearing 9695 such that fastener 9735 (best seen in FIG. 202) in the form of a bolt can extend therethough and engage a nut to squeeze portion 9693 towards portion 9694 thereby clamping the smaller diameter portion of bore 9696 around tubular bearing 9650. Lever arm 9655 includes elongate member 9700 that extends through tubular member 9680, telescoping elongate tubular members 9705 and 9710, handlebar stem 62 and handlebar 60. Elongate member 9700 is slidable through tubular member 9680 and securable thereto by fasteners 9715. Elongate member 9710 can telescope with respect to elongate member 9705 and is securable thereto by fastener 9720. In other embodiments, a single elongate member can be employed instead of telescoping elongate members 9705 and 9710. For example, the single elongate member can be a round tubular member having an outer diameter suitable for engaging handlebar stem 62 that connects handlebar 60 to the round tubular member. The single elongate member provides an improved and increased range of adjustment for handle bar stem 62 and handlebar 60. For all embodiments herein employing telescoping members to adjustably support handlebar 60, the single elongate member can be employed instead to support handlebar 60. With reference to FIGS. 205*b* and 206*b*, there is illustrated spring bearing 9695*b* that can be employed alternatively to spring bearing 9695. Parts in spring bearing 9695*b* that are like parts in spring bearing 9695 having corresponding reference numerals appended with the letter 'b' and only the differences are discussed. Bore 9696*b* is not stepped and has a single diameter through which tubular member 9650 extends. Spring 9690 abuts end 9590 of bore 9696*b* and leg 9692 extends through slot 9698*b* where it is retained. Slot 9698*b* extends from bore 9696*b* through to end 9592*b* of spring bearing 9695*b*. There are two bores 9699*b* through portions 9693*b* and 9694*b* for fasteners of which both or either can be used to squeeze portion 9693*b* towards portion 9694*b* thereby clamping bore 9696*b* around tubular bearing 9650 (seen in FIG. 204).

When torsion spring 9690 (seen in FIG. 204) is a left-hand wound spring then lever arm 9655 can be in the neutral position as shown in FIG. 207, for example, and when the cyclist rotates the lever arm about axis 5220 moving through the position shown in FIG. 208 to the position shown in FIG. 209, the torsion spring provides a torque in the counter-clockwise (CCW) direction. To set lever arm 9655 in the neutral position, for example as shown in FIG. 207 when spring 9690 is a left-hand wound spring, fastener 9735 is loosened, the lever arm is then rotated to the position shown in FIG. 207, and then fastener 9735 is tightened. Alternatively, when torsion spring 9690 (seen in FIG. 204) is a right-hand wound spring then lever arm 9655 can be in the neutral position as shown in FIG. 209, for example, and when the cyclist rotates the lever arm about axis 5220 moving through the position shown in FIG. 208 to the position shown in FIG. 207, the torsion spring provides a torque in the clockwise (CW) direction. In alternative embodiments for all lever-arm pivoting mechanisms herein instead of spring 9690 the biasing device can be an electromagnetic device, for example a solenoid such as a rotary solenoid, or an electric motor that can provide a bias torque in either the clockwise direction or counter-clockwise direction depending upon the direction of the current through windings of the electromagnetic device.

Referring now to FIGS. 210, 211 and 212, adjustable lever-arm pivoting mechanism 9640 is shown in different configurations. Pivot axis 5220 has been moved between the configuration shown in FIG. 210 and the configuration shown in FIG. 211. Alternatively, lever arm 9655 has moved to the right (while pivot axis 5220 remained unmoved) between the configuration shown in FIG. 210 and the configuration shown in FIG. 212. Pivot axis 5220 can be located behind, above (or across) and in front of the cyclist, without interfering with the legs of the cyclist. For cyclist with pelvic obliquity employing positions of pivot axis 5220 both behind the lumbar spine and in front can be beneficial to counteract the pelvic obliquity and restore balance to the muscles of the pelvis, torso and lower extremities. As an example, when the right side of the pelvis is forward of the left side, then a pivot axis location behind the lumber spine when rotating the lever arm against a clockwise torsion spring bias and a pivot axis location in from of the lumber spine when rotating the lever arm against a counter-clockwise torsion spring bias can be beneficial to reduce the amount of pelvic obliquity. Generally speaking, it is beneficial to employ a variety of pivot axis locations both behind, across and in front of the lumber spine for both clockwise and counter-clockwise torsion spring biases. Returning to FIG. 203, tubular support member 9645 can be secured selectively along slots 9632 such that pivot axis 5220 can be either within top-tube plane 964 (e.g. seen in FIG. 134) or spaced apart from the top-tube plane. Slots 9632 allow tubular support member 9645 to be arranged such that lever arm 9655 can have a variety of flight paths relative to the median plane of the rider. This can be beneficial for riders whose spinal axes are offset from their normal position due a variety of conditions, such as leg length difference. Different flight paths will also alter the muscles that are emphasized to effect motion of the lever arm that can improve range of motion in the hip joints and sacroiliac joints.

Referring now to FIG. 213 there is shown biased handlebar apparatus 9800 according to another embodiment. Adjustable lever-arm pivoting mechanism 9640 is illustrated supported by vertical members 9620, which are in turn supported by exercise bicycle 9810.

Referring now to FIG. 214 there is shown biased handlebar apparatus 9900 according to another embodiment. Adjustable lever-arm pivoting mechanism **9640*b* includes clamp bearing 9695*b* connected to weight stack 9905 by line 9910. Clamp bearing 9695*b* includes a portion similar to spring bearing 9695 shown in FIG. 205, but in place of slot 9697 there is flange 9915 that connects to line 9910. Weight stack 9905 has one or more weights 9920 tethered to lever arm 9655 such that they can be lifted by line 9910 when lever arm 9655 is rotated. Key 9925 is inserted into one of the weights 9920 and then into rod 9930 to select the number of weights to be lifted. Line 9910 extents over pulley 9935 and through pulleys 9940 and 9945 (best seen in FIG. 215) to an end point in flange 9915 where it is secured. Clamping bearing 9695*b* is shown in the neutral position in FIG. 215. When the cyclist rotates lever arm 9655 (best seen in FIG. 214) in a clockwise direction line 9910 engages pulley 9945 as shown in FIG. 216 and lifts all the weights selected by key 9925. Similarly, when the cyclist rotates lever arm 9655 (best seen in FIG. 214) in a clockwise direction line 9910 engages pulley 9940 as shown in FIG. 217 and lifts all the weights as selected by key 9925. The neutral position of lever arm 9655 can be set similarly to the lever arm in biased handlebar apparatus 9600 of FIG. 202. In alternative embodiments, instead of using weight stack 9905, a spring such as an extension spring, or a gas spring can be employed. Biased handlebar apparatus 9900** is illustrated configured with a stationary bicycle and in other embodiments it can be configured with stationary exercise equipment such as a treadmill or stair climber.

Referring now to FIG. 218 there is shown biased handlebar apparatus 9950 that includes adjustable lever-arm pivoting mechanism 9640 and treadmill 9952. Elongate tubular support member 9645 of adjustable lever-arm pivoting mechanism 9640 is supported by upper vertical supports 9954. Each vertical support 9954 is supported by respective lower vertical supports 9956, which also supports a control and display panel and handrails in the current embodiment. In other embodiments a single vertical support can be employed to support both or either the control and display panel and handrails and the adjustable lever-arm pivoting mechanism 9640. In further embodiments, piston 9660 can be fixed in a single location instead of being adjustable along elongate tubular support 9645.

Referring now to FIG. 219 there is shown biased handlebar apparatus 9960 that includes adjustable lever-arm pivoting mechanism 9640 and stair climber 9962. Elongate tubular support member 9645 of adjustable lever-arm pivoting mechanism 9640 is supported by upper vertical supports 9964. Each vertical support 9964 is supported by frame 9966, which also supports a control and display panel and handrails in the current embodiment. In other embodiments a single vertical support can be employed to support adjustable lever-arm pivoting mechanism 9640. In further embodiments, piston 9660 can be fixed in a single location instead of being adjustable along elongate tubular support 9645.

Referring now to FIG. 220 there is shown an adjustable lever-arm pivoting mechanism 10000 that can be alternatively employed instead of other adjustable lever-arm pivoting mechanisms herein and only the differences are discussed. Adjustable lever-arm pivoting mechanism 10000 employs gas spring 10010 instead of a spring to bias lever arm 9655. Gas spring 10010 includes cylinder 10020 and piston rod 10030. Cylinder 10020 is pivotably connected to support 10040 by fastener 10050 forming pivotable connection 10090. Piston rod 10030 is pivotably connected to support 10060 by fastener 10070 forming pivotable connection 10100. Support 10060 is connected to tubular member 9680 and angle 10080 (seen in FIG. 221) between support 10060 and tubular member 9680 is 90 degrees in the illustrated embodiment can be a different angle in other embodiments. With reference to FIGS. 221, 222 and 223, adjustable lever-arm pivoting mechanism 10000 is illustrated in a first position, a second position and a third position respectively where piston rod 10030 is increasingly extended out of cylinder 10020. A counter-clockwise torque is applied to lever arm 9655 in order to move the lever arm from the first position to the second position to the third position. The applied torque translates into a force on piston rod 10030 to extend the piston rod out of cylinder 10020 by counter-acting the force of the gas spring resisting the extension of the piston rod out of the cylinder. Pivotable connection 10100 is illustrated at end 10110 of support 10060 in the illustrated embodiment where lever arm 9655 is biased in the clockwise direction. Pivotable connection 10100 can be switched to end 10120 of support 10060 such that lever arm 9655 is biased in a counter-clockwise direction, and in this way both directions of bias on lever arm can be employed.

Referring now to FIGS. 224 and 225 there is shown biased bar apparatus 10200 including biased bar mechanism 10210 and treadmill 10220. In other embodiments biased bar mechanism 10210 can be configured with other stationary exercise equipment such as a stair climber. Biased bar mechanism 10210 is supported by vertical supports 10230. Biased bar mechanism 10210 includes curved elongate member 10240 extending between end members 10250. End members 10250 are fastened to respective top ends of supports 10230. Curved elongate tube 10260 telescopes along curved elongate member 10240 between springs 10270 and 10275 and forms an effective lever arm with effective pivot axis 10265. The curvature of curved elongate member 10240 and curved elongate tube 10260 is circular in the illustrated embodiment and the diameter of which can be selected according to application requirements. In other embodiments the curvature of curved elongate member 10240 can be elliptical, parabolic, hyperbolic or other geometric shapes, and in such embodiments curved elongate tube 10260 is flexible such that it can telescope along the curvature employed, for example a flexible material can be selected or the curved elongate member can be made up a several interconnected rigid pieces with each rigid piece flexibly connected with adjacent rigid pieces. Biased bar mechanism 10210 is illustrated in a default position in FIG. 225; and in a first compressed position in FIG. 226 where spring 10270 is compressed and spring 10275 is extended; and a second compressed position in FIG. 227 where spring 10275 is compressed and spring 10270 is extended. In other embodiments the default position for curved elongate tube 10260 can be anywhere along curved elongate member 10240, and both or either springs 10270 can be present. An arc length of curved elongate member 10240 can be selected for a desired stroke length for curved elongate tube 10260 and when the curvature is circular can be that of any semi-circle or can even form a complete circle. Supports 10230 are connected to biased bar mechanism 10210 at a location to provide the required support.

Referring now to FIGS. 228 and 229 there is shown biased bar apparatus 10300 including biased bar mechanism 10310 and treadmill 10220. In other embodiments biased bar mechanism 10310 can be configured with other stationary exercise equipment such as a stair climber. Biased bar mechanism 10310 is supported by vertical supports 10230. Gas spring 10010 is disposed within each vertical support 10230 and each gas spring 10010 is connected to cable 10305 at an end of piston rod 10030. Biased bar mechanism 10310 includes curved elongate member 10241 (that is tubular in this example) extending between end members 10251. End members 10251 are fastened to respective top ends of supports 10230. Curved elongate tube 10261 telescopes along curved elongate member 10241 and can be selectively connected with respective cables 10305 and forms an effective lever arm with effective pivot axis 10265. Cable 10305 is supported by pulley 10315 to change the direction of the cable between support 10230 and curved elongate member 10241. Curved elongate member 20141 has slot 10330 such that curved elongate tube 10261 can be connected selectively to either cable 10305. The curvature of curved elongate member 10241 and curved elongate tube 10261 is circular in the illustrated embodiment and the diameter of which can be selected according to application requirements. In other embodiments the curvature of curved elongate member 10241 can be elliptical, parabolic, hyperbolic or other geometric shapes, and in such embodiments curved elongate tube 10261 is flexible such that it can telescope along the curvature employed, for example a flexible material can be selected or the curved elongate member can be made up a several interconnected rigid pieces with each rigid piece flexibly connected with adjacent rigid pieces. Biased bar mechanism 10310 is illustrated in a default position in FIG. 229; and in a first extended position in FIG. 230 where piston rod 10030 is extended out of cylinder 10020; and a second extended position in FIG. 231 where piston rod 10030 is extended even further out of cylinder 10020. In other embodiments the default position for curved elongate tube 10260 can be anywhere along curved elongate member 10241, and both or either cables 10305 can be connected to curved elongate tube 10261. An arc length of curved elongate member 10241 can be selected for a desired stroke length for curved elongate tube 10261 and when the curvature is circular can be that of any semi-circle or can even form a complete circle. Supports 10230 are connected to biased bar mechanism 10310 at a location to provide the required support. In other embodiments a single gas spring 10010 can be disposed at a front location of treadmill 10220 and cable 10305 connected to curved elongate tube 10261 by way of a pulley mechanism (not shown). In still other embodiments curved elongate tube 10261 can instead be a piston disposed and travelling within curved elongate member 1024 land a handlebar can be connected with the piston by a member extending through slot 10330. The piston can be a spherical bearing with an annular slot (like a yo-yo) extending to the center of the spherical bearing where there is yet another bearing rotatable with respect to the outer spherical bearing and connected to cable 10305.

The techniques disclosed herein can help those with skeletal-muscular asymmetries who to reduce strain and pain when they load their bodies such as when they exercise, perform work in the yard or perform typical chores throughout the day. The biased handlebar apparatuses previously described can help the body adjust to using lift with a height equal to the leg length difference. This is beneficial in achieving muscular symmetry across the pelvis. When using the biased handlebar apparatuses described herein it is beneficial to employ a variety of knee angles KA, hip angles HA, shoulder angles SA, seat heights SH and handlebar heights HH as illustrated in FIGS. 6, 7 and 8. For example, changing the body position from one that resembles sitting in a chair to one that resembles standing up, and from moderate knee and hip extension to near maximum extension. The body is remarkably adaptable and can mask limitations of range of motion in the various joints that can be uncovered and impact reduced by employing the biased handlebar apparatus in a variety of positions.

For all embodiments herein employing a lever arm (such as lever arm 9655) and a stationary exercise apparatus (such as a treadmill, a stationary bicycle or a stair climber), the adjustable lever arm can be configured such that a pivot axis (such as axis 5220) substantially overlaps a spinal axis of a user, and a handlebar (such as handlebar 60) is around shoulder height of the user (and preferably at shoulder height) and around arm's length (and preferably at arm's length), whereby the user sweeps the handlebar about the pivot axis using their arms such that a torso of the user remains stationary, and more particularly where the shoulders articulate to cause the lever arm to move. In other embodiments the height of the handlebar can be configured such that the arms are within an arc of +/−30 degrees, and more preferably +/−15 degrees, with the shoulder joint as the origin and with respect to the horizontal position of the arms. The core muscles of the user are engaged to keep the torso stationary such that the arms can sweep the handlebar about the pivot axis.

In other embodiments joints 911, 1240 1380, 1740, 1900, 1970 and 2010 can be biased with a spring, such as a torsion spring or a spiral spring, to provide a bias torque about the joint axis. All mechanical joints herein can employ bearings, such as ball bearings as would be known by those skilled in mechanical joint engineering. As used herein, a neutral spine refers to the three natural curves that are present in a healthy spine. Looking directly at the front or back of the body, the thirty-three vertebrae in the spinal column should appear completely vertical. From a side view, the cervical (neck) region of the spine (C1-C7) is bent inward, the thoracic (upper back) region (T1-T12) bends outward, and the lumbar (lower back) region (L1-L5) bends inward. When lying on your back with knees bent and feet flat on the floor, a neutral spine should have two areas that do not touch the floor underneath you, your neck and your lower back (the cervical spine and lumbar spine, respectively). In other embodiments an air shock can be employed as biasing device 5345, 9110. In all embodiments herein employing a biased lever arm, especially of the stationary bicycle type having a lever arm rotatable about a pivot axis, the saddle for the bicycle can be a swivel seat that is rotatable about a longitudinal axis. The swivel seat when used on a stationary bicycle apparatus having a lever arm rotatable about a pivot axis allows the rider to articulate the hip giant through a greater range of motion that can be beneficial in developing improved range of motion and hip muscle strength through that range of motion, and increasing muscular symmetry between right and left hip joints.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. An exercise apparatus comprising:

a lever arm pivotably biased about a pivot axis, the lever arm comprising a cross-beam, and a first elongate member and a second elongate member extending from the cross-beam; and a support configured for supporting the lever arm above a treadmill;

a biasing device for rotatably biasing the lever arm with respect to the support about the pivot axis;

wherein the lever arm is configured such that a user walks between the first and second elongate members and the pivot axis is configured to be substantially a longitudinal axis of a torso of the user.

2. The exercise apparatus of claim 1, wherein the lever arm includes a first horizontal support extending from the first elongate member and a second horizontal support extending from the second elongate member.

3. The exercise apparatus of claim 2, further including a first grip extending from the first horizontal support, and a second grip extending from the second horizontal support.

4. The exercise apparatus of claim 3, wherein the first horizontal support and the second horizontal support are telescoping.

5. The exercise apparatus of claim 1, wherein the biasing device is configured to be disposed above the user of the treadmill.

6. The exercise apparatus of claim 1, wherein the support comprises first and second vertical elongate members, and a horizontal elongate support member supported by and extending between the first and second vertical elongate members, the biasing device and the lever arm supported by the horizontal elongate support member.

7. The exercise apparatus of claim 1, wherein the biasing device is one of a spring, an electric motor, and a rotary solenoid.

8. The exercise apparatus of claim 1, wherein the lever arm is vertically oriented and the cross-beam is configured to be disposed above the user.

9. The exercise apparatus of claim 1, wherein the lever arm is u-shaped.

10. The exercise apparatus of claim 1, wherein the lever arm is configured to bias the torso of the user about the longitudinal axis of the torso of the user.

11. An exercise apparatus comprising:

a lever arm pivotably biased about a pivot axis, the lever arm comprising a cross-beam, and a first elongate member and a second elongate member extending from the cross-beam; and a support configured for supporting the lever arm above a treadmill;

a biasing device for rotatably biasing the lever arm with respect to the support about the pivot axis;

wherein the lever arm is configured such that a user walks between the first and second elongate members of the lever arm; and wherein the biasing device is configured to be disposed above the user of the treadmill or wherein the lever arm is vertically oriented and the cross-beam is configured to be disposed above the user.

12. The exercise apparatus of claim 11, wherein the lever arm is u-shaped.

13. The exercise apparatus of claim 11, wherein the lever arm includes a first horizontal support extending from the first elongate member and a second horizontal support extending from the second elongate member, and a first grip extending from the first horizontal support, and a second grip extending from the second horizontal support.

14. The exercise apparatus of claim 11, wherein the lever arm is configured to bias a torso of the user about a longitudinal axis of the torso of the user.

* * * * *